US007281329B2

(12) United States Patent
Mandal et al.

(10) Patent No.: US 7,281,329 B2
(45) Date of Patent: Oct. 16, 2007

(54) METHOD FOR FABRICATING A ROLLER FOLLOWER ASSEMBLY

(75) Inventors: Dhruva Mandal, Vernon Hills, IL (US); Carroll Williams, Pocahontas, AR (US)

(73) Assignee: MacLean-Fogg Company, Mundelein, IL (US)

( * ) Notice: Subject to any disclaimer, the term of this patent is extended or adjusted under 35 U.S.C. 154(b) by 191 days.

(21) Appl. No.: 10/770,076

(22) Filed: Feb. 2, 2004

(65) Prior Publication Data

US 2004/0154571 A1 Aug. 12, 2004

Related U.S. Application Data

(63) Continuation of application No. 10/316,262, filed on Oct. 18, 2002, now Pat. No. 7,028,654.

(51) Int. Cl.
*B21K 1/76* (2006.01)
*F01L 1/20* (2006.01)

(52) U.S. Cl. ..... 29/888.03; 29/434; 29/437; 29/443; 29/557; 123/90.52; 72/352; 72/353.2; 72/356

(58) Field of Classification Search ..... 29/888.03, 29/557, 434, 437, 441.1, 443, 505, 509, DIG. 18; 123/90.52, 90.48, 90.45; 72/352, 353.2, 72/356, 357, 360
See application file for complete search history.

(56) References Cited

U.S. PATENT DOCUMENTS

| | | | |
|---|---|---|---|
| 188,764 | A | 3/1877 | Adams |
| 626,594 | A | 6/1899 | Chapman |
| 703,838 | A | 7/1902 | Scobee |
| 794,683 | A | 7/1905 | Riotte |
| 872,598 | A | 12/1907 | Watts et al. |
| 948,248 | A | 2/1910 | Reaugh |
| 992,089 | A | 5/1911 | Watt |
| 993,875 | A | 5/1911 | Richards et al. |
| 1,000,722 | A | 8/1911 | Danver |
| 1,001,265 | A | 8/1911 | Graham |
| 1,061,700 | A | 5/1913 | Steinbecker |
| 1,066,069 | A | 7/1913 | Willshaw |
| 1,080,733 | A | 12/1913 | Thomson |
| 1,084,514 | A | 1/1914 | Whitlock |
| 1,101,935 | A | 6/1914 | Jacobs et al. |
| 1,129,555 | A | 2/1915 | Curran |
| 1,198,115 | A | 9/1916 | De La Bar |
| 1,210,871 | A | 1/1917 | Suffa |
| 1,220,380 | A | 3/1917 | Turner |
| 1,245,552 | A | 11/1917 | Becket |
| 1,246,343 | A | 11/1917 | Snadecki |

(Continued)

OTHER PUBLICATIONS

"GM Displacement on Demand," Jim Kerr, Canadian Driver, Oct. 25, 2002, 01468-01469.

(Continued)

*Primary Examiner*—Jermie E. Cozart
(74) *Attorney, Agent, or Firm*—Dana Andrew Alden

(57) ABSTRACT

The present invention relates to a method for fabricating a roller follower assembly, comprising the steps of fabricating a lash adjuster body, fabricating a roller follower body, fabricating a leakdown plunger, fabricating a socket, wherein at least one of the lash adjuster body, roller follower body, leakdown plunger, and socket is fabricated at least in part by forging.

59 Claims, 68 Drawing Sheets

U.S. PATENT DOCUMENTS

| | | | |
|---|---|---|---|
| 1,247,366 | A | 11/1917 | Brockway |
| 1,252,692 | A | 1/1918 | Harris |
| 1,254,227 | A | 1/1918 | Huber |
| 1,292,312 | A | 1/1919 | Gronkwist |
| 1,331,787 | A | 2/1920 | Schlatter |
| 1,336,447 | A | 4/1920 | Suffa |
| 1,345,942 | A | 7/1920 | McCain |
| 1,350,989 | A | 8/1920 | Cox |
| 1,354,852 | A | 10/1920 | Schneider |
| 1,358,459 | A | 11/1920 | Pache |
| 1,363,398 | A | 12/1920 | Davids |
| 1,374,059 | A | 4/1921 | Church |
| 1,377,866 | A | 5/1921 | White |
| 1,399,839 | A | 12/1921 | Alborn |
| 1,409,625 | A | 3/1922 | Vosbrink |
| 1,409,878 | A | 3/1922 | Mainland |
| 1,410,771 | A | 3/1922 | Strohl |
| 1,422,698 | A | 7/1922 | Pagé |
| 1,427,111 | A | 8/1922 | Knudsen |
| 1,461,560 | A | 7/1923 | Rich |
| 1,464,082 | A | 8/1923 | Leo |
| 1,475,557 | A | 11/1923 | Albrecht |
| 1,479,735 | A | 1/1924 | Page |
| 1,515,201 | A | 11/1924 | Hewitt |
| 1,537,529 | A | 5/1925 | Enberg |
| 1,543,438 | A | 6/1925 | Hutt |
| 1,565,223 | A | 12/1925 | Church |
| 1,566,923 | A | 12/1925 | Roberts |
| 1,573,962 | A | 2/1926 | Charnock |
| 1,582,883 | A | 4/1926 | Rich |
| 1,594,471 | A | 8/1926 | Short |
| 1,605,494 | A | 11/1926 | Anderson |
| 1,607,128 | A | 11/1926 | Johansen |
| 1,613,012 | A | 1/1927 | Baker |
| 1,623,826 | A | 4/1927 | Burleson |
| 1,674,310 | A | 6/1928 | Topping |
| 1,682,821 | A | 9/1928 | Woolson |
| 1,696,866 | A | 12/1928 | Seaman |
| 1,728,149 | A | 9/1929 | Berne |
| 1,735,695 | A | 11/1929 | Rich |
| 1,741,093 | A | 12/1929 | Briggs |
| 1,741,230 | A | 12/1929 | Goodwin |
| 1,748,086 | A | 2/1930 | Small |
| 1,784,257 | A | 12/1930 | Thomas |
| 1,797,105 | A | 3/1931 | Shoblom |
| 1,798,738 | A | 3/1931 | Hoern |
| 1,798,938 | A | 3/1931 | Hallett |
| 1,802,330 | A | 4/1931 | Boland |
| 1,820,299 | A | 8/1931 | Church |
| 1,834,285 | A | 12/1931 | Loeffler |
| 1,835,622 | A | 12/1931 | Willgoos |
| 1,840,633 | A | 1/1932 | Morehouse |
| 1,844,021 | A | 2/1932 | Stewart |
| 1,847,312 | A | 3/1932 | Seufert |
| 1,848,083 | A | 3/1932 | Wetherald |
| 1,874,471 | A | 8/1932 | Du Bois |
| 1,899,251 | A | 2/1933 | Zerk |
| 1,907,506 | A | 5/1933 | Coburn |
| 1,915,867 | A | 6/1933 | Penick |
| 1,930,261 | A | 10/1933 | Berry |
| 1,930,368 | A | 10/1933 | Nelson |
| 1,930,568 | A | 10/1933 | Short |
| 1,955,844 | A | 4/1934 | Woolman |
| 1,956,014 | A | 4/1934 | Fink et al. |
| 1,962,057 | A | 6/1934 | Cluttterbuck |
| 1,968,982 | A | 8/1934 | Baranaby et al. |
| 1,971,083 | A | 8/1934 | Schlaa |
| 1,977,778 | A | 10/1934 | Rice |
| 1,985,447 | A | 12/1934 | Grubbs |
| 2,000,635 | A | 5/1935 | Edwards |
| 2,002,196 | A | 5/1935 | Ucko |
| 2,015,991 | A | 10/1935 | Breeler |
| 2,019,138 | A | 10/1935 | Kliesrath et al. |
| 2,019,252 | A | 10/1935 | Cottingham |
| 2,027,406 | A | 1/1936 | Spatta |
| 2,036,936 | A | 4/1936 | Halford |
| 2,051,415 | A | 8/1936 | Payson |
| 2,053,743 | A | 9/1936 | Russell |
| 2,055,341 | A | 9/1936 | Dyer |
| 2,067,114 | A | 1/1937 | Ashton |
| 2,071,051 | A | 2/1937 | Van Ranst |
| 2,071,719 | A | 2/1937 | Wurtele |
| 2,073,178 | A | 3/1937 | Rich |
| 2,081,390 | A | 5/1937 | Trapp |
| 2,089,478 | A | 8/1937 | Heiss |
| 2,091,451 | A | 8/1937 | Phillips |
| 2,091,674 | A | 8/1937 | Dostal |
| 2,097,413 | A | 10/1937 | Hurst et al. |
| 2,098,115 | A | 11/1937 | Voorhies |
| 2,107,456 | A | 2/1938 | Trapp |
| 2,109,815 | A | 3/1938 | Best |
| 2,114,655 | A | 4/1938 | Leibing |
| 2,116,749 | A | 5/1938 | Daisley |
| 2,117,434 | A | 5/1938 | Krebs |
| 2,120,389 | A | 6/1938 | Bettison |
| 2,127,245 | A | 8/1938 | Breeler |
| 2,131,948 | A | 10/1938 | Graham |
| 2,142,224 | A | 1/1939 | Turlay |
| 2,151,832 | A | 3/1939 | Bugatti |
| 2,154,494 | A | 4/1939 | Corlett |
| 2,163,969 | A | 6/1939 | Whalen |
| 2,166,968 | A | 7/1939 | Rohlin |
| 2,174,526 | A | 10/1939 | Parker |
| 2,175,466 | A | 10/1939 | Johnson |
| 2,179,354 | A | 11/1939 | Scott |
| 2,185,991 | A | 1/1940 | Voorhies et al. |
| 2,187,008 | A | 1/1940 | Baxter |
| 2,199,096 | A | 4/1940 | Berglund |
| 2,207,324 | A | 7/1940 | L'Orange |
| 2,209,479 | A | 7/1940 | Spencer |
| 2,227,127 | A | 12/1940 | Dillström |
| 2,247,278 | A | 6/1941 | Daisley |
| 2,247,299 | A | 6/1941 | Klavik |
| 2,250,011 | A | 7/1941 | Dayton |
| 2,250,814 | A | 7/1941 | Rohlin |
| 2,272,074 | A | 2/1942 | Voorhies |
| 2,280,753 | A | 4/1942 | Essl |
| 2,308,858 | A | 1/1943 | Burkhardt |
| 2,309,740 | A | 1/1943 | Voorhies |
| 2,319,546 | A | 5/1943 | Insley et al. |
| 2,322,172 | A | 6/1943 | Spencer |
| 2,322,173 | A | 6/1943 | Spencer |
| 2,322,174 | A | 6/1943 | Spencer |
| 2,322,195 | A | 6/1943 | Mock |
| 2,324,322 | A | 7/1943 | Reese et al. |
| 2,339,238 | A | 1/1944 | Buckley |
| 2,344,285 | A | 3/1944 | Cormode |
| 2,346,737 | A | 4/1944 | Essl |
| 2,349,203 | A | 5/1944 | Spencer |
| 2,356,900 | A | 8/1944 | Voorhies |
| 2,381,339 | A | 8/1945 | Doman |
| 2,385,309 | A | 9/1945 | Spencer |
| 2,386,317 | A | 10/1945 | Jenny et al. |
| 2,392,933 | A | 1/1946 | Mallory |
| 2,394,738 | A | 2/1946 | Anthony |
| 2,405,927 | A | 8/1946 | Tomblom |
| 2,408,325 | A | 9/1946 | Luce et al. |
| 2,410,411 | A | 11/1946 | Gregory |
| 2,434,386 | A | 1/1948 | Bradshaw |
| 2,435,727 | A | 2/1948 | Spencer |
| 2,438,631 | A | 3/1948 | Bergmann |
| 2,443,999 | A | 6/1948 | Wright |
| 2,451,395 | A | 10/1948 | Klukan |
| 2,483,779 | A | 10/1949 | Mucher |

2,485,760 A 10/1949 Millis et al.
2,494,128 A 1/1950 Holmquist et al.
2,508,557 A 5/1950 Wood, Jr.
2,516,775 A 7/1950 Johansen
2,518,272 A 8/1950 Beckwith
2,522,326 A 9/1950 Winter, Jr.
2,526,239 A 10/1950 Kincaid, Jr.
2,527,604 A 10/1950 Walk
2,528,983 A 11/1950 Weiss
2,542,036 A 2/1951 Knaggs
2,548,342 A 4/1951 Brook et al.
2,572,968 A 6/1951 Bachle
2,563,699 A 8/1951 Winter, Jr.
2,564,902 A 8/1951 Houser et al.
2,595,583 A 5/1952 Johnson
2,618,297 A 11/1952 Gosselin
2,619,946 A 12/1952 Michelich
2,629,639 A 2/1953 Johansen
2,631,576 A 3/1953 Schowalter
2,642,051 A 6/1953 Russell
2,665,669 A 1/1954 Ellis
2,688,319 A 9/1954 Humphreys
2,694,389 A 11/1954 Turkish
2,705,482 A 4/1955 Randol
2,733,619 A 2/1956 Smith
2,735,313 A 2/1956 Dickson
2,737,934 A 3/1956 Banker
2,739,580 A 3/1956 Brown
2,743,712 A 5/1956 Hulsing
2,743,713 A 5/1956 Russell
2,745,391 A 5/1956 Winkler, Jr.
2,763,250 A 9/1956 Bensinge
2,765,783 A 10/1956 Randol
2,773,761 A 12/1956 Fuqua et al.
2,781,868 A 2/1957 House
2,784,707 A 3/1957 Skinner
2,795,217 A 6/1957 Ware
2,808,818 A 6/1957 Sampietro
2,797,673 A 7/1957 Black
2,797,701 A 7/1957 Nurkiewicz
2,807,251 A 9/1957 Peras
2,815,740 A 12/1957 Slater
2,818,050 A 12/1957 Papenguth
2,818,844 A 1/1958 Wood
2,821,971 A 2/1958 Line
2,827,887 A 3/1958 Van Slooten
2,829,540 A 4/1958 Niemayer
2,840,063 A 6/1958 Purchas, Jr.
2,842,111 A 7/1958 Braun
2,845,914 A 8/1958 Cobo
2,846,988 A 8/1958 Iskenderian
2,849,997 A 9/1958 Kravits
2,853,984 A 9/1958 Sampietro
2,857,895 A 10/1958 Scheibe
2,859,510 A 11/1958 Baxa
2,863,430 A 12/1958 Sampietro
2,863,432 A 12/1958 O'Brien
2,865,352 A 12/1958 Thompson
2,874,685 A 2/1959 Line
2,875,742 A 3/1959 Dolza
RE25,154 E 4/1959 Bergmann
2,882,876 A 4/1959 Bergmann
2,887,098 A 5/1959 Thompson
2,891,525 A 6/1959 Moore
2,908,260 A 6/1959 Bergmann, Sr.
2,918,047 A 12/1959 Mick
2,919,686 A 1/1960 Mick
2,925,074 A 2/1960 Dadd
2,925,808 A 2/1960 Baumann
2,926,884 A 3/1960 Clinkenbeard
2,932,290 A 4/1960 Christensen
2,934,051 A 4/1960 Drew
2,934,052 A 4/1960 Longenecker
2,935,059 A 5/1960 Thompson
2,935,878 A 5/1960 Wirsching
2,937,632 A 5/1960 Voorhies
2,938,508 A 5/1960 Papenguth
2,942,595 A 6/1960 Bergmann, Sr. et al.
2,947,298 A 8/1960 Dolza
2,948,270 A 8/1960 Bergmann
2,948,274 A 8/1960 Wood
2,954,015 A 9/1960 Line
2,956,557 A 10/1960 Dadd
2,962,012 A 11/1960 Howson
2,963,012 A 12/1960 Kolbe
2,964,027 A 12/1960 Dadd
2,983,991 A 5/1961 Carlson
2,988,805 A 6/1961 Thompson
2,997,991 A 8/1961 Roan
3,009,450 A 11/1961 Engemann
3,016,887 A 1/1962 Streit et al.
3,021,593 A 2/1962 Cousino
3,021,826 A 2/1962 De Fezzy et al.
3,028,479 A 4/1962 Tauschek
3,029,832 A 4/1962 Tischler et al.
3,054,392 A 9/1962 Thompson
3,070,080 A 12/1962 Van Slooten
RE25,974 E 1/1963 Dadd
3,078,194 A 2/1963 Thompson
3,079,903 A 3/1963 Humphreys
3,086,507 A 4/1963 Mooney, Jr.
3,089,472 A 5/1963 Thompson
3,090,367 A 5/1963 Ayres
3,101,077 A 8/1963 Engle
3,101,402 A 8/1963 Gondek
3,108,580 A 10/1963 Crane, Jr.
3,109,418 A 11/1963 Exline et al.
3,111,118 A 11/1963 Weiman
3,111,119 A 11/1963 Bergmann
3,114,361 A 12/1963 Mullen
3,124,114 A 3/1964 Voorhies
3,124,115 A 3/1964 Voorhies
3,128,749 A 4/1964 Dadd
3,137,282 A 6/1964 Voorhies
3,137,283 A 6/1964 Sampietro
3,138,146 A 6/1964 Hutchison
3,139,076 A 6/1964 Flaherty
3,139,078 A 6/1964 Van Slooten
3,139,872 A 7/1964 Thompson
3,144,010 A 8/1964 Van Slooten
3,147,745 A 9/1964 Kilgore
3,151,603 A 10/1964 Schumm
3,153,404 A 10/1964 Van Slooten
3,166,057 A 1/1965 Konrad et al.
3,169,515 A 2/1965 Kilgore et al.
3,176,669 A 4/1965 Kuchen et al.
3,177,857 A 4/1965 Kuchen et al.
3,180,328 A 4/1965 Engle
3,194,439 A 7/1965 Beduerftig
3,200,801 A 8/1965 Dombos
3,220,393 A 11/1965 Schlink
3,224,243 A 12/1965 Van Deberg
3,225,752 A 12/1965 Robinson
3,234,815 A 2/1966 Line
3,240,195 A 3/1966 Sossna
3,255,513 A 6/1966 Robinson et al.
3,267,918 A 8/1966 Ayres
3,267,919 A 8/1966 Wortman
3,270,724 A 9/1966 Dolza
3,273,514 A 9/1966 Bender
3,273,546 A 9/1966 Von Arx
3,273,547 A 9/1966 Lesher
3,273,548 A 9/1966 Hoffman
3,273,998 A 9/1966 Knoth et al.
3,277,874 A 10/1966 Wagner
3,280,806 A 10/1966 Iskenderian 3,280,807 A 10/1966 Bardy
3,291,107 A 12/1966 Cornell
3,299,869 A 1/1967 Sicklesteel
3,299,986 A 1/1967 Briggs et al.
3,301,239 A 1/1967 Thauer
3,301,241 A 1/1967 Iskenderian
3,303,833 A 2/1967 Melling
3,304,925 A 2/1967 Rhoads
3,314,303 A 4/1967 Maat
3,314,404 A 4/1967 Thompson
3,322,104 A 5/1967 Abell, Jr.
3,332,405 A 7/1967 Haviland
3,354,898 A 11/1967 Barnes
3,365,979 A 1/1968 Ericson
3,367,312 A 2/1968 Jonsson
3,379,180 A 4/1968 Kabel et al.
3,385,274 A 5/1968 Shunta et al.
3,400,696 A 9/1968 Thompson
3,405,699 A 10/1968 Laas
3,410,366 A 11/1968 Winter, Jr.
3,413,965 A 12/1968 Gavasso
3,422,803 A 1/1969 Stivender
3,426,651 A 2/1969 Arendarski
3,430,613 A 3/1969 Barnes
3,437,080 A 4/1969 Abell, Jr.
3,439,659 A 4/1969 Bouwkamp
3,439,660 A 4/1969 Lesher
3,439,662 A 4/1969 Jones et al.
3,448,730 A 6/1969 Abell, Jr.
3,450,228 A 6/1969 Wortman et al.
3,455,346 A 7/1969 Stork
3,463,131 A 8/1969 Dolby
3,470,857 A 10/1969 Stivender
3,470,983 A 10/1969 Briggs
3,476,093 A 11/1969 Line
3,490,423 A 1/1970 Shunta et al.
3,502,058 A 3/1970 Thompson
3,518,976 A 7/1970 Thuesen
3,520,287 A 7/1970 Calvin
3,521,633 A 7/1970 Yahner
3,523,459 A 8/1970 Mowbray
3,528,451 A 9/1970 Hansen
3,542,001 A 11/1970 Line
3,547,087 A 12/1970 Siegler
3,549,430 A 12/1970 Kies et al.
3,549,431 A 12/1970 de Coye de Castelet
3,572,300 A 3/1971 Stager et al.
3,587,539 A 6/1971 Dadd
3,590,796 A 7/1971 Harkness
3,598,095 A 8/1971 Ayres
3,630,179 A 12/1971 Dadd
3,633,555 A 1/1972 Raggi
3,641,988 A 2/1972 Torazza et al.
3,650,251 A 3/1972 Pelizzoni
3,662,725 A 5/1972 Dragon et al.
3,664,312 A 5/1972 Miller, Jr.
3,665,156 A 5/1972 Lee
3,668,945 A 8/1972 Hofmann
3,690,959 A 9/1972 Thompson
3,716,036 A 2/1973 Kruger
3,717,134 A 2/1973 Cornell
3,722,484 A 3/1973 Gordini
3,741,240 A 6/1973 Berriman
3,742,921 A 7/1973 Rendine
3,782,345 A 1/1974 Erickson et al.
3,786,792 A 1/1974 Pelizzoni et al.
3,795,229 A 3/1974 Weber
3,799,129 A 3/1974 Cornell
3,799,186 A 3/1974 Bulin
3,805,753 A 4/1974 Bergmann et al.
3,822,683 A 7/1974 Clouse
3,831,457 A 8/1974 Kern
3,838,669 A 10/1974 Dadd
3,848,188 A 11/1974 Ardezzone et al.
3,855,981 A 12/1974 Loon
3,859,969 A 1/1975 Davis, Jr.
3,860,457 A 1/1975 Vourinen et al.
3,870,024 A 3/1975 Ridgeway
3,875,908 A 4/1975 Ayres
3,875,911 A 4/1975 Joseph
3,877,445 A 4/1975 Barnes
3,877,446 A 4/1975 Morgan
3,879,023 A 4/1975 Pearce et al.
3,880,127 A 4/1975 Abell, Jr.
3,886,808 A 6/1975 Weber
3,893,873 A 7/1975 Hanai et al.
3,902,467 A 9/1975 Cornell
3,911,879 A 10/1975 Altmann
3,915,129 A 10/1975 Rust et al.
3,921,609 A 11/1975 Rhoads
3,945,367 A 3/1976 Turner, Jr.
3,958,900 A 5/1976 Ueno
3,964,455 A 6/1976 Brown
3,967,602 A 7/1976 Brown
3,977,370 A 8/1976 Humphreys
3,992,663 A 11/1976 Seddick
3,998,190 A 12/1976 Keske
4,004,558 A 1/1977 Scheibe
4,007,716 A 2/1977 Jones
4,009,695 A 3/1977 Ule
4,009,696 A 3/1977 Cornell
4,050,435 A 9/1977 Fuller, Jr. et al.
4,061,123 A 12/1977 Janes
4,064,844 A 12/1977 Matsumoto et al.
4,064,861 A 12/1977 Schulz
4,080,941 A 3/1978 Bertrand
4,086,887 A 5/1978 Schoonover et al.
4,089,234 A 5/1978 Henson et al.
4,094,279 A 6/1978 Kueny
4,098,240 A 7/1978 Abell, Jr.
4,104,991 A 8/1978 Abdoo
4,104,996 A 8/1978 Hosono et al.
4,105,267 A 8/1978 Mori
4,107,921 A 8/1978 Iizuka
4,114,588 A 9/1978 Jordan
4,114,643 A 9/1978 Aoyama et al.
4,133,332 A 1/1979 Benson et al.
4,141,333 A 2/1979 Gilbert
4,151,817 A 5/1979 Mueller
4,152,953 A 5/1979 Headley
4,164,917 A 8/1979 Glasson
4,167,931 A 9/1979 Iizuka
4,173,209 A 11/1979 Jordan
4,173,954 A 11/1979 Speckhart
4,175,534 A 11/1979 Jordan
4,184,464 A 1/1980 Svihlik
4,188,933 A 2/1980 Iizuka
4,191,142 A 3/1980 Kodama
4,192,263 A 3/1980 Kitagawa et al.
4,200,081 A 4/1980 Meyer et al.
4,203,397 A 5/1980 Soeters, Jr.
4,204,814 A 5/1980 Matzen
4,206,734 A 6/1980 Perr et al.
4,207,775 A 6/1980 Lintott
4,213,442 A 7/1980 Mihalic
4,221,199 A 9/1980 Buuck et al.
4,221,200 A 9/1980 Soeters, Jr.
4,221,201 A 9/1980 Soeters, Jr.
4,222,354 A 9/1980 Uitvlugt
4,222,793 A 9/1980 Grindahl
4,227,149 A 10/1980 Faure et al.
4,227,494 A 10/1980 Uitvlugt
4,227,495 A 10/1980 Krieg
4,228,771 A 10/1980 Krieg
4,230,076 A 10/1980 Mueller
4,231,267 A 11/1980 Van Slooten 4,237,832 A 12/1980 Hartig et al.
4,245,596 A 1/1981 Bruder et al.
4,249,488 A 2/1981 Siegla
4,249,489 A 2/1981 Bruder et al.
4,252,093 A 2/1981 Hazelrigg
4,256,070 A 3/1981 Mueller
4,258,671 A 3/1981 Takizawa et al.
4,258,673 A 3/1981 Stoody, Jr. et al.
4,262,640 A 4/1981 Clark
4,284,042 A 8/1981 Springer
4,285,310 A 8/1981 Takizawa et al.
4,305,356 A 12/1981 Walsh
4,325,589 A 4/1982 Hirt
4,326,484 A 4/1982 Amrhein
4,335,685 A 6/1982 Clouse
4,336,775 A 6/1982 Meyer
4,337,738 A 7/1982 Bubniak et al.
4,338,894 A 7/1982 Kodama
4,356,799 A 11/1982 Clark
4,361,120 A 11/1982 Kueny
4,362,991 A 12/1982 Carbine
4,363,300 A 12/1982 Honda
4,367,701 A 1/1983 Buente
4,369,627 A 1/1983 Kasting et al.
4,380,219 A 4/1983 Walsh
4,385,599 A 5/1983 Hori et al.
4,387,674 A 6/1983 Connell
4,387,675 A 6/1983 Hori et al.
4,387,680 A 6/1983 Tsunetomi et al.
4,397,270 A 8/1983 Aoyama
4,401,064 A 8/1983 Nakamura et al.
4,402,285 A 9/1983 Arai et al.
4,406,257 A 9/1983 Keske et al.
4,408,580 A 10/1983 Kosuda et al.
4,411,229 A 10/1983 Curtis et al.
4,414,935 A 11/1983 Curtis et al.
4,437,439 A 3/1984 Speil
4,437,738 A 3/1984 Headley et al.
4,438,736 A 3/1984 Hara et al.
4,440,121 A 4/1984 Clancy et al.
4,442,806 A 4/1984 Matsuura et al.
4,448,155 A 5/1984 Hillebrand et al.
4,448,156 A 5/1984 Henault
4,452,187 A 6/1984 Kosuda et al.
4,457,270 A 7/1984 Kodama et al.
4,459,946 A 7/1984 Burandt
4,462,353 A 7/1984 Arai et al.
4,462,364 A 7/1984 Kodama
4,463,714 A 8/1984 Nakamura
4,465,038 A 8/1984 Speil
4,466,390 A 8/1984 Babitzka et al.
4,469,061 A 9/1984 Ajiki et al.
4,475,489 A 10/1984 Honda
4,475,497 A 10/1984 Honda et al.
4,480,617 A 11/1984 Nakano et al.
4,481,913 A 11/1984 Wirth
4,481,919 A 11/1984 Honda et al.
4,483,281 A 11/1984 Black
4,484,546 A 11/1984 Burandt
4,488,520 A 12/1984 Almor
4,498,432 A 2/1985 Hara et al.
4,499,870 A 2/1985 Aoyama
4,502,425 A 3/1985 Wride
4,502,428 A 3/1985 Paar
4,503,818 A 3/1985 Hara et al.
4,506,635 A 3/1985 van Rinsum
4,509,467 A 4/1985 Arai et al.
4,515,121 A 5/1985 Matsuura et al.
4,515,346 A 5/1985 Gaterman, III
4,517,936 A 5/1985 Burgio di Aragona
4,519,345 A 5/1985 Walter
4,523,550 A 6/1985 Matsuura
4,524,731 A 6/1985 Rhoads
4,526,142 A 7/1985 Hara et al.
4,534,323 A 8/1985 Kato et al.
4,535,732 A 8/1985 Nakano et al.
4,537,164 A 8/1985 Ajiki et al.
4,537,165 A 8/1985 Honda et al.
4,539,951 A 9/1985 Hara et al.
4,541,878 A 9/1985 Mühlberger et al.
4,545,342 A 10/1985 Nakano et al.
4,546,734 A 10/1985 Kodama
4,549,509 A 10/1985 Burtchell
4,556,025 A 12/1985 Morita
4,559,909 A 12/1985 Honda et al.
4,561,393 A 12/1985 Kopel
4,567,861 A 2/1986 Hara et al.
4,570,582 A 2/1986 Speil
4,576,128 A 3/1986 Kenichi
4,579,094 A 4/1986 Döppling et al.
4,584,974 A 4/1986 Aoyama et al.
4,584,976 A 4/1986 Hillebrand
4,587,936 A 5/1986 Matsuura et al.
4,589,383 A 5/1986 Showalter
4,589,387 A 5/1986 Miura et al.
4,590,898 A 5/1986 Buente et al.
RE32,167 E 6/1986 Buente
4,596,213 A 6/1986 Hillebrand
4,602,409 A 7/1986 Schaeffler
4,607,599 A 8/1986 Buente et al.
4,611,558 A 9/1986 Yoshizaki et al.
4,612,884 A 9/1986 Ajiki et al.
4,614,171 A 9/1986 Malhotra
4,615,307 A 10/1986 Kodam et al.
4,624,223 A 11/1986 Wherry et al.
4,628,874 A 12/1986 Barlow
4,633,827 A 1/1987 Buente
4,635,593 A 1/1987 Kodama
4,637,357 A 1/1987 Ohmi
4,638,773 A 1/1987 Bonvallet
4,643,141 A 2/1987 Bledsoe
4,648,360 A 3/1987 Schaeffler
4,653,441 A 3/1987 Belsanti
4,655,176 A 4/1987 Sheehan
4,656,977 A 4/1987 Nagahiro et al.
4,671,221 A 6/1987 Geringer et al.
4,674,451 A 6/1987 Rembold et al.
4,677,723 A 7/1987 Greene, Sr.
4,690,110 A 9/1987 Nishimura et al.
4,693,214 A 9/1987 Titolo
4,694,788 A 9/1987 Craig
4,696,265 A 9/1987 Nohira
4,697,473 A 10/1987 Patel
4,699,094 A 10/1987 Stegeman
4,704,995 A 11/1987 Soeters, Jr.
4,708,102 A 11/1987 Schmid
4,711,202 A 12/1987 Baker
4,711,207 A 12/1987 Bonvallet
4,716,863 A 1/1988 Pruzan
4,718,379 A 1/1988 Clark
4,724,802 A 2/1988 Ishii
4,724,804 A 2/1988 Wirth
4,724,822 A 2/1988 Bonvallet
4,726,332 A 2/1988 Nishimura et al.
4,727,830 A 3/1988 Nagahiro et al.
4,727,831 A 3/1988 Nagahiro et al.
4,738,231 A 4/1988 Patel et al.
4,741,297 A 5/1988 Nagahiro et al.
4,741,298 A 5/1988 Rhoads
4,745,888 A 5/1988 Kapp
4,747,376 A 5/1988 Speil et al.
4,756,282 A 7/1988 Kunz et al.
4,759,321 A 7/1988 Matsumoto et al.
4,759,322 A 7/1988 Konno
4,762,096 A 8/1988 Kamm et al.
4,765,288 A 8/1988 Linder et al.

4,765,289 A 8/1988 Masuda et al.
4,768,467 A 9/1988 Yamada et al.
4,768,475 A 9/1988 Ikemura
4,771,741 A 9/1988 Leer
4,771,742 A 9/1988 Nelson et al.
4,773,359 A 9/1988 Titolo
4,779,583 A 10/1988 Laffter et al.
4,779,589 A 10/1988 Matsuura et al.
4,782,799 A 11/1988 Goppelt et al.
4,784,095 A 11/1988 Golding et al.
4,787,347 A 11/1988 Schaeffler
4,790,274 A 12/1988 Inoue et al.
4,791,895 A 12/1988 Tittizer
4,793,295 A 12/1988 Downing
4,793,296 A 12/1988 Inoue et al.
4,796,483 A 1/1989 Patel et al.
4,796,573 A 1/1989 Wakeman et al.
4,799,463 A 1/1989 Konno
4,800,850 A 1/1989 Yoshida et al.
4,802,448 A 2/1989 Ableitner
4,803,334 A 2/1989 Burke et al.
4,805,567 A 2/1989 Heimburg
4,809,651 A 3/1989 Gerchow et al.
4,815,424 A 3/1989 Buuck et al.
4,825,717 A 5/1989 Mills
4,825,823 A 5/1989 Schaeffler
4,829,948 A 5/1989 Yoshida et al.
4,840,153 A 6/1989 Aida et al.
4,844,022 A 7/1989 Konno
4,844,023 A 7/1989 Konno et al.
4,848,180 A 7/1989 Mills
4,848,285 A 7/1989 Konno
4,850,311 A 7/1989 Shon
4,858,574 A 8/1989 Fukuo et al.
4,869,214 A 9/1989 Inoue et al.
4,872,429 A 10/1989 Anderson et al.
4,876,114 A 10/1989 Phinney et al.
4,876,944 A 10/1989 Wilson et al.
4,876,994 A 10/1989 Speil et al.
4,876,997 A 10/1989 Zorn et al.
4,883,027 A 11/1989 Oikawa et al.
4,887,561 A 12/1989 Kishi
4,887,563 A 12/1989 Ishida et al.
4,887,566 A 12/1989 Shida
4,896,635 A 1/1990 Willermet et al.
4,899,701 A 2/1990 Inoue et al.
4,905,639 A 3/1990 Konno
4,909,195 A 3/1990 Hasebe et al.
4,909,197 A 3/1990 Perr
4,917,056 A 4/1990 Yagi et al.
4,917,059 A 4/1990 Umeda
4,919,089 A 4/1990 Fujiyoshi et al.
4,920,935 A 5/1990 Shida
4,921,064 A 5/1990 Wazaki et al.
4,924,821 A 5/1990 Teerman
4,926,804 A 5/1990 Fukuo
4,930,465 A 6/1990 Wakeman et al.
4,940,048 A 7/1990 Mills
4,944,257 A 7/1990 Mills
4,951,619 A 8/1990 Schaeffler
4,957,076 A 9/1990 Inoue et al.
4,959,794 A 9/1990 Shiraishi et al.
RE33,411 E 10/1990 Inoue et al.
4,969,102 A 11/1990 Tamura et al.
4,971,164 A 11/1990 Fujita et al.
4,986,227 A 1/1991 Dewey, III
4,993,150 A 2/1991 Reinhardt et al.
4,995,281 A 2/1991 Allor et al.
5,003,939 A 4/1991 King
5,010,856 A 4/1991 Ojala
5,010,857 A 4/1991 Hempelmann et al.
5,018,487 A 5/1991 Shinkai
5,022,356 A 6/1991 Morel, Jr. et al.
5,025,761 A 6/1991 Chen
5,028,281 A 7/1991 Hayes et al.
5,033,420 A 7/1991 Matayoshi et al.
5,036,807 A 8/1991 Kaneko
5,040,651 A 8/1991 Hampton et al.
5,042,436 A 8/1991 Yamamoto et al.
5,042,437 A 8/1991 Sakuragi et al.
5,046,462 A 9/1991 Matayoshi et al.
5,048,475 A 9/1991 Mills
5,069,173 A 12/1991 Mallas
5,070,827 A 12/1991 Krieg et al.
5,074,260 A 12/1991 Yagi et al.
5,074,261 A 12/1991 Hamburg et al.
5,080,053 A 1/1992 Parsons
5,088,455 A 2/1992 Moretz
5,090,364 A 2/1992 McCarroll et al.
5,099,806 A 3/1992 Murata et al.
5,099,807 A 3/1992 Devine
5,107,806 A 4/1992 Döohring et al.
5,113,813 A 5/1992 Rosa
RE33,967 E 6/1992 Honda et al.
5,119,774 A 6/1992 Krieg et al.
5,127,374 A 7/1992 Morel, Jr. et al.
5,129,373 A 7/1992 Cuatt et al.
5,148,783 A 9/1992 Shinkai et al.
5,150,672 A 9/1992 Fischer et al.
5,161,493 A 11/1992 Ma
5,163,389 A 11/1992 Fujikawa et al.
5,178,107 A 1/1993 Morel, Jr. et al.
5,181,485 A 1/1993 Hirose et al.
5,184,581 A 2/1993 Aoyama et al.
5,186,130 A 2/1993 Melchior
5,188,067 A 2/1993 Fontichiaro et al.
5,188,068 A 2/1993 Gaterman, III et al.
5,189,997 A 3/1993 Schneider
5,193,496 A 3/1993 Kruger
5,199,393 A 4/1993 Baldassini
5,239,951 A 8/1993 Rao et al.
5,247,913 A 9/1993 Manolis
5,253,621 A 10/1993 Dopson et al.
5,259,346 A 11/1993 Mills
5,261,361 A 11/1993 Speil
5,263,386 A 11/1993 Campbell et al.
5,273,005 A 12/1993 Philo et al.
5,287,830 A 2/1994 Dopson et al.
5,301,636 A 4/1994 Nakamura
5,307,769 A 5/1994 Meagher et al.
5,320,082 A 6/1994 Murata et al.
5,343,833 A 9/1994 Shirai
5,345,898 A 9/1994 Krebs
5,347,965 A 9/1994 Decuir
5,351,662 A 10/1994 Dopson et al.
5,353,756 A 10/1994 Murata et al.
5,357,916 A 10/1994 Matterazzo
5,361,733 A 11/1994 Spath et al.
5,365,896 A 11/1994 Hara et al.
5,379,730 A 1/1995 Schaeffler
5,385,124 A 1/1995 Hillebrand et al.
5,386,806 A 2/1995 Allen et al.
5,394,843 A 3/1995 Decuir
5,398,648 A 3/1995 Spath et al.
5,402,756 A 4/1995 Bohme et al.
5,419,290 A 5/1995 Hurr et al.
5,429,079 A 7/1995 Murata et al.
5,430,934 A 7/1995 Groh et al.
5,431,133 A 7/1995 Spath et al.
5,454,353 A 10/1995 Elendt et al.
5,501,186 A 3/1996 Hara et al.
5,509,385 A 4/1996 LaVieri
5,520,144 A 5/1996 Philo et al.
5,544,626 A 8/1996 Diggs et al.
5,546,899 A 8/1996 Sperling et al.
5,549,081 A 8/1996 Ohlendorf et al.

| | | | |
|---|---|---|---|
| 5,553,584 | A | 9/1996 | Konno |
| 5,555,861 | A | 9/1996 | Mayr et al. |
| 5,560,265 | A | 10/1996 | Miller |
| 5,560,329 | A | 10/1996 | Hayman |
| 5,566,652 | A | 10/1996 | Deppe |
| 5,584,268 | A | 12/1996 | Natkin et al. |
| 5,592,907 | A | 1/1997 | Hasebe et al. |
| 5,603,294 | A | 2/1997 | Kawai |
| 5,613,469 | A | 3/1997 | Rygiel |
| 5,642,694 | A | 7/1997 | Dura et al. |
| 5,651,335 | A | 7/1997 | Elendt et al. |
| 5,653,198 | A | 8/1997 | Diggs |
| 5,655,487 | A | 8/1997 | Maas et al. |
| 5,655,488 | A | 8/1997 | Hampton et al. |
| 5,660,153 | A | 8/1997 | Hampton et al. |
| 5,673,661 | A | 10/1997 | Jesel |
| 5,678,514 | A | 10/1997 | Mazzella et al. |
| 5,697,333 | A | 12/1997 | Church et al. |
| 5,706,773 | A | 1/1998 | Dura et al. |
| 5,746,165 | A | 5/1998 | Speil et al. |
| 5,775,275 | A | 7/1998 | Philo |
| 5,797,364 | A | 8/1998 | Meek et al. |
| 5,806,475 | A | 9/1998 | Hausknecht |
| 5,875,748 | A | 3/1999 | Haas et al. |
| 5,893,344 | A | 4/1999 | Church |
| 5,908,015 | A | 6/1999 | Kreuter |
| 5,924,396 | A | 7/1999 | Ochiai et al. |
| 5,934,232 | A | 8/1999 | Greene et al. |
| 5,960,756 | A | 10/1999 | Miyachi et al. |
| 5,983,848 | A | 11/1999 | Calka |
| 6,006,706 | A | 12/1999 | Kanzaki |
| 6,032,624 | A | 3/2000 | Tsuruta et al. |
| 6,058,895 | A | 5/2000 | Hermsen |
| 6,092,497 | A | 7/2000 | Preston et al. |
| 6,186,101 | B1 | 2/2001 | Kreuter |
| 6,196,175 | B1 | 3/2001 | Church |
| 6,273,039 | B1 | 8/2001 | Church |
| 6,321,704 | B1 | 11/2001 | Church et al. |
| 6,321,705 | B1 | 11/2001 | Fernandez et al. |
| 6,325,030 | B1 | 12/2001 | Spath et al. |
| 6,325,034 | B1 | 12/2001 | Edelmayer |
| 6,328,009 | B1 | 12/2001 | Brothers |
| 6,418,904 | B2 | 7/2002 | Hannon |
| 6,439,179 | B2 | 8/2002 | Hendriksma et al. |
| 6,513,470 | B1 | 2/2003 | Hendriksma et al. |
| 6,735,997 | B2 * | 5/2004 | Rosenberger et al. ..... 72/356 |
| 2003/0196620 | A1 | 4/2003 | Spath |

OTHER PUBLICATIONS

"Eaton adds variablity to Displacement on Demand," Frank Bokulich, Automotive Engineering International Tech Brief, Jan. 2002, 01471-01476.
"GM Power Train Displaces on Demand," Jean L. Broge, Automotive Engineering International Online, Jul. 2001, 01474-01476.
"GM Technology," Daniel J. Holt, Service Tech Magazine, Jul. 2001, 01477-01479.
"Eaton adds variablity to Displacement on Demand," Frank Bokulich, Automotive Engineering International Tech Brief, Jan. 2002, 01480-01483.
Prints, Mar. 14, 2000, 01484-01485.
Prints, Nov. 30, 2000, 01486-01494.
Print, Feb. 25, 2000, 01495.
Confidentiality Agreement, Jul. 8, 2003, 01496-01499.
E-mail communications, Jan. 3, 2002 to Apr. 4, 2002, 01500-01510.
"Hydraulic Valve Lifter," Delphi, Jul. 2, 2002, 01511-01513.
E-mail communications, Oct. 23, 2001 to Oct. 25, 2001, 01514.
Interoffice Memorandum, Nov. 6, 2001, 01515-01516.
Interoffice Memorandum, Aug. 27, 2001, 01517-01528.
Correspondence, Fred Wasco, Jul. 16, 2001, 01529-01530.
Interoffice Memorandum, Undated, 01531-01534.
Correspondence, Dhruva Mandal, Aug. 3, 2001, 01535-01543.
Correspondence, Regis J. Leonard, Nov. 1, 2000, 01544.
E-mail communications, Sep. 28, 2001, 01545.
E-mail communication, Jerry Giessinger, Nov. 29, 2001, 01546.
E-mail communcation, Fred Wasco, Jul. 24, 2001, 01547.
Meeting Agenda, Aug. 2, 2001, 01548.
E-mail communication, Jerry Giessinger, Jun. 25, 2001, 01549.
Handwritten notes, Undated, 01550-01551.
Interoffice Memorandum, Undated, 01552-01554.
E-mail communications, Kojo Annan, Feb. 8, 2002, 01555.
Handwritten notes, Undated, 01556.
Calendar, Jul. 2001-Dec. 2001, 0157-01562.
Prints, Jul. 16, 2001, 01563-01565.
Prints, Aug. 24, 2001, 01566.
Prints, Jul. 16, 2001, 01567.
Prints, Aug. 24, 2001, 01568.
Report, Undated, 01569.
Notes, Undated, 01570.
Cost Estimate, Undated, 01571.
Prints, Jul. 17, 2001, 01572-01573.
E-mail communications, Feb. 27, 2002-Apr. 4, 2002, 01574-01578.
E-mail communications, Jerry Giessinger, Jun. 25, 2001, 01579-01580.
E-mail communications, Fred Wasco, Jul. 24, 2001, 01581.
Inspection Report, Feb. 2002, 01582-01609.
Prints, Jan. 16, 2002, 01610.
Inspection Report, Jan. 30, 2002, 01611.
E-mail communications, Ed Spangler, Feb. 3, 2002, 01612.
Inspection Report, Jan. 31, 2002, 01613-01617.
E-mail communications, Jerry Giessinger, Jun. 29, 2001, 01618.
E-mail communications, Fred Wasco, Feb. 5, 2002, 01619.
E-mail communications, Kojo Annan, Feb. 8, 2002, 01620.
Document relating to dimensions, Jan. 30, 2002, 01621-01624.
E-mail communications, Nalin Patel, Jan. 31, 2002, 01625.
Document relating to dimensions, Jan. 30, 2002, 01626-01630.
Handwritten notes, Feb. 4, 2002, 01631.
E-mail communications, Fred Wasco, Jun. 29, 2001, 01632.
E-mail communications, Kojo Annan, Feb. 27, 2002, 01633.
E-mail communications, Dhruva Mandal, Jul. 18, 2001, 01634.
Correspondence, Dhruva Mandal, Jun. 15, 2001, 01635-01638.
E-mail communications, Jerry Giessinger, Jan. 28, 2002, 01639.
Prints, Aug. 24, 2001, 01640.
Prints, Jul. 16, 2001, 01641.
Prints, Jun. 7, 2001, 01642.
Prints, Jun. 17, 2000, 01643.
Prints, Jan. 16, 2002, 01644.
Prints, Jul. 17, 2000, 01645-01646.
E-mail communications, Kojo Annan, Mar. 19, 2002, 01647-01650.
E-mail communications, Dhruva Mandal, Feb. 27, 2002, 01651-01652.
E-mail communications, Jerry Giessinger, Jan. 9, 2002, 01653.
E-mail communications, Jerry Giessinger, Oct. 25, 2001, 01654.
Interoffice communication, Undated, 01655.
Purchase Order, Oct. 18, 2001, 01656-01658.
Purchase Order, Feb. 7, 2002, 01659-01661.
Correspondence, Jerry Giessinger, Sep. 11, 2001, 01662-01701.
MacLean-Fogg Quotation Cover, 01702.
Prints, Jun. 17, 2000, 01703.
Prints, May 30, 2001, 01704.
Drawings, Undated, 01705.
MacLean-Fogg Quotation Cover, Jul. 30, 2001, 01706-01707.
Correspondence, Karen Allread, Jul. 27, 2001, 01708.
Interoffice correspondence, Aug. 6, 2001, 01709.
Prints, Jun. 21, 1999, 01710.
Meeting Minutes, Aug. 21, 2001, 01711.
Interoffice Memorandum, Jerry Giessinger, Aug. 22, 2001, 01712-01713.
Cost Estimate, Undated, 01714.
Notes, Undated, 01715.
Estimates, Aug. 17, 2001, 01716.
Draft correspondence, Aug. 17, 2001, 01717.
E-mail communications, Mike Fallaw, Aug. 10, 2001, 01718.
Interoffice correspondence, Dean Williams, Aug. 16, 2001, 01719.
Interoffice correspondence, Aug. 30, 2001, 01720.
Prints, Jun. 21, 1999, 01721.

Handwritten notes, Undated, 01722.
Interoffice correspondence, Aug. 17, 2001, 01723.
Cost Estimate, Aug. 17, 2001, 01724.
Prints, Jun. 21, 1999, 01725.
Prints, Sep. 5, 2001, 01726.
Prints, Nov. 22, 2000, 01727.
Handwritten notes, Undated, 01728.
Notes, Jul. 26, 2001, 01729.
Interoffice correspondence, Aug. 17, 2001, 01730.
Cost Estimate, Undated, 01731.
Prints, Jul. 16, 2001, 01732.
Notes, Jul. 26, 2001, 01733.
Interoffice correspondence, Aug. 17, 2001, 01734-01750.
Correspondence, Jerry Giessinger, Sep. 11, 2001, 01751-01764.
Interoffice correspondence, Undated, 01765.
Meeting Summary, Undated, 01766.
Prints, Aug. 24, 2001, 01767.
Prints, Jul. 17, 2001, 01768.
Prints, Sep. 5, 2001, 01769.
Prints, Jul. 16, 2001, 01770.
Prints, Jul. 21, 1999, 01771.
Handwritten notes, 01772-01774.
Correspondence, Jerry Giessinger, Sep. 11, 2001, 01775-01788.
Prints, Sep. 9, 2001, 01789-01792.
E-mail communications, Karen Allread, Oct. 4, 2001, 01793-01794.
Interoffice Memorandum, Oct. 4, 2001, 01795.
E-mail communications, Jerry Giessinger, Oct. 3, 2001, 01796-01797.
E-mail communications, David Britton, Aug. 27, 2001, 01798-1799.
Draft correspondence, Jerry Giessinger, Undated, 01800.
E-mail communications, Jerry Giessinger, Aug. 27, 2001, 01801-01802.
MacLean-Fogg Quotation Cover, Jul. 30, 2001, 01803-01804.
Cost Estimate, Aug. 6, 2001, 01805.
Correspondence, Karen Allread, Jul. 27, 2001, 01806.
Prints, Nov. 22, 2000, 01807.
MacLean-Fogg Quotation Cover, Jul. 30, 2001, 01808-01809.
Cost Estimate, Aug. 6, 2001, 01810.
Correspondence, Karen Allread, Jul. 30, 2001, 01811.
Prints, Jul. 16, 2001, 01812.
MacLean-Fogg Quotation Cover, Jul. 30, 2001, 01813-01814.
Cost Estimate, Aug. 6, 2001, 01815.
Correspondence, Karen Allread, Jul. 30, 2001, 01816.
Prints, Jul. 16, 2001, 01817.
MacLean-Fogg Quotation Cover, Jul. 30, 2001, 01818-01819.
Cost Estimate, Aug. 6, 2001, 01820.
Correspondence, Karen Allread, Jul. 27, 2001, 01821.
Prints, Jul. 17, 2001, 01822.
Deact Program Quote, Undated, 01823.
Notes, Undated, 01824.
Cost Estimate, Aug. 17, 2001, 01825-01826.
Interoffice communications, Undated, 01827-01828.
Deact Program Quote, Undated, 01829-01830.
Report, Jul. 1, 2002, 01831.
Meeting Minutes, Ed Spangler, Nov. 30, 2001, 01832-01833.
Meeting Minutes, Jerry Giessinger, Nov. 30, 2001, 01834.
Meeting Agenda, Nov. 30, 2001, 01835.
Prints, Aug. 1, 2001, 01836.
Prints, Jul. 25, 2001, 01837.
Prints, Aug. 20, 2001, 01838.
Roller Lifter Body Powerpoint, Feb. 6, 2002, 01839-01843.
Prints, Aug. 20, 2001, 01844-01849.
Flyer, Undated, 01850-01851.
Engineering Change Notice, Feb. 2, 1989, 01852.
Prints, Jan. 26, 1989, 01853-01854.
Purchase Order, Nov. 13, 1989, 01855.
Prints, Oct. 7, 1985, 01856.
Prints, May 1, 1985.
Correspondence, Herb Earl, Feb. 6, 1986, 01858.
Prints, May 31, 1985, 01859.
Prints, Mar. 6, 1986, 01860.
Interoffice Memorandum, Mar. 5, 1986, 01861.
Prints, Oct. 7, 1985, 01862-01863.
Prints, Feb. 20, 1989, 01864.
Prints, Jan. 29, 1986, 01865.
Prints, Mar. 6, 1986, 01866.
Production Order Schedule, Jul. 19, 1993, 01867-01868.
Correspondence, Jerry Giessinger, Feb. 7, 2002, 01869-01870.
Correspondence, Fred Wasco, Jul. 16, 2001, 01871-01872.
E-mail communications, Fred Wasco, Sep. 7, 2001, 01873.
E-mail communications, Jerry Giessinger, Jan. 3, 2002, 01874.
E-mail communications, Jerry Giessinger, Jan. 4, 2002, 01875.
E-mail communications, Jerry Giessinger, Jan. 3, 2002, 01876-01877.
Summary of MacLean-Fogg Tooling Issues, Undated, 01878.
Cost Estimate, May 31, 2001, 01879.
Interoffice Communications, Oct. 12, 2001, 01880.
Machine Rates, Undated, 01881.
Interoffice Communications, Oct. 12, 2001, 01882.
Cost Estimate, Oct. 12, 2001, 01883.
E-mail communications, Jerry Giessinger, Jun. 29, 2001, 01884.
Cost Estimate, Undated, 01885.
E-mail communications, Free Markets Inc., May 30, 2001, 01886.
Cost Estimate, Undated, 01887.
Self Assessment Checklist, Feb. 1, 2000, 01888.
Cost Breakdown, Jun. 6, 2001, 01889-01890.
Automatic Screw Machine, Undated, 01891.
Cost Breakdown, Jun. 6, 2001, 01892.
Free Markets Documents, May 10, 2001, 01893-01899.
Self Assessment Checklist, Undated, 01900.
E-mail communications, Jun. 7, 2001, 01901-01902.
Free Markets Documents, May 31, 2001, 01903-01913.
E-mail communications, David Howes, May 25, 2001, 01914.
Free Markets Documents, May 15, 2001, 01915-01916.
E-mail communications, David Howes, May 31, 2001, 01917.
Cost Estimate, May 31, 2001, 01918.
Worksheet, Undated, 01919.
MacLean-Fogg, Quotation Cover, May 30, 2001, 01920.
Prints, May 30, 2001, 01921.
Prints, Mar. 14, 2000, 01922.
Free Markest Documents, May 31, 2001, 01923-01925.
Correspondence, Nov. 2, 2001, 01926-01927.
E-mail communications, Jerry Giessinger, Dec. 2, 2001, 01928.
Correspondence, Oct. 17, 2001, 01929.
Handwritten notes, Nov. 6, 2001, 01930.
Correspondence, Oct. 17, 2001, 01931.
Correspondence, Oct. 23, 2001, 01932-01934.
Correspondence, Oct. 17, 2001, 01935.
Cost Estimate, May 31, 2001, 01936-01940.
Handwritten notes, Undated, 01941.
Cost Estimate, May 31, 2001, 01942-01944.
MacLean-Fogg Quotation Cover, May 30, 2001, 01945.
Prints, Jul. 17, 2000, 01946.
Prints, May 30, 2001, 01947.
Worksheet, Undated, 01948.
E-mail communications, Tom Richardson, May 31, 2001, 01949.
Prints, Jul. 17, 2000, 01950.
Line Item Details, Undated, 01951.
Prints, Mar. 14, 2000, 01952.
Prints, Nov. 30, 2000, 01953-01961.
Prints, Feb. 25, 2000, 01962.
Handwritten notes, Undated, 01963.
Free Markets Documents, Feb. 6, 2002, 01964-01965.
Prints, Jun. 21, 1999, 01966-01967.
Cost Estimate, Undated, 01968-01973.
E-mail communications, Jaime Steele, Feb. 4, 2002, 01974.
Free Markets Documents, Feb. 7, 2002, 01975-01985.
Free Markets Documents, Jan. 31, 2002, 01986.
Free Markets Documents, Feb. 6, 2002, 01987.
Free Markets Documents, Jan. 9, 2002C, 01988-02010.
Correspondence, Jan. 31, 2002, 02011-02014.
Cost Estimate, Aug. 17, 2001, 02015-02018.
Free Markets Documents, Jan. 31, 2002, 02019.
Material Specification, Mar. 17, 1999, 02020-02024.
Purchase Order Terms and Conditions, Undated, 02025-02032.

Free Market Documents, Undated, 02033-02034.
Prints, Dec. 12, 2001, 02035.
Free Market Documents, Undated, 02036.
Prints, Dec. 17, 2001, 02037.
Free Market Documents, Undated, 02038.
Prints, Jun. 21, 1999, 02039.
Free Market Documents, Undated, 02040.
Prints, Jun. 21, 1999, 02041.
Free Markets Documents, Undated, 02042.
Prints, Dec. 10, 2001, 02043.
Free Markets Documents, Undated, 02044.
Prints, Dec. 7, 2001, 02045.
Free Markets Documents, Undated, 02046.
Prints, Dec. 10, 2001, 02047.
Prints, Dec. 7, 2001, 02048.
E-mail communications, Jaime Steele, Jan. 29, 2002, 02049.
E-mail communications, Rudy Lang, Sep. 19, 2001, 02050.
Correspondence, Aug. 30, 2001, 02051.
Quotation Request, Sep. 14, 2001, 02052.
Prints, Jul. 16, 2001, 02053.
Prints, Nov. 22, 2000, 02054.
Prints, Jul. 17, 2001, 02055.
Prints, Jun. 21, 1999, 02956.
Prints, Jul. 16, 2001, 02057.
Quotation, Waltz Brothers Inc., Jan. 31, 2002, 02058-02060.
Quotation, Bodycoat, Sep. 24, 2001, 02061.
Quotation Request, Sep. 14, 2001, 02062.
Prints, Jul. 16, 2001, 02063.
Prints, Nov. 22, 2000, 02064.
Prints, Jul. 17, 2001, 02065.
Prints, Jun. 21, 1999, 02066.
Prints, Jul. 16, 2001, 02067.
Interoffice communications, Sep. 14, 2001, 02068.
Quote, Amac Enterprises Inc., Sep. 22, 2001, 02069.
Quotation Request, Sep. 14, 2001, 02070.
Prints, Jul. 16, 2001, 02071.
Prints, Nov. 22, 2000, 02072.
Prints, Jul. 17, 2001, 02073.
Prints, Jun. 21, 1999, 02074.
Prints, Jul. 16, 2001, 02075.
Interoffice communication, Sep. 14, 2001, 02076.
Draft correspondence, Jerry Giessinger, Aug. 17, 2001, 02077.
Interoffice communication, Undated, 02078-02079.
Cost Estimate, Aug. 17, 2001, 02080.
MacLean-Fogg Quotation Cover, Jul. 31, 2001, 02081.
Prints, Jun. 21, 1999, 02082.
Correspondence, Karen Allready, Jul. 27, 2001, 02083.
MacLean-Fogg Quotation Cover, Jul. 30, 2001, 02084-02085.
Cost Estimate, Aug. 6, 2001, 02086.
Correspondence, Karen Allread, Jul. 27, 2001, 02087.
Prints, Jun. 21, 1999, 02088-02089.
MacLean-Fogg Quotation Cover, Jul. 30, 2001, 02090.
Correspondence, Karen Allread, Jul. 27, 2001, 02091.
Cost Estimate, Aug. 17, 2001, 02092.
MacLean-Fogg Quotation Cover, Jul. 30, 2001, 02093.
Quotation Request and Routing Form, Jul. 30, 2001, 02094.
Cost Estimate, Aug. 6, 2001, 02095.
Correspondence, Jul. 30, 2001, 02096.
Prints, Jul. 16, 2001, 02097-2098.
MacLean-Fogg Quotation Cover, Jul. 30, 2001, 02099.
Correspondence, Karen Allread, Jul. 27, 2001, 02100.
Cost Estimate, Aug. 17, 2001, 02101.
MacLean-Fogg Quotation Cover, Jul. 31, 2001, 02102.
Quotation Request and Routing Form, Jul. 30, 2001, 02103.
Cost Estimate, Aug. 6, 2001, 02104.
Prints, Jul. 17, 2001, 02105.
Correspondence, Karen Allread, Jul. 27, 2001, 02106.
Prints, Jul. 17, 2001, 02107.
Cost Estimate, Aug. 17, 2001, 02108.
MacLean-Fogg Quotation Cover, Jul. 31, 2001, 02109.
Correspondence, Karen Allread, Jul. 27, 2001, 02110.
MacLean-Fogg Quotation Cover, Jul. 30, 2001, 02111.
Quotation Request and Routing Form, Jul. 30, 2001, 02112.
Cost Estimate, Aug. 6, 2001, 02113.
Correspondence, Karen Allread, Jul. 27, 2001, 02114.
Prints, Nov. 22, 2000, 02115-02116.
Cost Estimate, Aug. 17, 2001, 02117.
MacLean-Fogg Quotation Cover, Jul. 30, 2001, 02118.
Correspondence, Karen Allready, Jul. 27, 2001, 02119.
MacLean-Fogg Quotation Cover, Jul. 30, 2001, 02120.
Quotation Request and Routing Form, Jul. 30, 2001, 02121.
Cost Estimate, Aug. 6, 2001, 02122.
Correspondence, Karen Allready, Jul. 27, 2001, 02123.
Prints, Jul. 16, 2001, 02124-02125.
Supplier Quality Assurance Spefication, Sep. 1, 1985, 02126-02133.
Correspondence, Precise Metal Forming Products Inc., May 12, 1992, 02134.
Handwritten notes, Undated, 02135.
Correspondence, Joe Paganini, Oct. 17, 1986, 02136.
Correspondence, Dan Berg, Dec. 13, 1989, 02137-02138.
Correspondence, Sep. 7, 1976, 02139.
Handwritten Notes, Feb. 3, 1989, 02140.
Interoffice Memorandum, Herb Earl, May 27, 1992, 02141.
Correspondence, W. Lukens Ward, Mar. 13, 1986, 02142.
Correspondence, W. Luken Ward, Mar. 13, 1986, 02143.
Interoffice Correspondence, Dan Berg, Feb. 26, 1988, 02144.
Interoffice Memorandum, Herman Koestring, Jul. 5, 1998, 02145.
Interoffice Correspondence, Dan Berg, Jan. 13, 1998, 02146.
Interoffice Memorandum, Herman Koestring, Feb. 24, 1986, 02147.
Correspondence, James E. Shea, Mar. 12, 1987, 02148.
Interoffice Memorandum, Herb Earl, Feb. 27, 1985, 02149-02150.
Capability Analysis, Oct. 25, 1986, 02151-02153.
Interoffice Memorandum, Herb Earl, Sep. 20, 1986, 02154.
Correspondence, W. Lukens Ward, Mar. 21, 1986, 02155-02156.
Quality Assurance Finding, Herb Earl, Mar. 21, 1986, 02157-02164.
Correspondence, Ron Frankel, Apr. 10, 1989, 02165.
Prints, Jul. 15, 1988, 02166.
Correspondence, Herb Earl, Jul. 23, 1984, 02167-02168.
Correspondence, Bob McCormick, May 18, 1990, 02169-02170.
Correspondence, Jul. 17, 1990, 02171-02176.
Interoffice Report, Dan Berg, Oct. 2, 1986, 02177-02179.
Correspondence, Dan Berg, Undated, 02180.
Correspondence, Tadao, Undated, 02181.
Note, Dan Berg, Jan. 14, 1985, 02182.
Notes, Undated, 02183.
Notes, Dan Berg, Jan. 9, 1984, 02184.
Correspondence, Ron Frankel, Feb. 18, 1985, 02185.
Invoice, Sep. 13, 1984, 02186.
Notes, Jan. 31, 1985, 02187.
Correspondence, Herb Earl, Jan. 4, 1985, 02188.
Notes, Herb Earl, Jan. 4, 1985, 02189.
Invoice, Feb. 18, 1988, 02190-2192.
Interoffice Memorandum, W.B. Hamilton, May 20, 1985, 02193-2194.
Report, Feb. 14, 1990, 02195.
Inspection Report, M. Stewart, Sep. 20, 1986, 02196-02200.
Report, Nov. 5, 1986, 02201.
Report, Feb. 2, 1989, 02202-02204.
Report, Feb. 21, 1989, 02205-2210.
Report, Feb. 2, 1989, 02211-02216.
Report, J. Christmas, Apr. 27, 1989, 02217-02222.
Inspection Report, J. Christmas, Apr. 6, 1989, 02223-02224.
Report, J. Christmas, Apr. 27, 1989, 02225 02230.
Report, J. Christmas, Apr. 5, 1989, 02131-02132.
Correspondence, P.V. Foullon, Jun. 9, 1989, 02133-02134.
Report, Undated, 02235-02240.
Report, Undated, 02241-02242.
Report, Sep. 17, 1985, 02243-02244.
Report, Oct. 25, 1985, 02245-02250.
Form, Undated, 02251-02253.
Report, Undated, 02254.
Inspection Forms, Undated, 02255-02261.
Control Plan, Ron Frankel, Jun. 18, 1999, 02262-02269.
Control Plan, Ron Frankel, Mar. 1, 1999, 02270-02287.
Report, J. Christmas, Dec. 6, 1989, 02288.
Report, J. Christmas, Dec. 8, 1989, 02289-02290.

Notes, Undated, 02291-02298.
Correspondence, Larry Trout, Aug. 15, 1990, 02299-02300.
Interoffice Correspondence, Ron Frankel, Sep. 3, 1986, 02301.
Prints, Oct. 2, 1985, 02302.
Correspondence, Bob McCormick, Aug. 6, 1986, 02303-02304.
Report, Undated, 02305-02314.
Control Plan, Ron Frankel, Mar. 1, 1989, 02315-02323.
Control Plan, Ron Frankel, Jun. 18, 1990, 02324-02331.
Notes, Undated, 02332.
Report, Undated, 02333.
Control Plan, Ron Frankel, Nov. 5, 1986, 02334-02343.
Prints, Feb. 2, 1986, 02344-02345.
Correspondence, R.E. McCue, Dec. 17, 1985, 02346.
Production Order Schedule, Apr. 10, 1986, 02347.
Control Plan, Ron Frankel, Mar. 19, 1986, 02348-02355.
Control Plan, Ron Frankel, Nov. 5, 1986, 02356-02364.
Reports, Undated, 02365-02420.
Notes, Apr. 8, 1985, 02421.
Inspection Forms, Undated, 02422-02423.
Inspection Report, Dan Foss, Sep. 25, 1985, 02424-02425.
Correspondence, Ron Frankel, Oct. 23, 1986, 02426.
Report, Sep. 25, 1985, 02427.
Report, Undated, 02428.
Report, D. Burkeen, May 9, 1985, 02429-02430.
Interoffice Memorandum, Herb Earl, Feb. 7, 1999, 02431.
Correspondence, Bill Hamilton, Sep. 10, 1985, 02432-02433.
Engineering Change Notice, Feb. 12, 1986, 02434.
Interoffice Memorandum, W.B. Hamilton, Jul. 16, 1985, 02435.
Memorandum, W.E. Hamilton, Jul. 17, 1985, 02436-02437.
Notes, W.B. Hamilton, Jan. 12, 1985, 02438.
Correspondence, T.R. Downing, Jan. 10, 1984, 02439.
Notes, Undated, 02440-2441.
Notes, W.B. Hamilton, Apr. 7, 1986, 02442.
Memorandum, Herb Earl, Feb. 7, 1989, 02443.
Correspondence, Herb Earl, Sep. 22, 1986, 02444.
Prints, Oct. 7, 1985, 02445.
Prints, Feb. 12, 1986, 02446.
Correspondence, Jim Robinson, Apr. 12, 1990, 02447.
Prints, Jul. 16, 1986, 02448.
Prints, Apr. 11, 1990, 02449.
Notes, Jul. 24, 1992, 02450.
Prints, Jun. 18, 1992, 02451.
Prints, Jan. 26, 1989, 02452.
Notes, Undated, 02453-2454.
Correspondence, Herb Earl, Jun. 3, 1992, 02455.
Notes, Undated, 02456-02457.
Interoffice Memorandum, Oct. 6, 1989, 02458.
Correspondence, Herb Earl, Jan. 19, 1989, 02459-02460.
Memorandum, T.R. Downing, Jan. 10, 1984, 02461.
Prints, Mar. 16, 1984, 02462-02463.
Prints, Jul. 20, 1984, 02464.
Prints, Dec. 10, 1984, 02465.
Correspondence, Herb Earl, Nov. 15, 1986, 02466-02469.
Correspondence, W.B. Hamilton, Oct. 31, 1985, 02470-02471.
Correspondence, Herb Earl, Jul. 12, 1985, 02472-02473.
Prints, Jan. 2, 1985, 02474.
Prints, Feb. 12, 1986, 02475-02478.
Correspondence, Herb Earl, Aug. 17, 1992, 02479-02480.
Correspondence, P.V. Foullon, Mar. 7, 1990, 02481.
Handwritten Notes, Bill Hamilton, Jul. 8, 1985, 02482.
Prints, Jul. 10, 1985, 02483.
Prints, Jul. 8, 1985, 02484.
Handwritten Notes, Jun. 19, 1985, 02485.
Print, May 18, 1985, 02486.
Print, Jun. 6, 1985, 02487.
Prints, Jul. 26, 1985, 02488-02489.
Correspondence, Bill Hamilton, Jul. 25, 1985, 02490-02491.
Print, Jan. 2, 1985, 02492.
Print, Dec. 10, 1984, 02493.
Print, Jan. 2, 1995, 02494.
Memorandum, Barry MacLean, Nov. 11, 1986, 02495-02496.
Handwritten Notes, Undated, 02497-02500.
Handwritten Correspondence, Herb Earl, Dec. 5, 1986, 02501.
Handwritten Correspondence, Herb Earl, Dec. 16, 1986, 02502.
Correspondence, Nov. 20, 1986, 02503-02504.
Correspondence, Todd Downing, Oct. 3, 1986, 02505.
Correspondence, Herb EarlSep. 18, 1986, 02506.
Correspondence, Herb Earl, Sep. 17, 1986, 02507-2508.
Print, Undated, 02509.
Correspondence, Luke Ward, Mar. 14, 1986, 02510-02513.
Correspondence, Herb Earl, Feb. 27, 1985, 02514-02515.
Handwritten Notes, Undated, 02516.
Correspondence, William Gardner, Jul. 27, 1984, 02517-02518.
Print, Undated, 02519.
Print, Mar. 6, 1985, 02520.
Prints, Jan. 26, 1989, 02521-02522.
Correspondence, Phil Johnson, Mar. 6, 1989, 02523-02524.
Memorandum, Phil Johnson, Jul. 14, 1989, 02525.
Memorandum, Herb Earl, Jun. 23, 1989, 02526.
Correspondence, Dan Berg, Jun. 15, 1989, 02527-02530.
Handwritten Notes, Undated, 02531.
Correspondence, Herb Earl, Sep. 15, 1986, 02532-02533.
Handwritten Notes, Sep. 23, 1986, 02534.
Correspondence, Herb Earl, Sep. 15, 1986, 02535-02536.
Correspondence, Herb Earl, Sep. 20, 1986, 02537.
Correspondence, Herb Earl, Sep. 18, 1986, 02538-02539.
Memorandum, Barry MacLean, Nov. 11, 1986, 02540-02541.
Correspondence, Herb Earl, Aug. 26, 1976, 02542.
Print, Jun. 23, 1969, 02543.
Prints, Jun. 12, 1967, 02544.
Print, Undated, 02545.
Correpondence, Herb Earl, Dec. 16, 1986, 02546.
Handwritten Notes, Dec. 16, 1986, 02547.
Interoffice Correspondence, Barry MacLean, Aug. 31, 1976, 02548-02548.
Correspondence, Herb Earl, Sep. 2, 1976, 02549-02552.
Correspondence, Herb Earl, Aug. 26, 1976, 02553.
Print, Jun. 23, 1969, 02554.
Print, Jun. 12, 1967, 02555.
Print, Undated, 02556.
Interoffice Correspondence, Barry MacLean, Aug. 30, 1976, 02557.
Handwritten Notes, Undated, 02558.
Memorandum, Barry MacLean, Apr. 16, 1985, 02559-02594.
Memorandum, Barry MacLean, Feb. 10, 1989, 02595-02596.
Correspondence, Barry MacLean, Feb. 10, 1989, 02597.
Purchased Steel Description, Apr. 30, 1985, 02598.
Chemical Testing Report, Oct. 29, 1986, 02599.
Price Quotes, Mar. 36, 1985, 02600.
Purchased Steel Description, Apr. 3, 1985, 02601.
Handwritten Notes, Apr. 8, 1985, 02602.
Handwritten Notes, Undated, 02603.
Correspondence, Herb Earl, Nov. 5, 1985, 02604.
Load Tally, Oct. 31, 1985, 02605.
Certificate of Tests, Apr. 22, 1985, 02606.
Purchase Order Acceptance Acknowledgement, Apr. 23, 1985, 02607.
Purchase Requisition, Apr. 19, 1985, 02608.
Purchase order Apr. 22, 1985, 02609.
Shipping Tally, May 25, 1985, 02610.
Purchased Steel Description, Apr. 30, 1985, 02611.
Test Report, Jun. 17, 1985, 02612.
Purchased Steel Description, Jan. 30, 1986, 02613.
Purchased Steel Description, Apr. 30, 1985, 02614.
Test Report, Jun. 17, 1985, 02615.
Handwritten Notes, Undated, 02616-02619.
Correspondence, W. Burke, Mar. 22, 1979, 02620.
Correspondence, Bill Hamilton, Jun. 5, 1984, 02621.
Certificate of Tests, Dec. 20, 1985, 02622-02623.
Shipping Notice, Jan. 14, 1986, 02624.
Load Tally, Oct. 31, 1985, 02625.
Correspondence, Dan Berg, Oct. 27, 1986, 02626-02628.
Handwritten Notes, Undated, 02629.
Correspondence, Herb Earl, Oct. 30, 1986, 02630.
Chemical Testing Report, Oct. 29, 1986, 02631-02632.
Purchase Requisition, Jun. 3, 1985, 02633.
Purchase Requisition, Dec. 6, 1985, 02634.

Print, Dec. 10, 1984, 02635.
Purchase Order, Feb. 15, 1985, 02636-02637.
Purchase Order, Feb. 14, 1985, 02637-02639.
Correspondence, Herb Earl, Feb. 1, 1985, 02640.
Purchase Steel Description, Sep. 13, 1984, 02641.
Chemical Testing Report, Jun. 19, 1986, 02642-02643.
Prints, Oct. 7, 1985, 02644-02645.
Print, Jul. 22, 1974, 02646.
Prints, Sep. 7, 1972, 02647.
Purchase Order, Apr. 9, 1985, 02648.
Price Quotes, Mar. 26, 1985, 02649.
Purchased Steel Description, Apr. 3, 1985, 02650.
Handwritten Notes, Apr. 8, 1985, 02651.
Correspondence, Herb Earl, Apr. 19, 1989, 02652.
Correspondence, Herb Earl, May 17, 1989, 02653.
Correspondence, Phil Johnson, May 12, 1989, 02654.
Print, Nov. 9, 1982, 02655.
Print, Aug. 21, 1981, 02656.
Print, Sep. 3, 1986, 02657.
Request for Quotation, Apr. 28, 1992, 02658.
Prints, Apr. 19, 1982, 02659-02660.
Request for Quotation, Apr. 28, 1992, 02661.
Prints, Apr. 19, 1982, 02662-02663.
Print, Jan. 2, 1985, 02664.
Print, Sep. 5, 1985, 02665.
Print, Oct. 3, 1985, 02666-02669.
Prints, Sep. 11, 1985, 02670-02671.
Print, Oct. 7, 1985, 02672.
Print, Sep. 23, 1985, 02673.
Print, Jan. 2, 1985, 02674.
Print, Dec. 10, 1984, 02675.
Print, Mar. 4, 1985, 02676.
Print, Jul. 12, 1982, 02677.
Prints, Jan. 6, 1986, 02678-02679.
Print, May 7, 1984, 02680.
Print, Apr. 5, 1985, 02681.
Print, Sep. 17, 1985, 02682.
Print, Sep. 23, 1985, 02683.
Prints, Sep. 17, 1985, 02684-02686.
Print, Sep. 5, 1985, 02687.
Print, Dec. 10, 1984, 02688.
Print, Oct. 7, 1985, 02689.
Prints, Feb. 12, 1986, 02690-02691.
Prints, Oct. 7, 1985, 02692-02693.
Print, Feb. 12, 1986, 02694.
Correspondence, Todd Downing, Oct. 3, 1986, 02695.
Correspondence, Jun. 18, 1984, 02696.
Print, Mar. 16, 1984, 02697.
Prints, May 7, 1981, 02698-02699.
Print, Jul. 11, 1984, 02700.
Print, Jun. 1, 1984, 02701.
Print, Mar. 16, 1984, 02702.
Print, Feb. 25, 1984, 02703.
Print, Mar. 21, 1984, 02704.
Print, Mar. 16, 1984, 02705.
Print, Mar. 27, 1986, 02706.
Prints, Sep. 17, 1985, 02707.
Print, Dec. 10, 1984, 02708.
Print, Jan. 26, 1989, 02709.
Prints, Mar. 23, 1989, 02710-02712.
Print, Sep. 7, 1972, 02713.
Print, Jul. 22, 1974, 02714.
Print, Oct. 7, 1985, 02715.
Print, Dec. 4, 1984, 02716.
Prints, Jan. 6, 1986, 02717-02718.
Print, Sep. 17, 1985, 02719.
Prints, Feb. 12, 1986, 02720-02723.
Prints, Jan. 6, 1986, 02724-02725.
Print, Jul. 15, 1982, 02726.
Prints, May 26, 1982, 02727-02735.
Print, Sep. 7, 1972, 02736.
Handwritten Notes, Undated, 02737.
Print, Jul. 22, 1974, 02738.
Print, Sep. 7, 1972, 02739.
Print, Apr. 3, 1982, 02740.
Request for Quotation, Apr. 28, 1982, 02741.
Print, May 16, 1980, 02742.
Print, Aug. 20, 1980, 02743.
Print, May 26, 1982, 02744.
Request for Quotation, Apr. 28, 1982, 02745.
Print, May 16, 1980, 02746.
Print, Aug. 20, 1980, 02747.
Prints, Dec. 10, 1984, 02748-02749.
Print, Jul. 16, 1984, 02750.
Print, Jul. 16, 1984, 02751.
Request for Quotation, Apr. 28, 1982, 02752.
Print, Feb. 18, 1980, 02753.
Print, May 7, 1981, 02754.
Prints, May 7, 1981, 02755-02758.
Print, Oct. 29, 1982, 02759.
Prints, Sep. 26, 1983, 02760-02761.
Print, Oct. 29, 1982, 02762.
Print, Aug. 22, 1985, 02763.
Print, Oct. 7, 1985, 02764.
Print, Mar. 23, 1989, 02765.
Print, Jan. 26, 1989, 02766.
Correspondence, Leon Peaslee, Apr. 3, 1989, 02767-02769.
Print, Oct. 7, 1985, 02770.
Print, Apr. 4, 1986, 02771.
Prints, Feb. 12, 1986, 02772-02773.
Print, Oct. 7, 1985, 02774.
Print, Oct. 18, 1985, 02775.
Handwritten Notes, Undated, 02776.
Prints, Mar. 23, 1989, 02777-02779.
Prints, Jun. 3, 1982, 02780-02781.
Prints, Undated, 02782-02783.
Purchase Order, Jun. 25, 1986, 02784.
Print, Apr. 30, 1986, 02785.
Print, Jun. 23, 1986, 02786.
Print, Apr. 30, 1986, 02787.
Print, Jul. 11, 1984, 02788.
Print, Oct. 18, 1985, 02789.
Prints, Jul. 11, 1984, 02790-02791.
Prints, Sep. 16, 1986, 02792-02793.
Print, Jul. 10, 1984, 02794.
Surface Defects of Tappet Push Rod Seat Inserts, Oct. 4, 1965, 02795-02796.
Print, Apr. 30, 1987, 02797.
Prints, Oct. 4, 1966, 02798-02799.
Handwritten Notes, Undated, 02800-02801.
Print, Oct. 4, 1966, 02802.
Request for Quotation, Apr. 28, 1982, 02803.
Print, Feb. 18, 1980, 02804.
Print, May 7, 1981, 02805.
Request for Quotation, Apr. 28, 1982, 02806.
Print, Oct. 4, 1966, 02807.
Print, Mar. 21, 1984, 02808.
Request for Quotation, Apr. 28, 1982, 02809.
Print, Feb. 18, 1980, 02810.
Print, May 7, 1981, 02811.
Print, Undated, 02812.
Prints, Apr. 1, 1986, 02813-02815.
Prints, Sep. 9, 1984, 02816.
Prints, Sep. 26, 1984, 02817.
Prints, Sep. 28, 1984, 02818.
Prints, Jan. 24, 1986, 02819-02822.
Prints, Sep. 28, 1984, 02823.
Prints, Sep. 26, 1984, 02824-02826.
Prints, Dec. 4, 1984, 02827.
Prints, Sep. 28, 1984, 02828.
Prints, Feb. 11, 1986, 02829.
Prints, Sep. 28, 1984, 02830.
Prints, Sep. 28, 1984, 02831-02833.
Prints, Sep. 26, 1984, 02834-02837.
Prints, Sep. 28, 1984, 02838.
Prints, Sep. 28, 1982, 02839.

Prints, Undated, 02840-02841.
Prints, Dec. 17, 1985, 02842.
Prints, Oct. 5, 1985, 02843.
Prints, Oct. 7, 1985, 02844.
Interoffice Correspondence, Ron Frankel, Sep. 3, 1986, 02845.
Prints, Oct. 2, 1985, 02846.
Handwritten Notes, Bob McCormick, Aug. 6, 1986, 02847-02948.
Prints, Dec. 6, 1990, 02949.
Prints, Undated, 02950-02951.
Prints, Dec. 12, 1973, 02952.
Prints, Jun. 25, 1981, 02953.
Prints, Jun. 10, 1969, 02954.
Prints, Dec. 8, 1965, 02955-02956.
Prints, Jun. 10, 1969, 02957-02960.
Prints, Oct. 2, 1985, 02961.
Prints, Oct. 30, 1985, 02962.
Prints, Oct. 31, 1985, 02963-02964.
Prints, Undated, 02965.
Prints, Apr. 16, 1985, 02966.
Prints, Aug. 8, 1988, 02867.
Print, Feb. 21, 1985, 02868.
Print, Oct. 31, 1985, 02869.
Print, Oct. 30, 1985, 02870.
Print, Oct. 31, 1985, 02871.
Print, Feb. 21, 1985, 02872.
Correspondence, Richard Bizer, Aug. 22, 1984, 02873-02778.
Handwritten Notes, Undated, 02879-02880.
Print, Mar. 21, 1984, 02881.
Print, Sep. 26, 1984, 02882.
Print, Sep. 25, 1984, 02883.
Print, Nov. 9, 1982, 02884.
Print, Sep. 26, 1984, 02885.
Print, Jul. 11, 1984, 02886.
Print, Undated, 02887.
Print, Mar. 6, 1985, 02888.
Purchase Order, Jul. 1, 1988, 02889.
Print, Jul. 1, 1988, 02890.
Print, Dec. 9, 1988, 02891.
Print, Oct. 31, 1985, 02892.
Print, Undated, 02893.
Print, Undated, 02894-02895.
Prints, Undated, 02896-02898.
Prints, Jul. 24, 1981, 02899-02900.
Print, Oct. 22, 1985, 02901.
Print, Oct. 28, 1985, 02902.
Print, Undated, 02903.
Print, Oct. 30, 1985, 02904.
Print, Undated, 02905.
Prints, Undated, 02906-02911.
Correspondence, Herb Earl, Sep. 17, 1991, 02912-02914.
Handwritten Notes, Jan. 19, 1990, 02915.
Memorandum, Herb Earl, Mar. 5, 1986, 02916.
Production Order Schedule, Mar. 19, 1986, 02917.
Purchase Invoice, Jan. 31, 1986, 02918.
Purchase Invoice, Jan. 30, 1986, 02919.
Purchase Invoice, Jan. 31, 1986, 02920.
Correspondence, Nov. 13, 1985, 02921.
Correspondence, John Peterson, Dec. 19, 1985, 02922.
Correspondence, Herb Earl, Jan. 28, 1986, 02923.
Correspondence, Connie K., Aug. 4, 1986, 02924.
Handwritten Notes, Undated, 02925.
Correspondence, Herb Earl, Dec. 16, 1986, 02926.
Correspondence, David Trendler, Feb. 2, 1987, 02927-02928.
Handwritten Notes, Undated, 02929-02931.
Correspondence, John Radziewicz, Nov. 10, 1986, 02932-02947.
Handwritten Notes, Undated, 02948.
Handwritten Notes, Nov. 14, 1986, 02949.
Handwritten Notes, Herb Earl, Nov. 6, 1986, 02950.
Packing List, Nov. 6, 1989, 02951.
Shipping Order, Sep. 14, 1989, 02952.
Packing Lists, Sep. 14, 1989, 02953-02955.
Correspondence, Dan B., Nov. 20, 1989, 02956.
Handwritten Notes, Undated, 02957-02958.
Quotations, Sep. 3, 1985, 02959-02960.
Correspondence, Jun. 18, 1984, 02961.
Handwritten Notes, Undated, 02962.
Correspondence, Herb Earl, Feb. 7, 1989, 02963.
Handwritten Notes, Undated, 02964-02967.
Shipping Reports, Undated, 02968-02969.
Schedules, Undated, 02970-02971.
Part Number Inquiries, Sep. 23, 1986, 02972-02973.
Handwritten Notes, Undated, 02974.
Correspondence, Bill Hamilton, Sep. 6, 1985, 02975.
Print, Sep. 5, 1985, 02976.
Purchase Order, May 6, 1985, 02977.
Purchase Order, Jun. 25, 1986, 02978.
Print, Apr. 30, 1986, 02979.
Handwritten Notes, Feb. 18, 1986, 02980.
Correspondence, John Radziewicz, Feb. 27, 1986, 02981.
Purchase Order, May 5, 1986, 02982.
Prints, Feb. 12, 1986, 02983-02984.
Correspondence, Herb Earl, Mar. 10, 1986, 02985.
Shipping Notice, Oct. 16, 1985, 02986.
Purchase Order, Jan. 7, 1986, 02987.
Cost Estimate, Oct. 4, 1985, 02988.
Correspondence, Herb Earl, Jan. 28, 1986, 02989.
Shipping Reports, Undated, 02990-02996.
Memorandum, Bill Hamilton, Mar. 5, 1986, 02997.
Correspondence, Luke Ward, Mar. 21, 1986, 02998-03007.
Memorandum, Bill Hamilton, Mar. 5, 1986, 03008.
Correspondence, John Radziewicz, Feb. 19, 1986, 03009.
Report, Undated, 03010-03019.
Correspondence, Bill Hamilton, Jun. 6, 1985, 03020.
Correspondence, Robert McCue, Oct. 22, 1985, 03021.
Handwritten Notes, Undated, 03022.
Handwritten Notes, Dec. 16, 1986, 03023.
Memorandum, Gene Amistani, Jul. 18, 1990, 03024-03025.
Handwritten Notes, Undated, 03026-03028.
Correspondence, Gene Amistani, Oct. 4, 1990, 03029.
Handwritten Notes, Undated, 03030.
Correspondence, Larry Trout, Jul. 18, 1989, 03031.
Handwritten Notes, Undated, 03032-03035.
Correspondence, Undated, 03036-03038.
Correspondence, Dan Berg, Jan. 15, 1990, 03039.
Notes, Jan. 19, 1990, 03040.
Handwritten Notes, Jul. 8, 1987, 03041-03045.
Handwritten Notes, Undated, 03046.
Correspondence, Herb Earl, Sep. 2, 1976, 03047-03048.
Interoffice Correspondence, Ernie Majarucon, Sep. 8, 1976, 03049-03050.
Interoffice Correspondence, Roger Northrup, Sep. 7, 1976, 03051.
Rejected Material Notification, Oct. 20, 1986, 03052.
Handwritten Notes, Undated, 03053.
Correspondence, Bill Hamilton, Jun. 5, 1984, 03054.
Barry MacLean Stanadyn Visit, Undated, 03055.
Correspondence, Dan Berg, Oct. 3, 1986, 03056-03058.
Quality Assurance Findings, Jan. 6, 1986, 03059-03066.
Correspondence, Bill Hamilton, Undated, 03067.
Correspondence, J. Janda, Nov. 6, 1991, 03068.
Interoffice Correspondence, Ron Frankel, Dec. 2, 1986, 03069.
Quality Assurance Program Audit Report, Jan. 6, 7, 1986, 03070-03077.
Memorandum, Herb Earl, Mar. 5, 1986, 03078-03079.
Handwritten Notes, Undated, 03080-03081.
Handwritten Notes, Undated, 03082.
Correspondence, Jim Shea, Jan. 10, 1986, 03083.
Handwritten Notes, Jan. 20, 1986, 03084.
Correspondence, Dan Berg, Undated, 03085.
Quality Assurance Program Audit Report, Jan. 6,7, 1986, 03086-03095.
Correspondence, John Radziewicz, Apr. 11, 1986, 03096.
Memorandum, Herb Earl, Apr. 10, 1986, 03097.
Correspondence, John Radziewicz, Apr. 11, 1986, 03098.
Correspondence, Herb Earl, Jan. 31, 1985, 03099.
Print, Undated, 03100.
Correspondence, G. Perkins, Sep. 25, 1986, 03101-03102.

Correspondence, P. E. Eller/G. Croh, Sep. 24, 1986, 03103-03105.
Handwritten Notes, Undated, 03106.
Correspondence, Larry Trout, Aug. 15, 1990, 03107-03108.
Handwritten Notes, Feb. 21, 03109.
Handwritten Notes, Feb. 16, 03110.
Handwritten Notes, Undated, 03111-03112.
Correspondence, P.V. Foullon, Jun. 5, 1989, 03113.
Subgroup Report, May 16, 1989, 03114-03117.
Handwritten Notes, Oct. 23, 1991, 03118.
Memorandum, Larry Trout, Oct. 22, 1991, 03119.
Handwritten Notes, Jan. 19, 1990, 03120.
Correspondence, Pete Faullon, Jan. 25, 1990, 03121.
Handwritten Notes, Jan. 20, 1986, 03122-03123.
Handwritten Notes, Feb. 28, 1990, 03124-03125.
Correspondence, Herb Earl, Oct. 3, 1986, 03126.
Correspondence, Herb Earl, Nov. 7, 1986, 03127-03128.
Correspondence, Ron, Nov. 6, 1986, 03129-03130.
Inspection Report, Nov. 14, 1986, 03131-03132.
Correspondence, Dan Berg, Mar. 19, 1986, 03133-03135.
Correspondence, Dan Berg, Jan. 29, 1990, 03136.
Correspondence, Pete Foullon, Dec. 4, 1989, 03137.
Correspondence, Pete Foullon, Dec. 15, 1987, 03138-03139.
Correspondence, Dan Berg, Nov. 27, 1989, 03140-03141.
Handwritten Notes, Nov. 28, 1989, 03142.
Control Plan, Mar. 19, 1986, 03143-03150.
Handwritten Notes, Undated, 03151-03152.
Ford Motor Company Problem Report Worksheet, Nov. 20, 1989, 03153-03155.
Correspondence, Herb Earl, Sep. 18, 1986, 03156-03157.
Correspondence, J. Janda, Oct. 24, 1991, 03158-03159.
Correspondence, Pete Foullon, Jan. 25, 1990, 03160.
Correspondence, Ron Schuett, May 12, 1992, 03161-03162.
Memorandum, Herb Earl, Apr. 28, 1992, 03163-03164.
Correspondence, Todd Downing, Oct. 20, 1986, 03165.
Handwritten Notes, Apr. 15, 1992, 03166.
Memorandum, Herb Earl, May 1, 1992, 03167.
Memorandum, Larry Trout, Oct. 22, 1991, 03168.
Handwritten Notes, Oct. 23, 1991, 03169.
Correspondence, Dan Berg, Oct. 31, 1986, 03170.
Correspondence, Dan Berg, Oct. 29, 1986, 03171-03180.
Preproduction Qualification, Undated, 03181-03185.
Correspondence, Ron Frankel, Oct. 21, 1986, 03186.
Memorandum, John Radziewicz, Sep. 24, 1986, 03187.
Preproduction Qualification, Undated, 03188.
Correspondence, Dan Berg, Mar. 19, 1986, 03189-03190.
Correspondence, Herb Earl, Oct. 2, 1986, 03191.
Correspondence, Dan Berg, Oct. 16, 1986, 03192.
Data Sheets, Undated, 03193-03205.
Correspondence, Gene Amistani, May 8, 1990, 03206.
Memorandum, Herb Earl, Apr. 14, 1992, 03207.
Memorandum, Aug. 30, 1990, 03208.
Handwritten Notes, Undated, 03209.
Nonconformance Report, May 7, 1990, 03210.
Print, Mar. 23, 1989, 03211.
Correspondence, Pete Foullon, Undated, 03212-03216.
Correspondence, Pete Foullon, Undated, 03217-03218.
Handwritten Notes, Jan. 19, 1990, 03219.
Correspondence, Bob McCormick, Aug. 2, 1990, 03220-03223.
Engineering Change Notice, Jun. 26, 1989, 03224.
Rejected Material Notification, Feb. 28, 1990, 03225.
Correspondence, Bob McCormick, Aug. 17, 1990, 03226-03227.
Print, Mar. 23, 1989, 03228.
Correspondence, Dan Berg, Feb. 6, 1990, 03229.
Report, Jan. 26, 1990, 03230.
Memorandum, Pete Foullon, Jan. 31, 1990, 03231-03231.
Correspondence, Pete Foullon, Jan. 30, 1990, 03234.
Correspondence, Michael Segerson, Jan. 12, 1990, 03235.
Correspondence, Pete Foullon, Feb. 1, 1990, 03236-03238.
Invoice No. S-76328, Feb. 1, 1990, 03239.
Correspondence, Dan Berg, Jan. 26, 1990, 03240-03241.
Handwritten Notes, Undated, 03242-03243.
Correspondence, Gene Amistani, Jul. 31, 1990, 03244.
Correspondence, Undated, 03245.
Plunger Dimensions, Apr. 30, 1990, 03246-03248.
Quality Control Report, Sep. 17, 1985, 03249-03252.
Memorandum, Bob McCormick, Jun. 13, 1990, 03253.
Memorandum, John Radziewicz, Mar. 5, 1986, 03254-03255.
Correspondence, Herb Earl, Mar. 7, 1986, 03256-03257.
Memorandum, John Radziewicz, Feb. 13, 1986, 03258.
Memoradum, Luke Ward, Mar. 14, 1986, 03259-03262.
Correspondence, Ron Frankel, Apr. 10, 1989, 03263-03264.
Noncomformance Report, Apr. 10, 1989, 03265.
Correspondence, Dan McMillan, Jul. 14, 1989, 03266.
Correspondence, Pete Foullon, May 24, 1989, 03267-03268.
Correspondence, Ron Frankel, Jun. 7, 1989, 03269-03270.
Correspondence, Larry Trout, Jul. 18, 1989, 03271-03272.
Measured Diameters, Undated, 03273-03275.
Plunger Schedules, Jan. 14, 1985, 03276-03277.
Plunger Schedules, Jul. 27, 1984, 03278-03279.
Handwritten Notes, Undated, 03280-03283.
Correspondence, Jun. 24, 1986, 03284.
Handwritten Notes, Undated, 03285-03289.
Correspondence, W. Dwelly/J. Radziewicz, May 14, 1986, 03290-03291.
Correspondence, Pete Foullon, Feb. 22, 1990, 03292.
Correspondence, Dan Berg, Jan. 26, 1990, 03293-03294.
Memorandum, Dan Berg, Feb. 28, 1990, 03295.
Corresopndence, Pete Foullon, Undated, 03296.
Stanadyne Brainstorming Sessions Notes, Dan Berg, Feb. 28, 1990, 03297-03298.
Correspondence, Gene Amistani, Jul. 31, 1990, 03299.
Correspondence, Larry Trout, Jul. 26, 1990, 03300-03301.
Memoradum, Herb Earl, Jan. 9, 1992, 03302-03303.
Handwritten Notes, Undated, 03304.
Handwritten Notes, Dec. 26, 1991, 03305.
Handwritten Notes, Undated, 03306-03308.
Print, Mar. 23, 1989, 03309.
Quality Control Report, Sep. 17, 1985, 03310-03312.
Handwritten Notes, Nov. 1, 1986, 03313.
Correspondence, Herb Earl, Dec. 15, 1986, 03314.
Interoffice Correspondence, Ron Frankel, Jan. 26, 1987, 03315.
Action Request, Jan. 20, 1987, 03316.
Correspondence, Dan Berg, Dec. 24, 1986, 03317-03318.
Interoffice Correspondence, Ron Frankel, Jan. 26, 1987, 03319-03320.
Interoffice Correspondence, Ron Frankel, Jan. 26, 1987, 03321.
Rejection Analysis, Nov. 19, 1986, 03322-03323.
Correspondence, Herb Earl, Dec. 16, 1986, 03324.
Correspondence, Gene Amistani, Jul. 30, 1990, 03325.
Correspondence, Gene Amistani, Jul. 30, 1990, 03326.
Correspondence, Gene Amistani, Jul. 30, 1990, 03327.
Correspondence, Gene Amistani, Jul. 30, 1990, 03328.
Correspondence, Gene Amistani, Jul. 30, 1990, 03329.
Correspondence, Larry Trout, Aug. 10, 1989, 03330.
Correspondence, Gene Amistani, Apr. 17, 1990, 03331.
Correspondence, Gene Amistani, May 8, 1990, 03332.
Measured Dimensions, Undated, 03333.
Correspondence, Gene Amistani, May 8, 1990, 03334.
Correspondence, Gene Amistani, Jul. 30, 1990, 03335.
Correspondence, Gene Amistani, Jul. 27, 1990, 03336.
Correspondence, Gene Amistani, Jul. 27, 1990, 03337.
Correspondence, Gene Amistani, Jul. 31, 1990, 03338.
Handwritten Notes, Undated, 03339.
Memorandum, Bob McCormick, May 15, 1990, 03340.
Memorandum, Bob McCormick, Apr. 10, 1990, 03341.
Memorandum, Bob McCormick, Jun. 27, 1990, 03342.
Correspondence, Pete Foullon, Dec. 13, 1989, 03343.
Supplier Quality Alert Request for Cause and Corrective Action, Oct. 1, 1991, 03344-03345.
Handwritten Notes, Undated, 03346.
Correspondence, Ron Schutt, May 12, 1992, 03347-03348.
Correspondence, Gene Amistani, Jul. 30, 1990, 03349.
Correspondence, Herb Earl, Sep. 29, 1986, 03350.
Handwritten Notes, Undated, 03351.
Correspondence, Herb Earl, Sep. 22, 1986, 03352.
Inspection Report, Nov. 14, 1986, 03353-03354.

Plunger Deviation Request, Undated, 03355-03356.
Correspondence, Herb Earl, Nov. 20, 1986, 03357-03358.
Correspondence, Dan Berg, Mar. 19, 1986, 03359-03361.
Memorandum, Dan Berg, Feb. 28, 1990, 03362-03363.
Stanadyne Brainstorming Session Notes, Dan Berg, Feb. 28, 1990, 03364-03365.
Correspondence, Pete Foullon, Undated, 03366-03367.
Correspondence, Gene Amastani, Jun. 26, 1990, 03368.
Correspondence, Dan Berg, Jun. 15, 1988, 03369-03372.
Print, Oct. 7, 1985, 03373.
Nonconformance Report, Jul. 5, 1987, 03374-03375.
Correspondence, Larry Trout, Jul. 18, 1989, 03376-03377.
Tool Life Report, Nov. 1, 1986, 03378-03382.
Correspondence, G. Perkins, Sep. 25, 1986, 03383-03384.
Correspondence, P. E. Eller/ G. Kroh, Sep. 24, 1986, 03385-03387.
Machine Operation Report, Sep. 19-21, 1986, 03388-03391.
Kinsbury Machine Down Report, Aug. 17, 1986, 03392.
Kinsbury Machine Down Report, Aug. 31, 1986, 03393.
Kinsbury Machine Down Report, Sep. 7, 1986, 03394.
Kinsbury Machine Down Report, Sep. 14, 1986, 03395.
Kinsbury Machine Down Report, Sep. 21, 1986, 13396.
Machine Operation Report, Sep. 19-21, 1986, 03397-03400.
Correspondence, Herb Earl, Sep. 18, 1986, 03401-03402.
Correspondence, J. Janda, Oct. 24, 1991, 03403-03404.
Correspondence, G. Perkins, Sep. 25, 1986, 03405-03406.
Correspondence, P.E. Eller/G. Kroh, Sep. 24, 1986, 03407-03409.
Correspondence, Todd Downing, Oct. 3, 1986, 03410.
Correspondence, Herb Earl, Nov. 14, 1986, 03411.
Correspondence, Herb Earl, Nov. 15, 1986, 03412.
Handwritten Notes, Nov. 18, 1986, 03413.
Correspondence, Herb Earl, Nov. 20, 1986, 03414.
Corresponence, G. Perkins, Sep. 25, 1986, 03415-03416.
Correspondence, P.E. Eller/G. Kroh, Sep. 24, 1986, 03417-03419.
Correspondence, Gene Amastani, Oct. 4, 1990, 03420.
Correspondence, Gene Amastani, Oct. 4, 1990, 03421.
Correspondence, Gene Amastani, Sep. 4, 1990, 03422.
Nonconformance Report, Sep. 10, 1990, 03423.
Nonconformance Report, Aug. 27, 1990, 03424.
Handwritten Notes, Undated, 03425.
Memorandum, Aug. 30, 1990, 03426-03428.
Handwritten Notes, Undated, 03429.
Correspondence, Bob McCormick, Sep. 10, 1990, 03430-03431.
Correspondence, Gene Amastani, Oct. 4, 1990, 03432.
Nonconformance Report, Oct. 27, 1990, 03433-03434.
Nonconformance Report, Sep. 4, 1990, 03435-03437.
Nonconformance Report, Sep. 10, 1990, 03438-03440.
Print, Dec. 4, 1984, 03441.
Wall Thickness Measurements, Undated, 03442.
Print, Dec. 4, 1984, 03443.
Wall Thickness Measurements, Undated, 03444.
Quality Control Report, Nov. 5, 1984, 03445.
Memorandum, Bob McCormick, Jun. 13, 1990, 03446.
Correspondence, Herb Earl, Mar. 7, 1986, 03447-03448.
Memorandum, Luke Ward, Mar. 14, 1986, 03449-03452.
Correspondence, Herb Earl, Feb. 27, 1989, 03453-03456.
Piercing Punch Diameters, Undated, 03457.
Report, Feb. 9, 1989, 03458-03469.
Correspondence, Leon Peasley, Apr. 17, 1989, 03470-03471.
Correspondence, Leon Peasley, Apr. 14, 1989, 03472.
Correspondence, Larry Trout, Sep. 12, 1989, 03473.
Correspondence, Pete Foullon, Oct. 3, 1989, 03474-03475.
Customer Complaint Notification, Nov. 3, 1988, 03476-03479.
Correspondence, Jun. 24, 1986, 03480.
Handwritten Notes, Sep. 23, 03481.
Meeting Notice, Sep. 23, 1986, 03482-03483.
Corrective Action Plan, Sep. 22, 1986, 03484-03487.
Handwritten Notes, Undated, 03488-03491.
Handwritten Notes, Sep. 22, 1986, 03492.
Correspondence, W. Dwelly/J. Radziewicz, May 14, 1986, 03493-03494.
Correspondence, Larry Trout, Jul. 26, 1990, 03495-03496.
Correspondence, Mike Curtis, Undated, 03497.
Print, May 1, 1985, 03498.
Correspondence, Herb Earl, May 2, 1986, 03499.
Correspondence, Bill Hamilton, May 14, 1985, 03500.
Correspondence, Bill Hamilton, Apr. 3, 1985, 03501.
Print, Mar. 27, 1984, 03502.
Handwritten Notes, May 3, 1985, 03503-03504.
Correspondence, Gene Amastani, Jul. 30, 1990, 03505.
Invoice, Nov. 3, 1986, 03506.
Correspondence, Gene Amastani, Oct. 4, 1990, 03507-03508.
Correspondence, Gene Amastani, Jul. 9, 1990, 03509.
Correspondence, Gene Amastani, Sep. 19, 1990, 03510-03512.
Correspondence, Larry Trout, Aug. 10, 1989, 03513.
Correspondence, Larry Trout, Sep. 12, 1989, 03514.
Correspondence, Larry Trout, Jul. 26, 1990, 03515-03516.
Report, Jun. 13, 1990, 03517.
Correspondence, Gene Amastani, Jun. 13, 1990, 03518-03519.
Correspondence, Gene Amastani, Jul. 30, 1990, 03520.
Noncomformance Report, Dec. 13, 1989, 03521-03522.
Correspondence, Jun. 28, 1990, 03523.
Correspondence, Gene Amastani, Sep. 4, 1990, 03524-03526.
Memorandum, Bob McCormick, Jun. 27, 1990, 03527.
Noncomformance Report, Apr. 9, 1990, 03528.
Noncomformance Report, May 14, 1990, 03529.
Noncomformance Report, Jun. 25, 1990, 03530.
Noncomformance Report, May 15, 1990, 03531.
Noncomformance Report, Jun. 25, 1990, 03532.
Noncomformance Report, Mar. 23, 1990, 03533.
Noncomformance Report, Mar. 23, 1990, 03534.
Memorandum, Bob McCormick, May 15, 1990, 03535.
Memorandum, Bob, Mccormick, Apr. 10, 1990, 03536.
Supplier Quality Alert Request for Cause and Corrective Action, Feb. 19, 1992, 03537-03538.
Correspondence, Dan McMillan, Aug. 2, 1990, 03539-03541.
Correspondence, R.E. McCue, Sep. 30, 1985, 03542-03543.
Supplier Quality Assurance Specification, Sep. 1, 1985, 03544-03551.
Correspondence, Bob McCormick, Jun. 8, 1990, 03552-03553.
Correspondence, Todd Downing, Sep. 30, 1986, 03554.
Handwritten Notes, Undated, 03555.
Reports, Undated, 03556-03564.
Correspondence, Herb Earl, Nov. 20, 1986, 03565-03566.
Handwritten Notes, Undated, 03567.
Deviation Request, Undated, 03568-03569.
Deviation Request, Dec. 22, 1986, 03570.
Deviation Request, Dec. 18, 1986, 03571.
Correspondence, Herb Earl, Dec. 15, 1986, 03572.
Deviation Request, Dec. 15, 1986, 03573.
Deviaiton Request, Dec. 3, 1986, 03574.
Correspondence, Herb Earl, Dec. 11, 1988, 03575-03582.
Correspondence, Ron Frankel, Jan. 27, 1987, 03583.
Deviation Request, Jan. 27, 1987, 03584.
Deviation Request, Nov. 24, 1986, 03585.
Correspondence, Gene Amastani, Jul. 30, 03586.
Correspondence, Bob McCormick, Apr. 6, 1996, 03587.
Correspondence, Gene Amastani, Jul. 30, 1990, 03588.
Correspondence, Herb Earl, Sep. 22, 1986, 03589.
Deviation Request, Oct. 16, 1986, 03590-03591.
Correspondence, Herb Earl, Sep. 20, 1986, 03592-03593.
Correspondence, Dan Berg, Oct. 16, 1986, 03594-03595.
Correspondence, Herb Earl, Sep. 22, 1986, 03596.
Correspondence, Herb Earl, Sep. 18, 1986, 03597-03598.
Correspondence, Herb Earl, Sep. 18, 1986, 03599.
Deviation Request, Oct. 16, 1996, 03600-03601.
Correspondence, Herb Earl, Oct. 2, 1986, 03602.
Measured Dimensions, Undated, 03603.
Correspondence, Herb Earl, Sep. 20, 1986, 03604.
Correspondence, Herb Earl, Sep. 22, 1986, 03605.
Handwritten Notes, Undated, 03606.
Correspondence, Herb Earl, Oct. 3, 1986, 03607.
Handwritten Notes, Oct. 20, 1986, 03608.
Deviation Request, Undated, 03609-03611.
Handwritten Notes, Undated, 03612.
Correspondence, Herb Earl, Nov. 7, 1986, 03613-03614.
Correspondence, Ron, Nov. 6, 1986, 03615-03616.

Correspondence, Ron F., Nov. 7, 1986, 03617.
Deviation Request, Undated, 03618-03619.
Correspondence, Ron Frankel, Nov. 20, 1986, 03620-03621.
Deviation Request, Nov. 24, 1986, 03622.
Deviation Request, Undated, 03623-03624.
Correspondence, Herb Earl, Nov. 20, 1986, 03625-03626.
Handwritten Notes, Undated, 03627.
Deviation Request, Undated, 03628-03629.
Deviation Request, Dec. 9, 1986, 03630.
Deviation Request, Dec. 4, 1986, 03631.
Handwritten Notes, Dec. 4, 1986, 03632.
Deviation Request, Dec. 9, 1986, 03633.
Deviation Request, Feb. 20, 1987, 03634.
Deviation Request, Feb. 25, 1987, 03635.
Deviation Request, Undated, 03636.
Deviation Request, Mar. 11, 1987, 03637.
Correspondence, Ron Frankel, Mar. 10, 1987, 03638.
Correspondence, Herb Earl, Nov. 29, 1990, 03639.
Print, Undated, 03640.
Report, Feb. 8, 1990, 03641.
Correspondence, John Lundgren, Mar. 11, 1990, 03642-03643.
Print, Date Stamped Nov. 13, 1989, 03644.
Print, Sep. 28, 1989, 03645.
Print, Date Stamped Feb. 2, 1990, 03646.
Correspondence, John Lundgren, Undated, 03647.
Print, Oct. 22, 1986, 03648.
Print, Oct. 7, 1985, 03649.
Correspondence, John Lundgren, Apr. 6, 1990, 03650.
Print, Date Stamped Dec. 1, 1986, 03651.
Print, Aug. 29, 1985, 03652.
Print, Mar. 6, 1990, 03653-03655.
Handwritten Notes, Undated, 03656.
Print, Date Stamped Jul. 15, 1987, 03657.
Print, Date Stamped, Sep. 1, 1986, 03658.
Print, Date Stamped, Oct. 13, 1989, 03659.
Print, Feb. 6, 1990, 03660-03661.
Print, Date Stamped Feb. 2, 1990, 03662-03665.
Handwritten Notes, Undated, 03666.
Quotation, May 25, 1985, 03667.
Memorandum, Herman Koestring, May 22, 1985, 03668.
Quotation, May 28, 1985, 03669.
Correspondence, Herb Earl, May 20, 1985, 03670.
Handwritten Notes, Undated, 03671.
Correspondence, Herb Earl, Feb. 6, 1986, 03672.
Cost Estimate Request, Jan. 13, 1986, 03673-03674.
Handwritten Notes, Undated, 03675.
Print, May 31, 1985, 03676.
Memorandum, Herman Koestring, Feb. 10, 1986, 03677.
Memorandum, Jim Peterson, Jul. 9, 1987, 03678.
Report with Handwritten Notes, Undated, 03679-03680.
Memorandum, Jim Peterson, Jul. 9, 1987, 03681.
Handwritten Notes, Undated, 03682.
Quotation, Herb Earl, Sep. 25, 1985, 03683.
Correspondence, Herb Earl, May 20, 1985, 03684.
Quotation, Jim Peterson, Jun. 9, 1987, 03685.
Cost Estimate Request, May 14, 1987, 03686.
Print, Apr. 1, 1986, 03687.
Correspondence, Herb Earl, Mar. 1, 1990, 03688.
Correspondence, Herb Earl, Nov. 29, 1990, 03689-03690.
Correspondence, Herb Earl, Apr. 20, 1990, 03691.
Correspondence, Herb Earl, Jul. 13, 1987, 03692.
Quotation, Linda Johnsen, May 28, 1985, 03693.
Handwritten Notes, Undated, 03694.
Correspondence, Herb Earl, Jul. 23, 1984, 03695-03697.
Correspondence, Jan. 26, 1989, 03698.
Correspondence, Herb Earl, Feb. 28, 1989, 03699.
Cost Estimate, Sep. 18, 1984, 03700-03701.
Report, Dec. 29, 1988, 03702.
Report, Dec. 12, 1988, 03703.
Report, Undated, 03704.
Handwritten Notes, Sep. 2, 1986, 03705-03706.
Handwritten Notes, Undated, 03707.
Quotation, Linda Johnsen, Feb. 14, 1985, 03708.
Quotation, Linda Johnsen, Feb. 18, 1985, 03709.
Correspondence, Herb Earl, Jul. 13, 1987, 03710.
Interoffice Correspondence, George Pazdirek, May 24, 1985, 03711-03716.
Request for Quotation, Apr. 15, 1985, 03717.
Request for Quotation, Apr. 15, 1985, 03718.
Request for Quotation, Apr. 28, 1982, 03719.
Prints, Sep. 7, 1972, 03720-03721.
Request for Quotation, Apr. 28, 1982, 03722.
Print, Jul. 22, 1974, 03723.
Request for Quotation, Apr. 28, 1982, 03724.
Request for Quotation, Apr. 28, 1982, 03725.
Print, Aug. 21, 1981, 03726.
Print, Feb. 22, 1981, 03727.
Purchase Requisition, Herb Earl, Feb. 10, 1986, 03728-03729.
Chemical Testing Report, Jun. 19, 1986, 03730.
Handwritten Notes, Oct. 8, 1986, 03731.
Engineering Change Notice, Bill Hamilton, Jun. 17, 1985, 03732.
Print, May 1, 1985, 03733.
Correspondence, Bill Hamilton, Apr. 9, 1985, 03734.
Correspondence, Bill Hamilton, Apr. 3, 1985, 03735.
Print, Mar. 27, 1984, 03736-03737.
Engineering Change Notice, Bill Hamilton, May 30, 1985, 03738.
Correspodence, Jim Robinson, Apr. 12, 1990, 03739-03741.
Correspondence, Herb Earl, Jun. 3, 1992, 03742.
Correspondence, Herb Earl, Aug. 17, 1992, 03743-03744.
Correspondence, Mike S., Jul. 24, 1992, 03745-03747.
Print with Handwritten Notes, Undated, 03748.
Handwritten Notes, Undated, 03749.
Correspondence, Herb Earl, Jun. 3, 1992, 03750.
Correspondence, Bill Hamilton, Oct. 11, 1984, 03751.
Correspondence, Bill Hamilton, Feb. 22, 1985, 03752.
Print, Dec. 10, 1984, 03753.
Purchase Order, Jun. 20, 1985, 03754.
Print, May 1, 1985, 03755-03756.
Print, Dec. 13, 1984, 03757.
Print, Dec. 3, 1985, 03758.
Memorandum, R.B. Rogers, Jan. 8, 1985, 03759.
Correspondence, Larry Trout, Mar. 14, 1989, 03760.
Correspondence, Herb Earl, Sep. 17, 1985, 03761.
Correspondence, Daniel Burkeen, Aug. 20, 1985, 03762.
Document entitled, "Roller Follower Body Blank-Stanadyne Samples," May 7, 1975, 03763.
Document entitled, "Roller Follower Body Blank-Stanadyne Samples," May 7, 1975, 03764-03765.
Document entitled, "Roller Follower Body Blank-Stanadyne Samples," May 7, 1975, 03766.
Document entitled, "Roller Follower Body Blank-Stanadyne Samples," May 7, 1985, 03767-03768.
Correspondence, Herb Earl, Dec. 11, 1986, 03769-03776.
Shipping Notice, Roman Dombrowski, Apr. 11, 1986, 03777.
Memorandum, Bob McCormick, May 2, 1990, 03778-03779.
Measurements, May 4, 1990, 03780.
Shipping Notice, Gene Amastani, May 8, 1990, 03781.
Interoffice Correspondence, George Pazdirek, Mar. 11, 1986, 03782.
Print, Jan. 29, 1986, 03783.
Correspondence, Herb Earl, Jul. 11, 1986, 03784.
Handwritten Notes, Undated, 03785-03790.
Slug Progressions, Undated, 03791-03795.
Handwritten Notes, Undated, 03796.
Control Plan, Ron Frankel, Nov. 5, 1986, 03797-03805.
Correspondence, Herb Earl, Jun. 10, 1985, 03806.
Print, Jan. 2, 1985, 03807.
Handwritten Notes, Undated, 03808.
Print, Jun. 12, 1973, 03809.
Handwritten Notes, Apr. 15, 1986, 03810.
Handwritten Specifications, Undated, 03811-03812.
Slug Progressions, Undated, 03813-03814.
Slug Progressions, Undated, 03815-03817.
Print, Nov. 20, 1985, 03818.
Correspondence, Dan McMillen, Aug. 2, 1990, 03819-03821.
Correspondence, R.E. McCue, May 1, 1985, 03822-03823.
Correspondence, Herb Earl, Aug. 26, 1976, 03824.

Print, Oct. 4, 1966, 03825.
Print, Jun. 12, 1967, 03826.
Print, Undated, 03827.
Memorandum, Jim Peterson, Jul. 9, 1987, 03828.
Correspondence, Larry Trout, May 9, 1989, 03829.
Correspondence, R.E. McCue, Dec. 17, 1985, 03830.
Handwritten Notes, Undated, 03831.
Print, Undated, 03832.
Handwritten Notes, Undated, 03833.
Print, Undated, 03834.
Correspondence, Herb Earl, Nov. 20, 1986, 03835-03836.
Handwritten Notes, Undated, 03837-03838.
Correspondence, Herb Earl, Nov. 20, 1986, 03839.
Handwritten Notes, Undated, 03840-03841.
Correspondence, Bill Hamilton, Mar. 15, 1985, 03842.
Print, Dec. 4, 1984, 03843.
Correspondence, Herb Earl, Feb. 27, 1985, 03844-03845.
Purchase Requisition, Undated, 03846.
Quotation, Undated, 03847.
Report, Undated, 03848-03849.
Print, Dec. 4, 1984, 03850.
Inspection Layout, Dec. 13, 1984, 03851.
Report, Undated, 03852.
Slug Progressions, Undated, 03853-03858.
Engineering Change Notice, Jun. 20, 1989, 03859.
Engineering Change Notice, Feb. 17, 1986, 03860.
Production Order Schedule, Mar. 19, 1986, 03861.
Handwritten Notes, Undated, 03862-03863.
Tool Form Purchase Order, Nov. 18, 1985, 03864-03866.
Handwritten Notes, Undated, 03867.
Correspondence, Herb Earl, Sep. 17, 1985, 03868.
Handwritten Notes, Undated, 03869.
Correspondence, John Peterson, Dec. 19, 1985, 03870.
Tool Form Purchase Order, Sep. 26, 1986, 03871-03873.
Tool Description, Undated, 03874-03877.
Correspondence, Herb Earl, Aug. 26, 1976, 03878.
Print, Oct. 4, 1966, 03879.
Print, Jun. 12, 1967, 03880.
Print, Undated, 03881.
Invoice, May 8, 1986, 03882.
Print, May 6, 1986, 03883.
Correspondence, Bill Hamilton, Jun. 19, 1986, 03884.
Correspondence, Connie, Dec. 11, 1986, 03885.
Engineering Change Notice, Dec. 10, 1986, 03886.
Phase II Indexing Jig Information, Undated, 03887.
Charts, Undated, 03888-03889.
Cost Estimates, Undated, 03890.
Handwritten Notes, Undated, 03891.
Interoffice Correspondence, Barry MacLean, Aug. 31, 1976, 03892-03894.
Correspondence, Sep. 2, 1976, 03895-03896.
Correspondence, Herb Earl, Aug. 26, 1976, 03897.
Print, Oct. 4, 1966, 03898.
Print, Jun. 12, 1967, 03899.
Print, Undated, 03900-03901.
Print, Feb. 18, 1967, 03902.
Interoffice Correspondence, Ernie Majarucon, Sep. 8, 1976, 03903-03904.
Interoffice Correspondence, Roger Northrup, Sep. 7, 1976, 03905.
Handwritten Notes, Undated, 03906-03908.
Correspondence, Herb Earl, May 7, 1986, 03909.
Purchase Order, Jan. 2, 1985, 03910.
Purchase Order, Jan. 2, 1985, 03911.
Correspondence, Herb Earl, May 6, 1986, 03912.
Correspondence, John Peterson, May 1, 1986, 03913.
Correspondence, Jerry Reid, Sep. 20, 1991, 03914.
Handwritten Notes, Undated, 03915.
Handwritten Notes, Jun. 8, 1992, 03916.
Handwritten Notes, Jun. 17, 1992, 03917.
Handwritten Notes, Jun. 8, 1992, 03918.
Handwritten Notes, May 20, 1992, 03919.
Report, Sep. 14, 1988, 03920.
Correspondence, Leon Peasley, Apr. 12, 1989, 03921.
Tool Delivery Order, Mar. 10, 1989, 03922.
Correspondence, Dan B., Mar. 8, 1990, 03923.
Tool Description, Undated, 03924-03925.
Correspondence, Herb Earl, Jul. 13, 1987, 03926.
Handwritten Notes, Apr. 8, 1985, 03927.
Correspondence, Herb Earl, Jun. 10, 1985, 03928-03929.
Slug Progression, Undated, 03930.
Engineering Change Notice, Jan. 14, 1986, 03931.
Slug Progression, Undated, 03932-03932.
Print, Jan. 2, 1985, 03933.
Purchase Order, Sep. 18, 1985, 03934-03936.
Correspondence, Herb Earl, Jul. 23, 1984, 03937-03938.
Handwritten Notes, Apr. 8, 1985, 03939.
Handwritten Notes, Undated, 03940.
Purchase Order, J. Peterson, Jun. 25, 1986, 03941.
Print, Apr. 30, 1986, 03942.
Handwritten Notes, Undated, 03943.
Correspondence, Herb Earl, Dec. 9, 1986, 03944.
Correspondence, Gene Amastani, Jul. 30, 1990, 03945.
Correspondence, Herb Earl, Jul. 13, 1987, 03946.
Print, Jun. 12, 1967, 03947.
Print, Undated, 03948-03949.
Print, Dec. 18, 1967, 03950.
Print, Undated, 03951-03952.
Print, Dec. 18, 1967, 03953-03954.
Print, Jun. 12, 1967, 03955-03956.
Engineering Change Notice, Aug. 1, 1991, 03957.
Print, Undated, 03958.
Slug Progression, Undated, 03959.
Engineering Change Notice, Jun. 26, 1989, 03960.
Print, Undated, 03961.
Correspondence, Herb Earl, Jul. 13, 1987, 03962.
Correspondence, M. Curtis, Apr. 1, 1986, 03963.
Handwritten Notes, Undated, 03964-03965.
Correspondence, Herb Earl, Mar. 12, 1986, 03966.
Memorandum, Herb Earl, Mar. 5, 1986, 03967.
Memorandum, Herman Koestring, Dec. 13, 1985, 03968.
Memorandum, Herman Koestring, Dec. 10, 1985, 03969.
Handwritten Notes, Undated, 03970.
Correspondence, Herb Earl, Jan. 13, 1988, 03971.
Prints, Sep. 28, 1984, 03972-03974.
Print, Undated, 03975.
Print, Jun. 12, 1967, 03976.
Phase II Indexing Jig Information, Undated, 03977.
Charts, Undated, 03978-03979.
Information regarding Electronic Diesel Fuel Injection Pump, Undated, 03980-03983.
Photographs, Undated, 03984.
Handwritten Notes, Undated, 03985.
Correspondence, David LaVieri, Feb. 24, 1989, 03986-03987.
Print, Dec. 4, 1984, 03988-03991.
Prints, Jan. 29, 1986, 03992-03993.
Print, Dec. 26, 1984, 03994.
Prints, Jan. 6, 1986, 03995-03996.
Print, May 1, 1985, 03997.
Print, Nov. 21, 1985, 03998.
Print, Dec. 3, 1985, 03999.
Print, Sep. 23, 1985, 04000.
Print, May 31, 1985, 04001.
Print, Mar. 6, 1986, 04002.
Print, Dec. 4, 1984, 04003.
Prints, May 1, 1985, 04004-04006.
Print, Dec. 4, 1984, 04007.
Print, May 1, 1985, 04008.
Print, Dec. 4, 1984, 04009-04010.
Print, May 1, 1985, 04011.
Print, May 3, 1984, 04012.
Print, Mar. 27, 1984, 04013.
Print, May 31, 1985, 04014.
Print, Mar. 6, 1986, 04015.
Print, May 1, 1985, 04016.
Correspondence, Dec. 4, 1984, 04017-04019.
Correspondence, Darrell Burkeen, Jul. 25, 1986, 04020-04021.

Print, May 1, 1985, 04022.
Print, May 1, 1985, 04023.
Print, Feb. 20, 1989, 04024.
Print, Feb. 25, 1984, 04025.
Print, Jun. 11, 1984, 04026.
Print, Sep. 27, 1984, 04027.
Print, Jan. 15, 1985, 04028.
Print, Feb. 8, 1985, 04029.
Print, Dec. 3, 1988, 04030.
Print, Jan. 29, 1986, 04031.
Print, Mar. 13, 1985, 04032.
Print, Feb. 20, 1989, 04033.
Print, Feb. 20, 1989, 04034.
Engineering Change Notice, Feb. 5, 1986, 04035.
Print, May 1, 1985, 04036.
Print, Mar. 27, 1984, 04037.
Prints, Dec. 4, 1984, 04038-04043.
Prints, Jan. 6, 1986, 04043-04046.
Print, Jun. 3, 1985, 04047.
Interoffice Correspondence, George Pazdirek, May 24, 1985, 04048-04050.
Print, Undated, 04051.
Prints, Date Stamped Oct. 14, 1986, 04052-04054.
Print, Dec. 4, 1984, 04055-04061.
Print, Jul. 12, 1984, 04062.
Print, Jul. 12, 1984, 04063.
Print, Mar. 27, 1984, 04064.
Print, Mar. 27, 1984, 04065.
Print, Mar. 27, 1984, 04066.
Print, Mar. 27, 1984, 04067.
Print, Jul. 12, 1984, 04068.
Print, Mar. 27, 1984, 04069.
Correspondence, Ross Rogers, Undated, 04070.
Print, Mar. 27, 1984, 04071.
Prints, Feb. 20, 1989, 04072-04073.
Print, May 31, 1985, 04074.
Print, Aug. 16, 2001, 04075.

* cited by examiner

METHOD FOR FABRICATING A ROLLER FOLLOWER ASSEMBLY

This is a continuation of application Ser. No. 10/316,262, filed Oct. 18, 2002, now U.S. Pat. No. 7,028,654, entitled "METERING SOCKET," the disclosure of which is hereby incorporated herein by reference.

FIELD OF THE INVENTION

This invention relates to roller follower assemblies and particularly, in the preferred embodiment, to roller follower assemblies provided with a roller follower body, a lash adjuster body, a leakdown plunger, and a socket.

BACKGROUND OF THE INVENTION

Lash adjuster bodies are known in the art and are used in camshaft internal combustion engines. Lash adjuster bodies open and close valves that regulate fuel and air intake. As noted in U.S. Pat. No. 6,328,009 to Brothers, the disclosure of which is hereby incorporated herein by reference, bodies used in roller follower assemblies are typically fabricated through machining. Col. 8, ll. 1-3. However, casting and machining are inefficient, resulting in increased labor and decreased production.

The present invention is directed to overcoming this and other disadvantages inherent in prior-art roller follower assemblies.

Roller follower bodies are known in the art and are used in camshaft internal combustion engines. Roller follower bodies open and close valves that regulate fuel and air intake. As noted in U.S. Pat. No. 6,328,009 to Brothers, the disclosure of which is hereby incorporated herein by reference, roller follower assemblies are typically fabricated through machining. Col. 8, ll. 1-3. However, machining is inefficient, resulting in increased labor and decreased production.

In U.S. Pat. No. 6,273,039 to Church, the disclosure of which is hereby incorporated herein by reference, a roller follower is disclosed. Col. 4, ll. 33-36. However, U.S. Pat. No. 6,273,039 to Church does not disclose the fabrication of such a roller follower and does not disclose fabricating a roller follower through forging.

The present invention is directed to overcoming this and other disadvantages inherent in prior-art roller follower assemblies.

Leakdown plungers are known in the art and are used in camshaft internal combustion engines. Leakdown plungers open and close valves that regulate fuel and air intake. As noted in U.S. Pat. No. 6,273,039 to Church, leakdown plungers are typically fabricated through machining. Col. 8, ll. 1-3. However, machining is inefficient, resulting in increased labor and decreased production.

The present invention is directed to overcoming this and other disadvantages inherent in prior-art roller follower assemblies.

Sockets for push rods are known in the art and are used in camshaft internal combustion engines. U.S. Pat. No. 5,855,191 to Blowers et al., the disclosure of which is hereby incorporated herein by reference, discloses a socket for a push rod. However, U.S. Pat. No. 5,855,191 to Blowers et al. does not disclose the forging of a socket for a push rod nor efficient manufacturing techniques in fabricating a socket for a push rod.

The present invention is directed to overcoming this and other disadvantages inherent in prior-art roller follower assemblies.

SUMMARY OF THE INVENTION

The scope of the present invention is defined solely by the appended claims, and is not affected to any degree by the statements within this summary. Briefly stated, a method for fabricating a roller follower assembly, comprising the steps of fabricating a lash adjuster body, fabricating a roller follower body, fabricating a leakdown plunger, fabricating a socket, wherein at least one of the lash adjuster body, roller follower body, leakdown plunger, and socket is fabricated at least in part by forging.

BRIEF DESCRIPTION OF THE DRAWINGS

FIG. 4-*b* depicts the top view of a preferred embodiment of a roller follower body.

DETAILED DESCRIPTION OF THE PRESENTLY PREFERRED EMBODIMENTS

Figure 1:
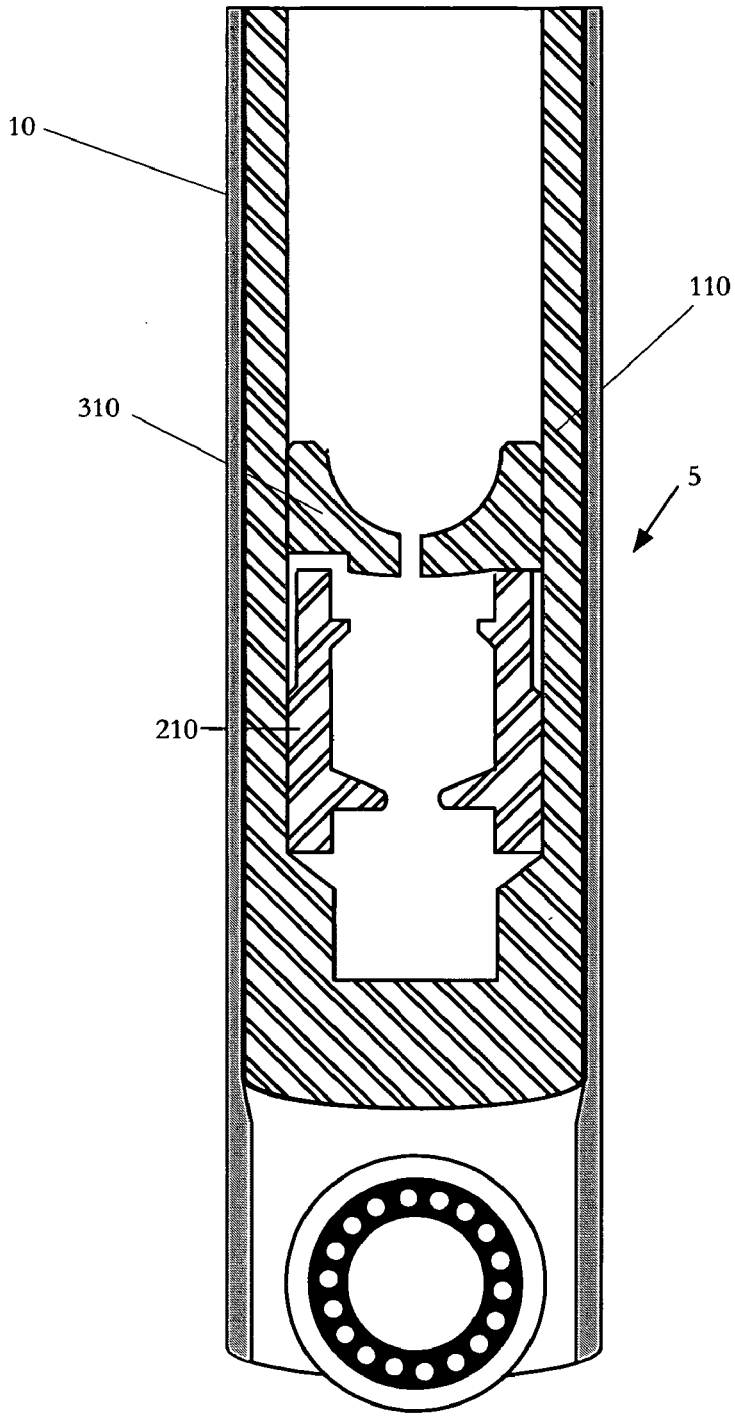
FIG. 1 depicts a roller follower assembly of the preferred embodiment of the present invention.

Turning now to the drawings, FIG. 1 shows a roller follower assembly 5 constituting a preferred embodiment of the present invention. As depicted therein, the roller follower assembly 5 is provided with a roller follower body 10 or valve lifter body as well as a lash adjuster body 110, a leakdown plunger 210, and a socket 310.

Figure 2:
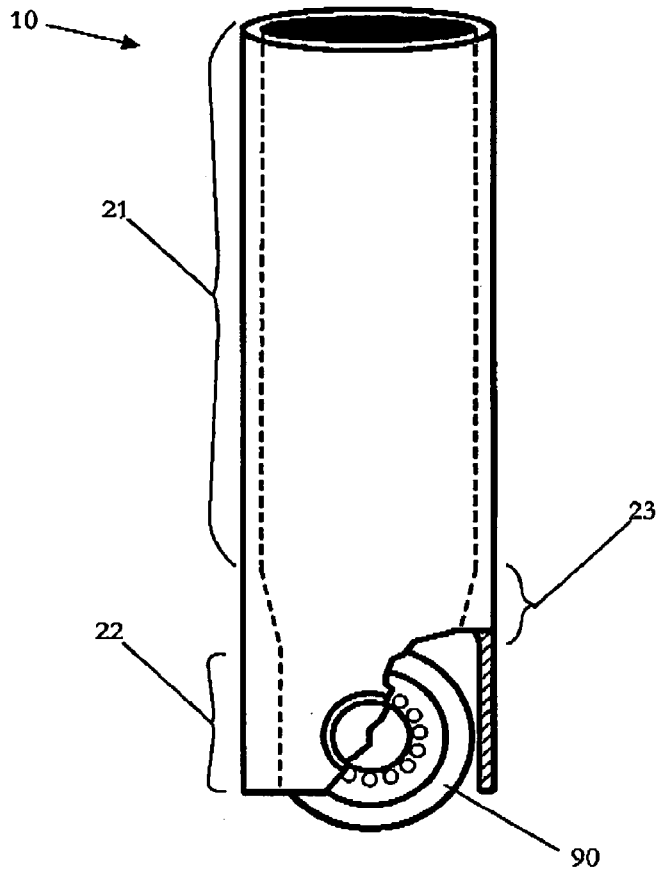
FIG. 2 depicts a preferred embodiment of a roller follower body.
Figure 3:
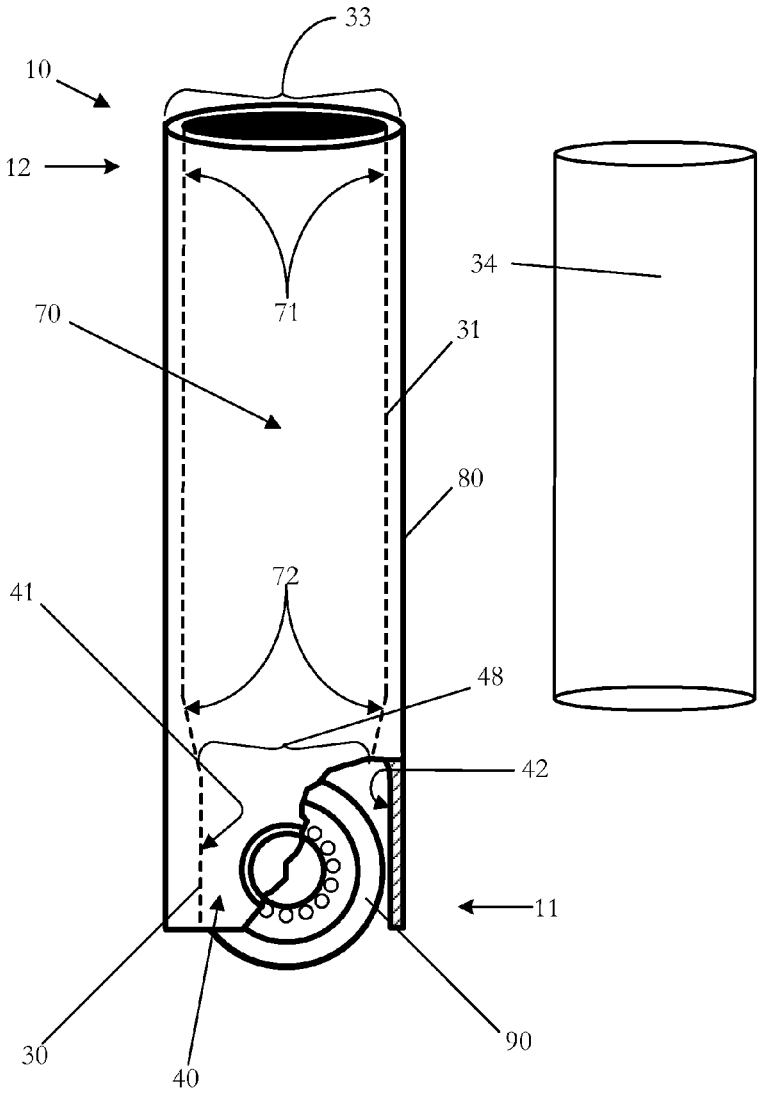
FIG. 3 depicts a preferred embodiment of a roller follower body.

FIGS. 2 and 3 show a roller follower body 10 constituting a preferred embodiment. The roller follower body 10 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the roller follower body 10 is composed of pearlitic material. According to still another aspect of the present invention, the roller follower body 10 is composed of austenitic material. According to another aspect of the present invention, the metal is a ferritic material.

The roller follower body 10 is composed of a plurality of roller elements. According to one aspect of the present invention, the roller element is cylindrical in shape. According to another aspect of the present invention, the roller element is conical in shape. According to yet another aspect of the present invention, the roller element is solid. According to still another aspect of the present invention, the roller element is hollow.

FIG. 2 depicts a cross-sectional view of the roller follower body 10 composed of a plurality of roller elements. FIG. 2 shows the roller follower body, generally designated 10. The roller follower body 10 of the preferred embodiment is fabricated from a single piece of metal wire or rod and is described herein as a plurality of roller elements. The roller follower body 10 includes a first hollow roller element 21, a second hollow roller element 22, and a third hollow roller element 23. As depicted in FIG. 2, the first hollow roller element 21 is located adjacent to the third hollow roller element 23. The third hollow roller element 23 is located adjacent to the second hollow roller element 22.

The first hollow roller element 21 has a cylindrically shaped inner surface. The second hollow roller element 22 has a cylindrically shaped inner surface with a diameter which is smaller than the diameter of the first hollow roller element 21. The third hollow roller element 23 has an inner surface shaped so that an insert (not shown) rests against its inner surface "above" the second hollow roller element 22. Those skilled in the art will understand that, as used herein, terms like "above" and terms of similar import are used to specify general relationships between parts, and not necessarily to indicate orientation of the part or of the overall assembly. In the preferred embodiment, the third hollow roller element 23 has a conically or frustoconically shaped inner surface; however, an annularly shaped surface could be used without departing from the scope of the present invention.

The roller follower body 10 functions to accommodate a plurality of inserts. According to one aspect of the present invention, the roller follower body 10 accommodates a lash adjuster, such as that disclosed in "Lash Adjuster Body," application Ser. No. 10/316,263, filed on Oct. 18, 2002 now U.S. Pat. No. 7,128,034, the disclosure of which is hereby incorporated herein by reference. In the preferred embodiment, the roller follower body 10 accommodates the lash adjuster body 110. According to another aspect of the present invention, the roller follower body 10 accommodates a leakdown plunger, such as that disclosed in "Leakdown Plunger," application Ser. No. 10/274,519, filed on Oct. 18, 2002 now U.S. Pat. No. 6,871,622, the disclosure of which is hereby incorporated herein by reference. In the preferred embodiment, the roller follower body 10 accommodates the leakdown plunger 210. According to another aspect of the present invention, the roller follower body 10 accommodates a push rod seat (not shown). According to yet another aspect of the present invention, the roller follower body 10 accommodates a socket, such as that disclosed in "Metering Socket," application Ser. No. 10/316,262, filed on Oct. 18, 2002 now U.S. Pat. No. 7,028,654, the disclosure of which is hereby incorporated herein by reference. In the preferred embodiment, the roller follower body 10 accommodates the socket 310.

The roller follower body 10 is provided with a plurality of outer surfaces and inner surfaces and a first end 11 and a second end 12. FIG. 3 depicts a cross-sectional view of the roller follower body 10 of the preferred embodiment. As shown therein, the roller follower body 10 is provided with an outer roller surface 80 which is cylindrically shaped. The outer surface 80 encloses a plurality of cavities. As depicted in FIG. 3, the outer surface 80 encloses a first cavity 30 and a second cavity 31. The first cavity 30 includes a first inner surface 40. The second cavity 31 includes a second inner surface 70.

Figure 4A:
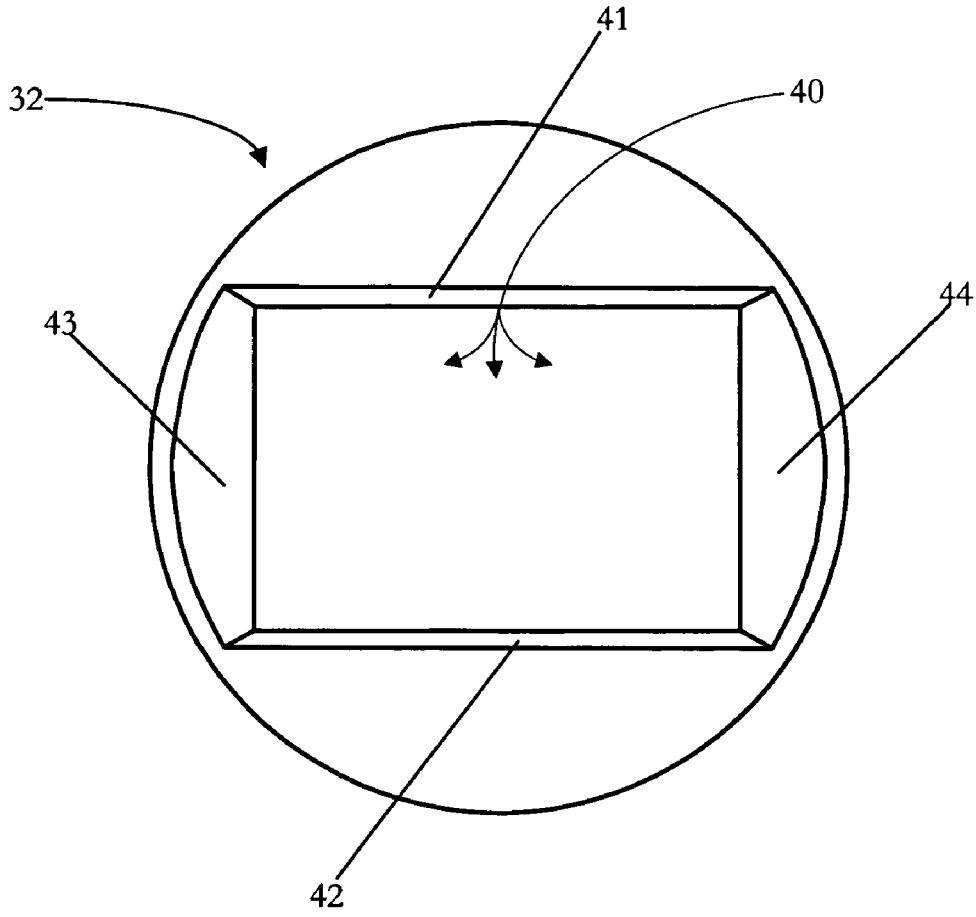
FIG. 4-*a* depicts the top view of a preferred embodiment of a roller follower body.
Figure 4B:
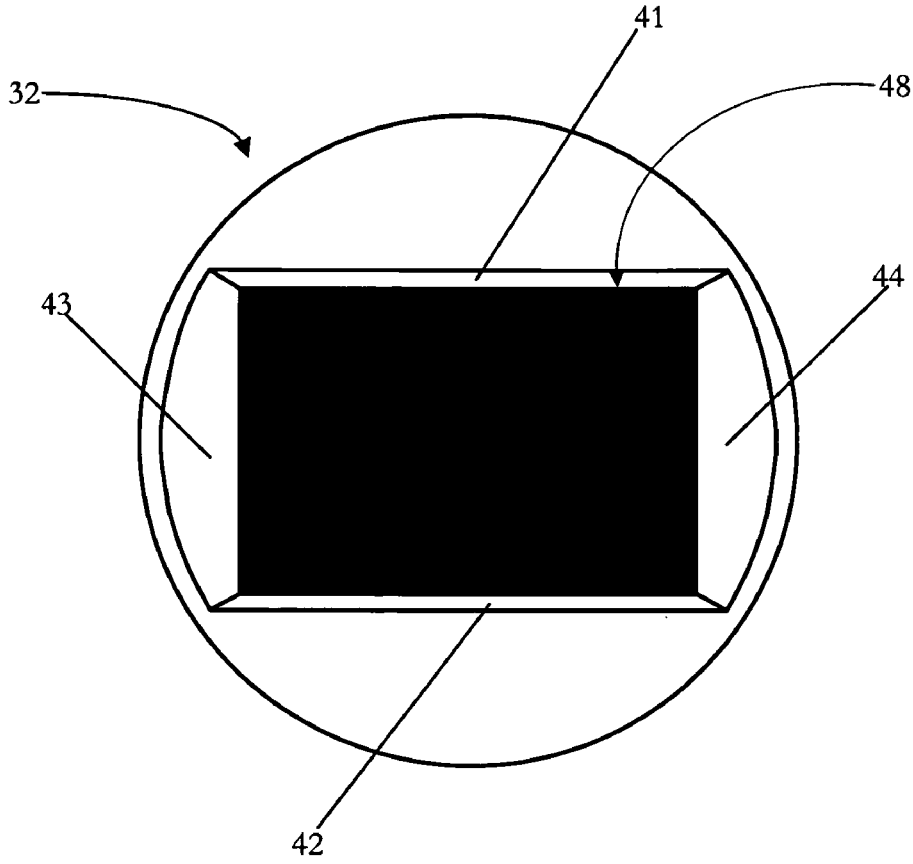

FIG. 4*a* and FIG. 4*b* depict top views and provide greater detail of the first roller cavity 30 of the preferred embodiment. As shown in FIG. 4*b*, the first roller cavity 30 is provided with a first roller opening 32 shaped to accept a cylindrical insert. Referring to FIG. 4*a*, the first inner roller surface 40 is configured to house a cylindrical insert 90, which, in the preferred embodiment of the present invention, functions as a roller. Those skilled in the art will appreciate that housing a cylindrical insert can be accomplished through a plurality of different configurations. In FIGS. 4*a* and 3*b*, the first inner roller surface 40 of the preferred embodiment includes a plurality of walls. As depicted in FIGS. 4*a* and 4*b*, the inner roller surface 40 defines a transition roller opening 48 which is in the shape of a polygon, the preferred embodiment being rectangular. The inner roller surface 40 includes opposing roller walls 41, 42 and opposing roller walls 43, 44. The first roller wall 41 and the second roller wall 42 are located generally on opposite sides of the transition roller opening 48. The transition roller opening 48 is further defined by the third and fourth roller walls 43, 44.

Referring now to FIG. 3, the second roller cavity 31 of the preferred embodiment includes a second roller opening 33 that is in a circular shape. The second roller cavity 31 is provided with a second inner roller surface 70 that is configured to house an inner body 34. In the preferred embodiment the inner body 34 is the lash adjuster body 110. The second inner roller surface 70 of the preferred embodiment is cylindrically shaped. Alternatively, the second inner roller surface 70 is conically or frustoconically shaped. As depicted in FIG. 3, the second inner roller surface 70 is a plurality of surfaces including a cylindrically shaped roller surface 71 adjacent to a conically or frustoconically shaped roller surface 72.

The present invention is fabricated through a plurality of processes. According to one aspect of the present invention, the roller follower body 10 is machined. According to another aspect of the present invention, the roller follower body 10 is forged. According to yet another aspect of the present invention, the roller follower body 10 is fabricated through casting. The preferred embodiment of the present invention is forged. As used herein, the term "forge," "forging," or "forged" is intended to encompass what is known in the art as "cold forming," "cold heading," "deep drawing," and "hot forging."

The roller follower body 10 of the preferred embodiment is forged with use of a National® 750 parts former machine. However, those skilled in the art will appreciate that other part formers, such as, for example, a Waterbury machine can be used. Those skilled in the art will further appreciate that other forging methods can be used as well.

The process of forging in the preferred embodiment begins with a metal wire or metal rod which is drawn to size. The ends of the wire or rod are squared off by a punch. After being drawn to size, the wire or rod is run through a series of dies or extrusions.

The second roller cavity 31, located at the second end 12, is extruded through use of a punch and an extruding pin. After the second roller cavity 31 has been extruded, the first roller cavity 30, located at the first end 11, is forged. The first roller cavity 30 is extruded through use of an extruding punch and a forming pin.

Alternatively, the roller follower body 10 is fabricated through machining. As used herein, machining means the use of a chucking machine, a drilling machine, a grinding machine, or a broaching machine. Machining is accomplished by first feeding the roller follower body 10 into a chucking machine, such as an ACME-Gridley automatic chucking machine. Those skilled in the art will appreciate that other machines and other manufacturers of automatic chucking machines can be used.

To machine the second roller cavity 31, the end containing the second roller opening 33 is faced so that it is substantially flat. The second roller cavity 31 is bored. Alternatively, the second roller cavity 31 can be drilled and then profiled with a special internal diameter forming tool.

After being run through the chucking machine, heat-treating is completed so that the required Rockwell hardness is achieved. Those skilled in the art will appreciate that this can be accomplished by applying heat so that the material is beyond its critical temperature and then oil quenching the material.

After heat-treating, the second roller cavity 31 is ground using an internal diameter grinding machine, such as a Heald grinding machine. Those skilled in the art will appreciate that the second roller cavity 31 can be ground using other grinding machines.

Those skilled in the art will appreciate that the other features of the present invention may be fabricated through machining. For example, the first roller cavity 30 can be machined. To machine the first roller cavity 30, the end containing the first roller opening 32 is faced so that it is substantially flat. The first roller cavity 30 is drilled and then the first roller opening 32 is broached using a broaching machine.

Figure 5:
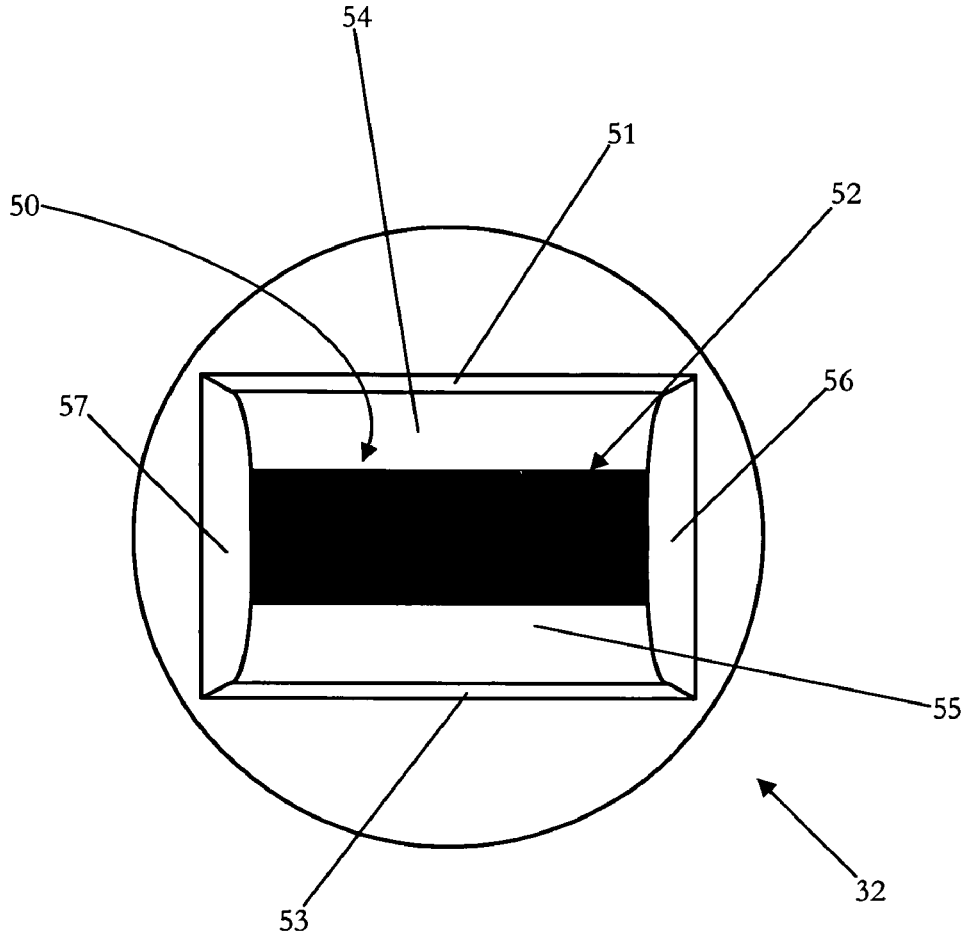
FIG. 5 depicts the top view of another preferred embodiment of a roller follower body.

In an alternative embodiment depicted in FIG. 5, the first roller cavity 30 is provided with a first inner roller surface 50 and first roller opening 32 shaped to accept a cylindrical insert 90. The first inner roller surface 50 defines a transition roller opening 52 and includes a plurality of curved surfaces and a plurality of walls. As depicted in FIG. 5, a first roller wall 51 is adjacent to a first curved roller surface 54. The first curved roller surface 54 and a second curved roller surface 55 are located on opposing sides of the transition roller opening 52. The second curved roller surface 55 is adjacent to a second roller wall 53. On opposing sides of the second roller wall 53 are third and fourth roller walls 56, 57.

Figure 6:
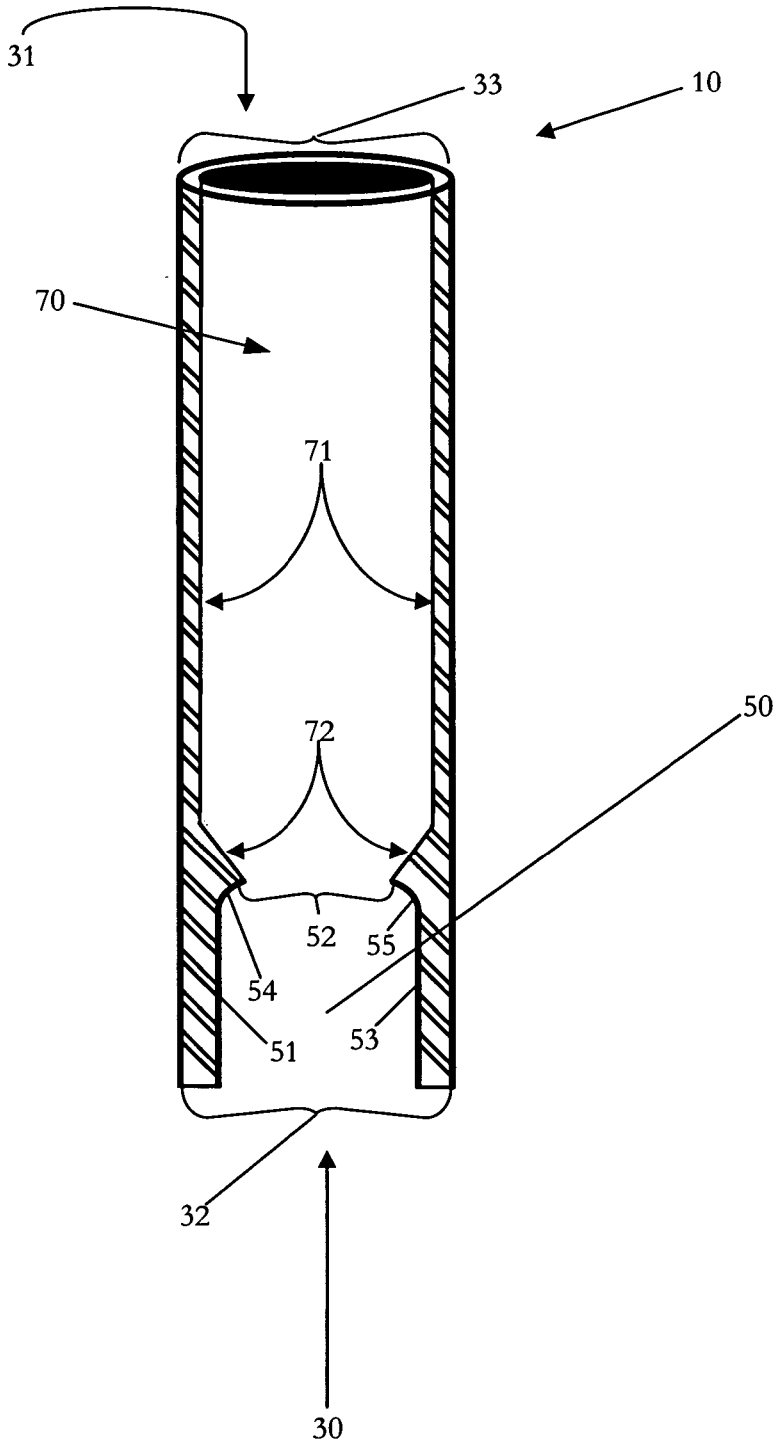
FIG. 6 depicts a second embodiment of a roller follower body.

FIG. 6 depicts a cross-sectional view of the roller follower body 10 with the first roller cavity 30 shown in FIG. 5. As shown in FIG. 6, the roller follower body 10 is also provided with a second cavity 31 which includes a second opening 33 which is in a circular shape. The second cavity 31 is provided with a second inner roller surface 70 which includes a plurality of surfaces. The second inner roller surface 70 includes a cylindrically shaped roller surface 71 and a frustoconically shaped roller surface 72.

Figure 7:
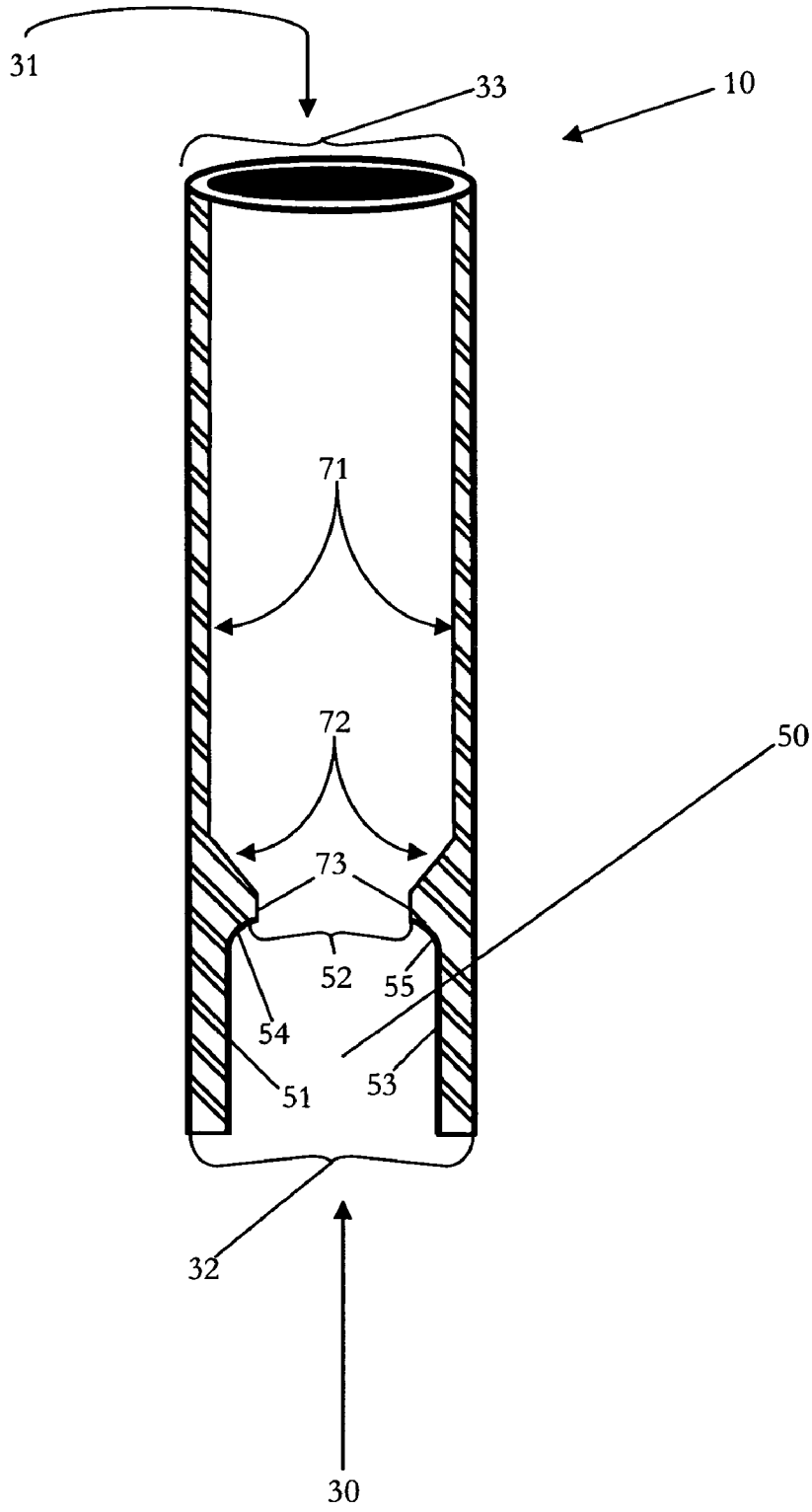
FIG. 7 depicts a third embodiment of a roller follower body.

Alternatively, the second inner roller surface 70 includes a plurality of cylindrical surfaces. As depicted in FIG. 7, the second inner roller surface 70 includes a first cylindrical roller surface 71 and a second cylindrical roller surface 73. The second inner roller surface 70 of the embodiment depicted in FIG. 7 also includes a frustoconical roller surface 72.

Figure 8:
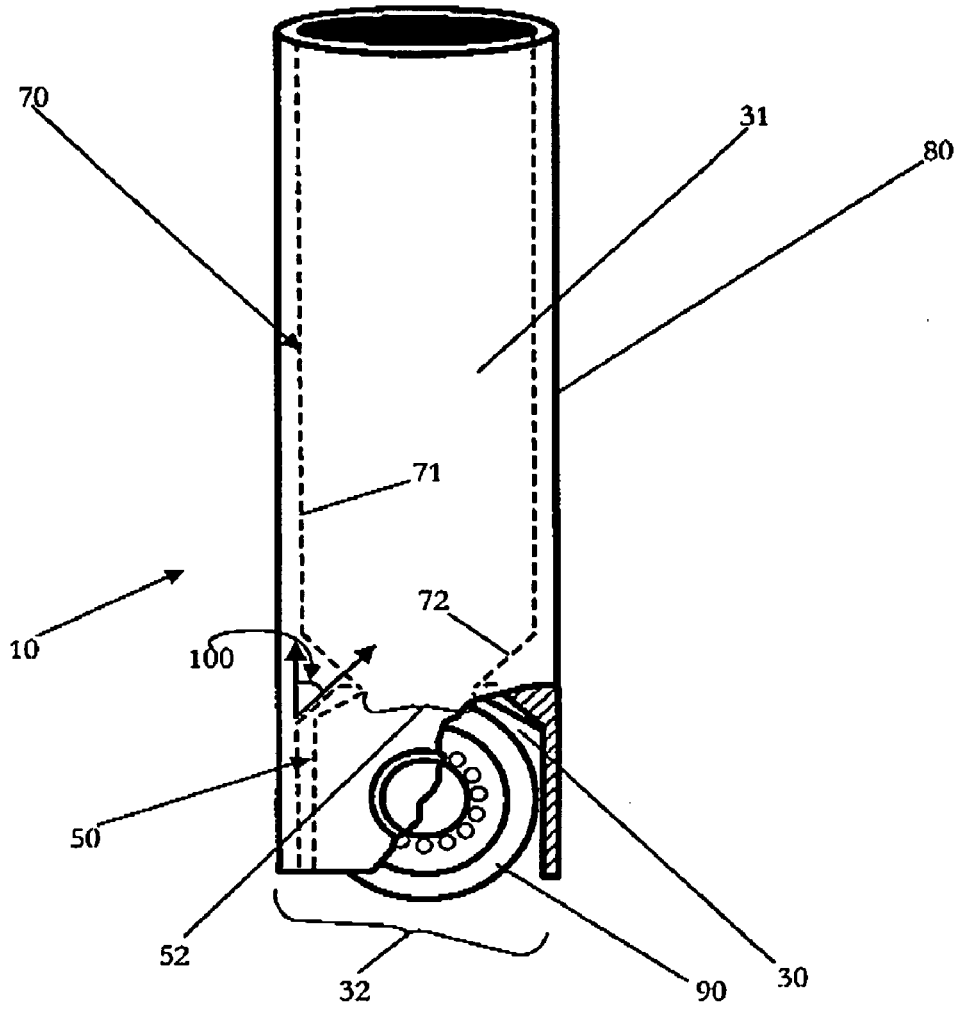
FIG. 8 depicts a fourth embodiment of a roller follower body.

In yet another alternative embodiment of the present invention, as depicted in FIG. 8, the first roller cavity 30 is provided with a first roller opening 32 shaped to accept a cylindrical insert and a first inner roller surface 50. The first inner roller surface 50 defines a transition roller opening 52 linking the first roller cavity 30 with the walls of the second roller cavity 31. The second roller cavity 31 is provided with a second inner roller surface 70 which includes a plurality of surfaces. As shown in FIG. 8, the second inner roller surface 70 includes a cylindrical roller surface 71 and a frustoconical roller surface 72.

Figure 9:
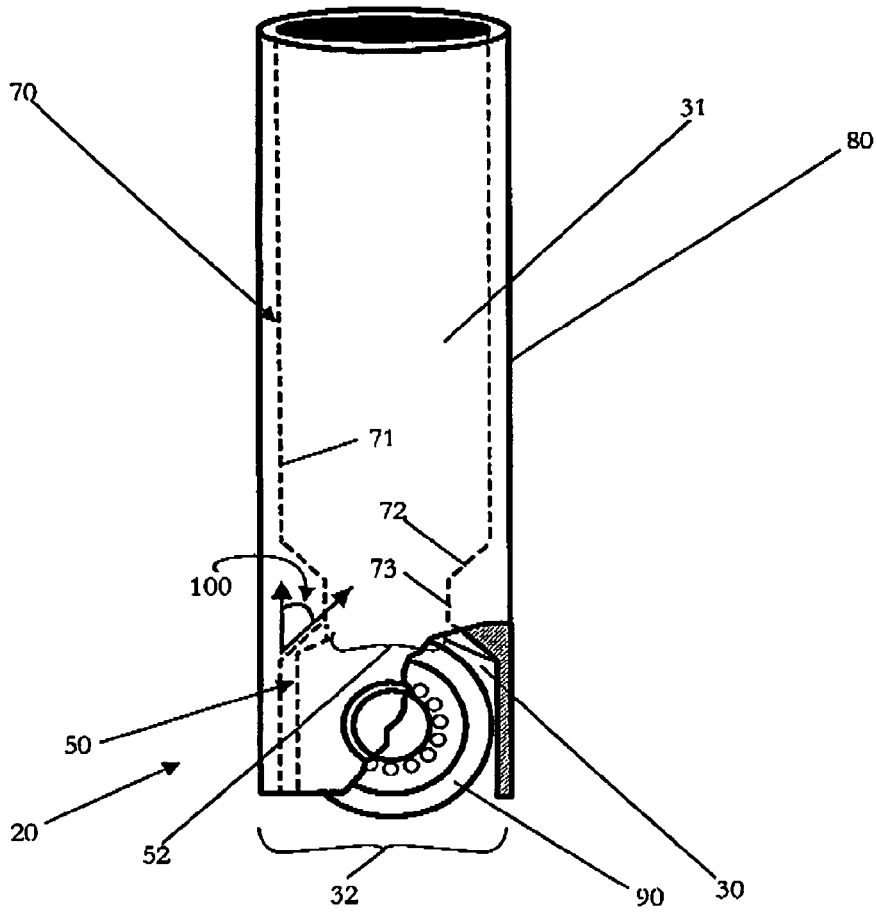
FIG. 9 depicts a fifth embodiment of a roller follower body.

Those skilled in the art will appreciate that the second inner roller surface 70 may include a plurality of cylindrical surfaces. FIG. 9 depicts a second inner roller surface 70 which includes a first cylindrical roller surface 71 adjacent to a frustoconical roller surface 72. Adjacent to the frustoconical roller surface 72 is a second cylindrical roller surface 73. The second cylindrical roller surface 73 depicted in FIG. 9 defines a transition roller opening 52 linking the second roller cavity 31 with a first roller cavity 30. As is evident in FIG. 9, the second inner roller surface 70 is provided with a plurality of cylindrical surfaces with a plurality of diameters. The first roller cavity 30 is provided with a first inner roller surface 50 and a first roller opening 32 shaped to accept a cylindrical insert. The first inner roller surface 50 includes a plurality of curved surfaces, angled surfaces, walls, and angled walls.

Figure 10:
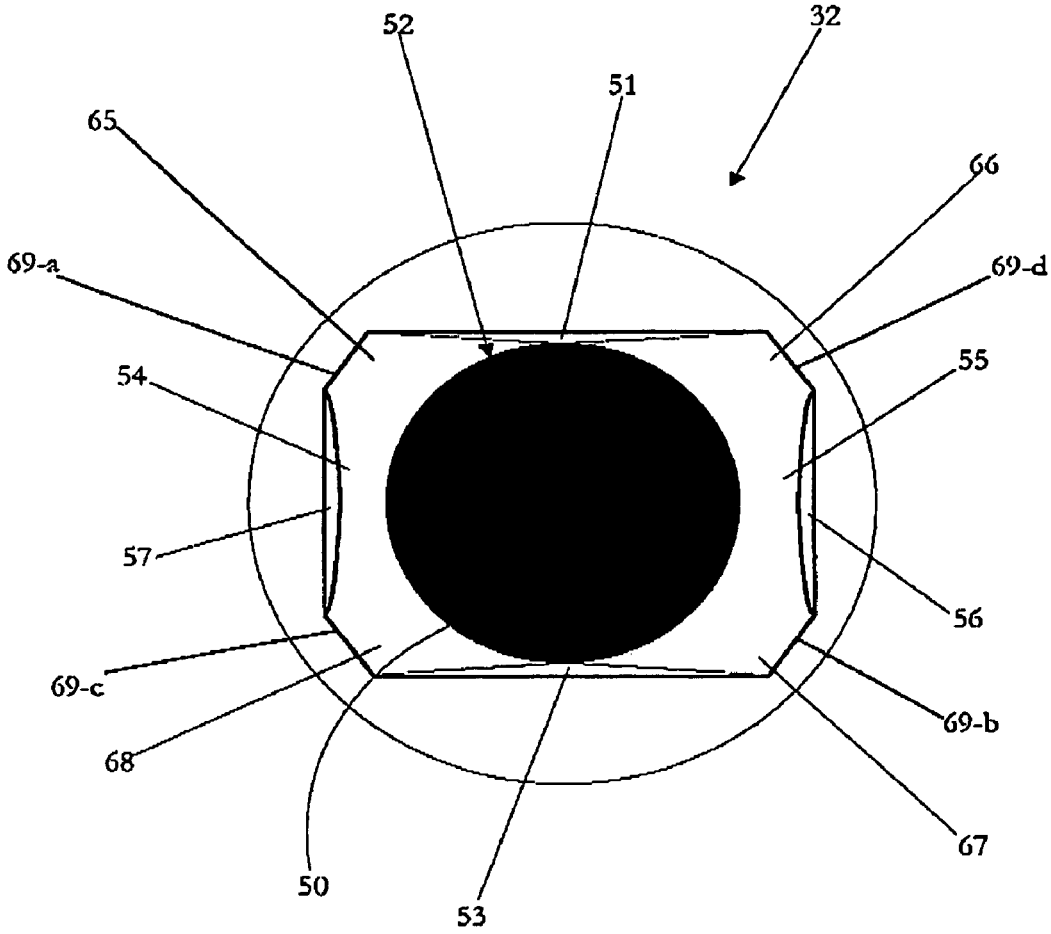
FIG. 10 depicts the top view of another preferred embodiment of a roller follower body.

FIG. 10 depicts a first inner roller surface 50 depicted in FIGS. 8 and 9. A first roller wall 51 is adjacent to the transition roller opening 52, a first angled roller surface 65, and a second angled roller surface 66. The first angled roller surface 65 is adjacent to the transition roller opening 52, a first curved roller surface 54, and a first angled roller wall 69-*a*. As depicted in FIGS. 8 and 9, the first angled roller surface 65 is configured to be at an angle 100 relative to the plane of a first angled roller wall 69-*a*, preferably between sixty-five and about ninety degrees.

The second angled roller surface 66 is adjacent to the transitional roller opening 52 and a fourth angled roller wall 69-*d*. As shown in FIGS. 8 and 9, the second angled roller surface 66 is configured to be at an angle 100 relative to the plane of the fourth angled roller wall 69-*d*, preferably between sixty-five and about ninety degrees. The second angled roller surface 66 is adjacent to a second curved roller surface 55. The second curved roller surface 55 is adjacent to a third angled roller surface 67 and a third roller wall 56. The third angled roller surface 67 is adjacent to the transitional roller opening 52, a second roller wall 53, and a second angled roller wall 69-*b*. As depicted in FIGS. 8 & 9, the third angled roller surface 67 is configured to be at an angle 100 relative to the plane of the second angled roller wall 69-*b*, preferably between sixty-five and about ninety degrees.

The second roller wall 53 is adjacent to a fourth angled roller surface 68. The fourth angled roller surface 68 adjacent to the first curved roller surface 54, a third angled roller wall 69-*c*, and a fourth roller wall 57. As depicted in FIGS. 8 and 9, the fourth angled roller surface 68 is configured to be at an angle relative to the plane of the third angled roller wall 69-*c*, preferably between sixty-five and about ninety degrees. FIGS. 8 and 9 depict cross-sectional views of embodiments with the first roller cavity 30 of FIG. 10.

Figure 11:
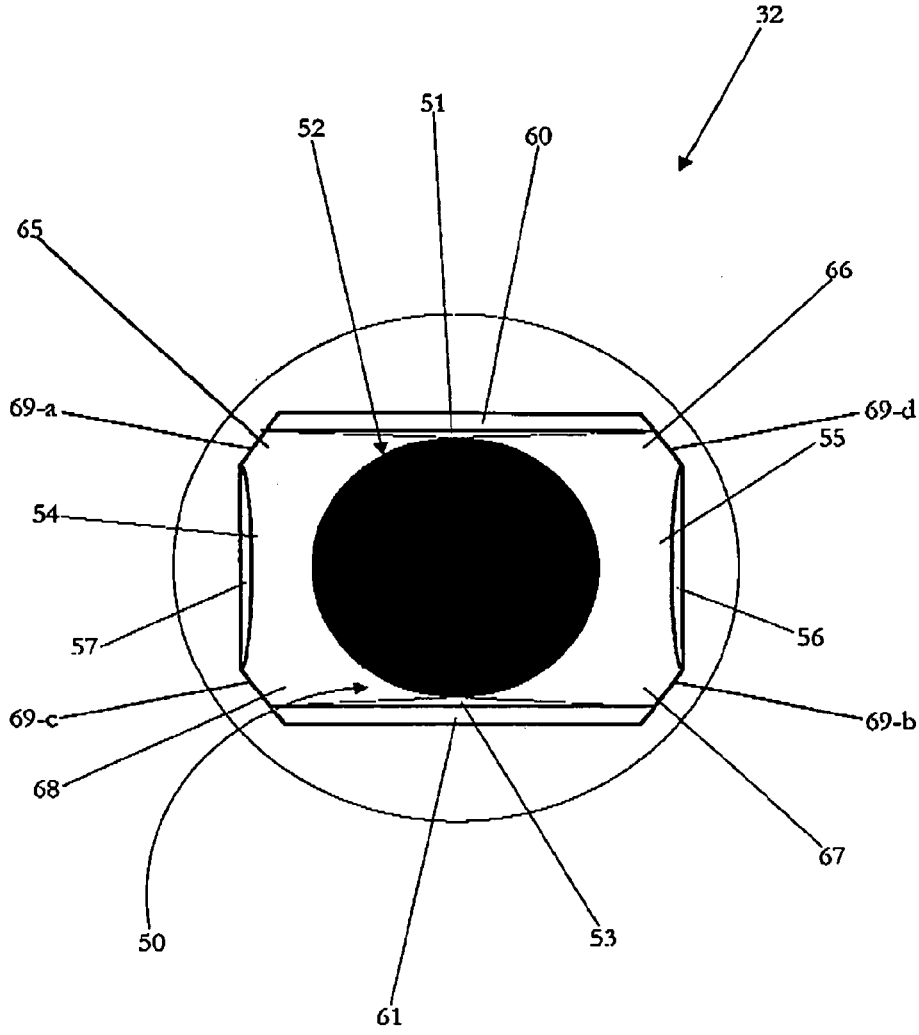
FIG. 11 depicts the top view of another preferred embodiment of a roller follower body.

Shown in FIG. 11 is an alternative embodiment of the first roller cavity 30 depicted in FIG. 10. In the embodiment depicted in FIG. 11, the first roller cavity 30 is provided with a chamfered roller opening 32 and a first inner roller surface 50. The chamfered roller opening 32 functions so that a cylindrical insert can be introduced to the roller follower body 10 with greater ease. The chamfered roller opening 32 accomplishes this function through roller chamfers 60, 61 which are located on opposing sides of the chamfered roller opening 32. The roller chamfers 60, 61 of the embodiment shown in FIG. 9 are flat surfaces at an angle relative to the roller walls 51, 53 so that a cylindrical insert 90 can be introduced through the first roller opening 32 with greater ease. Those skilled in the art will appreciate that the roller chamfers 60, 61 can be fabricated in a number of different configurations; so long as the resulting configuration renders introduction of a cylindrical insert 90 through the first roller opening 32 with greater ease, it is a "chamfered roller opening" within the spirit and scope of the present invention.

The roller chamfers 60, 61 are preferably fabricated through forging via an extruding punch pin. Alternatively, the roller chamfers 60, 61 are machined by being ground before heat-treating. Those skilled in the art will appreciate that other methods of fabrication can be employed within the scope of the present invention.

Figure 12:
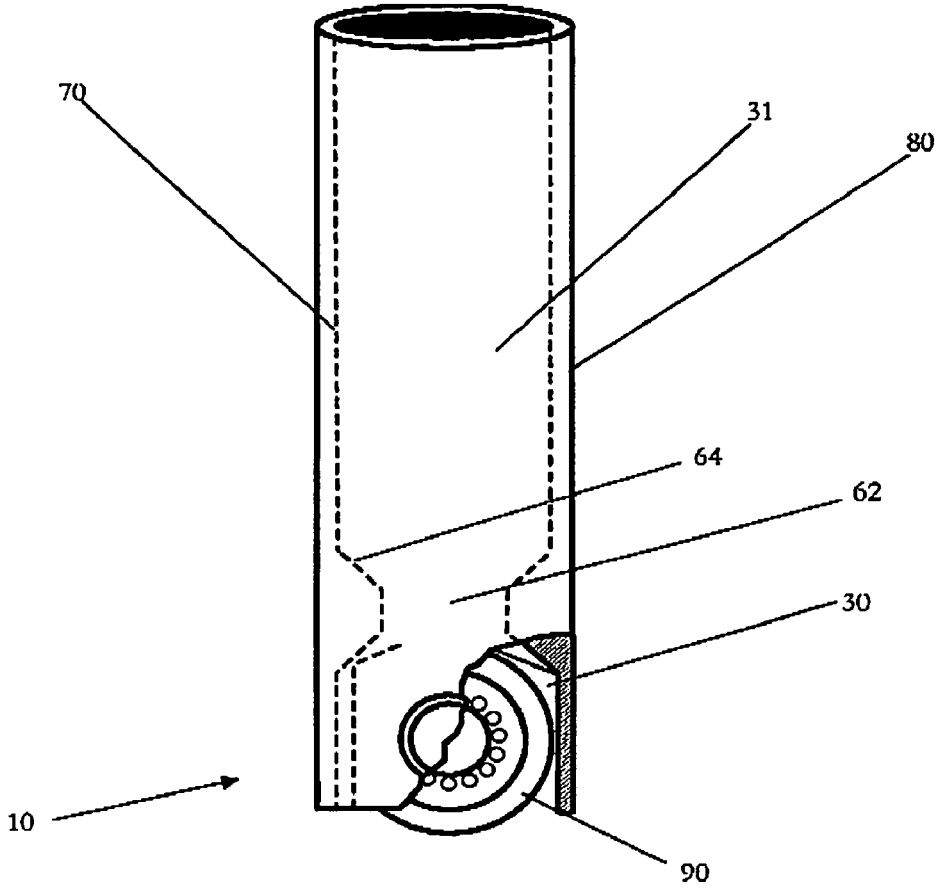
FIG. 12 depicts a sixth embodiment of a roller follower body.

FIG. 12 discloses the second roller cavity 31 of yet another alternative embodiment of the present invention. As depicted in FIG. 12, the roller follower body 10 is provided with a second roller cavity 31 which includes a plurality of cylindrical and conical surfaces. The second roller cavity 31 depicted in FIG. 12 includes a second inner roller surface 70. The second inner roller surface 70 of the preferred embodiment is cylindrically shaped, concentric relative to the cylindrically shaped outer roller surface 80. The second inner roller surface 70 is provided with a transitional tube 62. The transitional tube 62 is shaped to fluidly link the second roller cavity 31 with a first roller cavity 30. In the embodiment depicted in FIG. 12, the transitional tube 62 is cylindrically shaped at a diameter that is smaller than the diameter of the second inner roller surface 70. The cylindrical shape of the transitional tube 62 is preferably concentric relative to the outer roller surface 80. The transitional tube 62 is preferably forged through use of an extruding die pin.

Alternatively, the transitional tube 62 is machined by boring the transitional tube 62 in a chucking machine. Alternatively, the transitional tube 62 can be drilled and then profiled with a special internal diameter forming tool. After being run through the chucking machine, heat-treating is completed so that the required Rockwell hardness is achieved. Those skilled in the art will appreciate that heat-treating can be accomplished by applying heat so that the material is beyond its critical temperature and then oil quenching the material. After heat-treating, the transitional tube 62 is ground using an internal diameter grinding machine, such as a Heald grinding machine. Those skilled in the art will appreciate that the transitional tube 62 can be ground using other grinding machines.

Adjacent to the transitional tube 62, the embodiment depicted in FIG. 11 is provided with a conically-shaped roller lead surface 64 which can be fabricated through forging or machining. However, those skilled in the art will appreciate that the present invention can be fabricated without the roller lead surface 64

Figure 13:
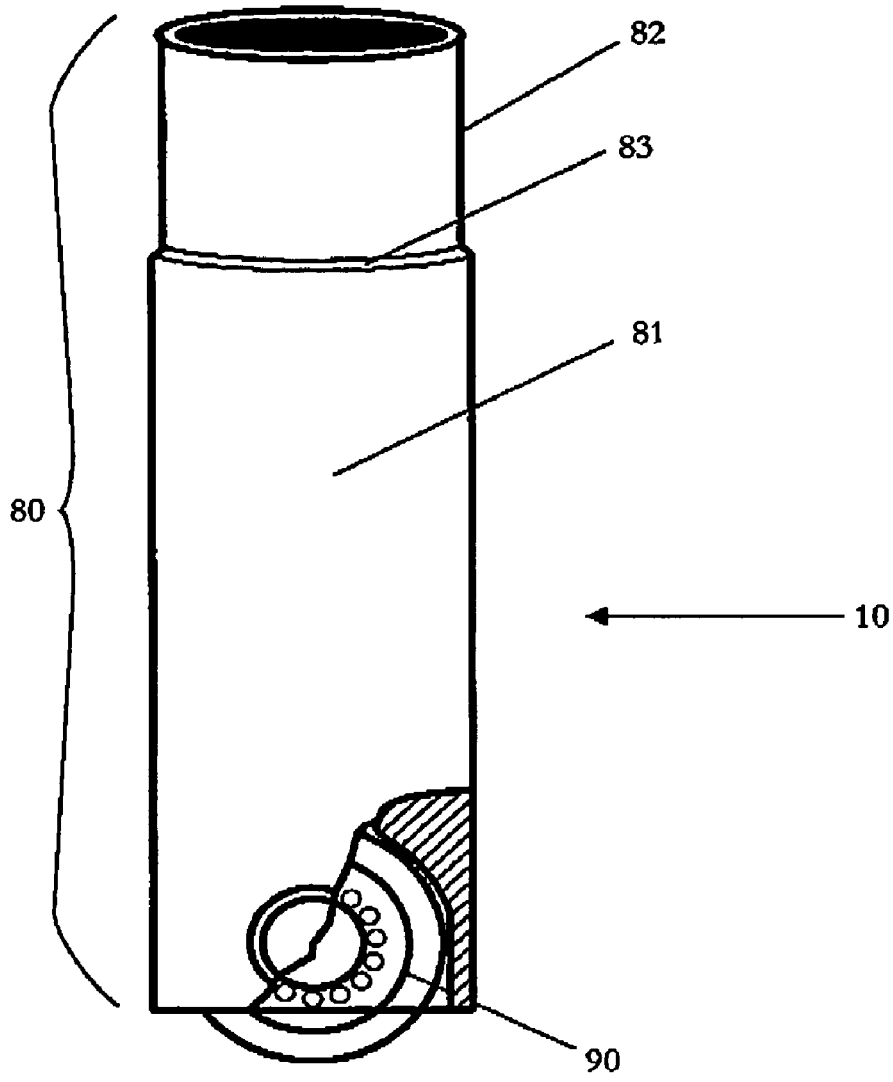
FIG. 13 depicts a seventh embodiment of a roller follower body.

Depicted in FIG. 13 is a roller follower body 10 of an alternative embodiment of the present invention. As shown in FIG. 13, the roller follower body 10 is provided with an outer roller surface 80. The outer roller surface 80 includes a plurality of surfaces. In the embodiment depicted in FIG. 13, the outer roller surface 80 includes a cylindrical roller surface 81, an undercut roller surface 82, and a conical roller surface 83. As depicted in FIG. 13, the undercut roller surface 82 extends from one end of the roller follower body 10 and is cylindrically shaped. The diameter of the undercut roller surface 82 is smaller than the diameter of the cylindrical roller surface 81.

The undercut roller surface 82 is preferably forged through use of an extruding die. Alternatively, the undercut roller surface 82 is fabricated through machining. Machining the undercut roller surface 82 is accomplished through use of an infeed centerless grinding machine, such as a Cincinnati grinder. The surface is first heat-treated and then the undercut roller surface 82 is ground via a grinding wheel. Those skilled in the art will appreciate that additional surfaces can be ground into the outer roller surface with minor alterations to the grinding wheel.

As depicted in FIG. 13, the conical roller surface 83 is located between the cylindrical roller surface 81 and the undercut roller surface 82. The conical roller surface 83 is preferably forged through use of an extruding die. Alternatively, the conical roller surface 83 is fabricated through machining. Those with skill in the art will appreciate that the outer roller surface 80 can be fabricated without the conical roller surface 83 so that the cylindrical surface 81 and the undercut roller surface 82 abut one another.

Figure 14:
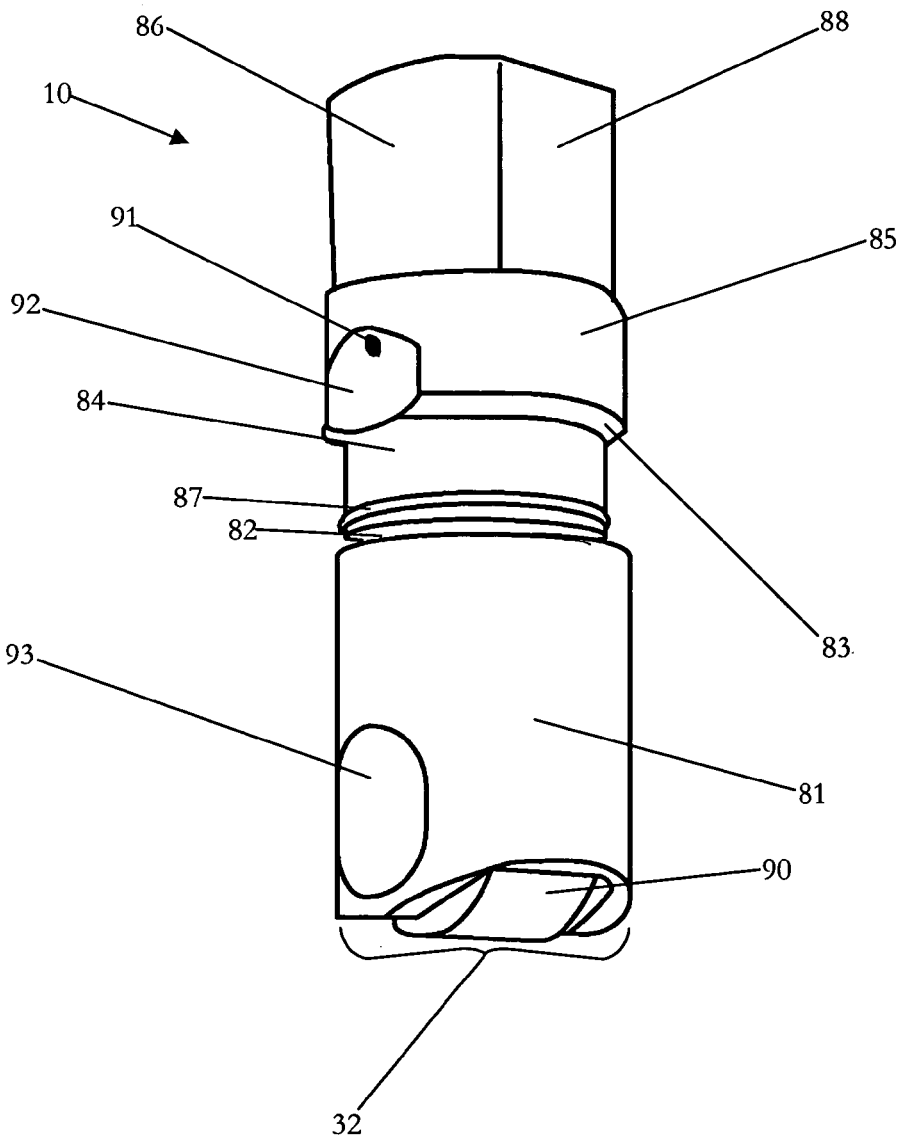
FIG. 14 depicts an eighth embodiment of a roller follower body.

FIG. 14 depicts a roller follower body 10 constituting another embodiment. In the embodiment depicted in FIG. 14, the outer roller surface 80 includes a plurality of surfaces. The outer roller surface 80 is provided with a first cylindrical roller surface 81. The first cylindrical roller surface 81 contains a first roller depression 93. Adjacent to the first cylindrical roller surface 81 is a second cylindrical roller surface 82. The second cylindrical roller surface 82 has a radius that is smaller than the radius of the first cylindrical roller surface 81. The second cylindrical roller surface 82 is adjacent to a third cylindrical roller surface 84. The third cylindrical roller surface 84 has a radius that is greater than the radius of the second cylindrical roller surface 82. The third cylindrical roller surface 84 contains a ridge 87. Adjacent to the third cylindrical roller surface 84 is a frusto-conical roller surface 83. The frusto-conical roller surface 83 is adjacent to a fourth cylindrical roller surface 85. The fourth cylindrical roller surface 85 and the frusto-conical roller surface 83 contain a second roller depression 92. The second roller depression 92 defines a roller hole 91. Adjacent to the fourth cylindrical roller surface 85 is a flat outer roller surface 88. The flat outer roller surface 88 is adjacent to a fifth cylindrical roller surface 86.

Those skilled in the art will appreciate that the features of the roller follower body 10 may be fabricated through a combination of machining, forging, and other methods of fabrication. By way of example and not limitation, the first roller cavity 30 can be machined while the second roller cavity 31 is forged. Conversely, the second roller cavity 31 can be machined while the first roller cavity is forged.

Figure 15:
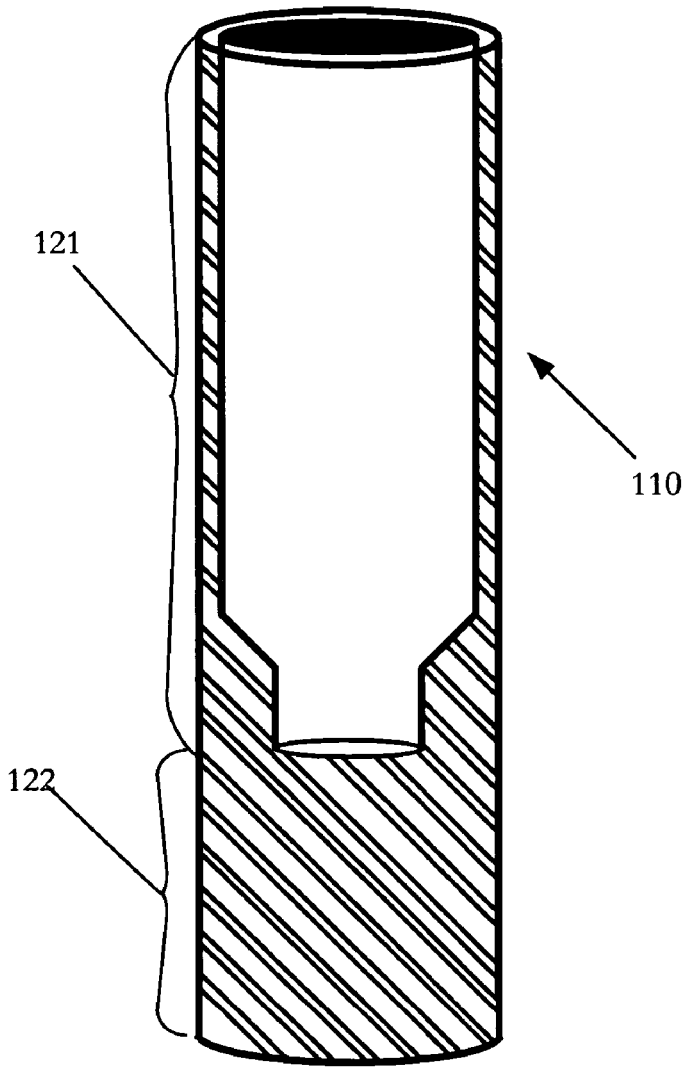
FIG. 15 depicts a preferred embodiment of a lash adjuster body.
Figure 16:
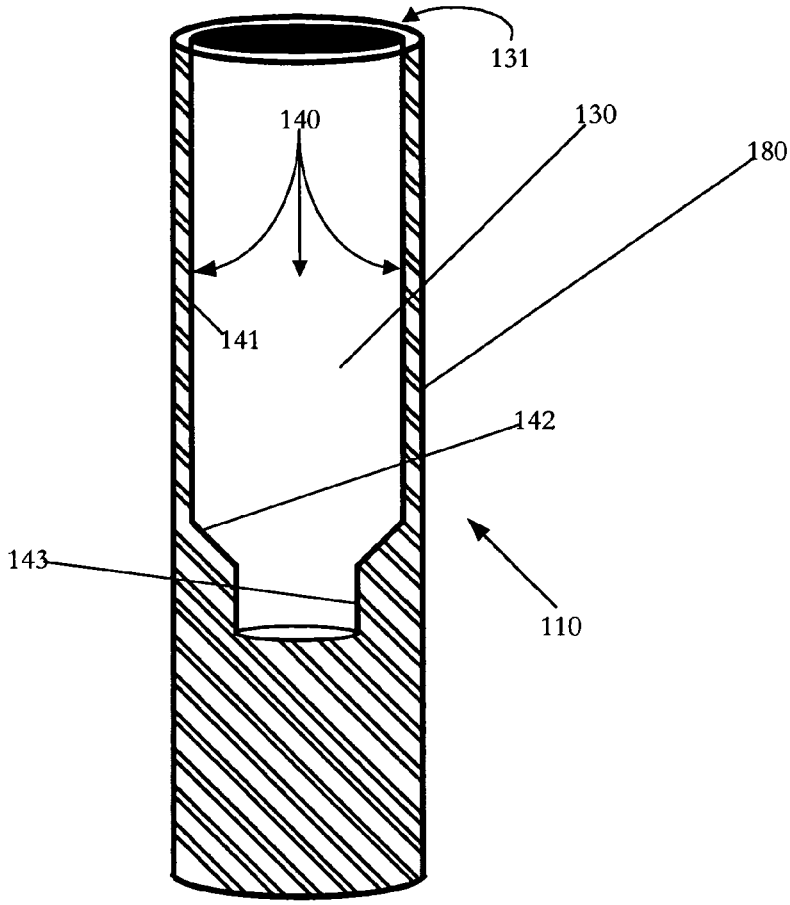
FIG. 16 depicts a preferred embodiment of a lash adjuster body.
Figure 17:
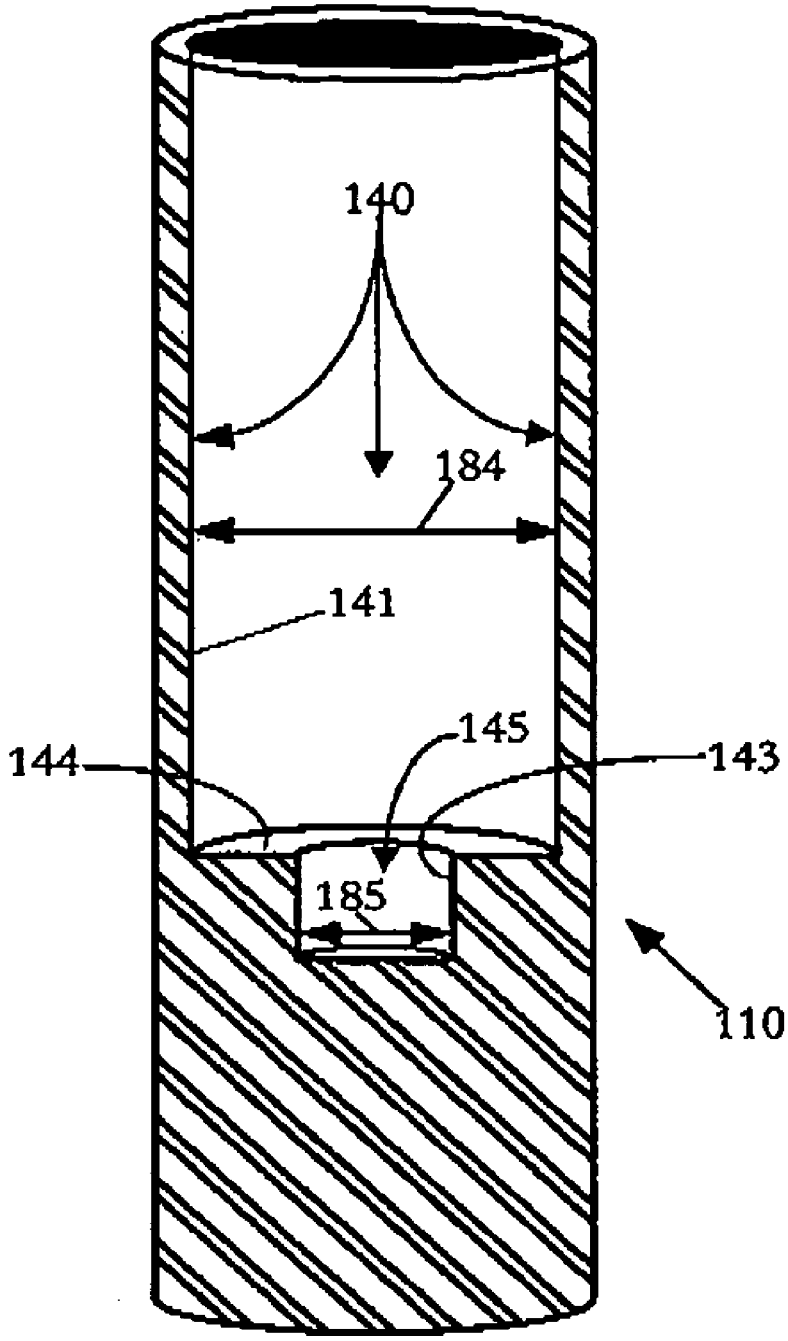
FIG. 17 depicts another embodiment of a lash adjuster body.

FIGS. 15, 16, and 17 show a lash adjuster body 110 of a preferred embodiment of the present invention. The lash adjuster body 110 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the lash adjuster body 110 is composed of pearlitic material. According to still another aspect of the present invention, the lash adjuster body 110 is composed of austenitic material. According to another aspect of the present invention, the metal is a ferritic material.

The lash adjuster body 110 is composed of a plurality of lash adjuster elements. According to one aspect of the present invention, the lash adjuster element is cylindrical in shape. According to another aspect of the present invention, the lash adjuster element is conical in shape. According to yet another aspect of the present invention, the lash adjuster element is solid. According to still another aspect of the present invention, the lash adjuster element is hollow.

FIG. 15 depicts a cross-sectional view of the lash adjuster 110 composed of a plurality of lash adjuster elements. FIG. 15 shows the lash adjuster body, generally designated 110. The lash adjuster body 110 of the preferred embodiment is fabricated from a single piece of metal wire or rod and is described herein as a plurality of lash adjuster elements. The lash adjuster body 110 includes a hollow lash adjuster element 121 and a solid lash adjuster element 122. In the preferred embodiment, the solid lash adjuster element 122 is located adjacent to the hollow lash adjuster element 121.

The lash adjuster body 110 functions to accommodate a plurality of inserts. According to one aspect of the present invention, the lash adjuster body 110 accommodates a leakdown plunger, such as that disclosed in "Leakdown Plunger," application Ser. No. 10/274,519, filed on Oct. 18, 2002 now U.S. Pat. No. 6,871,622. In the preferred embodiment, the lash adjuster body 110 accommodates the leakdown plunger 210. According to another aspect of the present invention, the lash adjuster body 110 accommodates a push rod seat (not shown). According to yet another aspect of the present invention, the lash adjuster body 110 accommodates a socket, such as that disclosed in "Metering Socket," application Ser. No. 10/316,262, filed on Oct. 18, 2002 now U.S. Pat. No. 7,028,654. In the preferred embodiment, the lash adjuster body 110 accommodates the socket 310.

Figure 57:
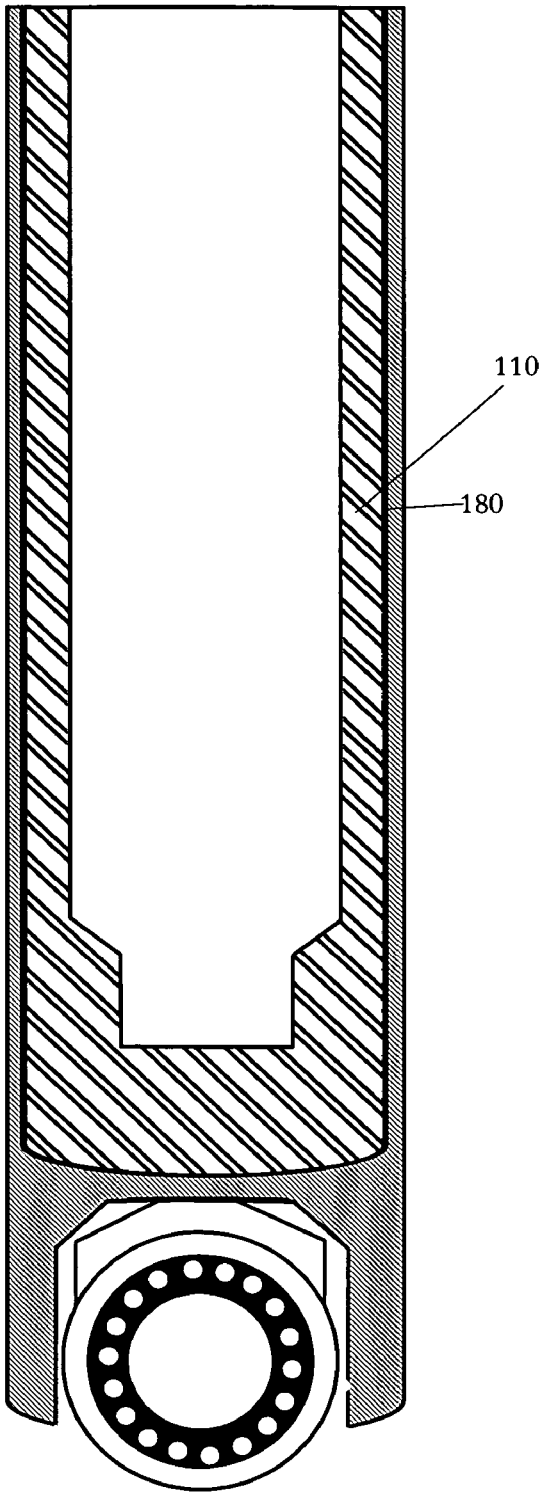
FIG. 57 depicts an alternative embodiment of the lash adjuster body within a valve lifter.

The lash adjuster body 110 is provided with a plurality of outer surfaces and inner surfaces. FIG. 16 depicts a cross-sectional view of the preferred embodiment of the present invention. As shown in FIG. 16, the lash adjuster body 110 is provided with an outer lash adjuster surface 180 which is configured to be inserted into another body. According to one aspect of the present invention, the outer lash adjuster surface 180 is configured to be inserted into a roller follower, such as that disclosed in Applicant's "Roller Follower Body," application Ser. No. 10/316,261, filed on Oct. 18, 2002 which is still pending, the disclosure of which is incorporated herein by reference. In the preferred embodiment, the outer lash adjuster surface is configured to be inserted into roller follower body 10. According to another aspect of the present invention, as depicted in FIG. 57, in an alternative embodiment the outer lash adjuster surface 180 is configured to be inserted into a valve lifter, such as that disclosed in Applicant's "Valve Lifter Body," application Ser. No. 10/316,263, filed on Oct. 18, 2002 now U.S. Pat. No. 7,128,034, the disclosure of which is incorporated herein by reference.

The outer lash adjuster surface 180 encloses at least one cavity. As depicted in FIG. 16, the outer lash adjuster surface 180 encloses a lash adjuster cavity 130. The lash adjuster cavity 130 is configured to cooperate with a plurality of inserts. According to one aspect of the present invention, the lash adjuster cavity 130 is configured to cooperate with a leakdown plunger. In the preferred embodiment, the lash adjuster cavity 130 is configured to cooperate with the leakdown plunger 210. According to another aspect of the present invention, the lash adjuster cavity 130 is configured to cooperate with a socket. In the preferred embodiment, the lash adjuster cavity 130 is configured to cooperate with the socket 310. According to yet another aspect of the present invention, the lash adjuster cavity 130 is configured to cooperate with a push rod. According to still yet another aspect of the present invention, the lash adjuster cavity is configured to cooperate with a push rod seat.

Referring to FIG. 16, the lash adjuster body 110 of the present invention is provided with a lash adjuster cavity 130 that includes a lash adjuster opening 131. The lash adjuster opening 131 is in a circular shape. The lash adjuster cavity 130 is provided with the inner lash adjuster surface 140.

The inner lash adjuster surface 140 includes a plurality of surfaces. According to one aspect of the present invention, the inner lash adjuster surface 140 includes a cylindrical lash adjuster surface. According to another aspect of the present invention, the inner lash adjuster surface 140 includes a conical or frustoconical surface.

As depicted in FIG. 16, the inner lash adjuster surface 140 is provided with a first cylindrical lash adjuster surface 141, preferably concentric relative to the outer lash adjuster surface 180. Adjacent to the first cylindrical lash adjuster surface 141 is a conical lash adjuster surface 142. Adjacent to the conical lash adjuster surface 142 is a second cylindrical lash adjuster surface 143. However, those skilled in the art will appreciate that the inner lash adjuster surface 140 can be fabricated without the conical lash adjuster surface 142.

FIG. 17 depicts a cut-away view of the lash adjuster body 110 of the preferred embodiment. The inner lash adjuster surface 140 is provided with a first cylindrical lash adjuster surface 141 that includes a first inner lash adjuster diameter 184. The first cylindrical lash adjuster surface 141 abuts an annular lash adjuster surface 144 with an annulus 145. The annulus 145 defines a second cylindrical lash adjuster surface 143 that includes a second inner lash adjuster diameter 185. In the embodiment depicted, the second inner lash adjuster diameter 185 is smaller than the first inner lash adjuster diameter 184.

The lash adjuster body 110 of the present invention is fabricated through a plurality of processes. According to one aspect of the present invention, the lash adjuster body 110 is machined. According to another aspect of the present invention, the lash adjuster body 110 is forged. According to yet another aspect of the present invention, the lash adjuster body 110 is fabricated through casting. The preferred embodiment of the present invention is forged. As used herein, the term "forge," "forging," or "forged" is intended to encompass what is known in the art as "cold forming," "cold heading," "deep drawing," and "hot forging."

In the preferred embodiment, the lash adjuster body 110 is forged with use of a National® 750 parts former machine. However, those skilled in the art will appreciate that other part formers, such as, for example, a Waterbury machine can be used. Those skilled in the art will further appreciate that other forging methods can be used as well.

The process of forging the preferred embodiment begins with a metal wire or metal rod which is drawn to size. The ends of the wire or rod are squared off by a punch. After being drawn to size, the wire or rod is run through a series of dies or extrusions.

The lash adjuster cavity 130 is extruded through use of a punch and an extruding pin. After the lash adjuster cavity 130 has been extruded, the lash adjuster cavity 130 is forged. The lash adjuster cavity 130 is extruded through use of an extruding punch and a forming pin.

Alternatively, the lash adjuster body 110 is fabricated through machining. As used herein, machining means the use of a chucking machine, a drilling machine, a grinding machine, or a broaching machine. Machining is accomplished by first feeding the lash adjuster body 110 into a chucking machine, such as an ACME-Gridley automatic chucking machine. Those skilled in the art will appreciate that other machines and other manufacturers of automatic chucking machines can be used.

To machine the lash adjuster cavity 130, the end containing the lash adjuster opening 131 is faced so that it is substantially flat. The lash adjuster cavity 130 is bored. Alternatively, the lash adjuster cavity 130 can be drilled and then profiled with a special internal diameter forming tool.

After being run through the chucking machine, heat-treating is completed so that the required Rockwell hardness is achieved. Those skilled in the art will appreciate that this can be accomplished by applying heat so that the material is beyond its critical temperature and then oil quenching the material.

After heat-treating, the lash adjuster cavity 130 is ground using an internal diameter grinding machine, such as a Heald grinding machine. Those skilled in the art will appreciate that the lash adjuster cavity 130 can be ground using other grinding machines.

Figure 18:
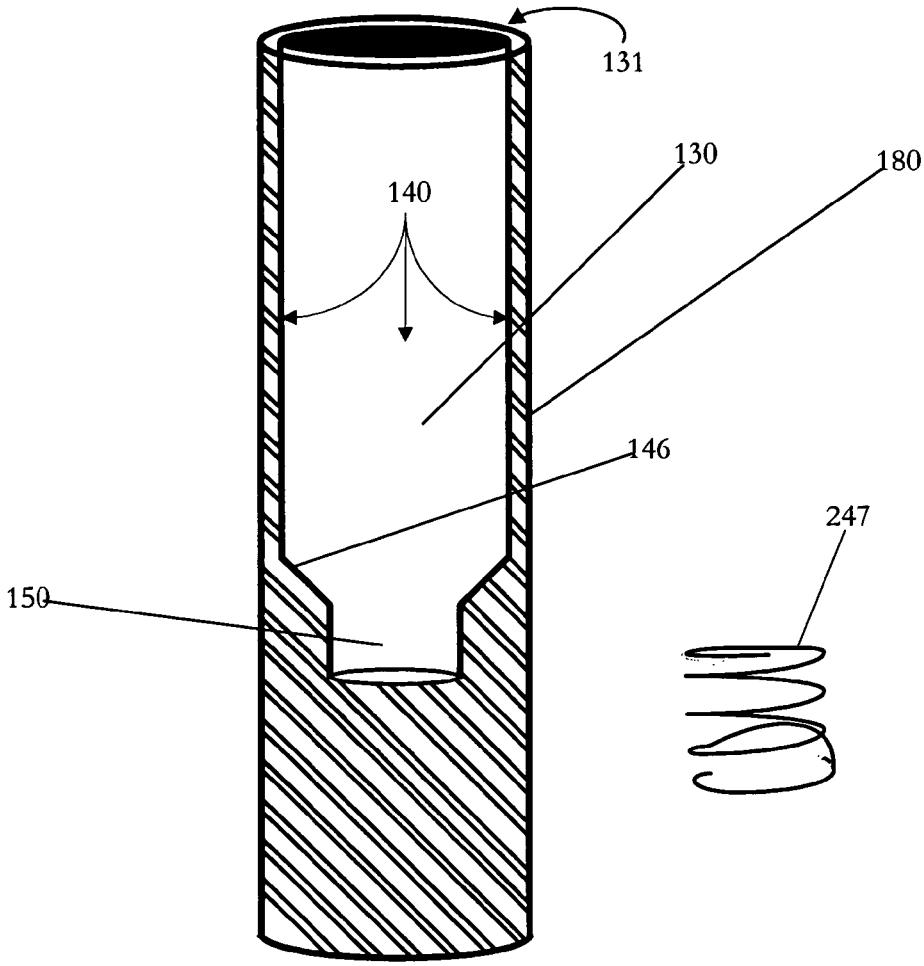
FIG. 18 depicts another embodiment of a lash adjuster body.

FIG. 18 depicts the inner lash adjuster surface 140 provided with a lash adjuster well 150. The lash adjuster well 150 is shaped to accommodate a cap spring 247. In the embodiment depicted in FIG. 18, the lash adjuster well 150 is cylindrically shaped at a diameter that is smaller than the diameter of the inner lash adjuster surface 140. The cylindrical shape of the lash adjuster well 150 is preferably concentric relative to the outer lash adjuster surface 180. The lash adjuster well 150 is preferably forged through use of an extruding die pin.

Alternatively, the lash adjuster well 150 is machined by boring the lash adjuster well 150 in a chucking machine. Alternatively, the lash adjuster well 150 can be drilled and then profiled with a special internal diameter forming tool. After being run through the chucking machine, heat-treating is completed so that the required Rockwell hardness is achieved. Those skilled in the art will appreciate that heat-treating can be accomplished by applying heat so that the material is beyond its critical temperature and then oil quenching the material. After heat-treating, the lash adjuster well 150 is ground using an internal diameter grinding machine, such as a Heald grinding machine. Those skilled in the art will appreciate that the lash adjuster well 150 can be ground using other grinding machines.

Adjacent to the lash adjuster well 150, in the embodiment depicted in FIG. 18, is a lash adjuster lead surface 146 which is conically shaped and can be fabricated through forging or machining. However, those skilled in the art will appreciate that the present invention can be fabricated without the lash adjuster lead surface 146.

Figure 19:
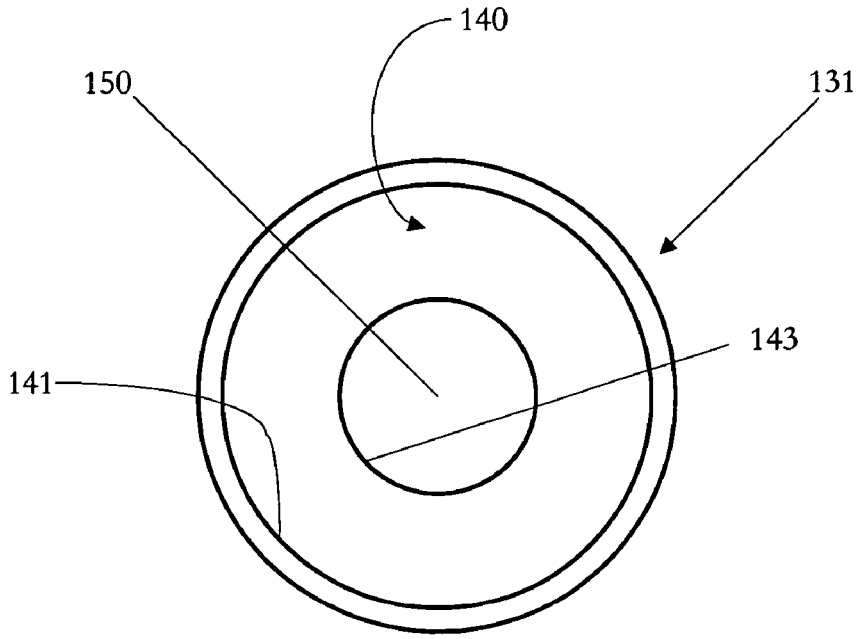
FIG. 19 depicts a top view of an embodiment of a lash adjuster body.

FIG. 19 depicts a view of the lash adjuster opening 131 that reveals the inner lash adjuster surface 140 of the preferred embodiment of the present invention. The inner lash adjuster surface 140 is provided with a first cylindrical lash adjuster surface 141. A lash adjuster well 150 is defined by a second cylindrical lash adjuster surface 143. As shown in FIG. 19, the second cylindrical lash adjuster surface 143 is concentric relative to the first cylindrical lash adjuster surface 141.

Figure 20:
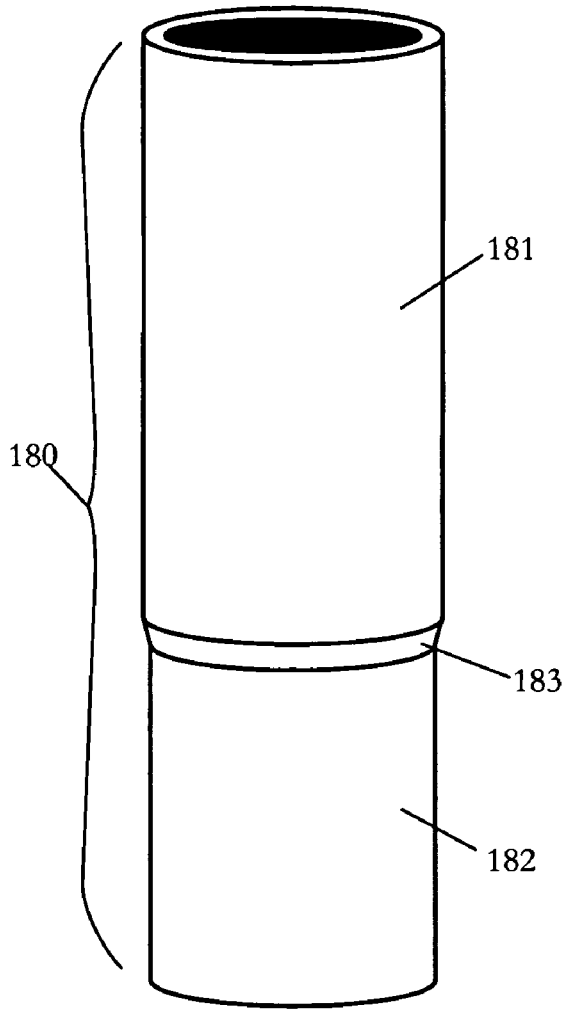
FIG. 20 depicts the top view of another preferred embodiment of a lash adjuster body.

Depicted in FIG. 20 is a lash adjuster body 110 constituting an alternative embodiment. As shown in FIG. 20, the lash adjuster body 110 is provided with an outer lash adjuster surface 180. The outer lash adjuster surface 180 includes a plurality of surfaces. In the embodiment depicted in FIG. 20, the outer lash adjuster surface 180 includes an outer cylindrical lash adjuster surface 181, an undercut lash adjuster surface 182, and a conical lash adjuster surface 183. As depicted in FIG. 20, the undercut lash adjuster surface 182 extends from one end of the lash adjuster body 110 and is cylindrically shaped. The diameter of the undercut lash adjuster surface 182 is smaller than the diameter of the outer cylindrical lash adjuster surface 181.

The undercut lash adjuster surface 182 is forged through use of an extruding die. Alternatively, the undercut lash adjuster surface 182 is fabricated through machining. Machining the undercut lash adjuster surface 182 is accomplished through use of an infeed centerless grinding machine, such as a Cincinnati grinder. The surface is first heat-treated and then the undercut lash adjuster surface 182 is ground via a grinding wheel. Those skilled in the art will appreciate that additional surfaces can be ground into the outer lash adjuster surface 180 with minor alterations to the grinding wheel.

As depicted in FIG. 20, the conical lash adjuster surface 183 is located between the outer cylindrical lash adjuster surface 181 and the undercut lash adjuster surface 182. The conical lash adjuster surface 183 is forged through use of an extruding die. Alternatively, the conical lash adjuster surface 183 is fabricated through machining. Those with skill in the art will appreciate that the outer lash adjuster surface 180 can be fabricated without the conical lash adjuster surface 183 so that the outer cylindrical lash adjuster surface 181 and the undercut lash adjuster surface 182 abut one another.

Those skilled in the art will appreciate that the features of the lash adjuster body 110 may be fabricated through a combination of machining, forging, and other methods of fabrication. By way of example and not limitation, aspects of the lash adjuster cavity 130 can be machined; other aspects of the lash adjuster cavity can be forged.

Figure 21:
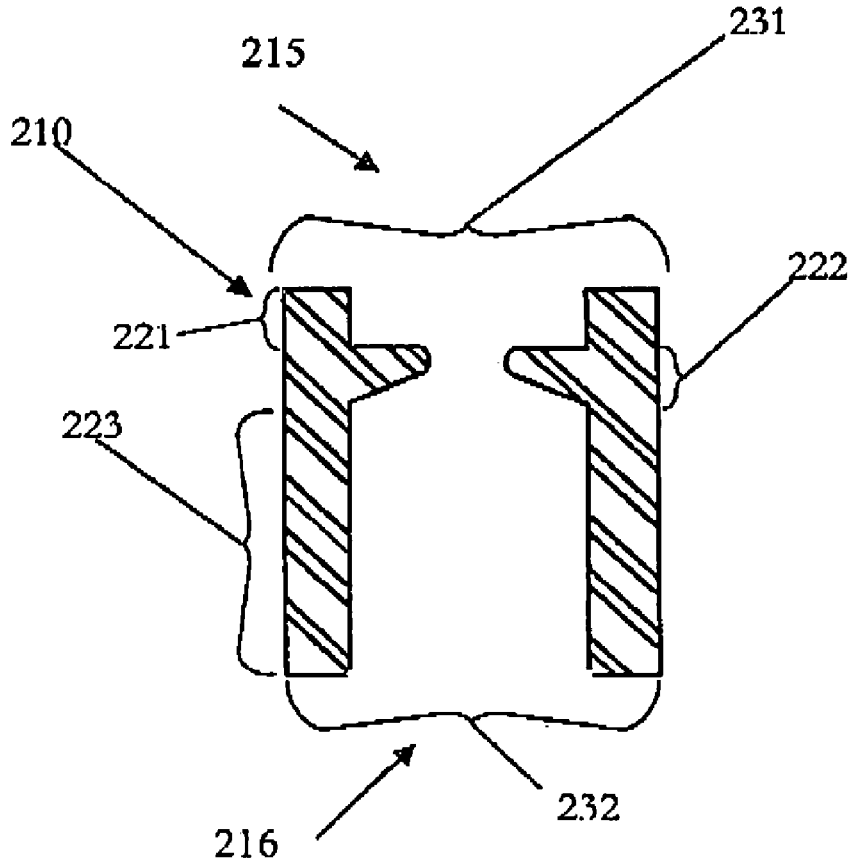
FIG. 21 depicts a preferred embodiment of a leakdown plunger.
Figure 22:
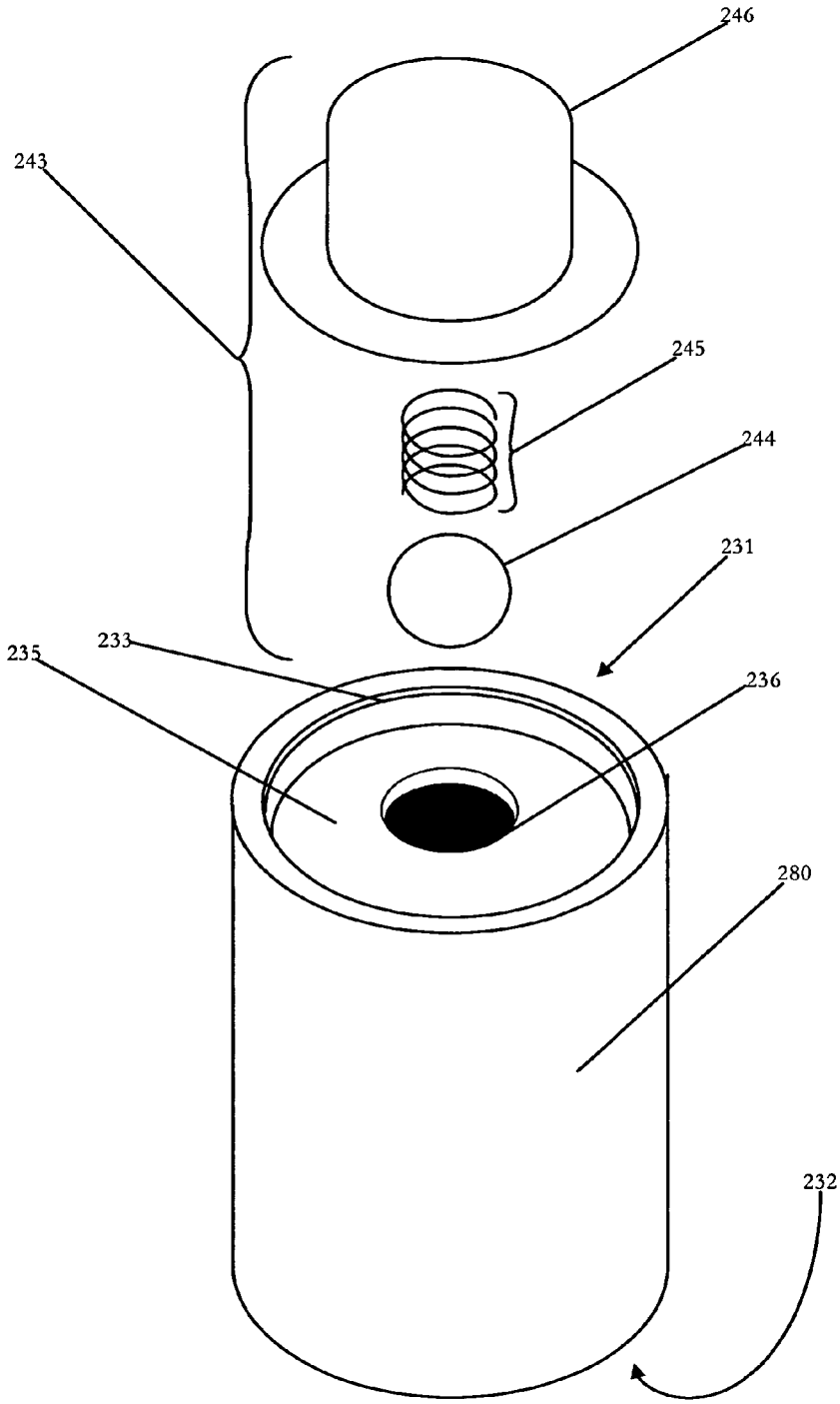
FIG. 22 depicts a preferred embodiment of a leakdown plunger.
Figure 23:
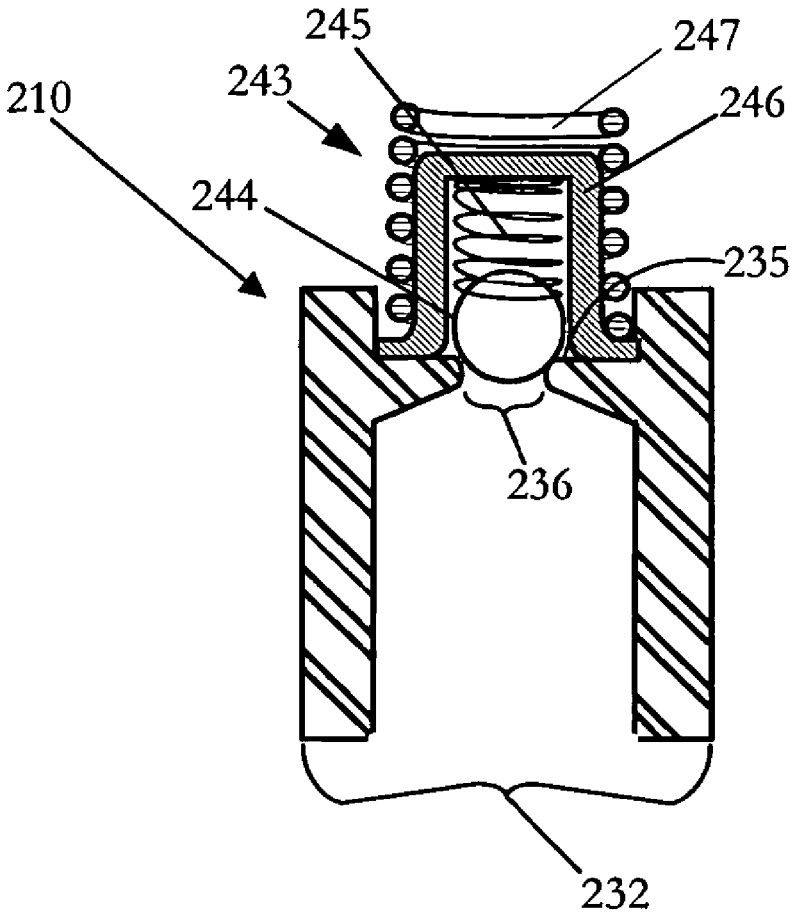
FIG. 23 depicts a cross-sectional view of a preferred embodiment of a leakdown plunger.

FIGS. 21, 22, and 23 show a leakdown plunger 210 constituting a preferred embodiment. The leakdown plunger 210 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the leakdown plunger 210 is composed of pearlitic material. According to still another aspect of the present invention, the leakdown plunger 210 is composed of austenitic material. According to another aspect of the present invention, the metal is a ferritic material.

The leakdown plunger 210 is composed of a plurality of plunger elements. According to one aspect of the present invention, the plunger element is cylindrical in shape. According to another aspect of the present invention, the plunger element is conical in shape. According to yet another aspect of the present invention, the plunger element is hollow.

FIG. 21 depicts a cross-sectional view of the leakdown plunger 210 composed of a plurality of plunger elements. FIG. 21 shows the leakdown plunger, generally designated 210. The leakdown plunger 210 functions to accept a liquid, such as a lubricant and is provided with a first end 215 and a second end 216. As used herein, the term "end" is intended broadly to encompass the extreme end as well as portions of the leakdown plunger 210 adjacent the extreme end. As shown therein, the first end defines a first plunger opening 231 and the second end 216 defines a second plunger opening 232. The first plunger opening 231 functions to accommodate an insert.

The leakdown plunger 210 of the preferred embodiment is fabricated from a single piece of metal wire or rod and is described herein as a plurality of plunger elements. The leakdown plunger 210 includes a first hollow plunger element 221, a second hollow plunger element 223, and an insert-accommodating plunger element 222. As depicted in FIG. 21, the first hollow plunger element 221 is located adjacent to the insert-accommodating plunger element 222. The insert-accommodating plunger element 222 is located adjacent to the second hollow plunger element 223.

The leakdown plunger 210 is provided with a plurality of outer surfaces and inner surfaces. FIG. 22 depicts the first plunger opening 231 of an alternative embodiment. The first plunger opening 231 of the embodiment depicted in FIG. 22 is advantageously provided with a chamfered plunger surface 233, however a chamfered plunger surface 233 is not necessary. When used herein in relation to a surface, the term "chamfered" shall mean a surface that is rounded or angled.

The first plunger opening 231 depicted in FIG. 22 is configured to accommodate an insert. The first plunger opening 231 is shown in FIG. 22 accommodating a valve insert 243. In the embodiment depicted in FIG. 22, the valve insert 243 is shown in an exploded view and includes a generally spherically shaped valve insert member 244, an insert spring 245, and a cap 246. Those skilled in the art will appreciate that valves other than the valve insert 243 shown herein can be used without departing from the scope and spirit of the present invention As shown in FIG. 22, the first plunger opening 231 is provided with an annular plunger surface 235 defining a plunger hole 236. The plunger hole 236 is shaped to accommodate an insert. In the embodiment depicted in FIG. 22, the plunger hole 236 is shaped to accommodate the spherical valve insert member 244. The spherical valve insert member 244 is configured to operate with the insert spring 245 and the cap 246. The cap 246 is shaped to at least partially cover the spherical valve insert member 244 and the insert spring 245. The cap 246 is preferably fabricated through stamping. However, the cap 246 may be forged or machined without departing from the scope or spirit of the present invention.

FIG. 23 shows a cross-sectional view of the leakdown plunger 210 depicted in FIG. 22 in a semi-assembled state. In FIG. 23 the valve insert 243 is shown in a semi-assembled state. As depicted in FIG. 23, a cross-sectional view of a cap spring 247 is shown around the cap 246. Those skilled in the art will appreciate that the cap spring 247 and the cap 246 are configured to be inserted into the well of another body. According to one aspect of the present invention, the cap spring 247 and the cap 246 are configured to be inserted into the well of a lash adjuster, such as the lash adjuster disclosed in Applicant's "Lash Adjuster Body," application Ser. No. 10/316,264 filed on Oct. 18, 2002 now U.S. Pat. No. 7,191,745. In the preferred embodiment, the cap spring 247 and cap 246 are configured to be inserted into the lash adjuster well 150 of the lash adjuster 110. In an alternative embodiment, the cap spring 247 and the cap 246 are configured to be inserted into the well of a valve lifter, such as the valve lifter disclosed in Applicant's "Valve Lifter Body," application Ser. No. 10/316,263, filed on Oct. 18, 2002 now U.S. Pat. No. 7,128,034.

The cap 246 is configured to at least partially depress the insert spring 245. The insert spring 245 exerts a force on the spherical valve insert member 244. In FIG. 23, the annular plunger surface 235 is shown with the spherical valve insert member 244 partially located within the plunger hole 236.

Figure 31:
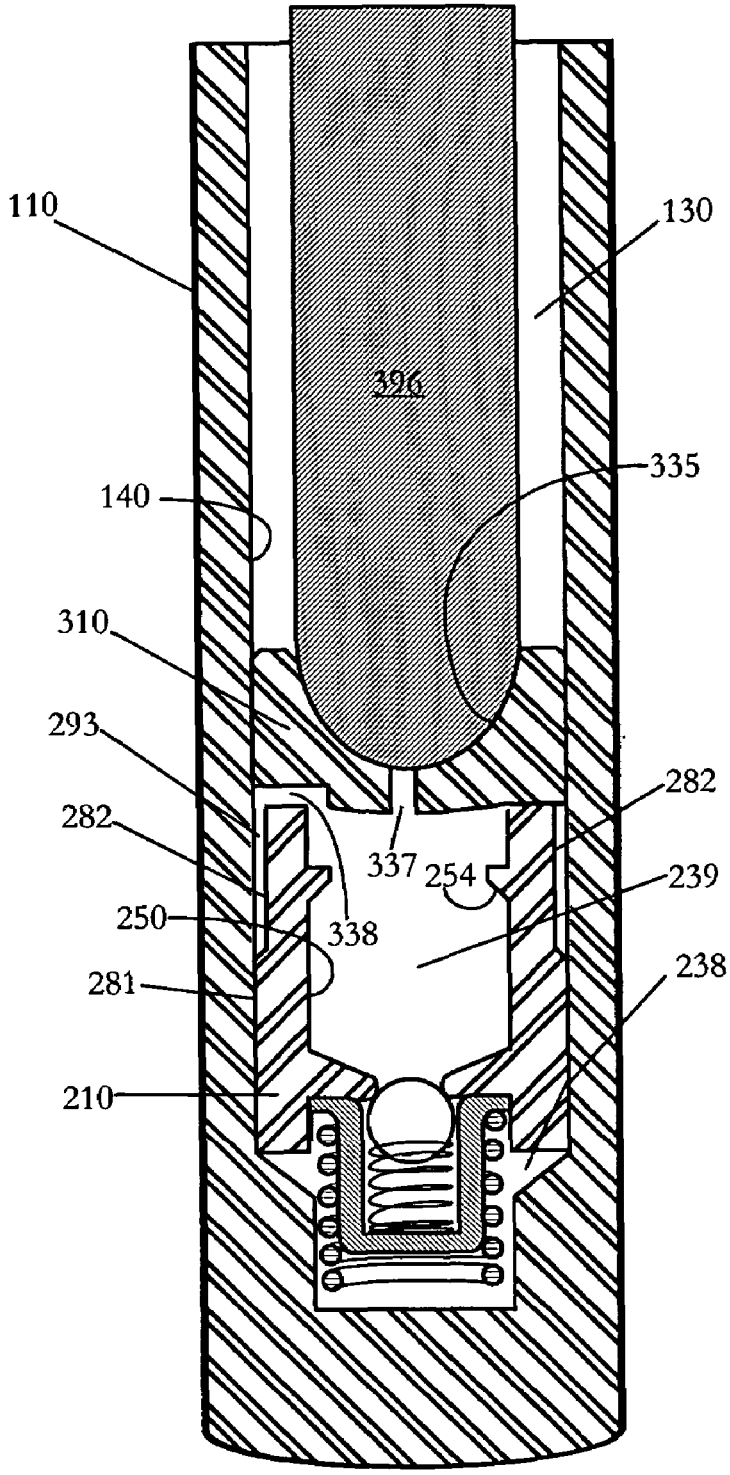
FIG. 31 depicts a sixth embodiment of a leakdown plunger.

Referring now to FIG. 22, leakdown plunger 210 is provided with an outer plunger surface 280 that includes an axis 211. The outer plunger surface 280 is preferably shaped so that the leakdown plunger 210 can be inserted into a lash adjuster body, such as that disclosed in the inventors' patent application entitled "Lash Adjuster Body," application Ser. No. 10/316,263 filed on Oct. 18, 2002 now U.S. Pat. No. 7,128,034. In the preferred embodiment, the outer plunger surface 280 is shaped so that the leakdown plunger 210 can be inserted into the lash adjuster body 110. Depicted in FIG. 31 is a lash adjuster body 110 having an inner lash adjuster surface 140 defining a lash adjuster cavity 130. An embodiment of the leakdown plunger 210 is depicted in FIG. 31 within the lash adjuster cavity 130 of the lash adjuster body 110. As shown in FIG. 31, the leakdown plunger 210 is preferably provided with an outer plunger surface 280 that is cylindrically shaped.

Figure 24:
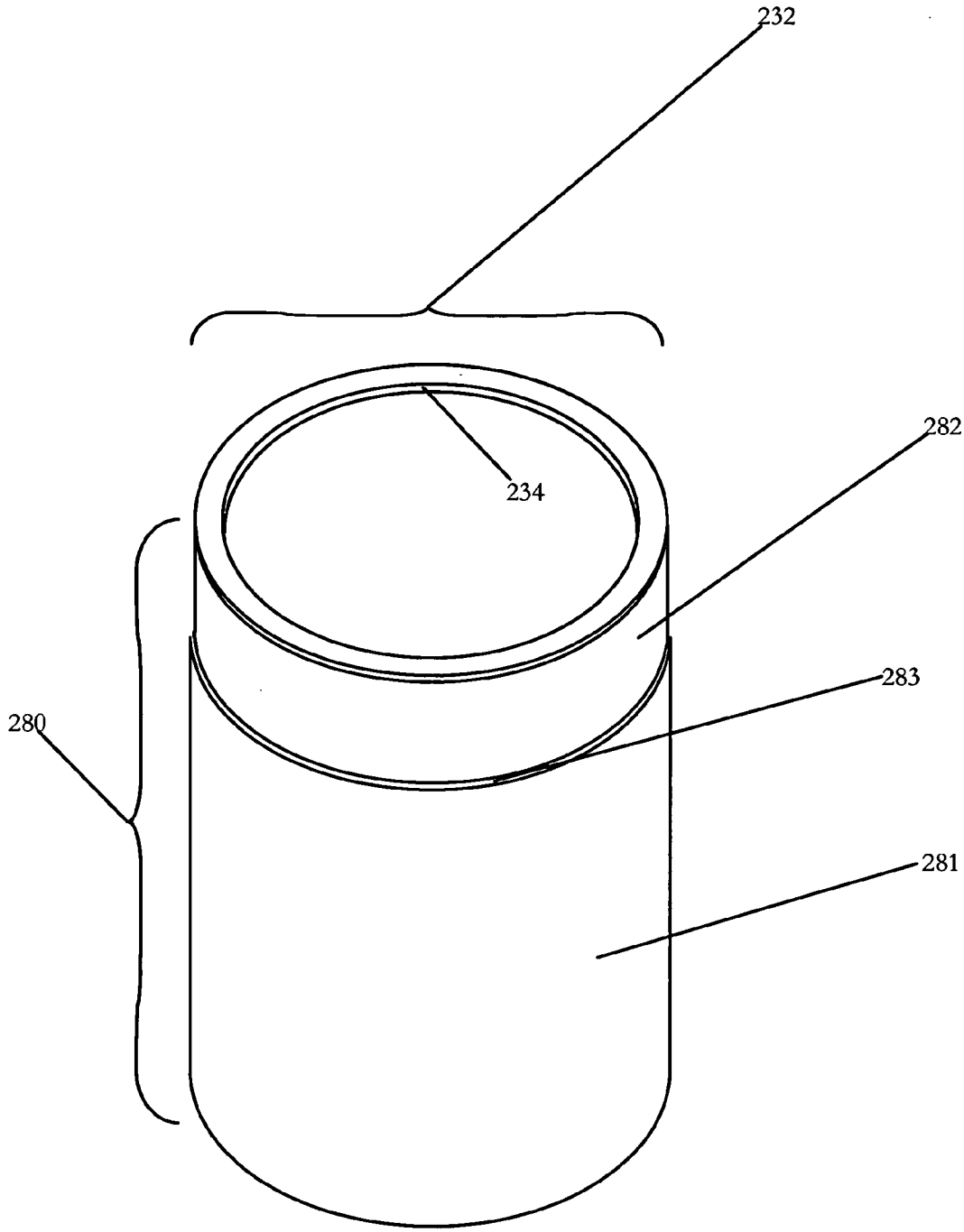
FIG. 24 depicts a perspective view of another preferred embodiment of a leakdown plunger.

FIG. 24 depicts a leakdown plunger 210 of an alternative embodiment. FIG. 24 depicts the second plunger opening 232 in greater detail. The second plunger opening 232 is shown with a chamfered plunger surface 234. However, those with skill in the art will appreciate that the second plunger opening 232 may be fabricated without the chamfered plunger surface 234.

In FIG. 24 the leakdown plunger 210 is provided with a plurality of outer surfaces. As shown therein, the embodiment is provided with an outer plunger surface 280. The outer plunger surface 280 includes a plurality of surfaces. FIG. 24 depicts a cylindrical plunger surface 281, an undercut plunger surface 282, and a conical plunger surface 283. As depicted in FIG. 24, the undercut plunger surface 282 extends from one end of the leakdown plunger 210 and is cylindrically shaped. The diameter of the undercut plunger surface 282 is smaller than the diameter of the cylindrical plunger surface 281.

The undercut plunger surface 282 is preferably forged through use of an extruding die. Alternatively, the undercut plunger surface 282 is fabricated through machining. Machining the undercut plunger surface 282 is accomplished through use of an infeed centerless grinding machine, such as a Cincinnati grinder. The surface is first heat-treated and then the undercut plunger surface 282 is ground via a grinding wheel. Those skilled in the art will appreciate that additional surfaces can be ground into the outer plunger surface 280 with minor alterations to the grinding wheel.

Referring again to FIG. 24, the conical plunger surface 283 is located between the cylindrical plunger surface 281 and the undercut plunger surface 282. Those with skill in the art will appreciate that the outer plunger surface 280 can be fabricated without the conical plunger surface 283 so that the cylindrical plunger surface 281 and the undercut plunger surface 282 abut one another.

Figure 26:
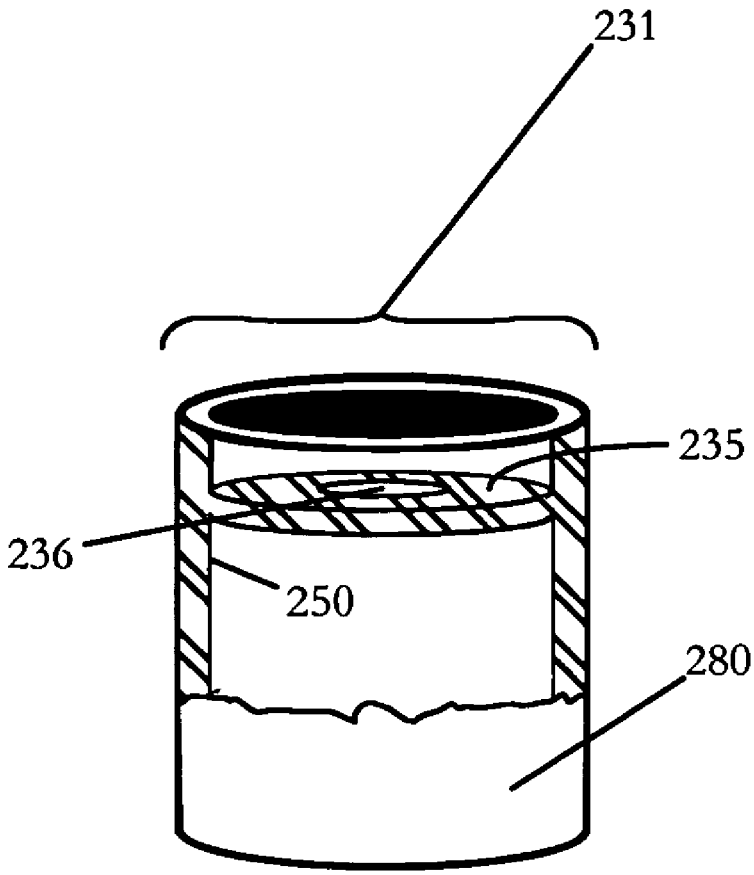
FIG. 26 depicts a third embodiment of a leakdown plunger.

FIG. 26 depicts an embodiment of the leakdown plunger 210 with a section of the outer plunger surface 280 broken away. The embodiment depicted in FIG. 26 is provided with a first plunger opening 231. As shown in FIG. 26, the outer plunger surface 280 encloses an inner plunger surface 250. The inner plunger surface 250 includes a first annular plunger surface 235 that defines a first plunger hole 236 and a second annular plunger surface 237 that defines a second plunger hole 249.

Figure 27:
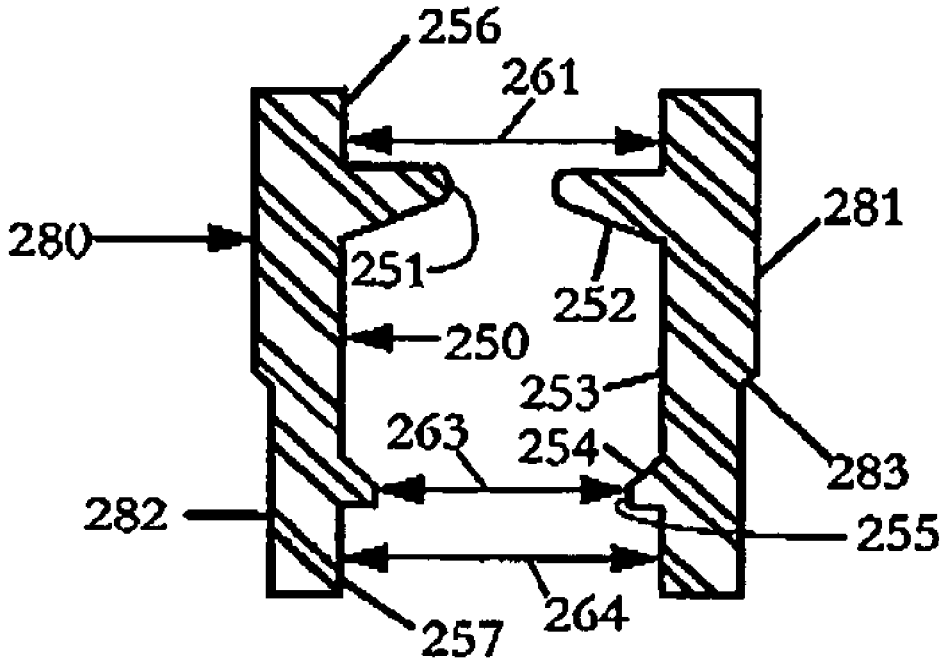
FIG. 27 depicts a fourth embodiment of a leakdown plunger.

FIG. 27 depicts a cross-sectional view of a leakdown plunger of an alternative embodiment. The leakdown plunger 210 shown in FIG. 27 is provided with an outer plunger surface 280 that includes a plurality of cylindrical and conical surfaces. In the embodiment depicted in FIG. 27, the outer plunger surface 280 includes an outer cylindrical plunger surface 281, an undercut plunger surface 282, and an outer conical plunger surface 283. As depicted in FIG. 27, the undercut plunger surface 282 extends from one end of the leakdown plunger 210 and is cylindrically shaped. The diameter of the undercut plunger surface 282 is smaller than, and preferably concentric relative to, the diameter of the outer cylindrical plunger surface 281. The outer conical plunger surface 283 is located between the outer cylindrical plunger surface 281 and the undercut plunger surface 282. Those with skill in the art will appreciate that the outer plunger surface 280 can be fabricated without the conical plunger surface 283 so that the outer cylindrical plunger surface 281 and the undercut plunger surface 282 abut one another.

Figure 28:
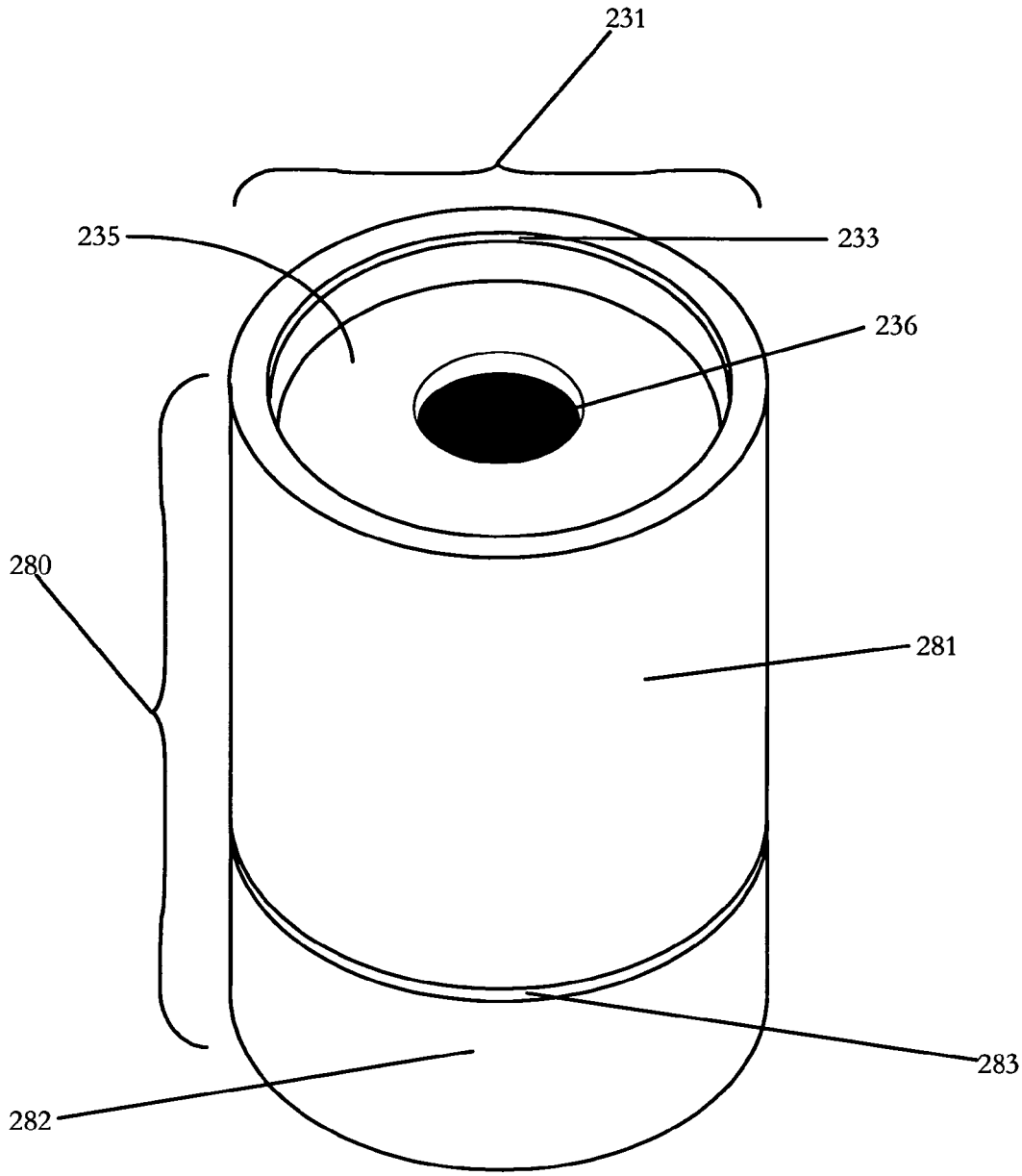
FIG. 28 depicts a fifth embodiment of a leakdown plunger.

FIG. 28 depicts in greater detail the first plunger opening 231 of the embodiment depicted in FIG. 27. The first plunger opening 231 is configured to accommodate an insert and is preferably provided with a first chamfered plunger surface 233. Those skilled in the art, however, will appreciate that the first chamfered plunger surface 233 is not necessary. As further shown in FIG. 28, the first plunger opening 231 is provided with a first annular plunger surface 235 defining a plunger hole 236.

The embodiment depicted in FIG. 28 is provided with an outer plunger surface 280 that includes a plurality of surfaces. The outer plunger surface 280 includes a cylindrical plunger surface 281, an undercut plunger surface 282, and a conical plunger surface 283. As depicted in FIG. 28, the undercut plunger surface 282 extends from one end of the leakdown plunger 210 and is cylindrically shaped. The diameter of the undercut plunger surface 282 is smaller than the diameter of the cylindrical plunger surface 281. The conical plunger surface 283 is located between the cylindrical plunger surface 281 and the undercut plunger surface 282. However, those with skill in the art will appreciate that the outer plunger surface 280 can be fabricated without the conical plunger surface 283 so that the cylindrical plunger surface 281 and the undercut plunger surface 282 abut one another. Alternatively, the cylindrical plunger surface 281 may abut the undercut plunger surface 282 so that the conical plunger surface 283 is an annular surface.

Figure 29:
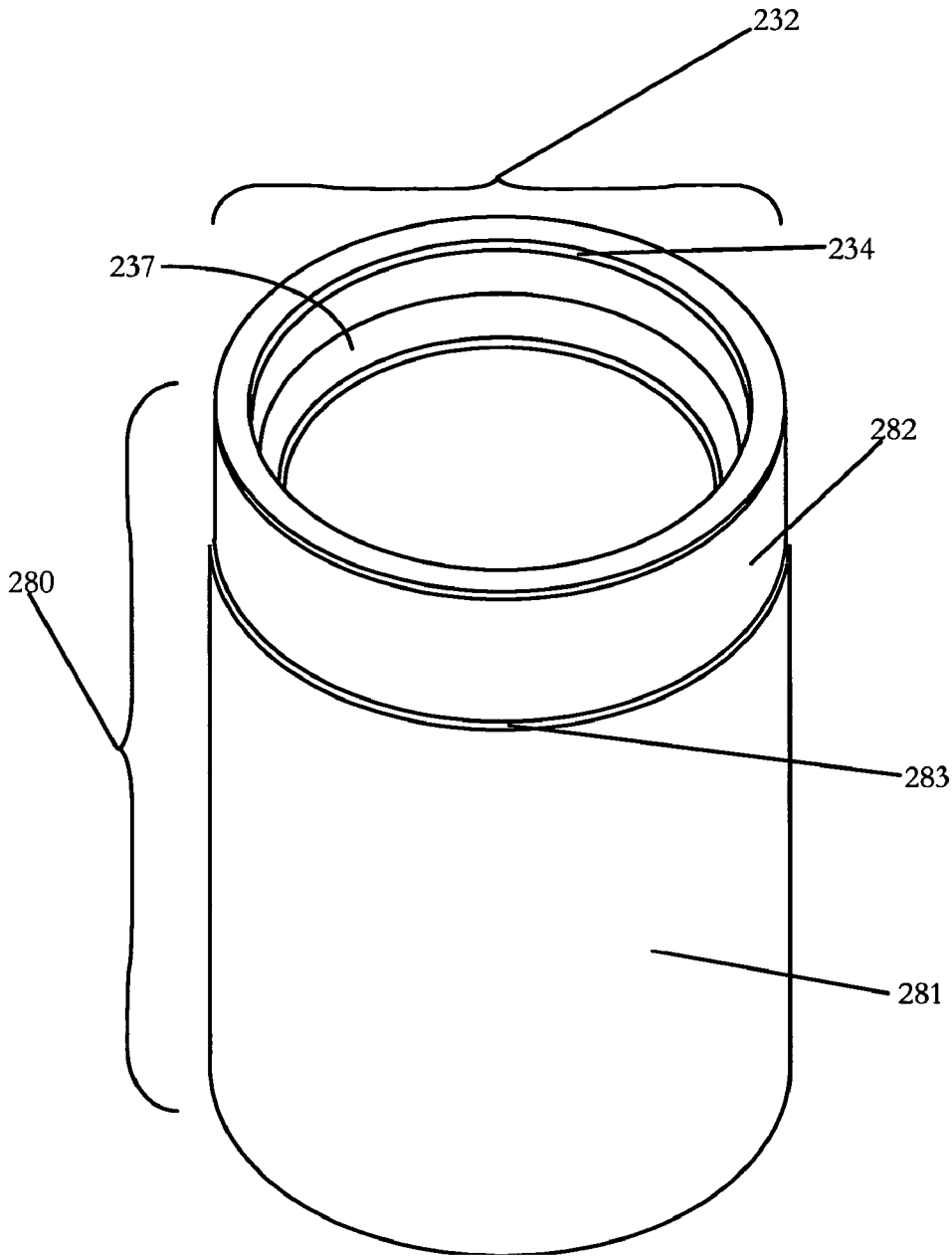
FIG. 29 depicts a perspective view of another preferred embodiment of a leakdown plunger.

FIG. 29 depicts the second plunger opening 232 of the embodiment depicted in FIG. 27. The second plunger opening 232 is shown with a second chamfered plunger surface 234. However, those with skill in the art will appreciate that the second plunger opening 232 may be fabricated without the second chamfered plunger surface 234. The second plunger opening 232 is provided with a second annular plunger surface 237.

Figure 30:
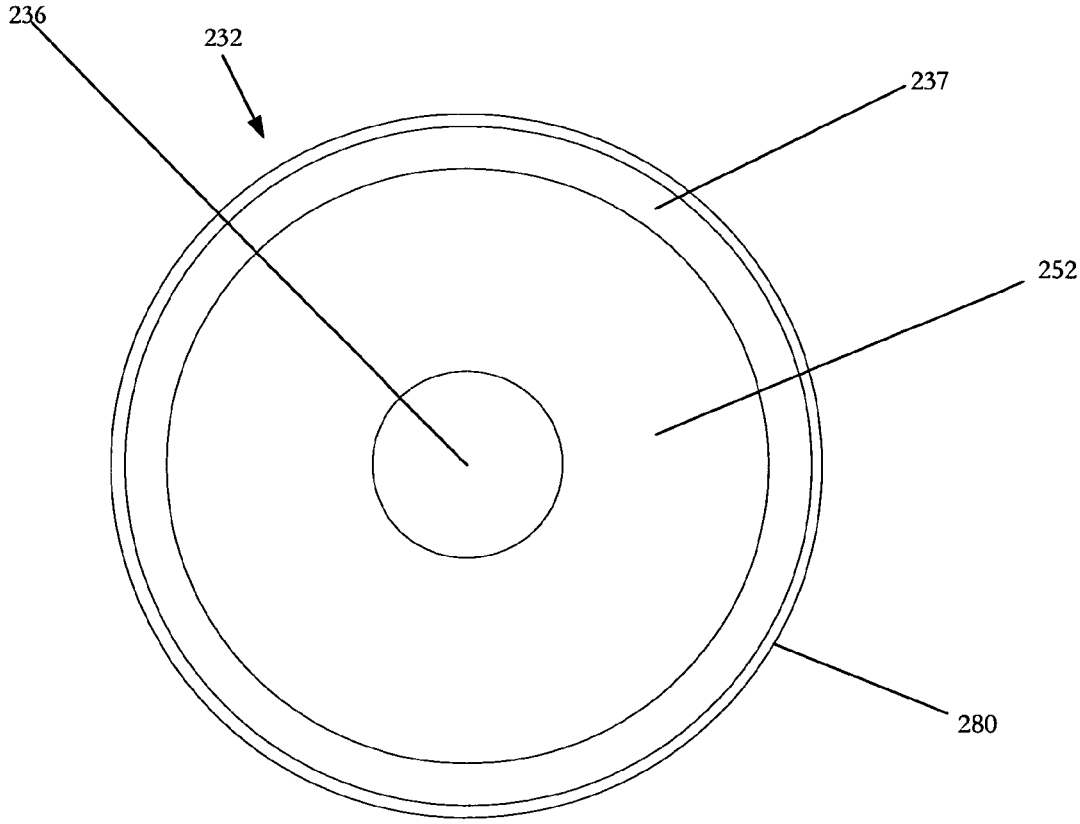
FIG. 30 depicts the top view of another preferred embodiment of a leakdown plunger.

FIG. 30 depicts a top view of the second plunger opening 232 of the embodiment depicted in FIG. 27. In FIG. 30, the second annular plunger surface 237 is shown in relation to the first inner conical plunger surface 252 and the plunger hole 236. As shown in FIG. 30, the plunger hole 236 is concentric relative to the outer plunger surface 280 and the annulus formed by the second annular plunger surface 237.

Figure 25:
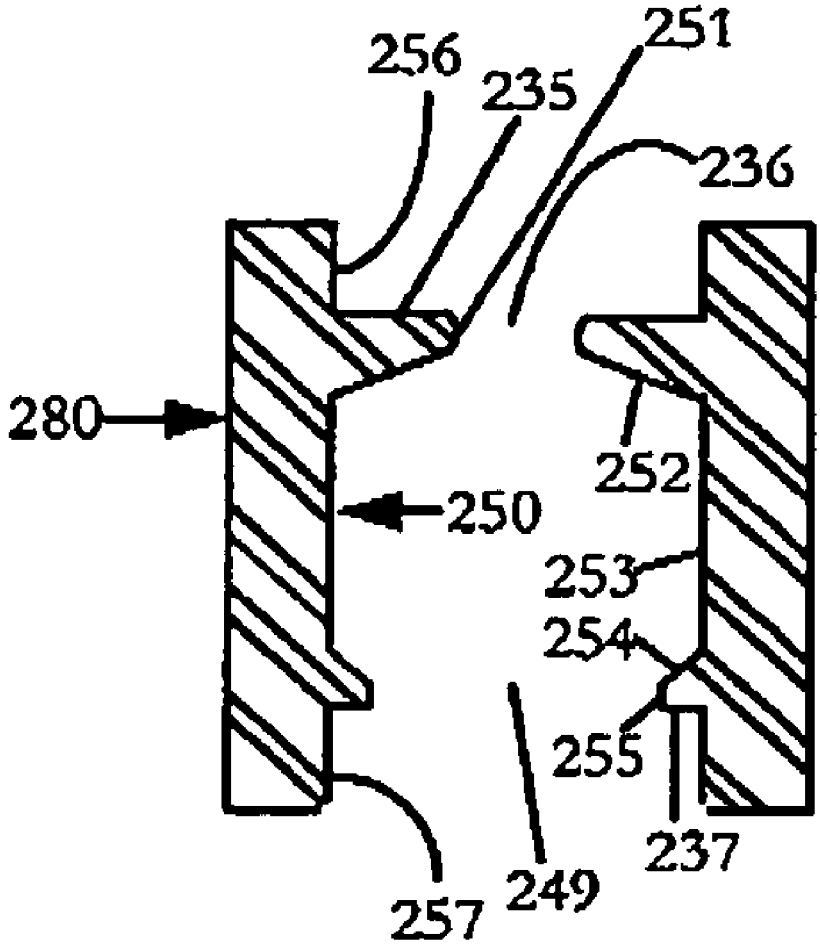
FIG. 25 depicts a second embodiment of a leakdown plunger.

Referring now to FIG. 25, the outer plunger surface 280 encloses an inner plunger surface 250. The inner plunger surface 250 includes a plurality of surfaces. In the alternative embodiment depicted in FIG. 25, the inner plunger surface 250 includes a first inner cylindrical surface 256. The first inner cylindrical surface 256 is located adjacent to the first annular plunger surface 235. The first annular plunger surface 235 is located adjacent to a rounded plunger surface 251 that defines a plunger hole 236. Those skilled in the art will appreciate that the rounded plunger surface 251 need not be rounded, but may be flat. The rounded plunger surface 251 is located adjacent to a first inner conical plunger surface 252, which is located adjacent to a second inner cylindrical plunger surface 253. The second inner cylindrical surface 253 is located adjacent to a second inner conical plunger surface 254, which is located adjacent to a third inner cylindrical plunger surface 255. The third inner cylindrical plunger surface 255 is located adjacent to the second annular plunger surface 237, which is located adjacent to the fourth inner cylindrical plunger surface 257. The inner plunger surface 250 includes a plurality of diameters. As shown in FIG. 27, the first inner cylindrical plunger surface 256 is provided with a first inner diameter 261, the third inner cylindrical plunger surface 255 is provided with a third inner diameter 263, and the fourth cylindrical plunger surface 257 is provided with a fourth inner diameter 264. In the embodiment depicted, the third inner diameter 263 is smaller than the fourth inner diameter 264.

FIG. 31 depicts an embodiment of the leakdown plunger 210 within another body cooperating with a plurality of inserts. The undercut plunger surface 282 preferably cooperates with another body, such as a lash adjuster body or a valve lifter, to form a leakdown path 293. FIG. 31 depicts an embodiment of the leakdown plunger 210 within a lash adjuster body 110; however, those skilled in the art will appreciate that the present invention may be inserted within other bodies, such as roller followers, and valve lifters.

As shown in FIG. 31, in the preferred embodiment, the undercut plunger surface 282 is configured to cooperate with the inner lash adjuster surface 140 of a lash adjuster body 110. The undercut plunger surface 282 and the inner lash adjuster surface 140 of the lash adjuster body 110 cooperate to define a leakdown path 293 for a liquid such as a lubricant.

The embodiment depicted in FIG. 31 is further provided with a cylindrical plunger surface 281. The cylindrical plunger surface 281 cooperates with the inner lash adjuster surface 140 of the lash adjuster body 110 to provide a first chamber 238. Those skilled in the art will appreciate that the first chamber 238 functions as a high pressure chamber for a liquid, such as a lubricant.

The second plunger opening 232 is configured to cooperate with a socket, such as that disclosed in Applicants' "Metering Socket," application Ser. No. 10/316,262, filed on Oct. 28, 2002 now U.S. Pat. No. 7,028,654. In the preferred embodiment, the second plunger opening 232 is configured to cooperate with the socket 310. The socket 310 is configured to cooperate with a push rod 396. As shown in FIG. 31, the socket 310 is provided with a push rod cooperating surface 335. The push rod cooperating surface 335 is configured to function with a push rod 396. Those skilled in the art will appreciate that the push rod 396 cooperates with the rocker arm (not shown) of an internal combustion engine (not shown).

The socket 310 cooperates with the leakdown plunger 210 to define at least in part a second chamber 239 within the inner plunger surface 250. Those skilled in the art will appreciate that the second chamber 239 may advantageously function as a reservoir for a lubricant. The inner plunger surface 250 of the leakdown plunger 210 functions to increase the quantity of retained fluid in the second chamber 239 through the damming action of the second inner conical plunger surface 254.

The socket 310 is provided with a plurality of passages that function to fluidly communicate with the lash adjuster cavity 130 of the lash adjuster body 110. In the embodiment depicted in FIG. 31, the socket 310 is provided with a socket passage 337 and a plunger reservoir passage 338. The plunger reservoir passage 338 functions to fluidly connect the second chamber 239 with the lash adjuster cavity 130 of the lash adjuster body 110. As shown in FIG. 31, the socket passage 337 functions to fluidly connect the socket 310 and the lash adjuster cavity 130 of the lash adjuster body 110.

FIGS. 32 to 36 illustrate the presently preferred method of fabricating a leakdown plunger. FIGS. 32 to 36 depict what is known in the art as "slug progressions" that show the fabrication of the leakdown plunger 210 of the present invention from a rod or wire to a finished or near-finished body. In the slug progressions shown herein, pins are shown on the punch side; however, those skilled in the art will appreciate that the pins can be switched to the die side without departing from the scope of the present invention.

The leakdown plunger 210 of the preferred embodiment is forged with use of a National® 750 parts former machine. However, those skilled in the art will appreciate that other part formers, such as, for example, a Waterbury machine can be used. Those skilled in the art will further appreciate that other forging methods can be used as well.

Figure 32:
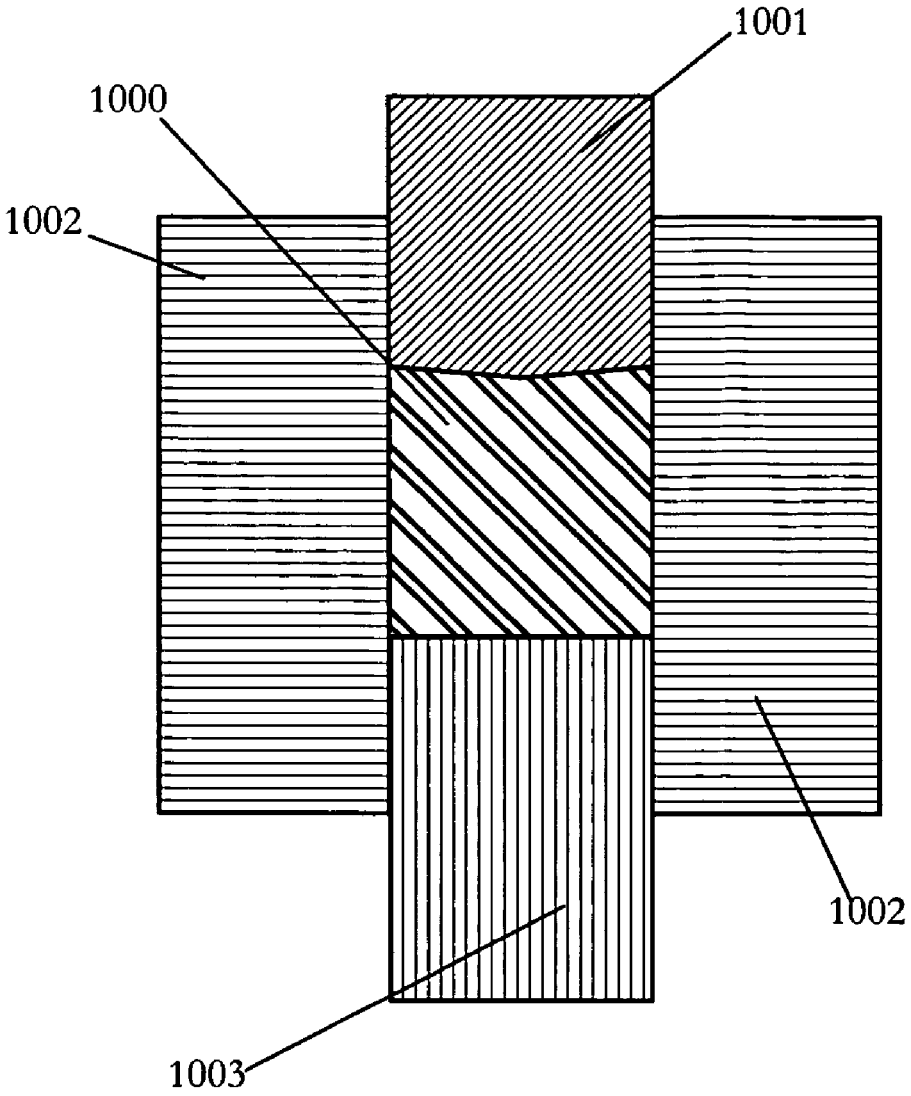
FIGS. 32-36 depict a preferred method of fabricating a leakdown plunger.

The process of forging the leakdown plunger 210 an embodiment of the present invention begins with a metal wire or metal rod 1000 which is drawn to size. The ends of the wire or rod are squared off. As shown in FIG. 32, this is accomplished through the use of a first punch 1001, a first die 1002, and a first knock out pin 1003.

Figure 33:
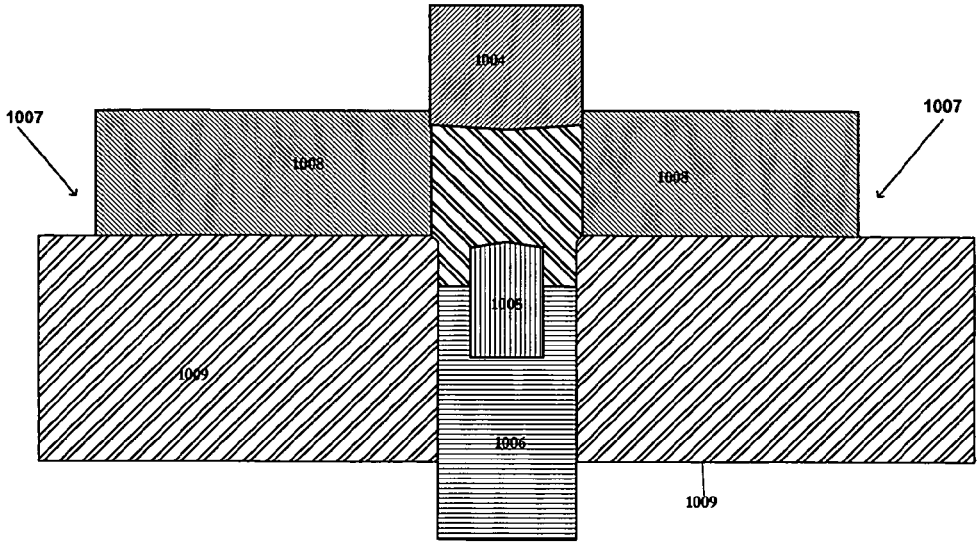

After being drawn to size, the wire or rod 1000 is run through a series of dies or extrusions. As depicted in FIG. 33, the fabrication of the second plunger opening 232 and the outer plunger surface 280 is preferably commenced through use of a second punch 1004, a second knock out pin 1005, a first sleeve 1006, and a second die 1007. The second plunger opening 232 is fabricated through use of the second knock out pin 1005 and the first sleeve 1006. The second die 1007 is used to fabricate the outer plunger surface 280. As shown in FIG. 33, the second die 1007 is composed of a second die top 1008 and a second die rear 1009. In the preferred forging process, the second die rear 1009 is used to form the undercut plunger surface 282 and the conical plunger surface 283.

Figure 34:
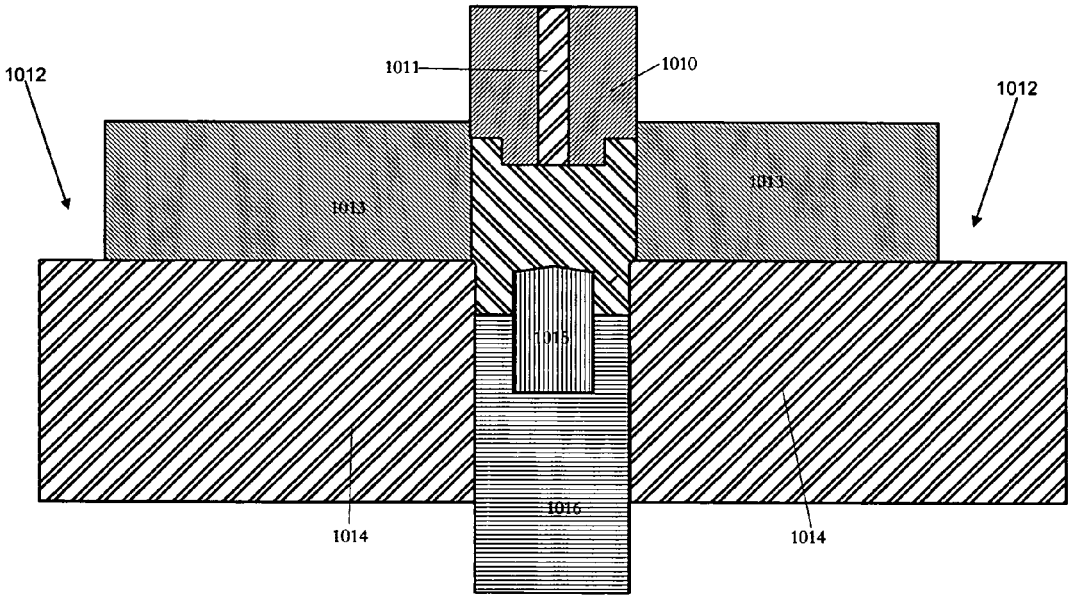

As depicted in FIG. 34, the first plunger opening 231 is fabricated through use of a third punch 1010. Within the third punch 1010 is a first pin 1011. The third punch 1010 and the first pin 1011 are used to fabricate at least a portion of the annular plunger surface 235. As shown in FIG. 34, it is desirable to preserve the integrity of the outer plunger surface 280 through use of a third die 1012. The third die 1012 is composed of a third die top 1013 and a third die rear 1014. Those skilled in the art will appreciate the desirability of using a third knock out pin 1015 and a second sleeve 1016 to preserve the forging of the second opening.

Figure 35:
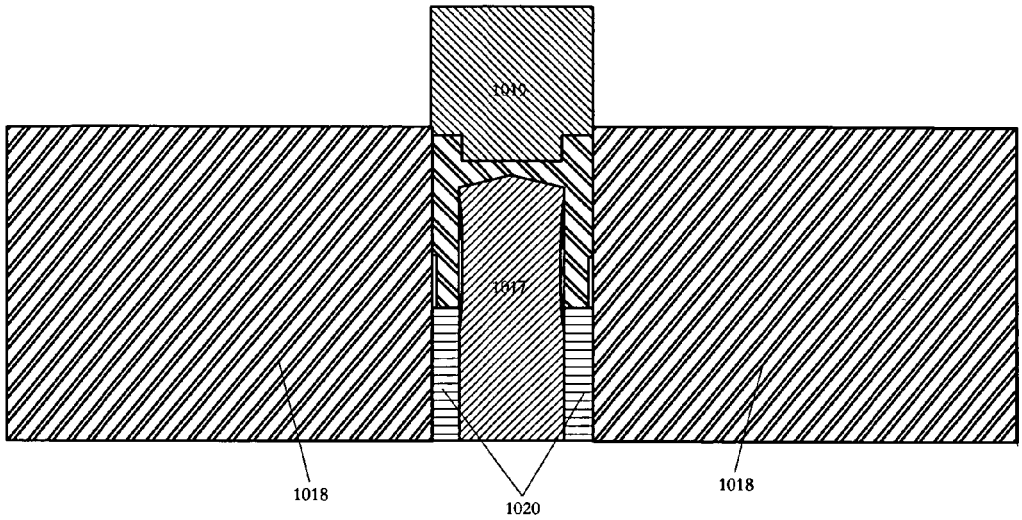

FIG. 35 depicts the forging of the inner plunger surface 250. As depicted, the inner plunger surface 250 is forged through use of a punch extrusion pin 1017. Those skilled in the art will appreciate that it is advantageous to preserve the integrity of the first plunger opening 231 and the outer plunger surface 280. This function is accomplished through use of a fourth die 1018 and a fourth knock out pin 1019. A punch stripper sleeve 1020 is used to remove the punch extrusion pin 1017 from the inner plunger surface 250.

Figure 36:
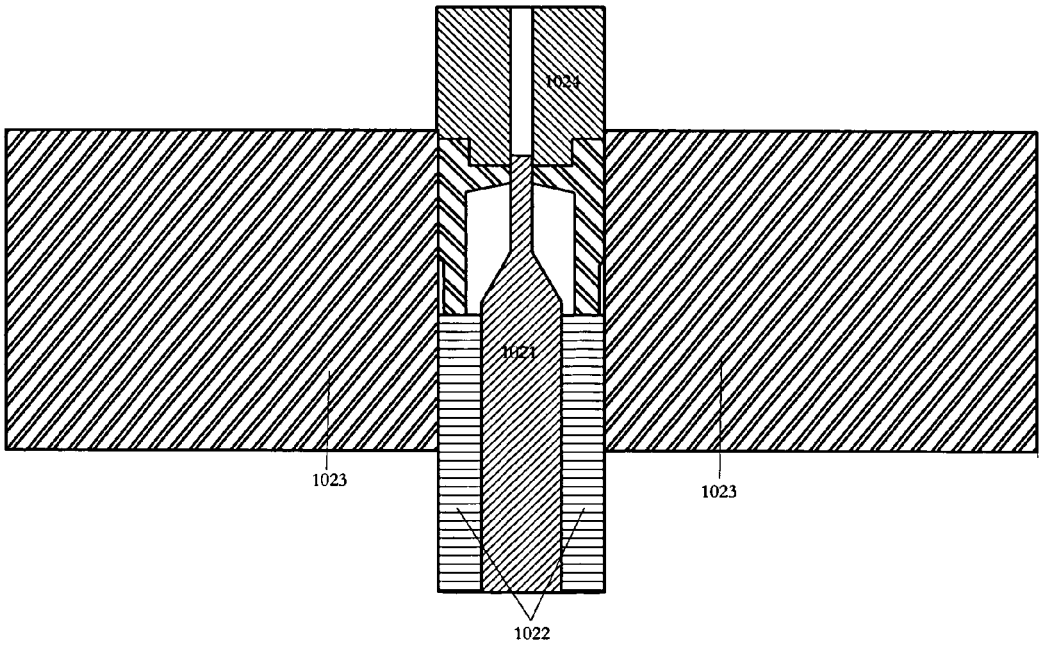

As shown in FIG. 36, the plunger hole 236 is fabricated through use of a piercing punch 1021 and a stripper sleeve 1022. To assure that other forging operations are not affected during the fabrication of the plunger hole 236, a fifth die 1023 is used around the outer plunger surface 280 and a tool insert 1024 is used at the first plunger opening 231.

Figure 37:
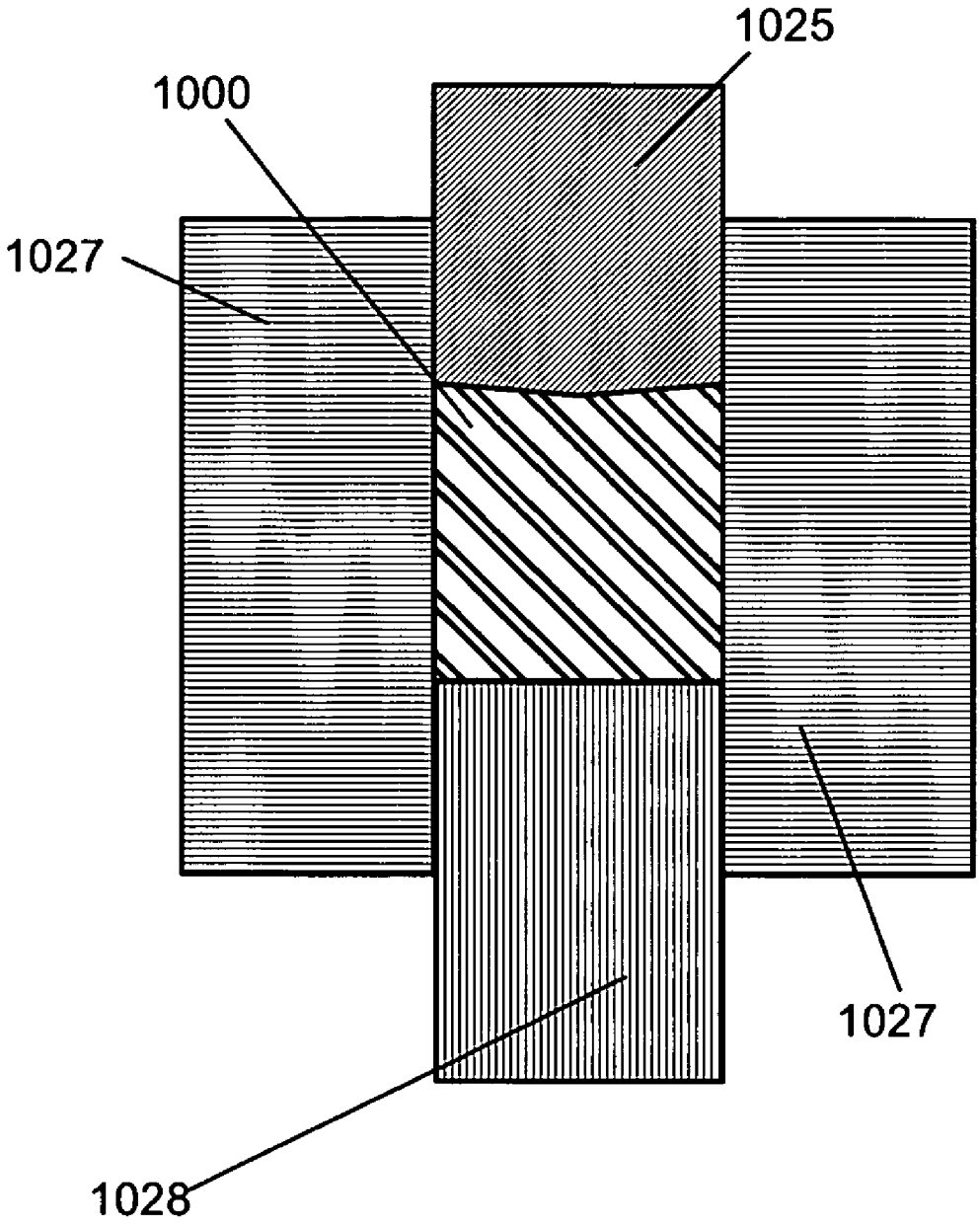
FIGS. 37-41 depict an alternative method of fabricating a leakdown plunger.

FIGS. 37 to 41 illustrate an alternative method of fabricating a leakdown plunger. FIG. 37 depicts a metal wire or metal rod 1000 drawn to size. The ends of the wire or rod 1000 are squared off through the use of a first punch 1025, a first die 1027, and a first knock out pin 1028.

Figure 38:
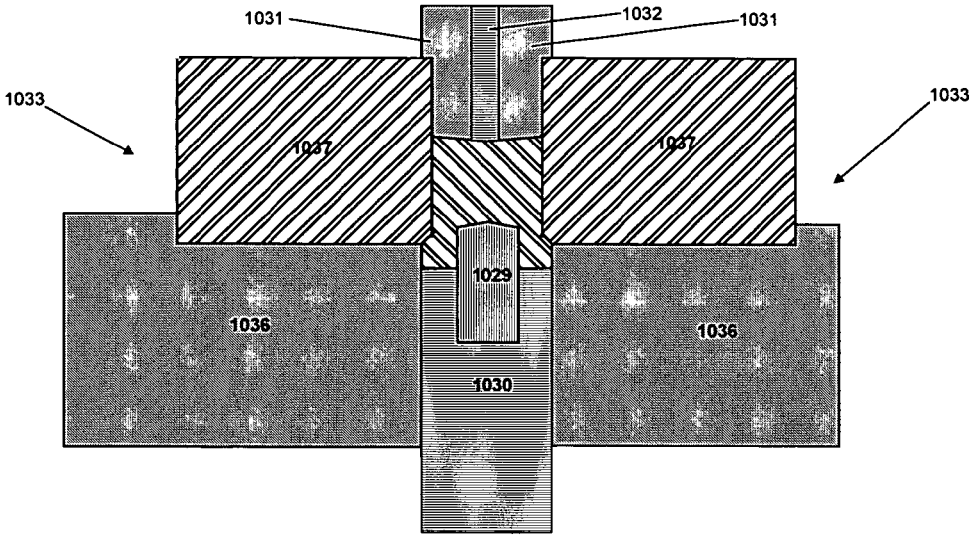

As depicted in FIG. 38, the fabrication of the first plunger opening 231, the second plunger opening 232, and the outer plunger surface 280 is preferably commenced through use of a punch pin 1029, a first punch stripper sleeve 1030, second knock out pin 1031, a stripper pin 1032, and a second die 1033. The first plunger opening 231 is fabricated through use of the second knock out pin 1031. The stripper pin 1032 is used to remove the second knock out pin 1031 from the first plunger opening 231.

The second plunger opening 232 is fabricated, at least in part, through the use of the punch pin 1029. A first punch stripper sleeve 1034 is used to remove the punch pin 1029 from the second plunger opening 232. The outer plunger surface 280 is fabricated, at least in part, through the use of a second die 1033. The second die 1033 is composed of a second die top 1036 and a second die rear 1037.

Figure 39:
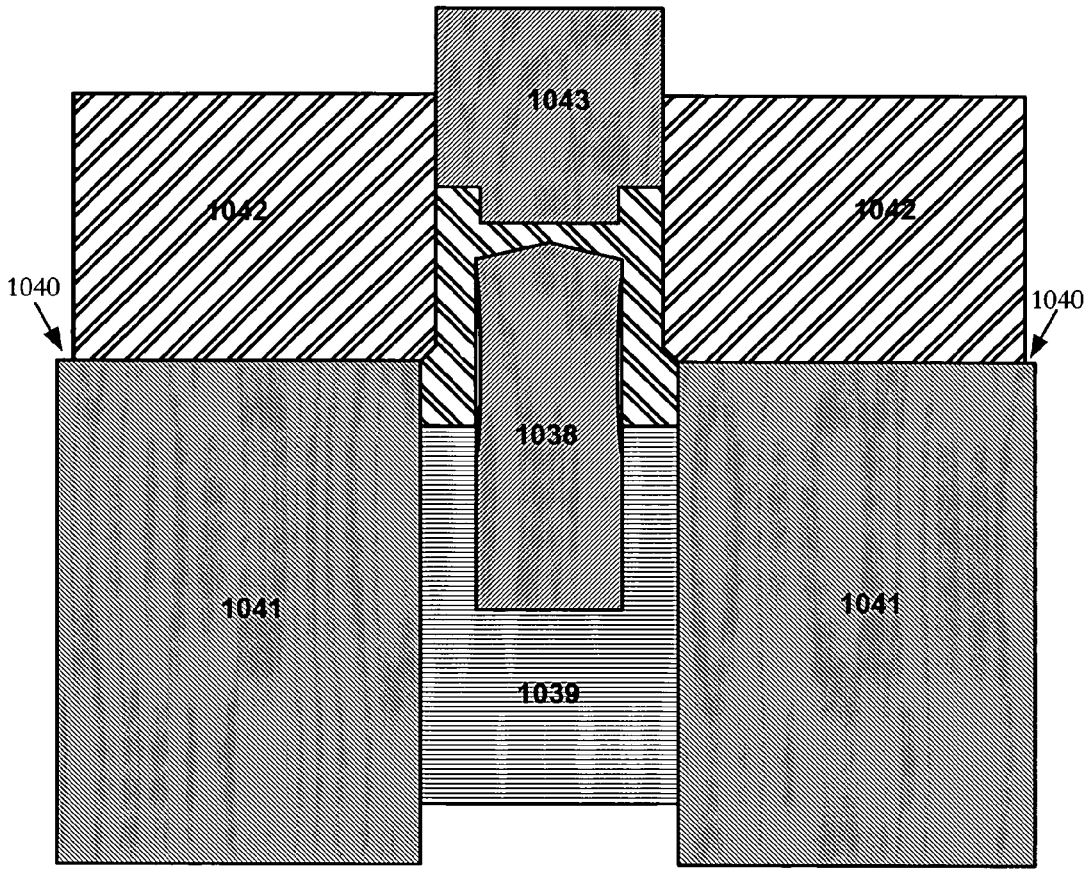

FIG. 39 depicts the forging of the inner plunger surface 250. As depicted, the inner plunger surface 250 is forged through the use of an extrusion punch 1038. A second punch stripper sleeve 1039 is used to remove the extrusion punch 1038 from the inner plunger surface 250.

Those skilled in the art will appreciate that it is advantageous to preserve the previous forging of the first plunger opening 231 and the outer plunger surface 280. A third knock out pin 1043 is used to preserve the previous forging operations on the first plunger opening 231. A third die 1040 is used to preserve the previous forging operations on the outer plunger surface 280. As depicted in FIG. 39, the third die 1040 is composed of a third die top 1041 and a third die rear 1042.

Figure 40:
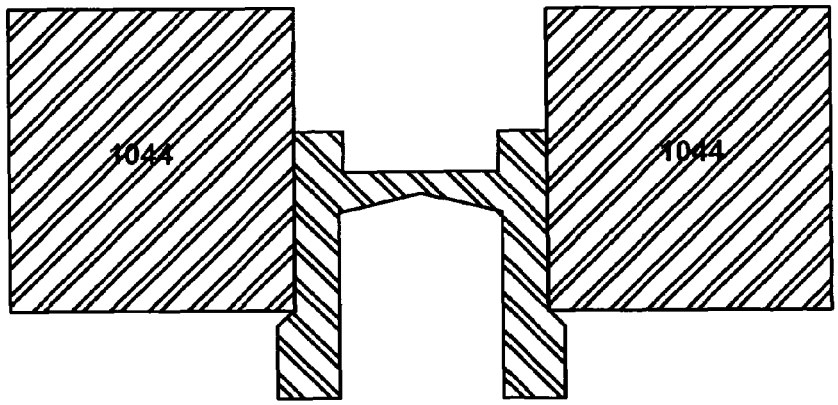

As depicted in FIG. 40, a sizing die 1044 is used in fabricating the second inner conical plunger surface 254 and the second inner cylindrical plunger surface 255. The sizing die 1044 is run along the outer plunger surface 280 from the first plunger opening 231 to the second plunger opening 232. This operation results in metal flowing through to the inner plunger surface 250.

Figure 41:
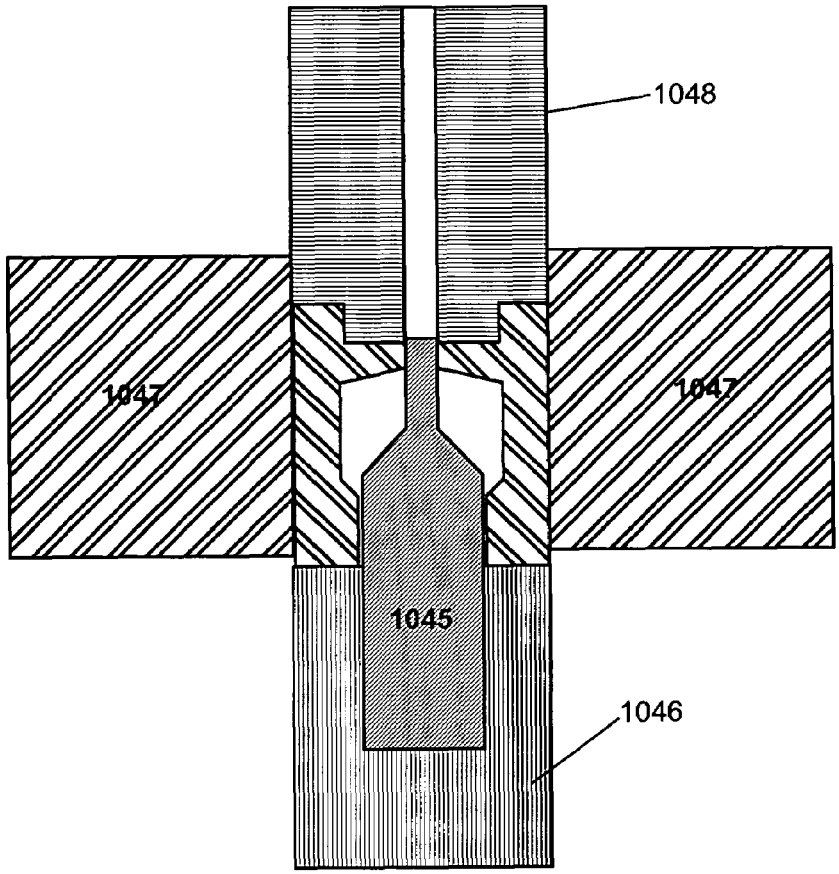

As shown in FIG. 41, the plunger hole 236 is fabricated through use of a piercing punch 1045 and a stripper sleeve 1046. The stripper sleeve 1046 is used in removing the piercing punch 1045 from the plunger hole 236. To assure that other forging operations are not affected during the fabrication of the plunger hole 236, a fourth die 1047 is used around the outer plunger surface 280 and a tool insert 1048 is used at the first plunger opening 231.

Figure 42:
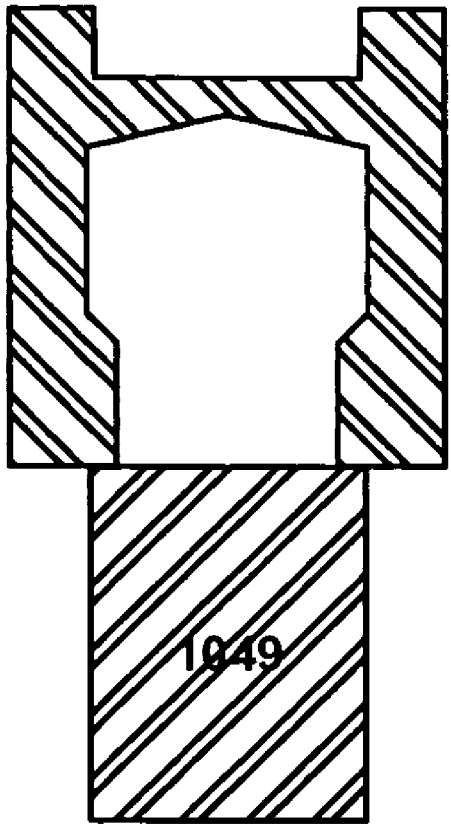
FIG. 42 depicts a step in an alternative method of fabricating a leakdown plunger.

Those skilled in the art will appreciate that further desirable finishing may be accomplished through machining. For example, an undercut plunger surface 282 may be fabricated and the second plunger opening 232 may be enlarged through machining. Alternatively, as depicted in FIG. 42, a shave punch 1049 may be inserted into the second plunger opening 232 and plow back excess material.

Figure 43:
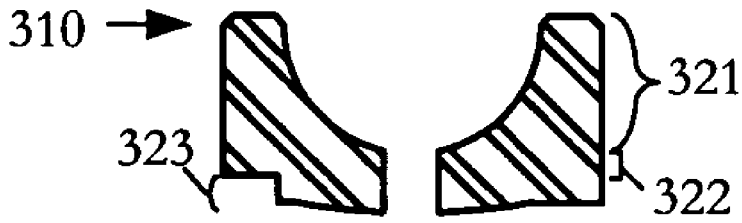
FIG. 43 depicts a preferred embodiment of a socket.
Figure 44:
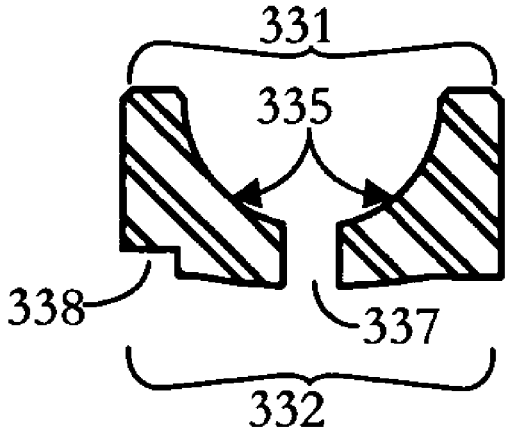
FIG. 44 depicts a preferred embodiment of a socket.
Figure 45:
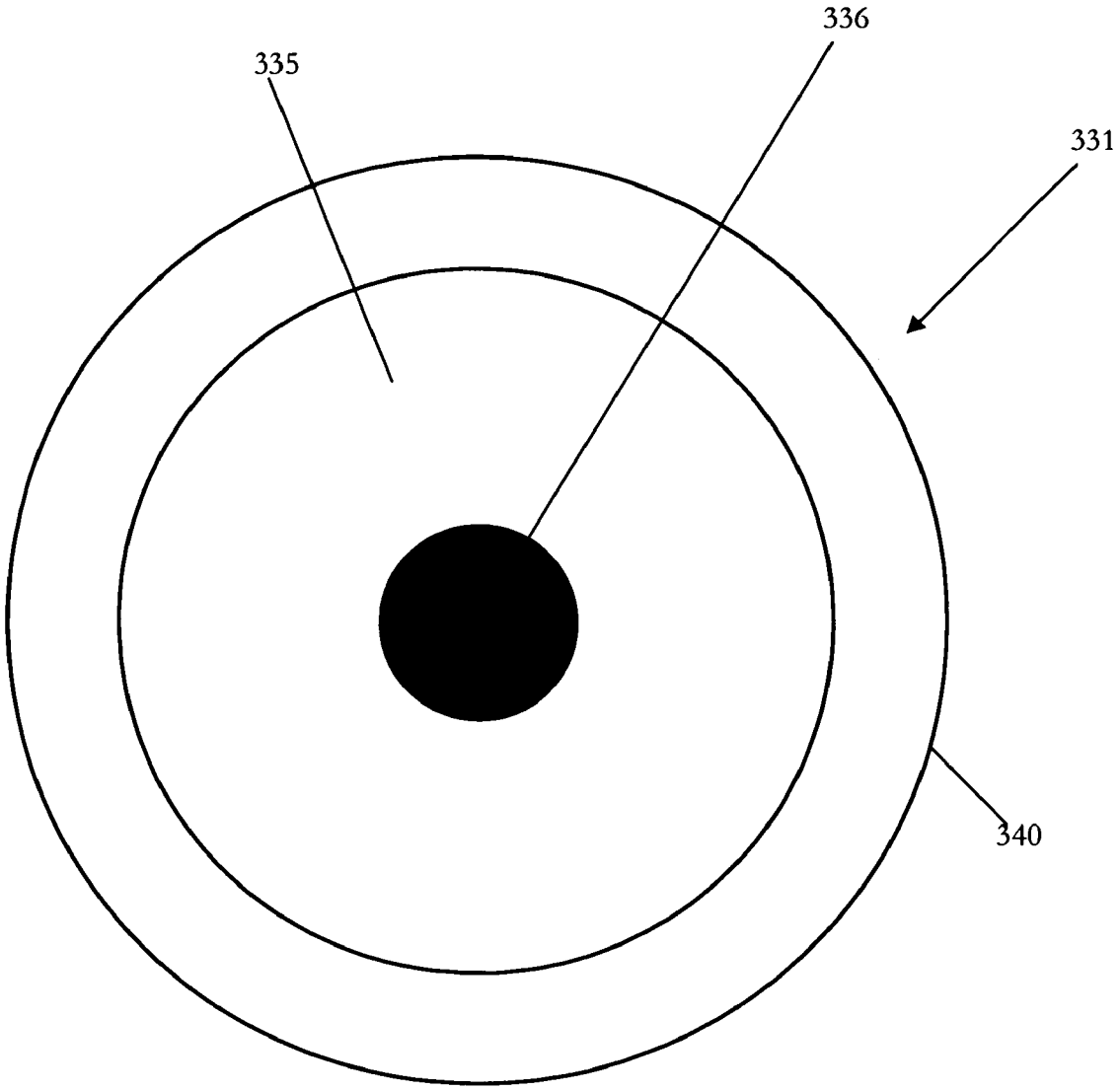
FIG. 45 depicts the top view of a surface of a socket.

FIGS. 43, 44, and 45, show a socket 310 constituting a preferred embodiment. The socket 310 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the socket 310 is composed of pearlitic material. According to still another aspect of the present invention, the socket 310 is composed of austenitic material. According to another aspect of the present invention, the metal is a ferritic material.

The socket 310 is composed of a plurality of socket elements. According to one aspect of the present invention, the socket element is cylindrical in shape. According to another aspect of the present invention, the socket element is conical in shape. According to yet another aspect of the present invention, the socket element is solid. According to still another aspect of the present invention, the socket element is hollow.

FIG. 43 depicts a cross-sectional view of the socket 310 composed of a plurality of socket elements. FIG. 43 shows the socket, generally designated 310. The socket 310 functions to accept a liquid, such as a lubricant and is provided with a plurality of surfaces and passages. Referring now to FIG. 45, the first socket surface 331 functions to accommodate an insert, such as, for example, a push rod 396.

The socket 310 of the preferred embodiment is fabricated from a single piece of metal wire or rod and is described herein as a plurality of socket elements. As shown in FIG. 43, the socket 310 includes a first hollow socket element 321, a second hollow socket element 322, and a third hollow socket element 323. As depicted in FIG. 43, the first hollow socket element 321 is located adjacent to the second socket element 322. The second hollow socket element 322 is located adjacent to the third hollow socket element 323.

The first hollow socket element 321 functions to accept an insert, such as a push rod. The third hollow socket element 323 functions to conduct fluid. The second hollow socket element 322 functions to fluidly link the first hollow socket element 321 with the third hollow socket element 323.

Referring now to FIG. 44, the socket 310 is provided with a plurality of outer surfaces and inner surfaces. FIG. 44 depicts a cross sectional view of the socket 310 of the preferred embodiment of the present invention. As shown in FIG. 44, the preferred embodiment of the present invention is provided with a first socket surface 331. The first socket surface 331 is configured to accommodate an insert. The preferred embodiment is also provided with a second socket surface 332. The second socket surface 332 is configured to cooperate with an engine workpiece.

FIG. 45 depicts a top view of the first socket surface 331. As shown in FIG. 45, the first socket surface 331 is provided with a push rod cooperating surface 335 defining a first socket hole 336. Preferably, the push rod cooperating surface 335 is concentric relative to the outer socket surface 340; however, such concentricity is not necessary.

In the embodiment depicted in FIG. 45, the first socket hole 336 fluidly links the first socket surface 331 with a socket passage 337 (shown in FIG. 44). The socket passage 337 is shaped to conduct fluid, preferably a lubricant. In the embodiment depicted in FIG. 44, the socket passage 337 is cylindrically shaped; however, those skilled in the art will appreciate that the socket passage 337 may assume any shape so long as it is able to conduct fluid.

Figure 46:
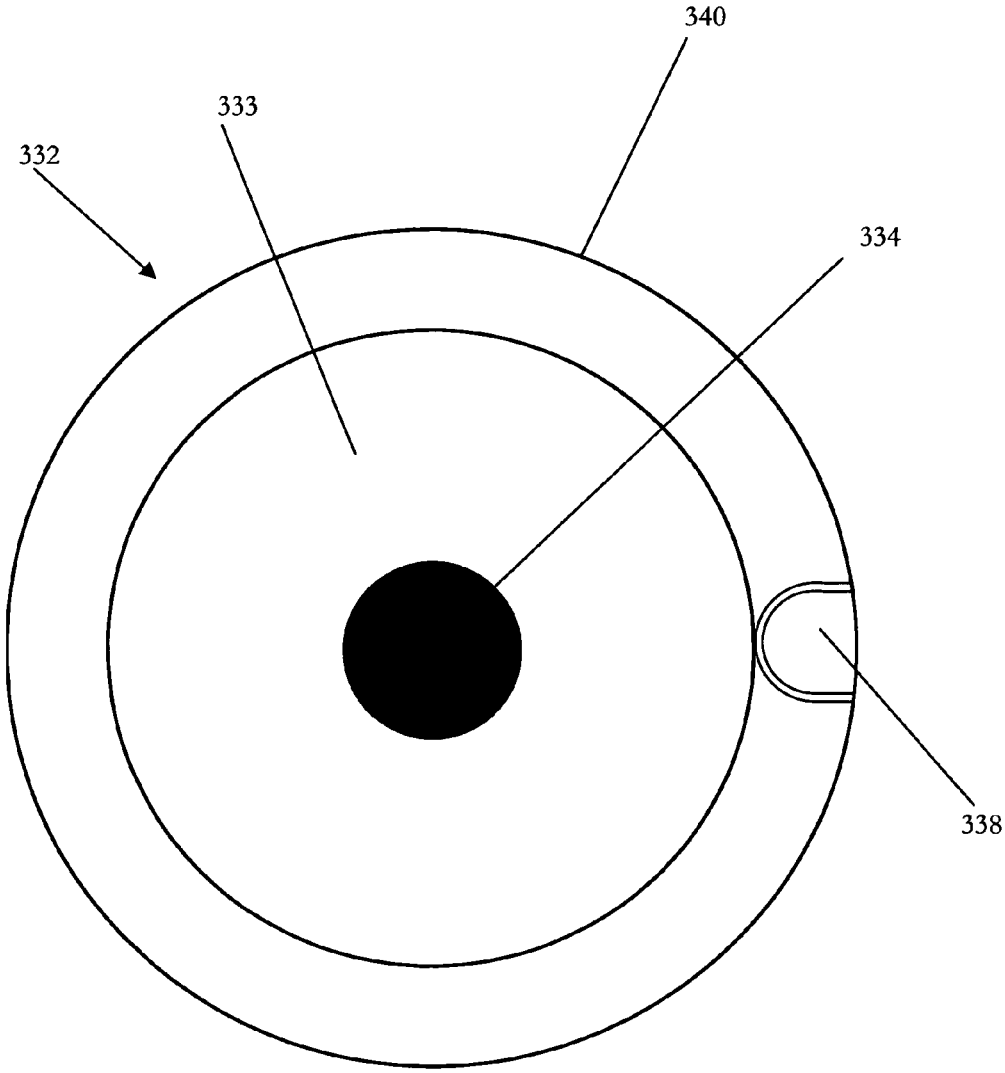
FIG. 46 depicts the top view of another surface of a socket.

FIG. 46 depicts a top view of the second socket surface 332. The second socket surface is provided with a plunger reservoir passage 338. The plunger reservoir passage 338 is configured to conduct fluid, preferably a lubricant. As depicted in FIG. 46, the plunger reservoir passage 338 of the preferred embodiment is generally cylindrical in shape; however, those skilled in the art will appreciate that the plunger reservoir passage 338 may assume any shape so long as it conducts fluid.

The second socket surface 332 defines a second socket hole 334. The second socket hole 334 fluidly links the second socket surface 332 with socket passage 337. The second socket surface 332 is provided with a protruding surface 333. In the embodiment depicted, the protruding surface 33 is generally curved. The protruding surface 333 is preferably concentric relative to the outer socket surface 340. However, those skilled in the art will appreciate that it is not necessary that the second socket surface 332 be provided with a protruding surface 333 or that the protruding surface 333 be concentric relative to the outer socket surface 340. The second socket surface 332 may be provided with any surface, and the protruding surface 333 of the preferred embodiment may assume any shape so long as the second socket surface 332 cooperates with the opening of an engine workpiece.

Figure 47:
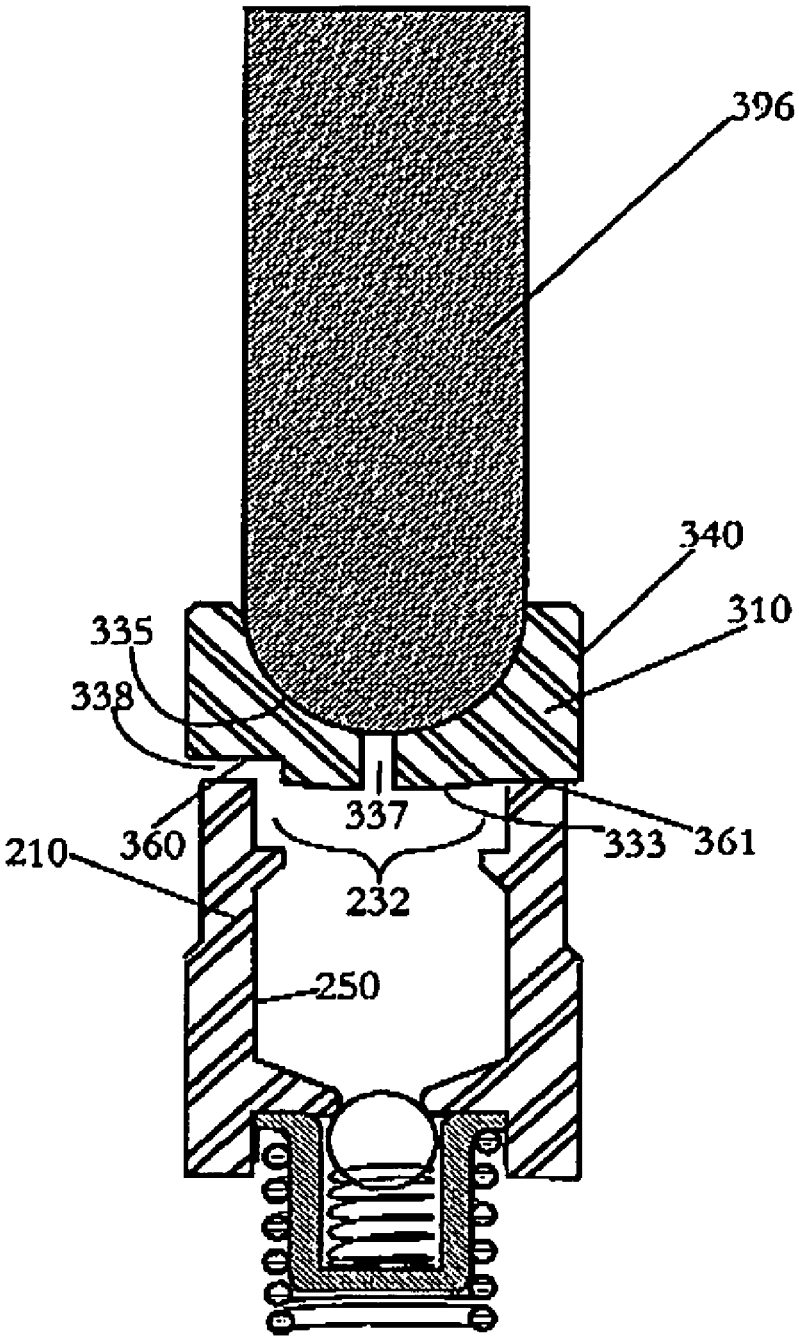
FIG. 47 depicts an embodiment of a socket accommodating an engine work piece.

As shown in FIG. 47, the protruding surface 333 on the second socket surface 332 is located between a first flat surface 360 and a second flat surface 361. As shown therein, the protruding surface 333 is raised with respect to the first and second flat surfaces 360, 361.

Referring now to FIG. 47, the first socket surface 331 is depicted accommodating an insert. As shown in FIG. 47, that insert is a push rod 396. The second socket surface 332 is further depicted cooperating with an engine workpiece. Those skilled in the art will appreciate that the engine workpiece can be a leakdown plunger, such as that disclosed in Applicants' "Leakdown Plunger," application Ser. No. 10/274,519 filed on Oct. 18, 2002 now U.S. Pat. No. 6,871,622. As depicted in FIG. 47, in the preferred embodiment the engine workpiece is the leakdown plunger 210. Those skilled in the art will appreciate that push rods other than the push rod 396 shown herein can be used without departing from the scope and spirit of the present invention. Furthermore, those skilled in the art will appreciate that leakdown plungers other than leakdown plunger 210 and those disclosed in Applicants' "Leakdown Plunger," application Ser. No. 10/274,519 now U.S. Pat. No. 6,871,622 can be used without departing from the scope and spirit of the present invention.

As depicted in FIG. 47, the protruding socket surface 333 preferably cooperates with the second plunger opening 232 of the leakdown plunger 210. According to one aspect of the present invention, the protruding socket surface 333 preferably corresponds to the second plunger opening 232 of the leakdown plunger 210. According to another aspect of the present invention, the protruding socket surface 333 preferably provides a closer fit between the second socket surface 332 of the socket 310 and second plunger opening 232 of the leakdown plunger 210.

In the socket 310 depicted in FIG. 47, a socket passage 337 is provided. The socket passage 337 preferably functions to lubricate the push rod cooperating surface 335. The embodiment depicted in FIG. 47 is also provided with a plunger reservoir passage 338. The plunger reservoir passage 338 is configured to conduct fluid, preferably a lubricant.

The plunger reservoir passage 338 performs a plurality of functions. According to one aspect of the present invention, the plunger reservoir passage 338 fluidly links the second plunger opening 232 of the leakdown plunger 210 and the outer socket surface 340 of the socket 310. According to another aspect of the present invention, the plunger reservoir passage 338 fluidly links the inner plunger surface 250 of the leakdown plunger 210 and the outer socket surface 340 of the socket 310.

Those skilled in the art will appreciate that the plunger reservoir passage 338 can be extended so that it joins socket passage 337 within the socket 310. However, it is not necessary that the socket passage 337 and plunger reservoir passage 338 be joined within the socket 310. As depicted in FIG. 47, the plunger reservoir passage 338 of an embodiment of the present invention is fluidly linked to socket passage 337. Those skilled in the art will appreciate that the outer socket surface 340 is fluidly linked to the first socket surface 331 in the embodiment depicted in FIG. 47.

Figure 48:
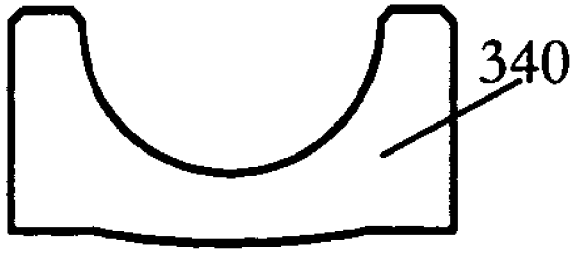
FIG. 48 depicts an outer surface of an embodiment of a socket.

As depicted in FIG. 48, socket 310 of the preferred embodiment is provided with an outer socket surface 340. The outer socket surface 340 is configured to cooperate with the inner surface of an engine workpiece. The outer socket surface 340 of the presently preferred embodiment is cylindrically shaped. However, those skilled in the art will appreciate that the outer socket surface 340 may assume any shape so long as it is configured to cooperate with the inner surface of an engine workpiece.

Figure 50:
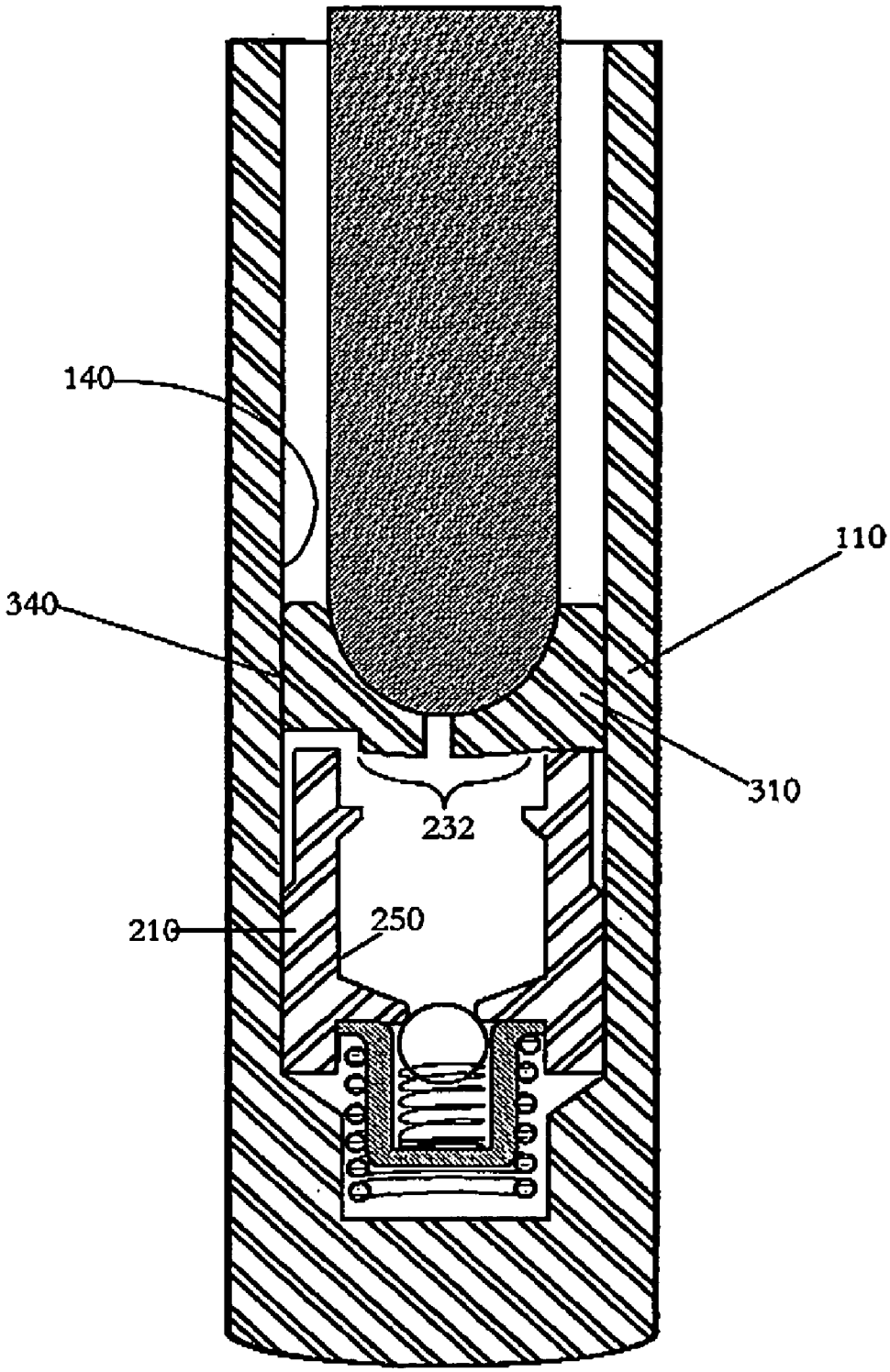
FIG. 50 depicts an embodiment of a socket cooperating with an engine work piece.

FIG. 50 depicts the outer socket surface 340 configured to cooperate with the inner surface of an engine workpiece. The outer socket surface 340 is configured to cooperate with a lash adjuster, such as that disclosed in Applicants' "Lash Adjuster Body," application Ser. No. 10/316,264 filed on Oct. 18, 2002 now U.S. Pat. No. 7,191,745. As shown in FIG. 50, the outer socket surface 340 is preferably configured to cooperate with the inner lash adjuster surface 140 of the lash adjuster 110.

Figure 51:
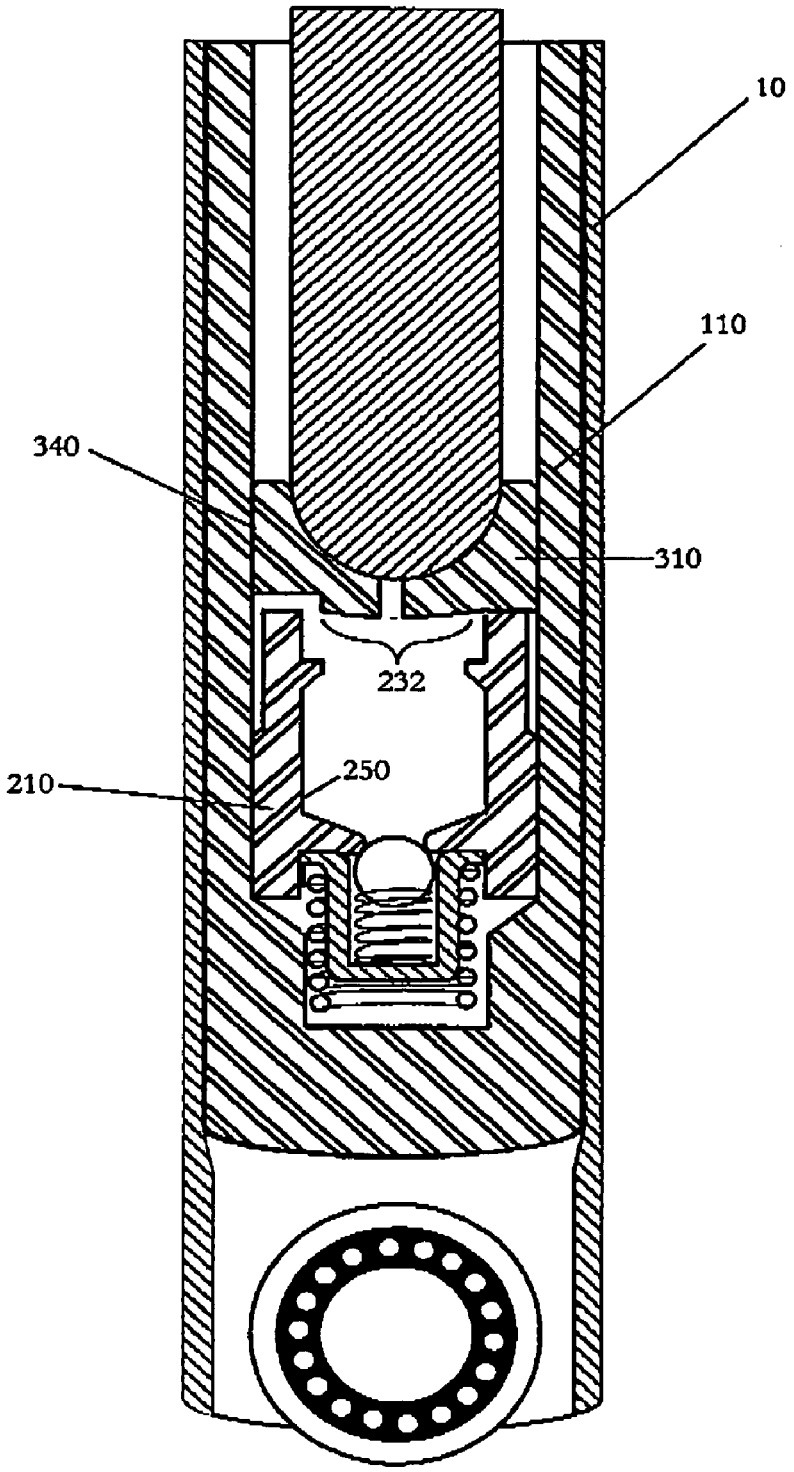
FIG. 51 depicts an embodiment of a socket cooperating with an engine work piece.

The lash adjuster body 110, with the socket 310 of the present invention located therein, may be inserted into a roller follower body, such as that disclosed in Applicants' "Roller Follower Body," application Ser. No. 10/316,261 filed on Oct. 18, 2002 which is still pending. As shown in FIG. 51, in the preferred embodiment the lash adjuster body 110, with the socket 310 of the present invention located therein, is inserted into the roller follower body 10.

Figure 49:
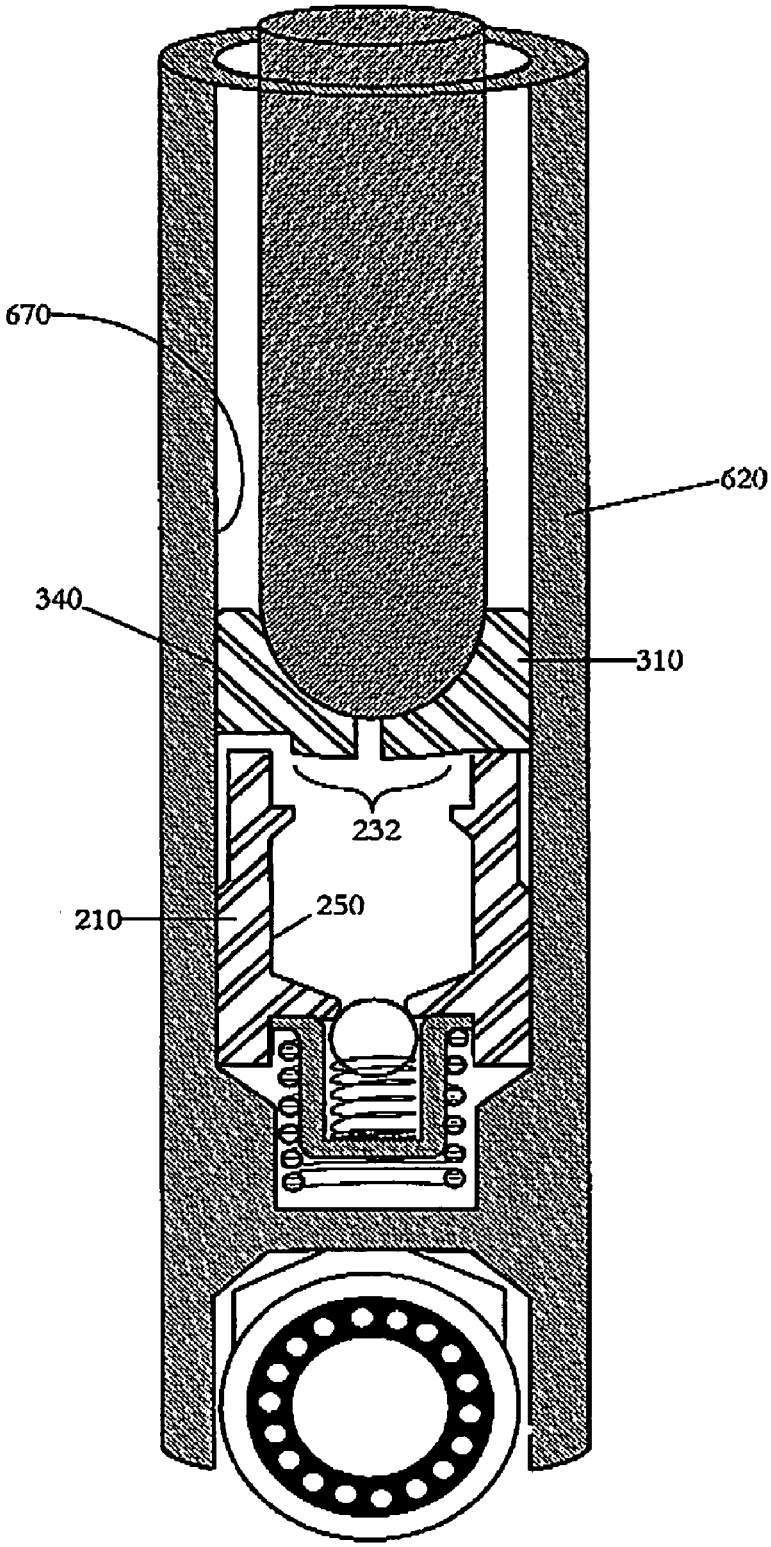
FIG. 49 depicts an embodiment of a socket cooperating with an engine work piece.

As depicted in FIG. 49, the outer socket surface 340 may advantageously be configured to cooperate with the inner surface of an engine workpiece. As shown in FIG. 49, in an alternative embodiment, the outer socket surface 340 is configured to cooperate with the inner surface 670 of a lifter body 620. Those skilled in the art will appreciate that the outer socket surface 340 may advantageously be configured to cooperate with the inner surfaces of other lifter bodies, such as, for example, the lifter bodies disclosed in Applicants' "Valve Lifter Body," application Ser. No. 10/316,263 filed on Oct. 18, 2002 now U.S. Pat. No. 7,128,034.

Referring now to FIG. 52 to FIG. 56, the presently preferred method of fabricating a socket 310 is disclosed. FIGS. 52 to 56 depict what is known in the art as a "slug progression" that shows the fabrication of the present invention from a rod or wire to a finished or near-finished socket body. In the slug progression shown herein, pins are shown on the punch side; however, those skilled in the art will appreciate that the pins can be switched to the die side without departing from the scope of the present invention.

The socket 310 of the preferred embodiment is forged with use of a National® 750 parts former machine. However, those skilled in the art will appreciate that other part formers, such as, for example, a Waterbury machine can be used. Those skilled in the art will further appreciate that other forging methods can be used as well.

Figure 52:
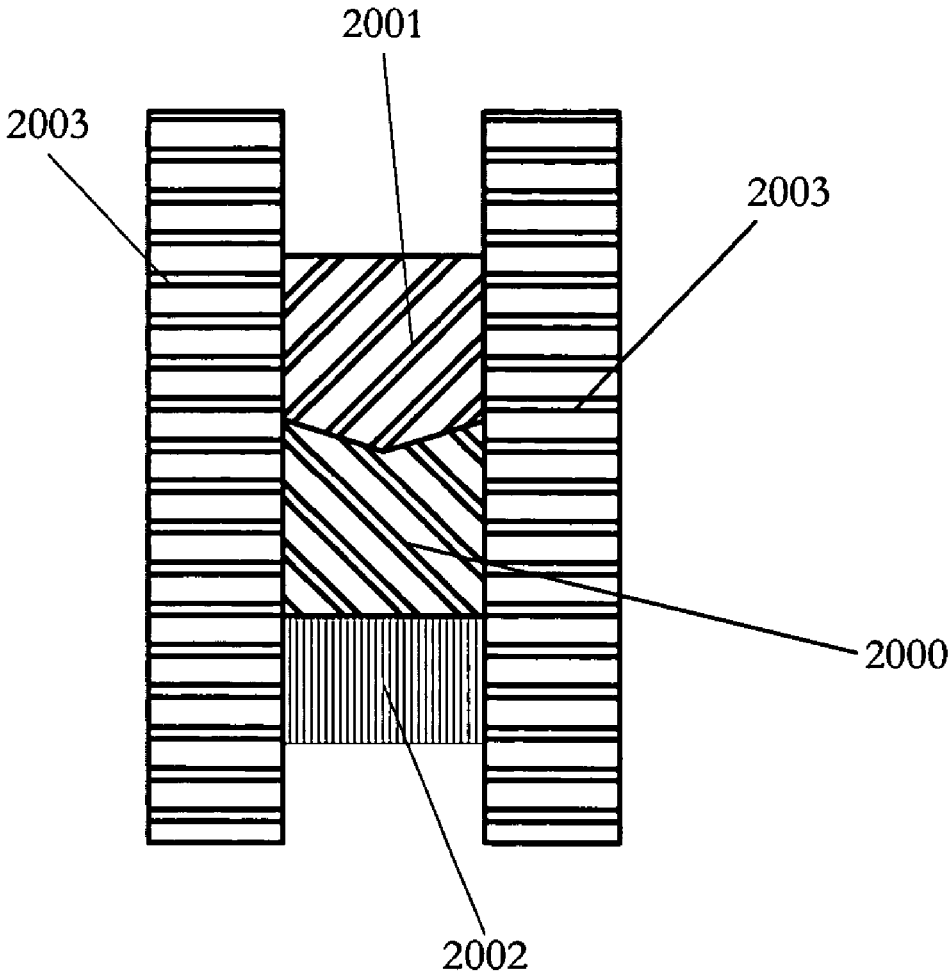
FIGS. 52-56 depict a preferred method of fabricating a socket.

The process of forging an embodiment of the present invention begins with a metal wire or metal rod 2000 which is drawn to size. The ends of the wire or rod are squared off. As shown in FIG. 52, this is accomplished through the use of a first punch 2001, a first die 2002, and a first knock out pin 2003.

Figure 53:
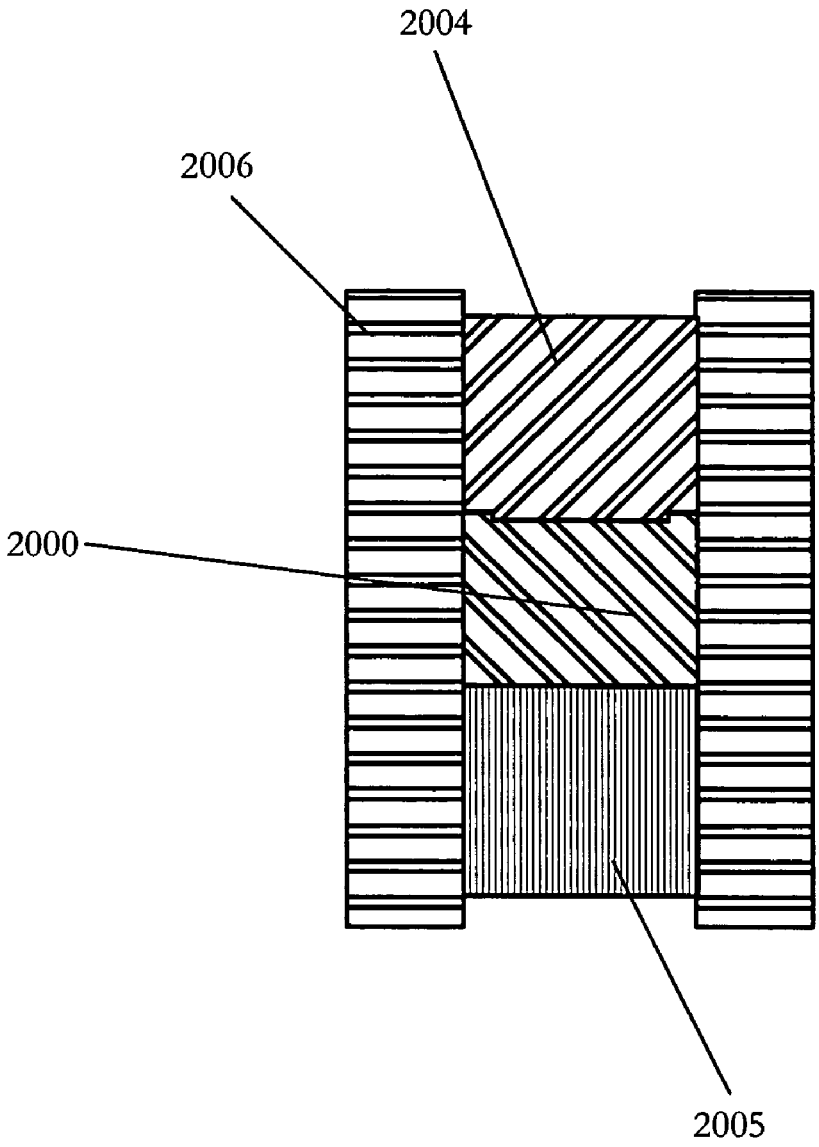

After being drawn to size, the wire or rod 2000 is run through a series of dies or extrusions. As depicted in FIG. 53, the fabrication of the first socket surface 331, the outer socket surface, and the third surface is preferably commenced through use of a second punch 2004, a second knock out pin 2005, and a second die 2006. The second punch 2004 is used to commence fabrication of the first socket surface 331. The second die 2006 is used against the outer socket surface 340. The second knock out pin 2005 is used to commence fabrication of the second socket surface 332.

Figure 54:
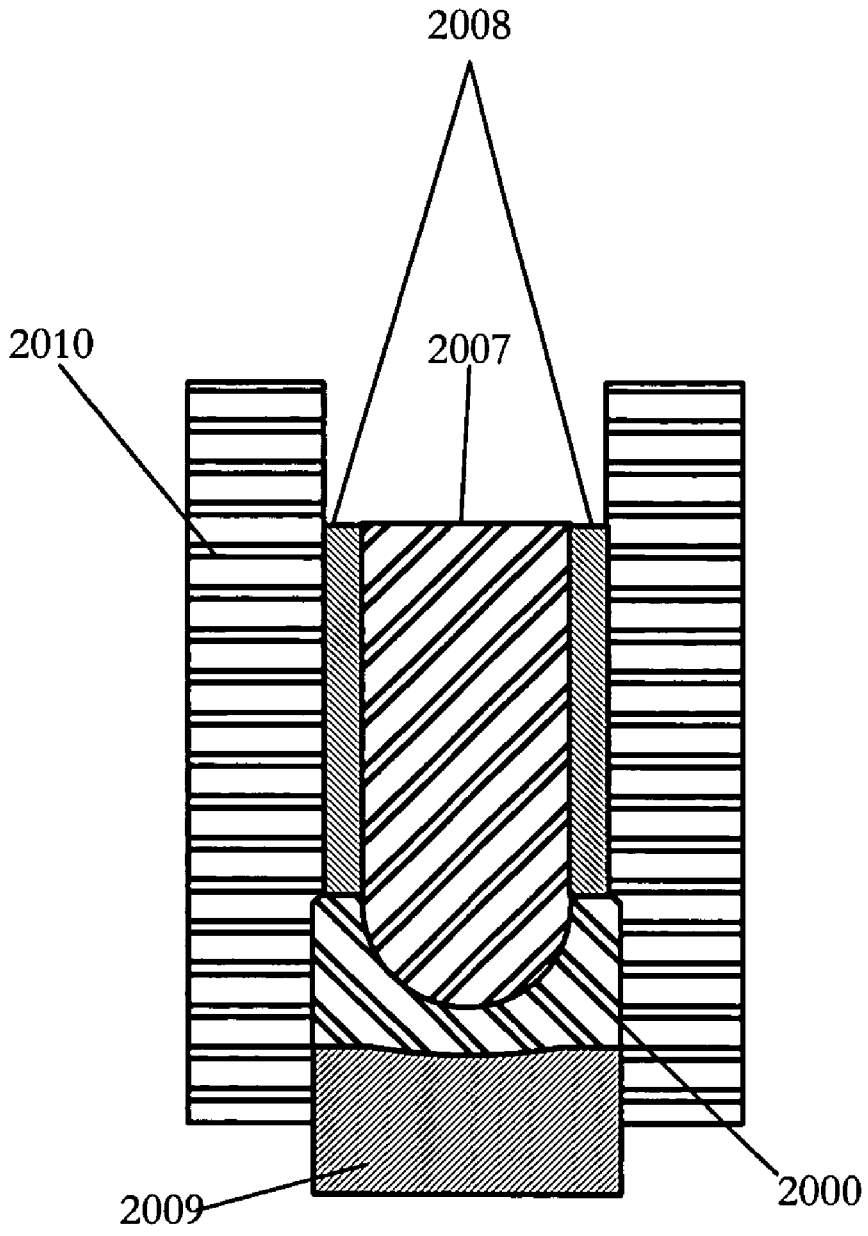

FIG. 54 depicts the fabrication of the first socket surface 331, the second socket surface 332, and the outer socket surface 340 through use of a third punch 2007, a first stripper sleeve 2008, a third knock out pin 2009, and a third die 2010. The first socket surface 331 is fabricated using the third punch 2007. The first stripper sleeve 2008 is used to remove the third punch 2007 from the first socket surface 331. The second socket surface 332 is fabricated through use of the third knock out pin 2009, and the outer socket surface 340 is fabricated through use of the third die 2010.

Figure 55:
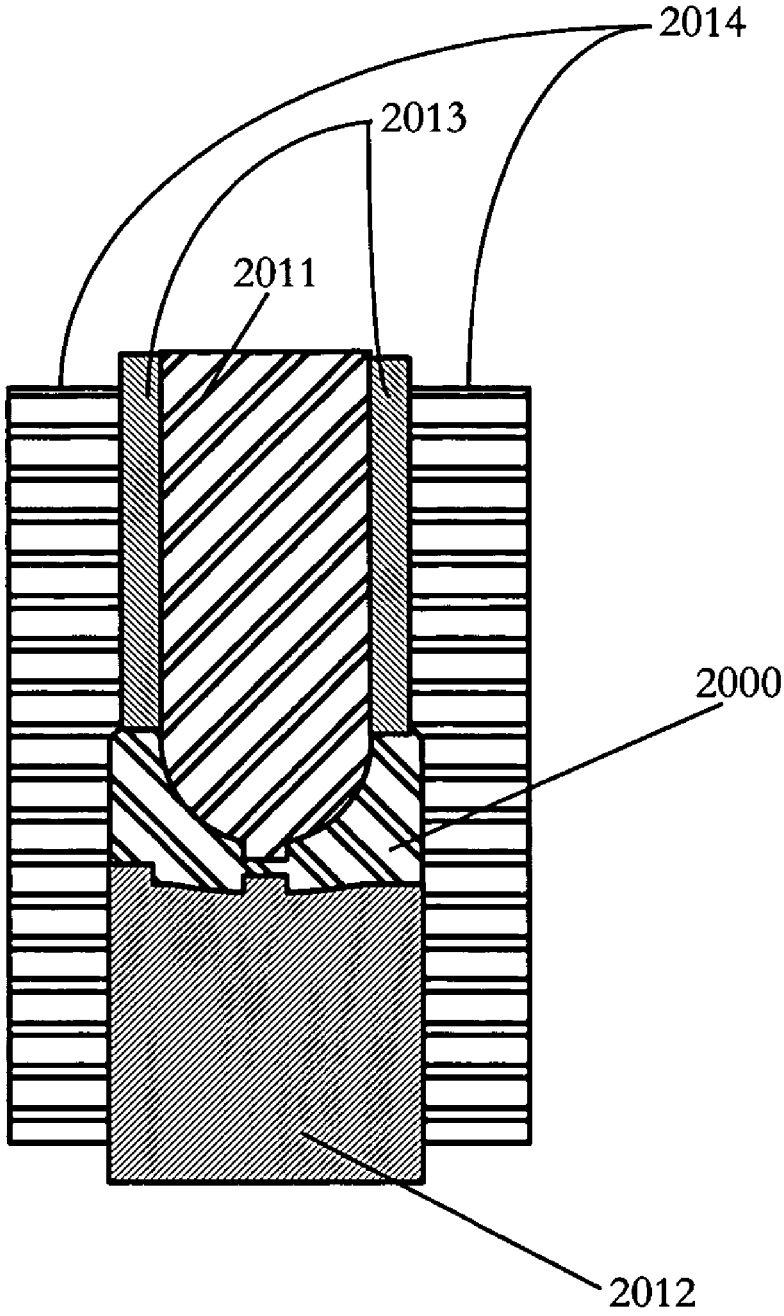

As depicted in FIG. 55, the fabrication of the socket passage 337 and plunger reservoir passage 338 is commenced through use of a punch pin 2011 and a fourth knock out pin 2012. A second stripper sleeve 2013 is used to remove the punch pin 2011 from the first socket surface 331. The fourth knock out pin 2012 is used to fabricate the plunger reservoir passage 338. A fourth die 2014 is used to prevent change to the outer socket surface 340 during the fabrication of the socket passage 337 and plunger reservoir passage 338.

Figure 56:
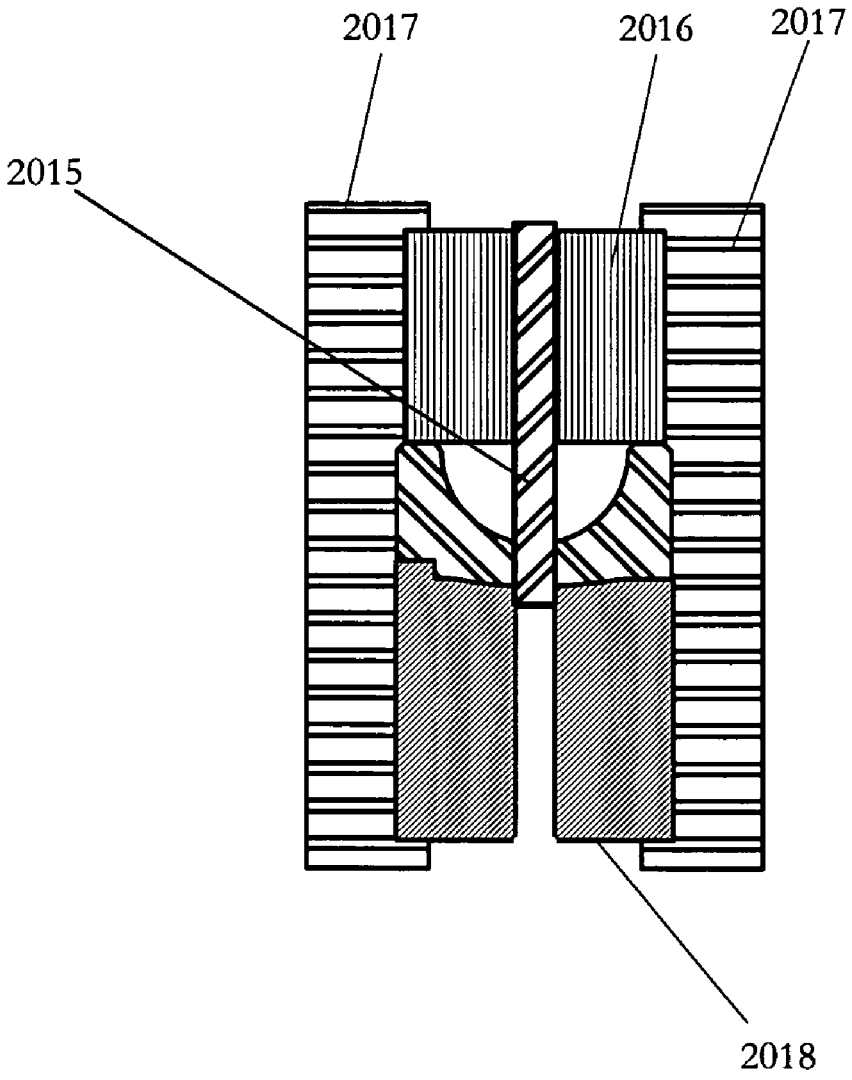

Referring now to FIG. 56, fabrication of socket passage 337 is completed through use of pin 2015. A third stripper sleeve 2016 is used to remove the pin 2015 from the first socket surface 331. A fifth die 2017 is used to prevent change to the outer socket surface 340 during the fabrication of socket passage 337. A tool insert 2018 is used to prevent change to the second socket surface 332 and the plunger reservoir passage 338 during the fabrication of socket passage 337.

Those skilled in the art will appreciate that further desirable finishing may be accomplished through machining. For example, socket passage 337 and plunger reservoir passage 338 may be enlarged and other socket passages may be drilled. However, such machining is not necessary.

Figure 58:
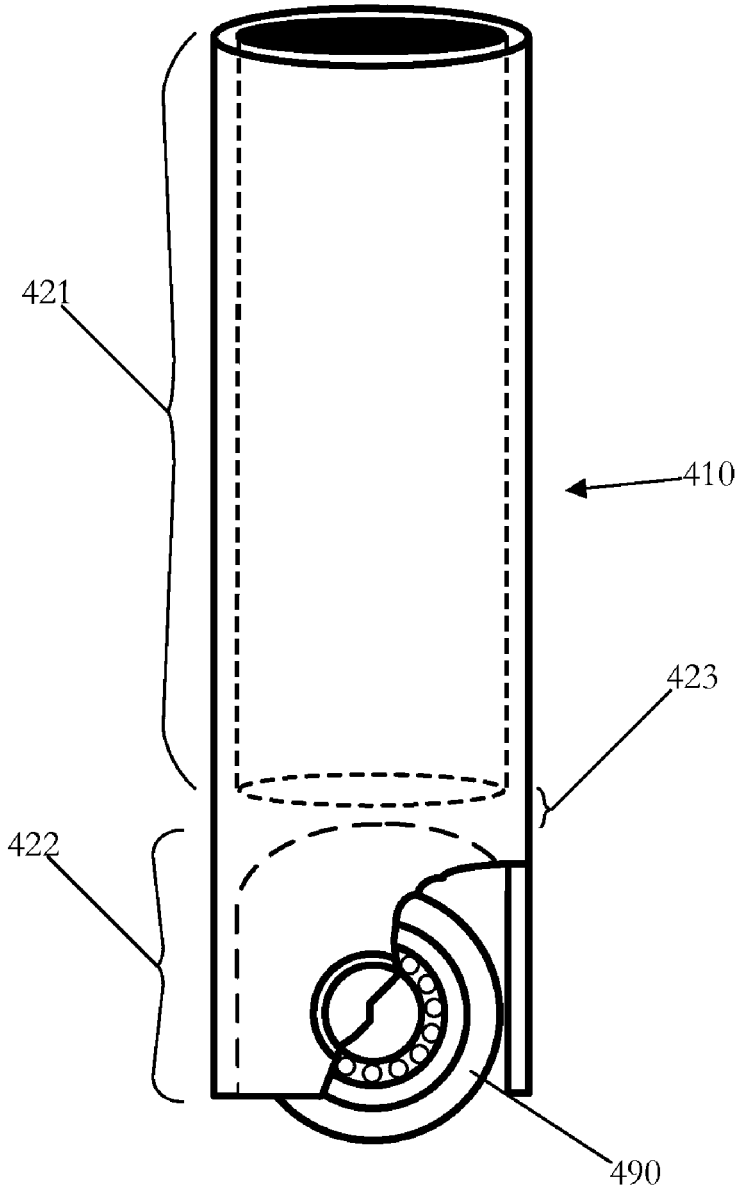
FIG. 58 depicts a preferred embodiment of a valve lifter body.
Figure 59:
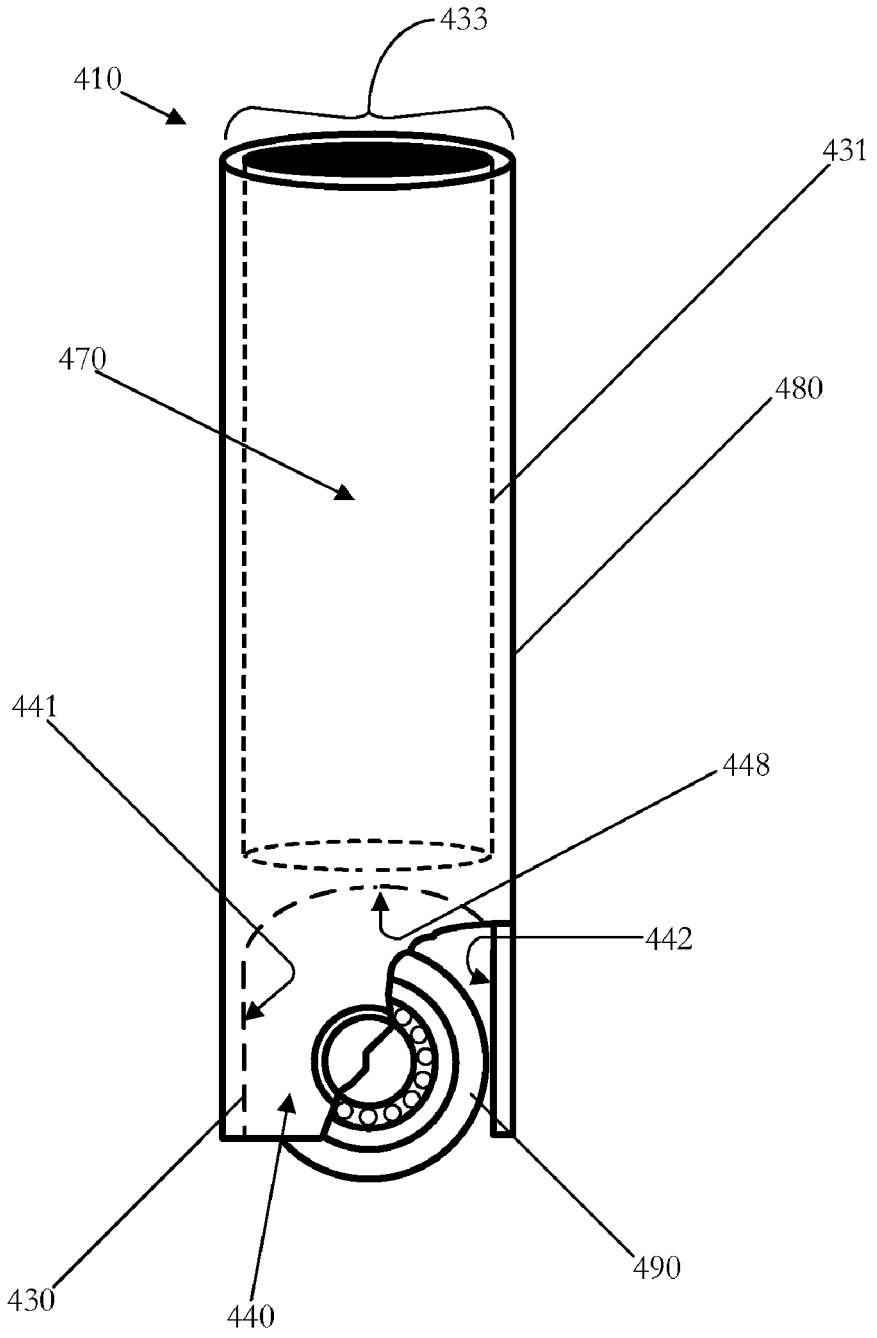
FIG. 59 depicts a preferred embodiment of a valve lifter body.
Figure 60:
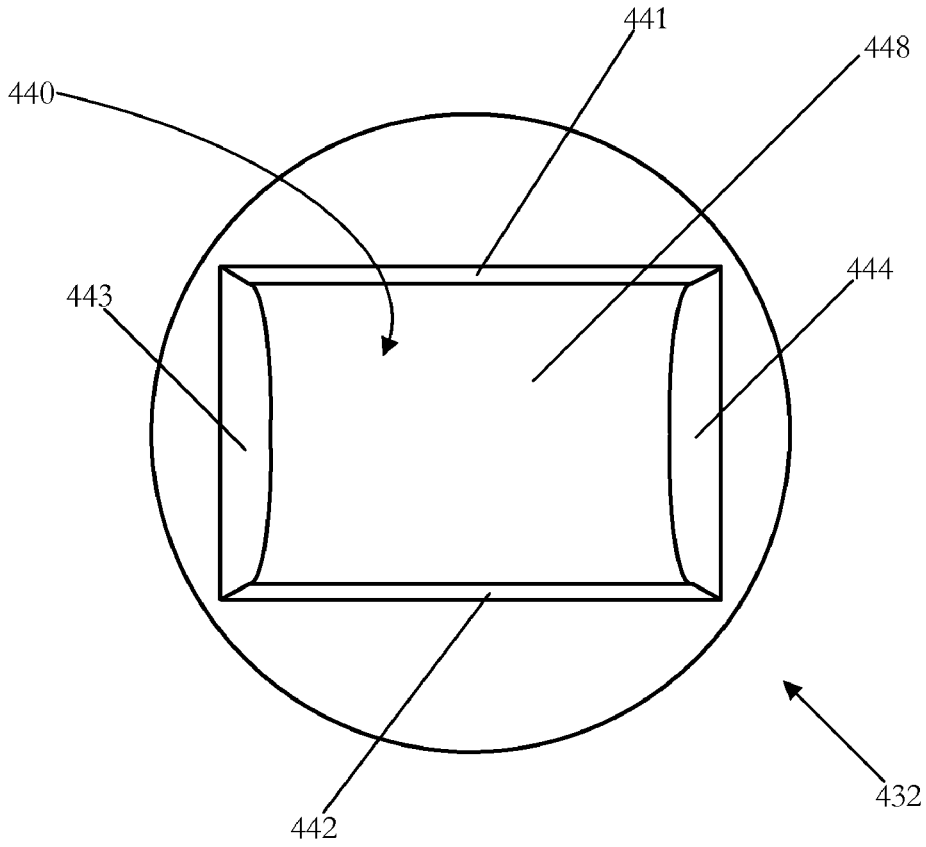
FIG. 60 depicts the top view of a preferred embodiment of a valve lifter body.

In an alternative embodiment, the roller follower assembly 5 is provided with a valve lifter body 410. Turning now to the drawings, FIGS. 58, 59, and 60 show a preferred embodiment of the valve lifter body 410. The valve lifter 410 is composed of a metal, preferably aluminum. According to one aspect of the present invention, the metal is copper. According to another aspect of the present invention, the metal is iron.

Those skilled in the art will appreciate that the metal is an alloy. According to one aspect of the present invention, the metal includes ferrous and non-ferrous materials. According to another aspect of the present invention, the metal is a steel. Those skilled in the art will appreciate that steel is in a plurality of formulations and the present invention is intended to encompass all of them. According to one embodiment of the present invention the steel is a low carbon steel. In another embodiment of the present invention, the steel is a medium carbon steel. According to yet another embodiment of the present invention, the steel is a high carbon steel.

Those with skill in the art will also appreciate that the metal is a super alloy. According to one aspect of the present invention, the super alloy is bronze; according to another aspect of the present invention, the super alloy is a high nickel material. According to yet another aspect of the present invention, the valve lifter 410 is composed of pearlitic material. According to still another aspect of the present invention, the valve lifter 410 is composed of austenitic material. According to another aspect of the present invention, the metal is a ferritic material.

The valve lifter body 410 is composed of a plurality of lifter elements. According to one aspect of the present invention, the lifter element is cylindrical in shape. According to another aspect of the present invention, the lifter element is conical in shape. According to yet another aspect of the present invention, the lifter element is solid. According to still another aspect of the present invention, the lifter element is hollow.

FIG. 58 depicts a cross-sectional view of the valve lifter body 410 of the preferred embodiment of the present invention composed of a plurality of lifter elements. FIG. 58 shows the valve lifter body, generally designated 410, with a roller 490. The valve lifter body 410 of the preferred embodiment is fabricated from a single piece of metal wire or rod and is described herein as a plurality of lifter elements. The valve lifter body 410 includes a first hollow lifter element 421, a second hollow lifter element 422, and a solid lifter element 423. In the preferred embodiment, the solid lifter element 423 is located between the first hollow lifter element 421 and the second hollow lifter element 422.

The valve lifter body 410 functions to accommodate a plurality of inserts. According to one aspect of the present invention, the valve lifter body 410 accommodates a lash adjuster, such as the lash adjuster body 110. According to another aspect of the present invention, the valve lifter body 410 accommodates a leakdown plunger, such as the leakdown plunger 210. According to another aspect of the present invention, the valve lifter body 410 accommodates a push rod seat (not shown). According to yet another aspect of the present invention, the valve lifter body 410 accommodates a socket, such as the socket 310.

The valve lifter body 410 is provided with a plurality of outer surfaces and inner surfaces. FIG. 59 depicts a cross-sectional view of the valve lifter body 410 of the preferred embodiment of the present invention. As shown in FIG. 59, the valve lifter body 410 is provided with an outer lifter surface 480 which is cylindrically shaped. The outer lifter surface 480 encloses a plurality of cavities. As depicted in FIG. 59, the outer lifter surface 480 encloses a first lifter cavity 430 and a second lifter cavity 431. The first lifter cavity 430 includes a first inner lifter surface 440. The second lifter cavity 431 includes a second inner lifter surface 470.

FIG. 60 depicts a top view and provides greater detail of the first lifter cavity 430 of the preferred embodiment. As shown in FIG. 60, the first lifter cavity 430 is provided with a first lifter opening 432 shaped to accept a cylindrical insert. The first inner lifter surface 440 is configured to house a cylindrical insert 490, which, in the preferred embodiment of the present invention, functions as a roller. Those skilled in the art will appreciate that housing a cylindrical insert can be accomplished through a plurality of different configurations. The first inner lifter surface 440 of the preferred embodiment includes a curved surface and a plurality of walls. As depicted in FIG. 60, the inner lifter surface 440 includes a first lifter wall 441, a second lifter wall 442, a third lifter wall 443, and a fourth lifter wall 444. The first lifter wall 441 is adjacent to a curved lifter surface 448. The curved lifter surface 448 is adjacent to a second lifter wall 442. The third and fourth walls 443, 444 are located on opposing sides of the curved lifter surface 448.

Figure 69:
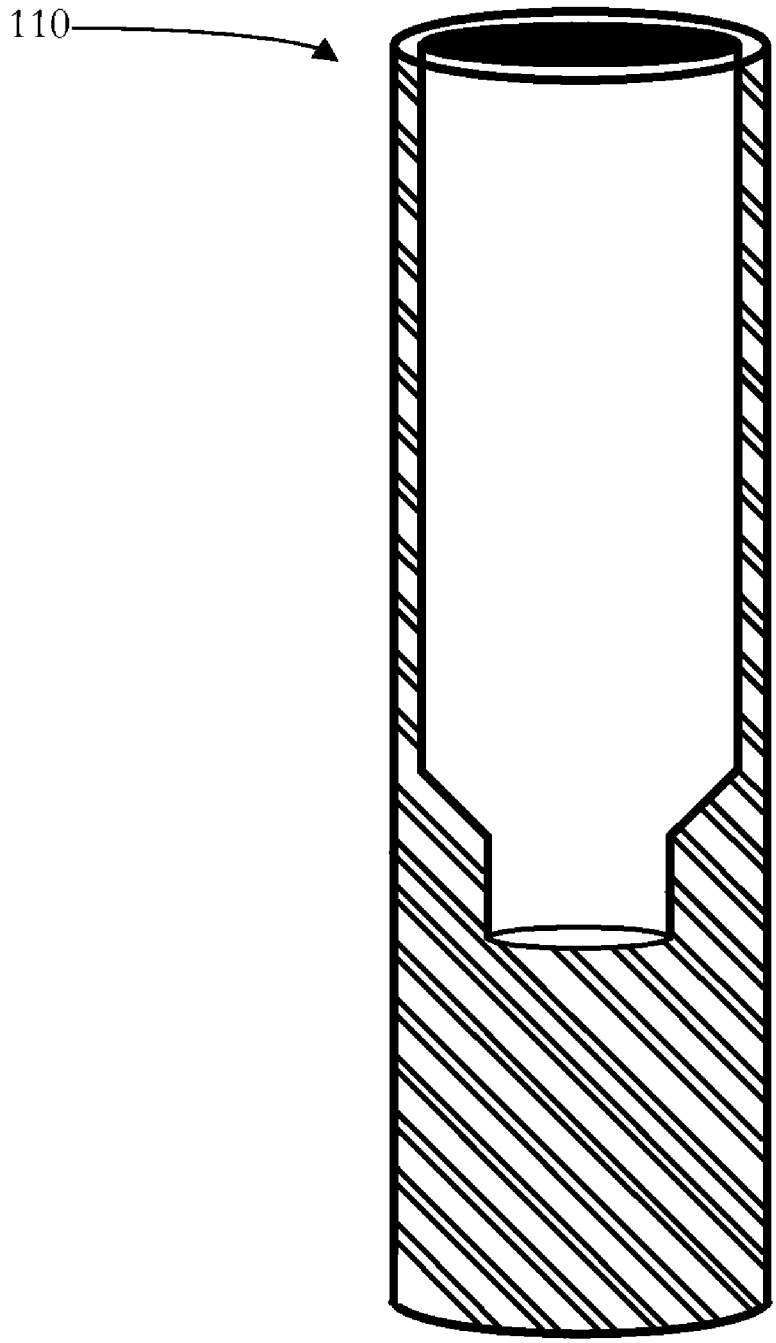
FIG. 69 depicts a lash adjuster body.

Referring to FIG. 59, the valve lifter body 410 of the present invention is provided with a second lifter cavity 431 which includes a second lifter opening 433 which is in a circular shape. The second lifter cavity 431 is provided with a second inner lifter surface 470. The second inner lifter surface 470 of the preferred embodiment is cylindrically shaped. Alternatively, the second inner lifter surface 470 is configured to house a lash adjuster generally designated 110 on FIG. 69. However, those skilled in the art will appreciate that the second inner lifter surface 470 can be conically or frustoconically shaped without departing from the spirit of the present invention.

The present invention is fabricated through a plurality of processes. According to one aspect of the present invention, the valve lifter body 410 is machined. According to another aspect of the present invention, the valve lifter body 410 is forged. According to yet another aspect of the present invention, the valve lifter body 410 is fabricated through casting. The valve lifter body 410 of the preferred embodiment of the present invention is forged. As used herein, the term "forge," "forging," or "forged" is intended to encompass what is known in the art as "cold forming," "cold heading," "deep drawing," and "hot forging."

The valve lifter body 410 is preferably forged with use of a National® 750 parts former machine. Those skilled in the art will appreciate that other part formers, such as, for example, a Waterbury machine can be used. Those skilled in the art will further appreciate that other forging methods can be used as well.

The process of forging the valve lifter body 410 preferably begins with a metal wire or metal rod which is drawn to size. The ends of the wire or rod are squared off by a punch. After being drawn to size, the wire or rod is run through a series of dies or extrusions. The second lifter cavity 431 is extruded through use of a punch and an extruding pin. After the second lifter cavity 431 has been extruded, the first lifter cavity 430 is forged. The first lifter cavity 430 is extruded through use of an extruding punch and a forming pin.

Alternatively, the valve lifter body 410 is fabricated through machining. As used herein, machining means the use of a chucking machine, a drilling machine, a grinding machine, or a broaching machine. Machining is accomplished by first feeding the valve lifter body 410 into a chucking machine, such as an ACME-Gridley automatic chucking machine. Those skilled in the art will appreciate that other machines and other manufacturers of automatic chucking machines can be used.

To machine the second lifter cavity 431, the end containing the second lifter opening 433 is faced so that it is substantially flat. The second lifter cavity 431 is bored. Alternatively, the second lifter cavity 431 can be drilled and then profiled with a special internal diameter forming tool.

After being run through the chucking machine, heat-treating is completed so that the required Rockwell hardness is achieved. Those skilled in the art will appreciate that this can be accomplished by applying heat so that the material is beyond its critical temperature and then oil quenching the material.

After heat-treating, the second lifter cavity 431 is ground using an internal diameter grinding machine, such as a Heald grinding machine. Those skilled in the art will appreciate that the second lifter cavity 431 can be ground using other grinding machines.

Those skilled in the art will appreciate that the other features of the present invention may be fabricated through machining. For example, the first lifter cavity 430 can be machined. To machine the first lifter cavity 430, the end containing the first lifter opening 432 is faced so that it is substantially flat. The first lifter cavity 430 is drilled and then the first lifter opening 432 is broached using a broaching machine.

Figure 61:
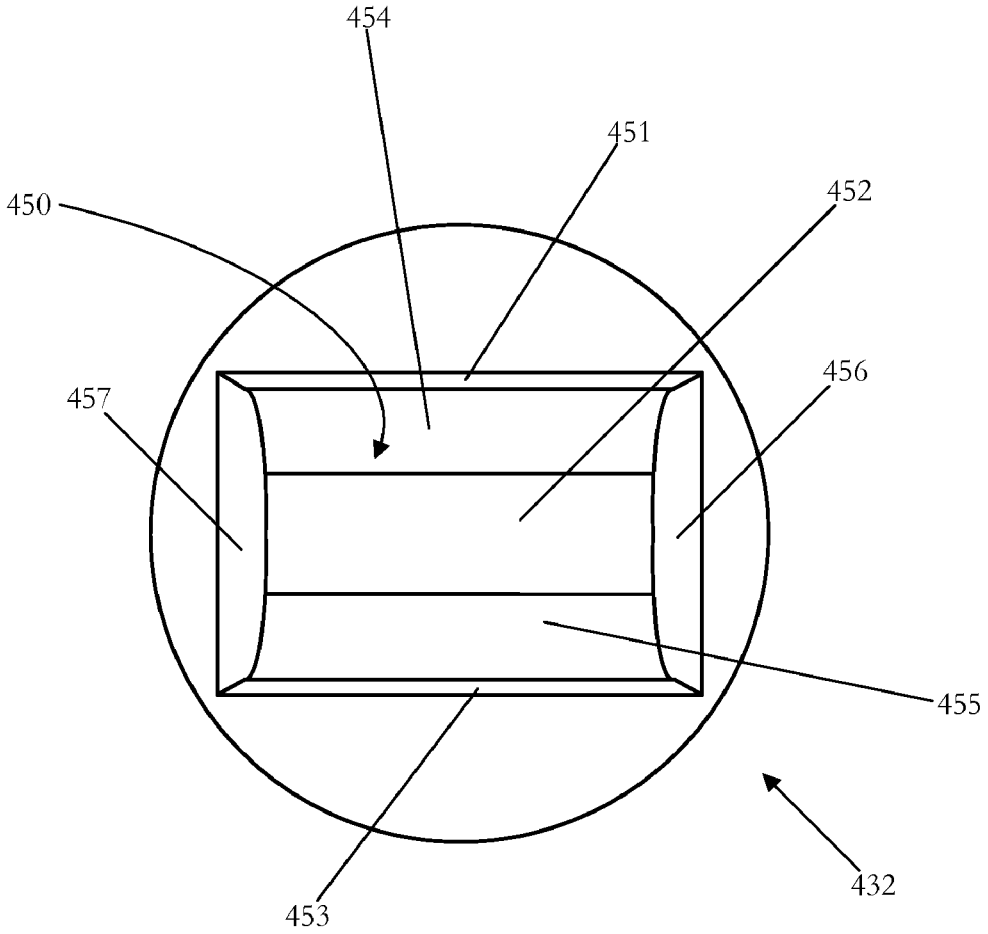
FIG. 61 depicts the top view of another preferred embodiment of a valve lifter body.

In an alternative embodiment of the present invention depicted in FIG. 61, the first lifter cavity 430 is provided with a first lifter opening 432 shaped to accept a cylindrical insert and a first inner lifter surface 450. The first inner lifter surface 450 includes a lifter surface, a plurality of curved surfaces, and a plurality of walls referred to herein as a first wall 451, a second wall 453, a third wall 456, and a fourth wall 457. As depicted in FIG. 61, the first wall 451 is adjacent to a first curved lifter surface 454. The first curved lifter surface 454 is adjacent to a lifter surface 452. The lifter surface 452 is adjacent to a second curved lifter surface 455. The second curved lifter surface 455 is adjacent to the second wall 453.

Figure 62:
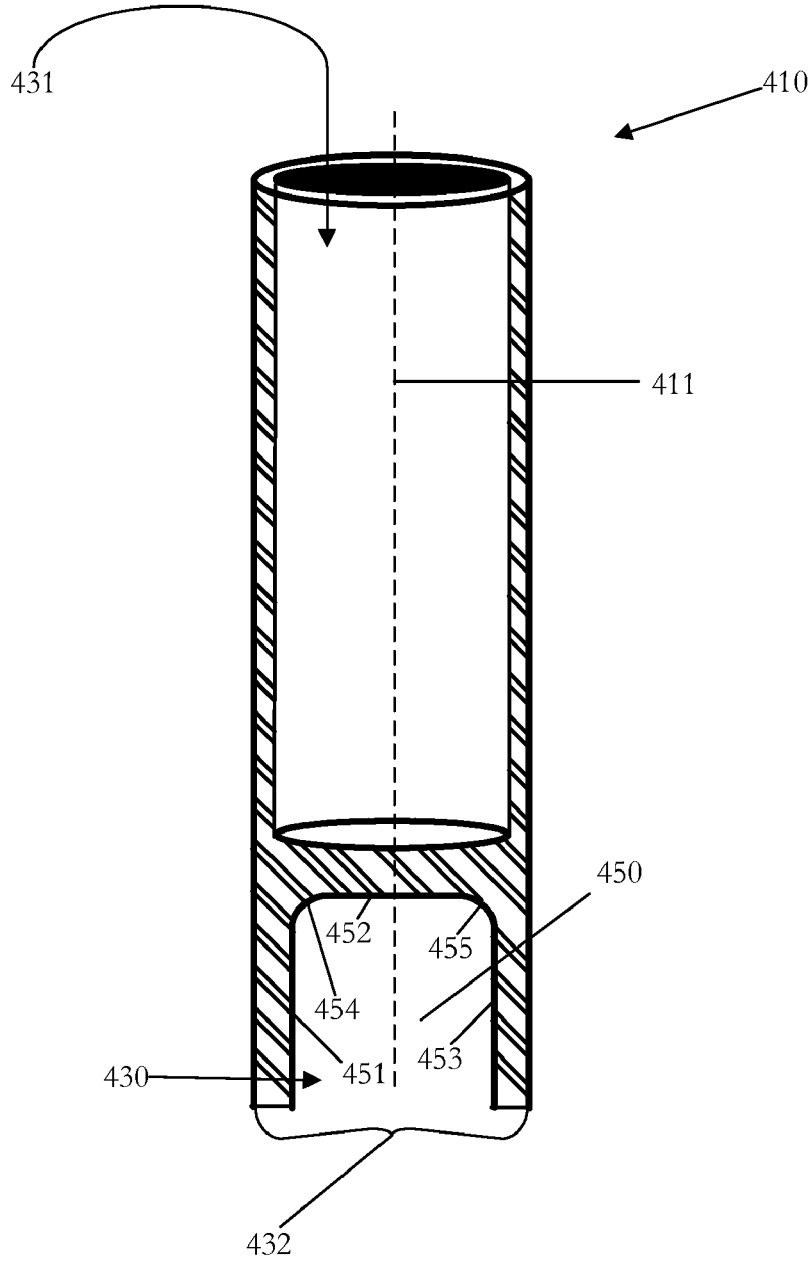
FIG. 62 depicts a second embodiment of a valve lifter body.

As depicted in FIG. 61, the third wall 456 and the fourth wall 457 are located on opposing sides of the second wall 453. FIG. 62 depicts a cross-sectional view of the valve lifter body 410 with the first lifter cavity 430 shown in FIG. 61. As shown in FIG. 62, the lifter surface 452 preferably is, relative to the first and second curved surfaces 454, 455, generally flat in shape and oriented to be generally orthogonal to the valve lifter axis 411 of the valve lifter body 410.

Figure 63:
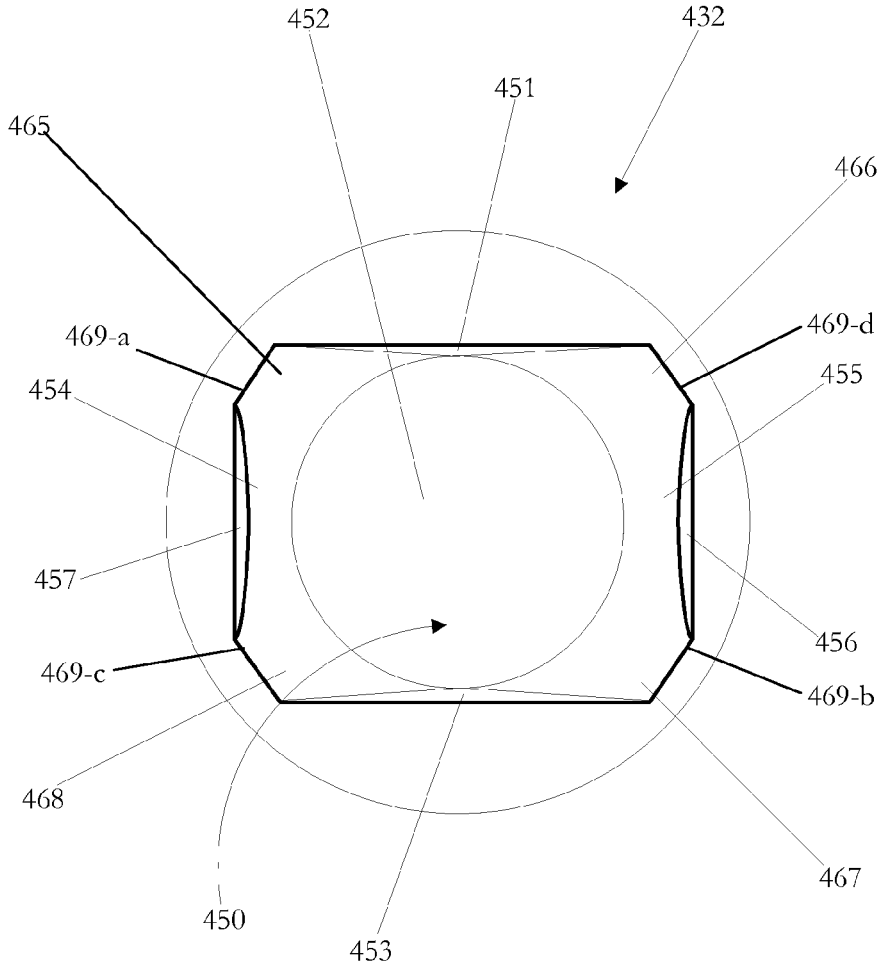
FIG. 63 depicts the top view of another preferred embodiment of a valve lifter body.
Figure 64:
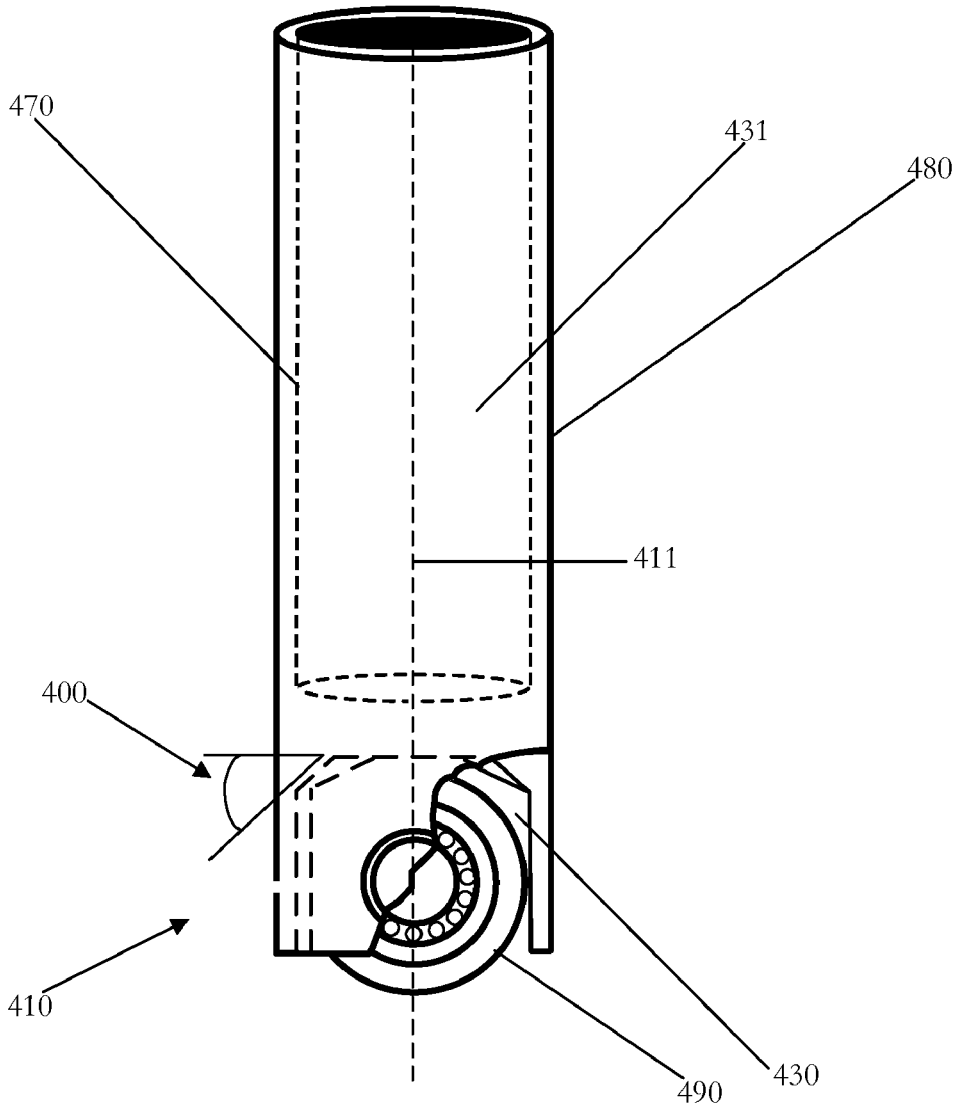
FIG. 64 depicts a third embodiment of a valve lifter body.

In another alternative embodiment of the present invention, as depicted in FIGS. 63 and 64, the first lifter cavity 430 is provided with a first lifter opening 432 shaped to accept a cylindrical insert and a first inner lifter surface 450. The first inner lifter surface 450 includes a plurality of walls referred to herein as a first wall 451, a second wall 453, a third wall 456, and a fourth wall 457. The first inner lifter surface 450 also includes a plurality of angled walls referred to herein as a first angled wall 469-*a*, a second angled wall 469-*b*, a third angled wall 469-*c*, and a fourth angled wall 469-*d*. Referring to FIG. 63, the first wall 451 is adjacent to a lifter surface 452, which is preferably circular in shape and oriented to be generally orthogonal to the valve lifter axis 411 of the valve lifter body 410. In FIG. 63, the first wall 451 is adjacent to a first angled lifter surface 465 and a second angled lifter surface 466. The first angled wall 469-*a* is shown extending axially into the valve lifter body 410 from the first lifter opening 432 and terminating at the first angled surface 465. The first angled lifter surface 465 is adjacent to the lifter surface 452 and a first curved lifter surface 454. As depicted in FIG. 64 the first angled lifter surface 465 is configured to be at an angle 400 relative to a plane that is generally orthogonal to the valve lifter axis 411 of the valve lifter body 410 (such as the plane of the annular lash adjuster surface 144). Advantageously, the angle 400 measures preferably between twenty-five and about ninety degrees.

The second angled lifter surface 466 is adjacent to the lifter surface 452. The fourth angled wall 469-*d* is shown extending axially into the valve lifter body 410 from the first lifter opening 432 and terminating at the second angled surface 466. As shown in FIG. 64, the second angled lifter surface 466 is configured to be at an angle 400 relative to a plane that is generally orthogonal to the valve lifter axis 411 of the valve lifter body 410 (such as the plane of the annular lash adjuster surface 144). Advantageously, the angle 400 measures preferably between twenty-five and about ninety degrees. The second angled lifter surface 466 is adjacent to a second curved lifter surface 455. The second curved lifter surface 455 is adjacent to a third angled lifter surface 467 and a third wall 456. The third angled lifter surface 467 is adjacent to the lifter surface 452 and the second wall 453. The second angled wall 469-*b* is shown extending axially into the valve lifter body 410 from the first lifter opening 432 and terminating at the third angled surface 467. As depicted in FIG. 64, the third angled lifter surface 467 is configured to be at an angle 400 relative to a plane that is generally orthogonal to the valve lifter axis 411 of the valve lifter body 410 (such as the plane of the annular lash adjuster surface 144). Advantageously, the angle 400 measures preferably between twenty-five and about ninety degrees.

The second wall 453 is adjacent to a fourth angled lifter surface 468. The fourth angled lifter surface 468 adjacent to the first curved lifter surface 454 and a fourth wall 457. The third angled wall 469-*c* is shown extending axially into the valve lifter body 410 from first lifter opening 432 and terminating at the fourth angled surface 468. As depicted in FIG. 64, the fourth angled lifter surface 468 is configured to be at an angle 400 relative to a plane that is generally orthogonal to the valve lifter axis 411 of the valve lifter body 410 (such as the plan of the annular lash adjuster surface 144). Advantageously, the angle 400 measures preferably between twenty-five and about ninety degrees. FIG. 64 depicts a cross-sectional view of an embodiment with the first lifter cavity 430 of FIG. 63.

Figure 65:
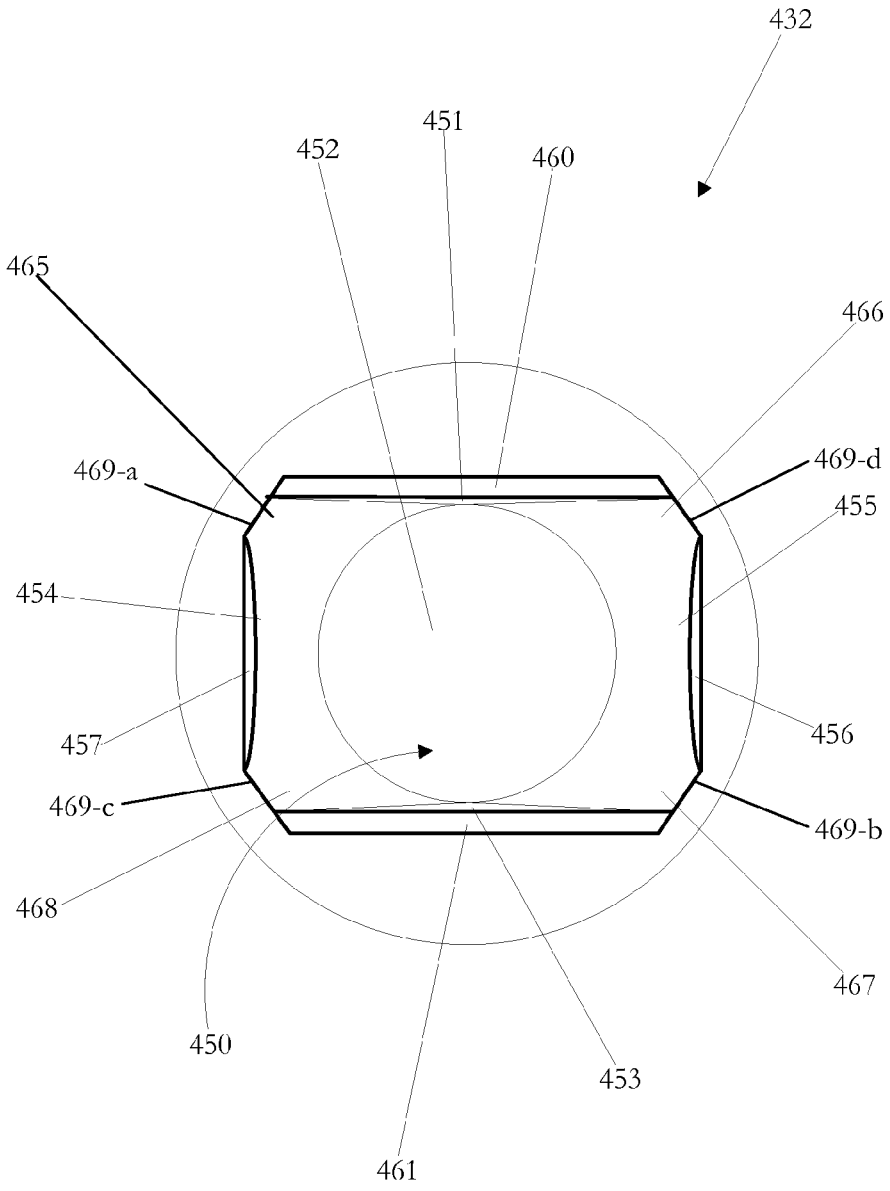
FIG. 65 depicts the top view of another preferred embodiment of a valve lifter body.

Shown in FIG. 65 is an alternative embodiment of the first lifter cavity 430 depicted in FIG. 63. In the embodiment depicted in FIG. 65, the first lifter cavity 430 is provided with a chamfered lifter opening 432 and a first inner lifter surface 450. The chamfered lifter opening 432 functions so that a cylindrical insert can be introduced to the valve lifter body 410 with greater ease. The chamfered lifter opening 432 accomplishes this function through lifter chamfers 460, 461 which are located on opposing sides of the chamfered lifter opening 432. The lifter chamfers 460, 461 of the embodiment shown in FIG. 65 are flat surfaces at an angle relative to the walls 451, 453 so that a cylindrical insert 490 can be introduced through the first lifter opening 432 with greater ease. Those skilled in the art will appreciate that the lifter chamfers 460, 461 can be fabricated in a number of different configurations; so long as the resulting configuration renders introduction of a cylindrical insert 490 through the first lifter opening 432 with greater ease, it is a "chamfered lifter opening" within the spirit and scope of the present invention.

The lifter chamfers 460, 461 are preferably fabricated through forging via an extruding punch pin. Alternatively, the lifter chamfers 460, 461 are machined by being ground before heat-treating. Those skilled in the art will appreciate that other methods of fabrication can be employed within the scope of the present invention.

Figure 66:
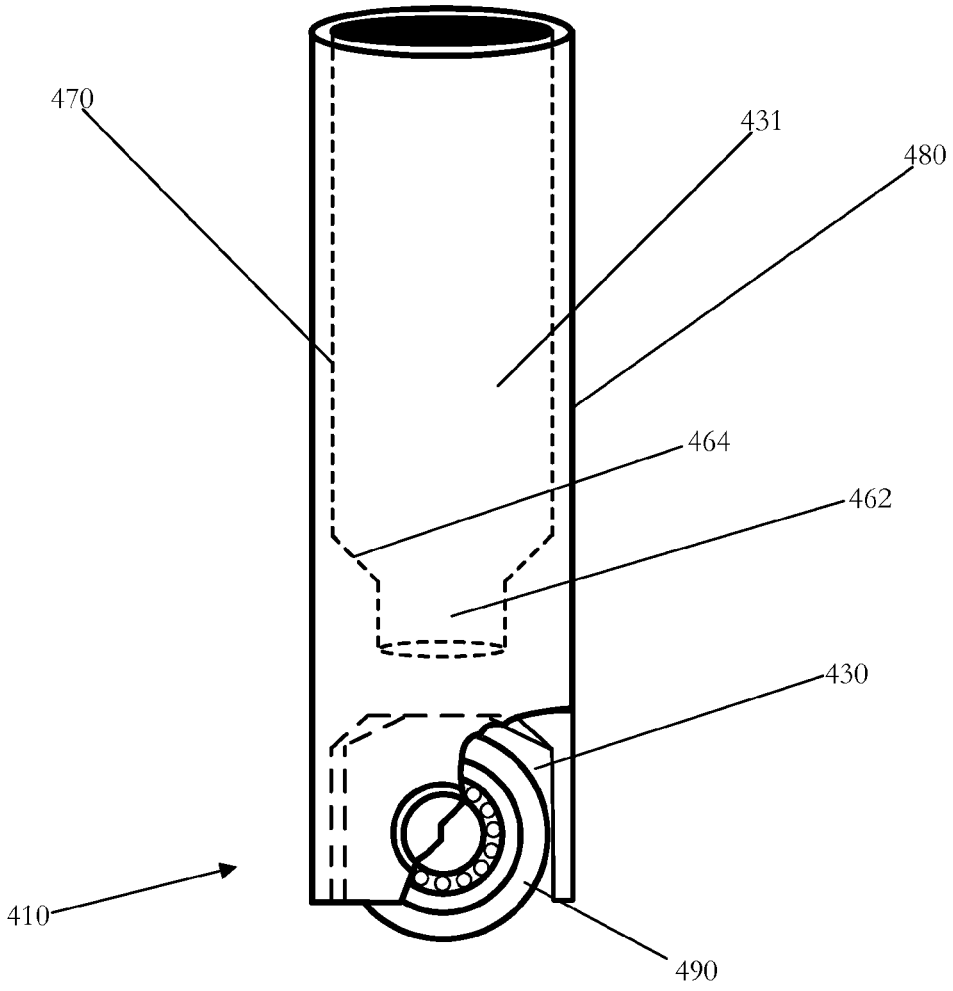
FIG. 66 depicts a fourth embodiment of a valve lifter body.

FIG. 66 discloses yet another alternative embodiment of the present invention. As depicted in FIG. 66, the valve lifter body 410 is provided with a second lifter cavity 431 which includes a plurality of cylindrical and conical surfaces. The second lifter cavity 431 depicted in FIG. 66 includes a second inner lifter surface 470. The second inner lifter surface 470 of the preferred embodiment is cylindrically shaped, concentric relative to the cylindrically shaped outer surface 480. The second inner lifter surface 470 is provided with a lifter well 462. The lifter well 462 is shaped to accommodate a spring (not shown). In the embodiment depicted in FIG. 66, the lifter well 462 is cylindrically shaped at a diameter that is smaller than the diameter of the second inner lifter surface 470. The cylindrical shape of the lifter well 462 is preferably concentric relative to the outer lifter surface 480. The lifter well 462 is preferably forged through use of an extruding die pin.

Alternatively, the lifter well 462 is machined by boring the lifter well 462 in a chucking machine. Alternatively, the lifter well 462 can be drilled and then profiled with a special internal diameter forming tool. After being run through the chucking machine, heat-treating is completed so that the required Rockwell hardness is achieved. Those skilled in the art will appreciate that heat-treating can be accomplished by applying heat so that the material is beyond its critical temperature and then oil quenching the material. After heat-treating, the lifter well 462 is ground using an internal diameter grinding machine, such as a Heald grinding machine. Those skilled in the art will appreciate that the lifter well 462 can be ground using other grinding machines.

Adjacent to the lifter well 462, the embodiment depicted in FIG. 66 is provided with a lead lifter surface 464 which can be fabricated through forging or machining. As shown therein the lead lifter surface 464 is generally annular in shape and generally frusto-conical. However, those skilled in the art will appreciate that the present invention can be fabricated without the lead lifter surface 464.

Figure 67:
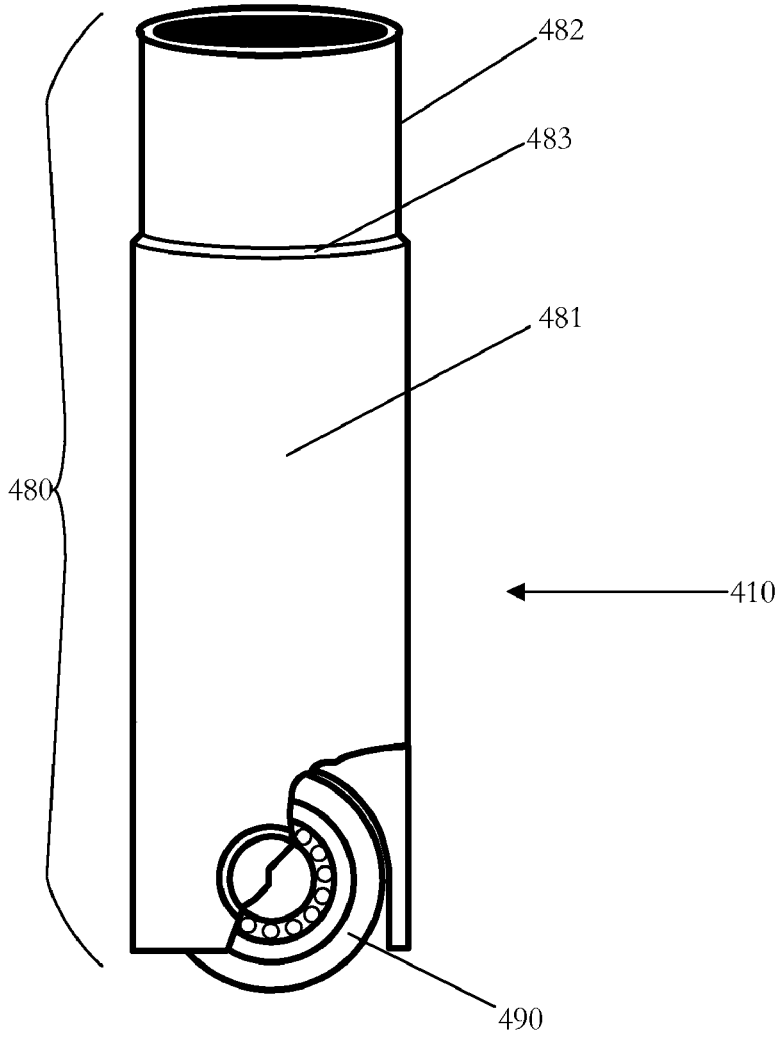
FIG. 67 depicts a fourth embodiment of a valve lifter body.

Depicted in FIG. 67 is another alternative embodiment of the present invention. As shown in FIG. 67, the valve lifter body 410 is provided with an outer lifter surface 480. The outer lifter surface 480 includes a plurality of surfaces. In the embodiment depicted in FIG. 67, the outer lifter surface 480 includes a cylindrical lifter surface 481, an undercut lifter surface 482, and a conical lifter surface 483. As depicted in FIG. 67, the undercut lifter surface 482 extends from one end of the valve lifter body 410 and is cylindrically shaped. The diameter of the undercut lifter surface 482 is smaller than the diameter of the cylindrical lifter surface 481.

The undercut lifter surface 482 is preferably forged through use of an extruding die. Alternatively, the undercut lifter surface 482 is fabricated through machining. Machining the undercut lifter surface 482 is accomplished through use of an infeed centerless grinding machine, such as a Cincinnati grinder. The surface is first heat-treated and then the undercut lifter surface 482 is ground via a grinding wheel. Those skilled in the art will appreciate that additional surfaces can be ground into the outer lifter surface 480 with minor alterations to the grinding wheel.

As depicted in FIG. 67, the conical lifter surface 483 is located between the cylindrical lifter surface 481 and the undercut lifter surface 482. The conical lifter surface 483 is preferably forged through use of an extruding die. Alternatively, the conical lifter surface 483 is fabricated through machining. Those with skill in the art will appreciate that the outer lifter surface 480 can be fabricated without the conical lifter surface 483 so that the cylindrical lifter surface 481 and the undercut lifter surface 482 abut one another.

Figure 68:
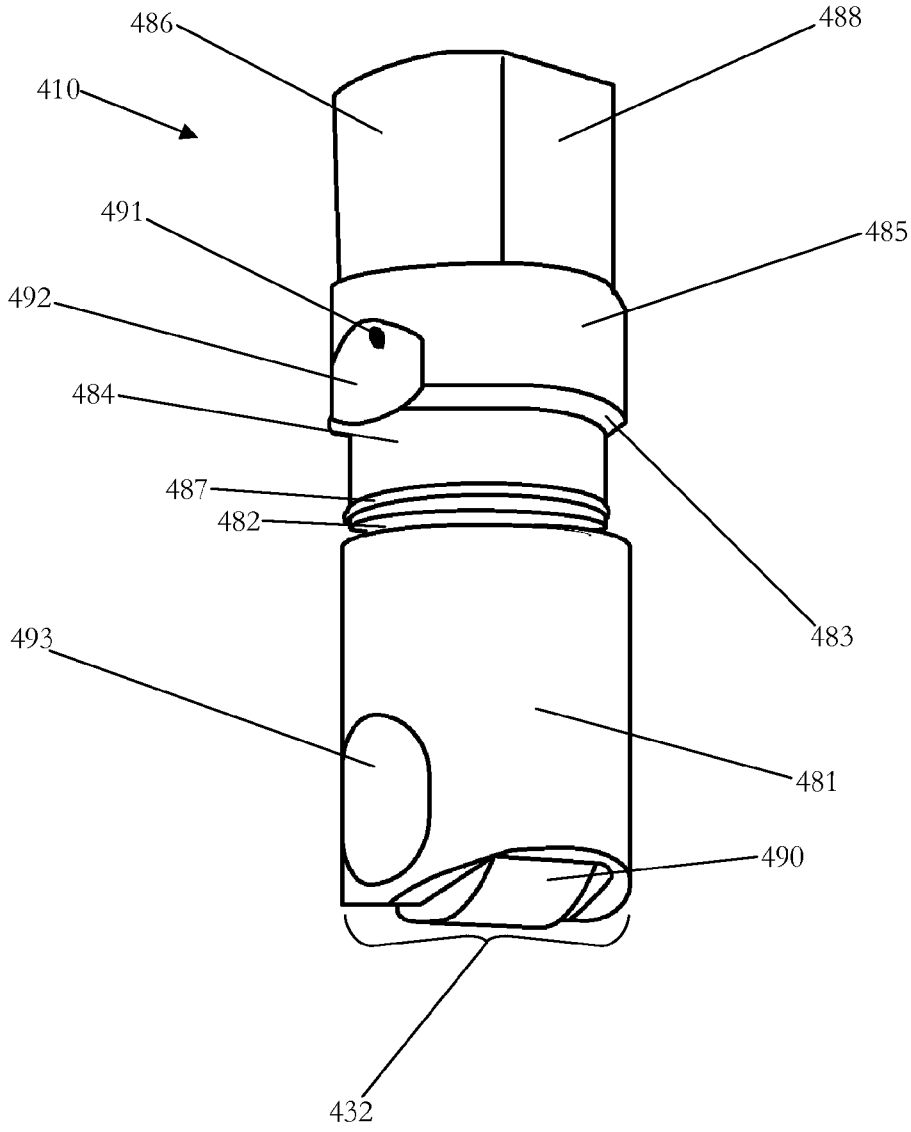
FIG. 68 depicts a fifth embodiment of a valve lifter body.

FIG. 68 depicts another embodiment valve lifter body 410 of the present invention. In the embodiment depicted in FIG. 68, the outer lifter surface 480 includes a plurality of outer surfaces. The outer lifter surface 480 is provided with a first cylindrical lifter surface 481. The first cylindrical lifter surface 481 contains a first lifter depression 493. Adjacent to the first cylindrical lifter surface 481 is a second cylindrical lifter surface 482. The second cylindrical lifter surface 482 has a radius which is smaller than the radius of the first cylindrical lifter surface 481. The second cylindrical lifter surface 482 is adjacent to a third cylindrical lifter surface 484. The third cylindrical lifter surface 484 has a radius which is greater than the radius of the second cylindrical lifter surface 482. The third cylindrical lifter surface 484 contains a lifter ridge 487. Adjacent to the third cylindrical lifter surface 484 is a conical lifter surface 483. The conical lifter surface 483 is adjacent to a fourth cylindrical lifter surface 485. The fourth cylindrical lifter surface 485 and the conical lifter surface 483 contain a second lifter depression 492. The second lifter depression 492 defines a lifter hole 491. Adjacent to the fourth cylindrical lifter surface 485 is a flat outer lifter surface 488. The flat outer lifter surface 488 is adjacent to a fifth cylindrical lifter surface 486.

Those skilled in the art will appreciate that the features of the valve lifter body 410 may be fabricated through a combination of machining, forging, and other methods of fabrication. By way of example and not limitation, the first lifter cavity 430 can be machined while the second lifter cavity 431 is forged. Conversely, the second lifter cavity 431 can be machined while the first lifter cavity 430 is forged.

While the roller follower assembly 5 of this invention has been particularly shown and described with references to preferred embodiments thereof, it will be understood by those skilled in the art that various changes in form and details may be made therein without departing from the spirit and scope of the invention as defined by the appended claims.

What is claimed is:

1. A method of fabricating a roller follower assembly, comprising the steps of:

a) fabricating a roller follower body, comprising the steps of:
   - i) providing a first rod;
   - ii) cold forming a first roller cavity into the first rod to provide the first roller cavity with a first inner roller surface;
   - iii) enclosing at least a portion of the first roller cavity within an outer roller surface;
   - iv) configuring the first inner roller surface to house a roller;
   - v) cold forming a second roller cavity into the first rod to provide the second roller cavity with a second inner roller surface;
   - vi) enclosing at least a portion of the second roller cavity within the outer roller surface;
   - vii) configuring the second inner roller surface to house a leakdown plunger;

b) fabricating the leakdown plunger, comprising the steps of:
   - i) providing a second rod;
   - ii) cold forming an inner plunger surface into the second rod to provide a chamber;
   - iii) cold forming a first plunger opening into the second rod;
   - iv) configuring the first plunger opening to accommodate a valve insert;
   - v) cold forming a second plunger opening into the second rod;
   - vi) configuring the second plunger opening to cooperate with a socket;
   - vii) fabricating an outer plunger surface;
   - viii) configuring the outer plunger surface for insertion into the roller follower body;

ix) enclosing at least a portion of the inner plunger surface within the outer plunger surface;

x) configuring the inner plunger surface to define a chamber;

c) fabricating the socket, comprising the steps of:

i) fabricating a first socket surface;

ii) configuring the first socket surface to accommodate a push rod;

iii) fabricating a second socket surface;

iv) configuring the second socket surface to cooperate with the leakdown plunger;

v) fabricating an outer socket surface;

vi) fabricating a passage; and d) at least one of the first roller cavity, the second roller cavity, the first plunger opening, the second plunger opening, the outer plunger surface, the inner plunger surface, the first socket surface, the second socket surface, the outer socket surface, and the passage is fabricated at least in part through forging.

2. The method of claim 1, further comprising providing a lash adjuster body, including the steps of:

a) providing a third rod;

b) cold forming a lash adjuster cavity into the third rod; and c) providing the lash adjuster cavity with an inner lash adjuster surface.

3. The method of claim 2, further comprising the steps of: (a) enclosing at least a portion of the lash adjuster cavity within an outer lash adjuster surface, (b) configuring the inner lash adjuster surface to accommodate the leakdown plunger, (c) configuring the second inner roller surface to house the lash adjuster body; (d) configuring the outer plunger surface for insertion into the lash adjuster body; and wherein at least one of the steps of: providing the lash adjuster cavity with the inner lash adjuster surface; enclosing at least a portion of the lash adjuster cavity within the outer lash adjuster surface; configuring the inner lash adjuster surface to accommodate the leakdown plunger; enclosing at least a portion of the first roller cavity within an outer roller surface, configuring the first inner roller surface to house the roller, enclosing at least a portion of the second roller cavity within the outer roller surface, configuring the second inner roller surface to house the lash adjuster body, configuring the first plunger opening to accommodate the valve insert, configuring the second plunger opening to cooperate with the socket, configuring the outer plunger surface for insertion into the lash adjuster body, enclosing at least a portion of the inner plunger surface within the outer plunger surface, configuring the inner plunger surface to define the chamber, configuring the first socket surface to accommodate the push rod, configuring the second socket surface to cooperate with the leakdown plunger is accomplished at least in part through cold forming.

4. The method of claim 2, and wherein at least one of the steps of: (a) enclosing at least a portion of the lash adjuster cavity within an outer lash adjuster surface; (b) configuring the inner lash adjuster surface to accommodate the leakdown plunger; (c) enclosing at least a portion of the first roller cavity within an outer roller surface; (d) configuring the first inner roller surface to house a cylindrical insert; (e) enclosing at least a portion of the second roller cavity within the outer roller surface; (f) configuring the second inner roller surface to house the lash adjuster body; (g) configuring the first plunger opening to accommodate the valve insert; (h) configuring the second plunger opening to cooperate with the socket; (i) configuring the outer plunger surface for insertion into the lash adjuster body; (j) enclosing at least a portion of the inner plunger surface within the outer plunger surface; (k) configuring the inner plunger surface to define the chamber; (l) configuring the first socket surface to accommodate the push rod; (m) configuring the second socket surface to cooperate with the leakdown plunger; (n) enclosing at least a portion of the lash adjuster cavity within an outer lash adjuster surface; (o) configuring the inner lash adjuster surface to accommodate the leakdown plunger; (p) configuring the second inner toilet surface to house the lash adjuster body; and (q) configuring the outer plunger surface for insertion into the lash adjuster body is accomplished at least in part through cold forming.

5. A method of fabricating a roller follower assembly, comprising the steps of:

a) fabricating a roller follower body, comprising the steps of:

i) cold forming a first roller cavity;

ii) enclosing at least a portion of the first roller cavity within an outer roller surface;

iii) providing the first roller cavity with a first inner roller surface;

iv) configuring the first inner roller surface to accommodate a cylindrical insert;

v) cold forming a second roller cavity;

vi) enclosing at least a portion of the second roller cavity within the outer roller surface;

vii) machining, at least in part, the second roller cavity to provide a second inner roller surface;

viii) configuring the second inner roller surface to house a leakdown plunger;

ix) machining, at least in part, the outer roller surface to provide a generally cylindrical roller surface located adjacent to a frusto-conical roller surface;

b) fabricating the leakdown plunger, comprising the steps of:

i) cold forming a first plunger opening;

ii) configuring the first plunger opening to accommodate a valve insert;

iii) cold forming a second plunger opening;

iv) configuring the second plunger opening to cooperate with a socket;

v) cold forming, at least in part, an outer plunger surface;

vi) machining, at least in part, the outer plunger surface for insertion into the roller follower body;

vii) enclosing at least a portion of an inner plunger surface within the outer plunger surface;

viii) configuring the inner plunger surface to define a chamber;

c) fabricating the socket, comprising the steps of:

i) cold forming a first socket surface;

ii) configuring the first socket surface to cooperate with a push rod;

iii) cold forming a second socket surface;

iv) configuring the second socket surface to cooperate with the leakdown plunger;

v) fabricating an outer socket surface;

vi) configuring the outer socket surface to cooperate with the leakdown plunger; and vii) fabricating a passage.

6. The method of claim 5, wherein at least one of the first inner roller surface, and the second inner roller surface is provided at least in part through forging.

7. The method of claim 5, wherein at least one of the steps of: configuring the first plunger opening to accommodate the valve insert, configuring the second plunger opening to cooperate with the socket, enclosing at least a portion of the inner plunger surface within the outer plunger surface, configuring the inner plunger surface to define the chamber, configuring the first socket surface to accommodate the push rod, and configuring the second socket surface to cooperate with the leakdown plunger is accomplished at least in part through cold forming.

8. The method of claim 5, wherein at least one of the first roller cavity, the first inner roller surface, and the second inner roller surface is provided at least in part through forging and wherein at least one of the steps of: enclosing at least a portion of the first roller cavity within the outer roller surface, configuring the first inner roller surface to house the cylindrical insert, enclosing at least a portion of the second roller cavity within the outer roller surface, configuring the second inner roller surface to house the leakdown plunger, configuring the first plunger opening to accommodate the valve insert, configuring the second plunger opening to cooperate with the socket, configuring the outer plunger surface for insertion into the roller follower body, enclosing at least a portion of the inner plunger surface within the outer plunger surface, configuring the inner plunger surface to define the chamber, configuring the first socket surface to cooperate with the push rod, configuring the second socket surface to cooperate with the leakdown plunger, and configuring the outer socket surface to cooperate with the leakdown plunger is accomplished at least in part through forging.

9. A method of fabricating a roller follower assembly, comprising the steps of:

a) fabricating a roller follower body, comprising the steps of:
- i) providing a first rod;
- ii) cold forming a roller cavity into the first rod;
- iii) enclosing at least a portion of the roller cavity within an outer roller surface;
- iv) machining, at least in part, the roller cavity to provide an inner roller surface that includes a plurality of cylindrical surfaces with a plurality of diameters;
- v) providing the first rod with an end that includes a plurality of walls;
- vi) providing the roller follower body with a transition opening that links the roller cavity with the walls;
- vii) dimensioning the walls of the roller follower body to accommodate a roller;
- viii) machining, at least in part, the outer roller surface to provide a plurality of cylindrical roller surfaces wherein at least one of the cylindrical roller surfaces is located adjacent to a frusto-conical roller surface;

b) fabricating a leakdown plunger, comprising the steps of:
- i) providing a second rod;
- ii) cold forming a first plunger opening into the second rod;
- iii) configuring the first plunger opening to accommodate a valve insert;
- iv) cold forming a second plunger opening into the second rod;
- v) configuring the second plunger opening to cooperate with a socket;
- vi) cold forming the second rod to provide, at least in part, an outer plunger surface;
- vii) configuring the outer plunger surface for insertion into the roller follower body;
- viii) enclosing at least a portion of an inner plunger surface within the outer plunger surface;
- ix) configuring the inner plunger surface to define a chamber;

c) fabricating the socket, comprising the steps of:
- i) providing a third rod;
- ii) cold forming a first socket surface into the third rod;
- iii) configuring the first socket surface to accommodate a push rod;
- iv) cold forming a second socket surface into the third rod;
- v) configuring the second socket surface to cooperate with the leakdown plunger;
- vi) cold forming the third rod to provide, at least in part, an outer socket surface;
- vii) configuring the outer socket surface to cooperate with the inner roller surface of the roller follower body; and
- viii) fabricating a passage.

10. The method of claim 9, wherein the roller cavity is provided with the inner roller surface at least in part through cold forming.

11. The method of claim 9, wherein at least one of the steps of: (a) configuring the first plunger opening to accommodate with the valve insert and (b) enclosing at least a portion of the inner plunger surface within the outer plunger surface is accomplished at least in part through forging.

12. The method of claim 9, wherein the roller cavity is provided with the inner roller surface at least in part through forging and wherein at least one of the steps of: (a) configuring the first plunger opening to accommodate the valve insert, (b) configuring the second plunger opening to cooperate with the socket, and (c) configuring the outer plunger surface for insertion into the roller follower body is accomplished at least in part through forging.

13. A method of fabricating a roller follower assembly, comprising the steps of:

a) fabricating a roller follower body, comprising the steps of:
- i) providing a forgeable material;
- ii) cold forming the forgeable material so that the forgeable material is provided with a first end and a second end;
- iii) cold forming the forgeable material, at least in part, to provide a plurality of roller walls at the first end;
- iv) cold forming the forgeable material to provide, at least in part, an outer roller surface;
- v) configuring the roller walls to accommodate a roller;
- vi) cold forming a roller cavity into the second end of the forgeable material;
- vii) enclosing at least a portion of the roller cavity within the outer roller surface;
- viii) machining, at least in part, the roller cavity to provide an inner roller surface;
- ix) configuring the inner roller surface to house a leakdown plunger;
- x) machining, at least in part, the outer roller surface to provide a cylindrical roller surface;

b) fabricating the leakdown plunger, comprising the steps of:
- i) cold forming a first plunger opening;
- ii) configuring the first plunger opening to accommodate a valve insert;
- iii) cold forming a second plunger opening;
- iv) configuring the second plunger opening to cooperate with a socket;
- v) cold forming, at least in part, an outer plunger surface;

vi) configuring the outer plunger surface for insertion into the inner roller surface of the roller follower body;

vii) cold forming, at least in part, an inner plunger surface within the outer plunger surface;

viii) configuring the inner plunger surface to define a chamber;

c) fabricating the socket, comprising the steps of:

i) cold forming a first socket surface;

ii) configuring the first socket surface to cooperate with a push rod;

iii) cold forming a second socket surface;

iv) configuring the second socket surface to cooperate with the leakdown plunger;

v) cold forming an outer socket surface;

vi) configuring the outer socket surface to cooperate with the inner roller surface of the roller follower body; and vii) fabricating a passage.

14. The method of claim 13, wherein at least one of the first inner roller surface and the second inner roller surface is provided at least in part through forging.

15. The method of claim 13, wherein at least one of the steps of: enclosing at least a portion of the roller cavity within the outer roller surface, configuring the roller walls to accommodate the roller, and configuring the inner roller surface to house the leak down plunger is accomplished at least in part through forging.

16. The method of claim 13, wherein the inner roller surface is provided at least in part through forging and wherein at least one of the steps of: enclosing at least a portion of the roller cavity within the outer roller surface, configuring the inner roller surface to house the leakdown plunger, and configuring the roller walls to accommodate the roller is accomplished at least in part through forging.

17. A method of fabricating a roller follower assembly, comprising the steps of:

a) fabricating a roller follower body, comprising the steps of:

i) providing a first rod of forgeable material;

ii) cold forming the first rod to provide a first end and a second end;

iii) cold forming the first end of the first rod to provide a plurality of roller walls;

iv) configuring the roller walls to house a roller;

v) cold forming a roller cavity into the second end of the first rod of forgeable material;

vi) enclosing at least a portion of the roller cavity within an outer roller surface;

vii) machining, at least in part, the roller cavity to provide an inner roller surface;

viii) configuring the inner roller surface to accommodate a leakdown plunger;

b) fabricating the leakdown plunger, comprising the steps of:

i) providing a second rod of forgeable material;

ii) cold forming a first plunger opening into the second rod;

iii) configuring the first plunger opening to accommodate a valve insert;

iv) cold forming a second plunger opening into the second rod;

v) cold forming, at least in part, an inner plunger surface into the second rod;

vi) configuring the second plunger opening to cooperate with a socket;

vii) fabricating an outer plunger surface;

viii) configuring the outer plunger surface for insertion into the roller follower body;

ix) enclosing at least a portion of the inner plunger surface within the outer plunger surface;

x) configuring the inner plunger surface to define a chamber;

c) fabricating the socket, comprising the steps of:

i) providing a third rod of forgeable material;

ii) cold forming a first socket surface into the third rod so that the first socket surface cooperates with a push rod;

iii) cold forming a second socket surface into the third rod so that the second socket surface cooperates with the leakdown plunger;

iv) cold forming an outer socket surface so that the outer socket surface cooperates with the inner roller surface of the roller follower body;

v) heat treating the socket; and vi) fabricating a passage.

18. The method of claim 17, wherein at least one of the steps of configuring the first plunger opening to accommodate the valve insert, configuring the second plunger opening to cooperate with the socket, configuring the outer plunger surface for insertion into the roller follower body, enclosing at least a portion of the inner plunger surface within the outer plunger surface, and configuring the inner plunger surface to define the chamber is accomplished at least in part through forging.

19. A method of fabricating a roller follower assembly, comprising the steps of:

a) fabricating a roller follower body, comprising the steps of:

i) providing a first rod of forgeable material;

ii) cold forming the first rod to provide a first end and a second end;

iii) cold forming the first end of the first rod to provide a plurality of roller walls;

iv) configuring the roller walls to house a cylindrical insert;

v) cold forming a roller cavity, at least in part, into the second end of the first rod of forgeable material;

vi) enclosing at least a portion of the roller cavity within an outer roller surface;

vii) machining, at least in part, the roller cavity to provide an inner roller surface that is configured to accommodate a leakdown plunger;

viii) cold forming, at least in part, an undercut surface into the outer roller surface so that the undercut surface is located at the second end of the first rod;

b) fabricating the leakdown plunger, comprising the steps of:

i) providing a second rod of forgeable material;

ii) cold forming a first plunger opening into the second rod;

iii) configuring the first plunger opening to accommodate a valve insert;

iv) cold forming a second plunger opening into the second rod;

v) cold forming, at least in part, an inner plunger surface into the second rod;

vi) configuring the second plunger opening to cooperate with a socket;

vii) fabricating an outer plunger surface;

viii) configuring the outer plunger surface for insertion into the roller follower body;

ix) enclosing at least a portion of the inner plunger surface within the outer plunger surface;

x) configuring the inner plunger surface to define a chamber;

c) fabricating the socket, comprising the steps of:

i) providing a third rod of forgeable material;

ii) cold forming a first socket surface into the third rod so that the first socket surface cooperates with a push rod;

iii) cold forming a second socket surface into the third rod so that the second socket surface cooperates with the leakdown plunger;

iv) cold forming the third rod to provide an outer socket surface; and v) fabricating a passage.

20. The method of claim 19, wherein at least one of the steps of: configuring the first socket surface to accommodate the push rod, configuring the second socket surface to cooperate with the leakdown plunger, and configuring the outer socket surface to cooperate with the inner roller surface is accomplished at least in part through forging.

21. A method of fabricating a roller follower assembly, comprising the steps of:

a) fabricating a roller follower body, comprising the steps of:

i) providing a first rod of forgeable material;

ii) cold forming the first rod to provide a first end and a second end;

iii) cold forming the first end of the first rod to provide a plurality of roller walls;

iv) configuring the roller walls to house a roller;

v) cold forming a roller cavity into the second end of the first rod of forgeable material;

vi) enclosing at least a portion of the roller cavity within an outer roller surface;

vii) machining, at least in part, the roller cavity to provide an inner roller surface;

viii) configuring the inner roller surface to accommodate a leakdown plunger;

ix) cold forming, at least in part, a well into the inner roller surface;

b) fabricating the leakdown plunger, comprising the steps of:

i) providing a second rod of forgeable material;

ii) cold forming a first plunger opening into the second rod;

iii) configuring the first plunger opening to accommodate a valve insert;

iv) cold forming a second plunger opening into the second rod;

v) cold forming, at least in part, an inner plunger surface into the second rod;

vi) configuring the second plunger opening to cooperate with a socket;

vii) fabricating an outer plunger surface;

viii) configuring the outer plunger surface for insertion into the roller follower body;

ix) enclosing at least a portion of the inner plunger surface within the outer plunger surface;

x) configuring the inner plunger surface to define a chamber;

c) fabricating the socket, comprising the steps of:

i) providing a third rod of forgeable material;

ii) cold forming a first socket surface into the third rod so that the first socket surface cooperates with a push rod;

iii) cold forming a second socket surface into the third rod so that the second socket surface cooperates with the leakdown plunger;

iv) cold forming an outer socket surface so that the outer socket surface cooperates with the inner roller surface of the roller follower body; and v) fabricating a passage.

22. The method of claim 21, further comprising the step of: heat treating any one of the roller follower body, the leakdown plunger, and the socket.

23. The method of claim 21, wherein the inner roller surface is provided at least in part through machining.

24. The method of claim 21, wherein at least one of the steps of: (a) enclosing at least a portion of the roller cavity within the outer roller surface; (b) configuring the inner roller surface to accommodate the socket, the leakdown plunger, and the valve insert; (c) configuring the plurality of roller walls to accommodate the roller; (d) configuring the first plunger opening to accommodate the valve insert; (e) configuring the second plunger opening to cooperate with the socket; (f) configuring the outer plunger surface for insertion into the roller follower body; (g) enclosing at least a portion of the inner plunger surface within the outer plunger surface; (h) configuring the inner plunger surface to define the chamber; (i) configuring the first socket surface to cooperate with the push rod; (j) configuring the second socket surface to cooperate with the leakdown plunger; and (k) configuring the outer socket surface to cooperate with the inner roller surface of the roller follower body is accomplished at least in part through machining.

25. The method of claim 21, wherein the inner roller surface is provided at least in part through machining and wherein at least one of the steps of: (a) enclosing at least a portion of the roller cavity within the outer roller surface, (b) configuring the plurality of roller walls to house the toiler, (c) configuring the first plunger opening to accommodate the valve insert, (d) configuring the second plunger opening to cooperate with the socket, (e) configuring the outer plunger surface for insertion into the roller follower body, (f) enclosing at least a portion of the inner plunger surface within the outer plunger surface, (g) configuring the inner plunger surface to define the chamber, (h) configuring the first socket surface to cooperate with the push rod; (i) configuring the second socket surface to cooperate with the leakdown plunger; and (j) configuring the outer socket surface to cooperate with the inner roller surface of the roller follower body is accomplished at least in part through machining.

26. The method of claim 21, wherein at least one of the inner roller surface and the plurality of roller walls is provided at least in part through forging.

27. The method of claim 21, wherein at least one of the steps of: enclosing at least a portion of the roller cavity within the outer roller surface, configuring the second plunger opening to cooperate with the socket, the leakdown plunger, and the valve insert, configuring the plurality of toilet walls to house the roller, configuring the inner roller surface to accommodate the leakdown plunger, configuring the first plunger opening to accommodate the valve insert, configuring the second plunger opening to cooperate with the socket, configuring the outer plunger surface for insertion into the roller follower body, enclosing at least a portion of the inner plunger surface within the outer plunger surface, configuring the inner plunger surface to define the chamber, configuring the first socket surface to cooperate with the push rod, configuring the second socket surface to cooperate with the leakdown plunger, and configuring the outer socket surface to cooperate with the inner roller surface of the roller follower body is accomplished at least in part through cold forming.

28. The method of claim 21, wherein the inner roller surface, is provided at least in part through cold forming and wherein at least one of the steps of: enclosing at least a portion of the roller cavity within the outer roller surface, configuring the inner roller surface to accommodate the socket, the leakdown plunger, and the valve insert, configuring the plurality of walls to house the roller, configuring the inner roller surface to accommodate the leakdown plunger, configuring the first plunger opening to accommodate the valve insert, configuring the second plunger opening to cooperate with the socket, configuring the outer plunger surface for insertion into the roller follower body, enclosing at least a portion of the inner plunger surface within the outer plunger surface, configuring the inner plunger surface to define the chamber, configuring the first socket surface to cooperate with the push rod, configuring the second socket surface to cooperate with the leakdown plunger, and configuring the outer socket surface to cooperate with the inner roller surface of the roller follower body is accomplished at least in part through machining.

29. The method of claim 21, wherein the inner roller surface is provided at least in part through machining and cold forming.

30. The method of claim 21, wherein at least one of the steps of: enclosing at least a portion of the roller cavity within the outer roller surface, configuring the roller adjuster surface to accommodate the socket, the leakdown plunger, and the valve insert, enclosing at least a portion of the roller walls within the outer roller surface, configuring the plurality of walls to house the roller, configuring the first plunger opening to accommodate the valve insert, configuring the second plunger opening to cooperate with the socket, configuring the outer plunger surface for insertion into the roller follower body, enclosing at least a portion of the inner plunger surface within the outer plunger surface, configuring the inner plunger surface to define the chamber, configuring the first socket surface to cooperate with the push rod, configuring the second socket surface to cooperate with the leakdown plunger, and configuring the outer socket surface to cooperate with the inner roller surface of the roller follower body is accomplished at least in part through machining and forging.

31. The method of claim 21, wherein the inner roller surface is provided at least in part through cold forming and machining and wherein at least one of the steps of: enclosing at least a portion of the roller cavity within the outer roller surface, configuring the inner roller surface to accommodate the socket, the leakdown plunger, and the valve insert, enclosing at least a portion of the roller cavity within the outer roller surface, configuring the plurality of walls to house the roller, configuring the inner roller surface to accommodate the leakdown plunger, configuring the first plunger opening to accommodate the valve insert, configuring the second plunger opening to cooperate with the socket, configuring the outer plunger surface for insertion into the roller follower body, enclosing at least a portion of the inner plunger surface within the outer plunger surface, configuring the inner plunger surface to define the chamber, configuring the first socket surface to cooperate with the push rod, configuring the second socket surface to cooperate with the leakdown plunger, and configuring the outer socket surface to cooperate with the inner roller surface of the roller follower body is accomplished at least in part through machining and forging.

32. The method of claim 21, wherein the inner roller surface is provided at least in part through forging and wherein at least one of the steps of: configuring the inner roller surface to accommodate the socket, the leakdown plunger, and the valve insert, enclosing at least a portion of the roller cavity within the outer roller surface, configuring the plurality of roller walls to house the roller, enclosing at least a portion of the roller cavity within the outer roller surface, configuring the inner roller surface to house the leakdown plunger, configuring the first plunger opening to accommodate the valve insert, configuring the second plunger opening to cooperate with the socket, configuring the outer plunger surface for insertion into the roller follower body, enclosing at least a portion of the inner plunger surface within the outer plunger surface, configuring the inner plunger surface to define the chamber, configuring the first socket surface to cooperate with the push rod, configuring the second socket surface to cooperate with the leakdown plunger, and configuring the outer socket surface to cooperate with the roller adjuster surface of the roller follower body is accomplished at least in part through machining.

33. The method of claim 21, wherein the inner roller surface is provided at least in part through machining and wherein at least one of the steps of: configuring the inner roller surface to accommodate the socket, the leakdown plunger, and the valve insert, enclosing at least a portion of the roller cavity within the outer roller surface, configuring the plurality of roller walls to house the roller, enclosing at least a portion of the roller walls within the outer roller surface, configuring the inner roller surface to house the leakdown plunger, configuring the first plunger opening to accommodate the valve insert, configuring the second plunger opening to cooperate with the socket, configuring the outer plunger surface for insertion into the roller follower body, enclosing at least a portion of the inner plunger surface within the outer plunger surface, configuring the inner plunger surface to define the chamber, configuring the first socket surface to cooperate with the push rod, configuring the second socket surface to cooperate with the leakdown plunger, and configuring the outer socket surface to cooperate with the inner roller surface of the roller follower body is accomplished at least in part through forging.

34. The method of claim 21, wherein the inner roller surface is provided at least in part through forging and machining and wherein at least one of the steps of: configuring the plurality of roller walls to house the roller, configuring the first plunger opening to accommodate the valve insert, configuring the second plunger opening to cooperate with the socket, enclosing at least a portion of the inner plunger surface within the outer plunger surface, configuring the inner plunger surface to define the chamber, configuring the first socket surface to cooperate with the push rod, and configuring the second socket surface to cooperate with the leakdown plunger is accomplished at least in part through machining.

35. The method of claim 21, wherein the inner roller surface is provided at least in part through forging and machining and wherein at least one of the steps of: enclosing at least a portion of the roller cavity within the outer roller surface, configuring the plurality of roller walls to house the roller, enclosing at least a portion of the roller cavity within the outer roller surface, configuring the inner roller surface to accommodate the leakdown plunger, configuring the first plunger opening to accommodate the valve insert, configuring the second plunger opening to cooperate with the socket, configuring the outer plunger surface for insertion into the roller follower body, enclosing at least a portion of the inner plunger surface within the outer plunger surface, configuring the inner plunger surface to define the chamber, configuring the first socket surface to cooperate with the push rod, configuring the second socket surface to cooperate with the leakdown plunger, and configuring the outer socket surface to cooperate with the inner roller surface of the roller follower body is accomplished at least in part through forging.

36. The method of claim 21, wherein the inner roller surface is provided at least in part through forging and wherein at least one of the steps of: enclosing at least a portion of the roller cavity within the outer roller surface, configuring the inner roller surface to accommodate the socket, the leakdown plunger, and the valve insert, enclosing at least a portion of the roller walls within the outer roller surface, configuring the roller walls to house the roller, enclosing at least a portion of the roller cavity within the outer roller surface, configuring the inner roller surface to house the leakdown plunger, configuring the first plunger opening to accommodate the valve insert, configuring the second plunger opening to cooperate with the socket, configuring the outer plunger surface for insertion into the roller follower body, enclosing at least a portion of the inner plunger surface within the outer plunger surface, configuring the inner plunger surface to define the chamber, configuring the first socket surface to cooperate with the push rod, configuring the second socket surface to cooperate with the leakdown plunger, and configuring the outer socket surface to cooperate with the inner roller surface of the roller follower body is accomplished at least in part through machining and forging.

37. The method of claim 21, wherein the inner roller surface is provided at least in part through machining and wherein at least one of the steps of: configuring the inner roller surface to accommodate the socket, the leakdown plunger, and the valve insert, enclosing at least a portion of the roller walls within the outer roller surface, configuring the roller walls to accommodate the roller, enclosing at least a portion of the roller cavity within the outer roller surface, configuring the inner roller surface to house the leakdown plunger, configuring the first plunger opening to accommodate the valve insert, configuring the second plunger opening to cooperate with the socket, configuring the outer plunger surface for insertion into the roller follower body, enclosing at least a portion of the inner plunger surface within the outer plunger surface, configuring the inner plunger surface to define the chamber, configuring the first socket surface to cooperate with the push rod, configuring the second socket surface to cooperate with the leakdown plunger, and configuring the outer socket surface to cooperate with an inner lash adjuster surface of a lash adjuster body is accomplished at least in part through machining and forging.

38. A method of fabricating a roller follower assembly, comprising the steps of:

a) fabricating a roller follower body, comprising the steps of:
   i) providing a first rod of forgeable material;
   ii) cold forming the first rod to provide a first end and a second end;
   iii) cold forming the first end of the first rod to provide a plurality of roller walls so that the roller walls accommodate a roller;
   iv) cold forming a roller cavity into the second end of the first rod of forgeable material;
   v) enclosing at least a portion of the roller cavity within an outer roller surface;
   vi) machining, at least in part, the roller cavity to provide an inner roller surface;
   vii) configuring the inner roller surface to accommodate a leakdown plunger;
   viii) cold forming, at least in part, a well into the inner roller surface
   ix) cold forming, at least in part, an undercut surface into the outer roller surface so that the undercut surface is located at the second end of the first rod;
b) fabricating the leakdown plunger, comprising the steps of:
   i) providing a second rod of forgeable material;
   ii) cold forming a first plunger opening into the second rod;
   iii) configuring the first plunger opening to accommodate a valve insert;
   iv) cold forming a second plunger opening into the second rod;
   v) cold forming, at least in part, an inner plunger surface into the second rod;
   vi) configuring the second plunger opening to cooperate with a socket;
   vii) fabricating an outer plunger surface;
   viii) configuring the outer plunger surface for insertion into the roller follower body;
   ix) enclosing at least a portion of the inner plunger surface within the outer plunger surface;
   x) configuring the inner plunger surface to define a chamber;
c) fabricating the socket, comprising the steps of:
   i) providing a third rod of forgeable material;
   ii) cold forming a first socket surface into the third rod so that the first socket surface cooperates with a push rod;
   iii) cold forming a second socket surface into the third rod so that the second socket surface cooperates with the leakdown plunger;
   iv) cold forming an outer socket surface so that the outer socket surface cooperates with the inner roller surface of the roller follower body; and
   v) fabricating a passage.

39. The method of claim 38, wherein at least one of the well, the undercut surface, the first plunger opening, the second plunger opening, the outer plunger surface, the inner plunger surface, the first socket surface, the second socket surface, and the outer socket surface, is provided or fabricated at least in part through machining.

40. The method of claim 38, wherein at least one of the steps of: (a) enclosing at least a portion of the roller cavity within the outer roller surface; (b) configuring the inner roller surface to accommodate the leakdown plunger; (c) configuring the first plunger opening to accommodate the valve insert; (d) configuring the second plunger opening to cooperate with the socket; (e) configuring the outer plunger surface for insertion into the roller follower body; (f) enclosing at least a portion of the inner plunger surface within the outer plunger surface, and (g) configuring the inner plunger surface to define the chamber is accomplished at least in part through machining.

41. The method of claim 38, wherein at least one of the well, the undercut surface, the roller cavity, the first plunger opening, the second plunger opening, the outer plunger surface, the inner plunger surface, the first socket surface, the second socket surface, and the outer socket surface is provided or fabricated at least in part through machining and wherein at least one of the steps of: (a) enclosing at least a portion of the roller cavity within the outer roller surface; (b)

configuring the inner roller surface to accommodate the leakdown plunger; (c) configuring the first plunger opening to accommodate the valve insert; (d) configuring the second plunger opening to cooperate with the socket; (e) configuring the outer plunger surface for insertion into the roller follower body; (f) enclosing at least a portion of the inner plunger surface within the outer plunger surface; and (g) configuring the inner plunger surface to define the chamber is accomplished at least in part through machining.

42. The method of claim 38, wherein at least one of the roller cavity, inner roller surface, the outer plunger surface, the inner plunger surface, and the passage is provided at least in part through cold forming.

43. The method of claim 38, wherein at least one of the steps of: (a) enclosing at least a portion of the roller cavity within the outer roller surface; (b) configuring the inner roller surface to accommodate the leakdown plunger; (c) configuring the first plunger opening to accommodate the valve insert; (d) configuring the second plunger opening to cooperate with the socket; (e) configuring the outer plunger surface for insertion into the roller follower body; (f) enclosing at least a portion of the inner plunger surface within the outer plunger surface; and (g) configuring the inner plunger surface to define the chamber is accomplished at least in part through cold forming.

44. The method of claim 38, wherein at least one of the roller cavity, the outer roller surface, the outer plunger surface, and the passage is provided at least in part through cold forming and wherein at least one of the steps of: (a) enclosing at least a portion of the roller cavity within the outer roller surface; (b) configuring the inner roller surface to accommodate the leakdown plunger; (c) configuring the first plunger opening to accommodate the valve insert; (d) configuring the second plunger opening to cooperate with the socket; (e) configuring the outer plunger surface for insertion into the roller follower body; (f) enclosing at least a portion of the inner plunger surface within the outer plunger surface; and (g) configuring the inner plunger surface to define the chamber is accomplished at least in part through cold forming.

45. The method of claim 38, wherein at least one of the well, the undercut surface, the roller cavity, the first plunger opening, the second plunger opening, the outer plunger surface, the inner plunger surface, the first socket surface, the second socket surface, the outer socket surface, the passage, and the inner roller surface is provided or fabricated at least in part through machining and cold forming.

46. The method of claim 38, wherein at least one of the steps of: (a) enclosing at least a portion of the roller cavity within the outer roller surface, (b) configuring the inner roller surface to accommodate the leakdown plunger, (c) configuring the first plunger opening to accommodate the valve insert, (d) configuring the second plunger opening to cooperate with the socket, (e) configuring the outer plunger surface for insertion into the roller follower body, (f) enclosing at least a portion of the inner plunger surface within the outer plunger surface, and (g) configuring the inner plunger surface to define the chamber is accomplished at least in part through machining and cold forming.

47. The method of claim 38, wherein at least one of the well, the undercut surface, the roller cavity, the first plunger opening, the second plunger opening, the outer plunger surface, the inner plunger surface, the first socket surface, the second socket surface, the outer socket surface, the passage, and the inner roller surface is provided or fabricated at least in part through machining and cold forming and wherein at least one of the steps of: (a) enclosing at least a portion of the roller cavity within the outer roller surface, (b) configuring the inner roller surface to accommodate the socket and the leakdown plunger, (c) configuring the first plunger opening to accommodate the valve insert, (d) configuring the second plunger opening to cooperate with the socket, (e) configuring the outer plunger surface for insertion into the roller follower body, and (f) enclosing at least a portion of the inner plunger surface within the outer plunger surface is accomplished at least in part through machining and cold forming.

48. A method for manufacturing an assembly that includes a socket body, a leakdown plunger, and a roller follower body, comprising the steps of:

a) providing the socket body that has, at least in part, been cold formed to include a first socket surface, an outer socket surface, and a second socket surface;

b) providing the leakdown plunger that has, at least in part, been cold formed to include a first annular plunger surface located at a first end of the leakdown plunger, an inner plunger surface provided with a cylindrical plunger surface that abuts an inner conical plunger surface;

c) providing the roller follower body that has, at least in part, been cold formed to include:

i) a plurality of roller walls that are configured to accommodate a roller;

ii) a second roller cavity that is provided with a second roller surface and a second roller opening wherein a second inner roller surface is provided with a plurality of cylindrical surfaces and configured to accommodate the socket body and the leakdown plunger; and d) assembling the socket body and the leakdown plunger within the roller follower body so that the socket body and the leakdown plunger are located at least in part within the second roller cavity and the second socket surface of the socket body faces the a second annular plunger surface.

49. The method for manufacturing an assembly according to claim 48 further comprising the step of heat treating the socket body, the leakdown plunger and the roller follower body prior to assembling the socket body and the leakdown plunger within the roller follower body so that the socket body and the leakdown plunger are located at least in part within the second roller cavity and the second socket surface of the socket body faces the second annular plunger surface.

50. The method for manufacturing an assembly according to claim 49 further comprising the step of heat treating the toilet follower body prior to machining and assembling the socket body and the leakdown plunger within the roller follower body.

51. The method for manufacturing an assembly according to claim 48 wherein the roller follower body has been provided with a transition opening linking a first roller cavity with the second roller cavity.

52. The method for manufacturing an assembly according to claim 48 further comprising the steps of:

a) providing the roller follower body with a transition opening that links a first roller cavity with the second roller cavity; and b) machining the second roller cavity so that a frusto-conical roller surface is located adjacent to the transition opening.

53. The method for manufacturing an assembly according to claim 48 wherein a first roller cavity has been cold formed, at least in part, to include:

a) a first roller opening and a first inner roller surface that includes a first wall, a second wall, a third wall, a fourth wall, a first angled wall, a second angled wall, a third angled wall, a fourth angled wall, a first angled surface, a second angled surface, a third angled surface, a fourth angled surface, a first curved surface, and a second curved surface, wherein:

i) the walls and angled walls extend axially into the body from the first opening and are positioned so that the first wall faces the second wall, the third wall faces the fourth wall, the first angled wall faces the second angled wall, and the third angled wall faces the fourth angled wall;

ii) the first curved surface abuts the fourth wall and the second curved surface abuts the third wall;

iii) the angled surfaces extend axially into the roller follower body at an angle relative to a plane of one of the angled walls;

iv) the first angled surface is located adjacent to the first wall, the fourth wall, the first angled wall, and the first curved surface;

v) the second angled surface is located adjacent to the first wall, the third wall, the fourth angled wall, and the second curved surface;

vi) the third angled surface is located adjacent to the second wall, the third wall, the second angled wall, and the second curved surface; and vii) the fourth angled surface is located adjacent to the second wall, the fourth wall, the third angled wall, and the first curved surface.

54. A method for manufacturing an assembly that includes a socket body, a leakdown plunger, and a roller follower body, comprising the steps of:

a) providing the socket body that has been cold formed to include a first socket surface, an outer socket surface, and a second socket surface, wherein the first socket surface defines a hole;

b) providing the leakdown plunger that has been cold formed to include a first annular plunger surface and a second annular plunger surface wherein the first annular plunger surface defines a plunger hole located at a first end of the leakdown plunger, an inner plunger surface with an inner cylindrical plunger surface that abuts an inner conical plunger surface;

c) providing the roller follower body that has been cold formed to include a plurality of walls that accommodate a roller and cold formed and machined to include a roller cavity that is provided with a roller surface and a roller opening wherein an inner roller surface is provided with a plurality of cylindrical surfaces and configured to accommodate the socket body and the leakdown plunger; and d) assembling the socket body and the leakdown plunger within the roller follower body so that the socket body and the leakdown plunger are located at least in part within the second roller cavity and the second socket surface of the socket body faces a second annular plunger surface.

55. The method for manufacturing an assembly according to claim 54 further comprising the steps of heat treating the socket body, the leakdown plunger and the roller follower body prior to assembling the socket body and the leakdown plunger within the roller follower body so that the socket body and the leakdown plunger are located at least in part within the second roller cavity and the second socket surface of the socket body faces the second annular plunger surface.

56. The method for manufacturing an assembly according to claim 55 further comprising the step of heat treating the roller follower body prior to machining and assembling the socket body and the leakdown plunger within the roller follower body.

57. The method for manufacturing an assembly according to claim 54 wherein the roller follower body has been provided with a transition opening linking a first roller cavity with the second roller cavity.

58. The method for manufacturing an assembly according to claim 54 further comprising the steps of:

a) providing the roller follower body with a transition opening that links a first roller cavity with the second roller cavity; and b) machining the second roller cavity so that a frusto-conical roller surface is located adjacent to the transition opening.

59. The method for manufacturing an assembly according to claim 54 wherein the roller follower body has been cold formed, at least in part, to include:

a) a first wall, a second wall, a third wall, a fourth wall, a first angled wall, a second angled wall, a third angled wall, a fourth angled wall, a first angled surface, a second angled surface, a third angled surface, a fourth angled surface, a first curved surface, and a second curved surface, wherein:

i) the walls and angled walls extend axially into the body from a first opening and are positioned so that the first wall faces the second wall, the third wall faces the fourth wall, the first angled wall faces the second angled wall, and the third angled wall faces the fourth angled wall;

ii) the first curved surface abuts the fourth wall and the second curved surface abuts the third wall;

iii) the angled surfaces extend axially into the roller follower body an angle relative a plane of one of the angled walls;

iv) the first angled surface is located adjacent to the first wall, the fourth wall, the first angled wall, and the first curved surface;

v) the second angled surface is located adjacent to the first wall, the third wall, the fourth angled wall, and the second curved surface;

vi) the third angled surface is located adjacent to the second wall, the third wall, the second angled wall, and the second curved surface; and vii) the fourth angled surface is located adjacent to the second wall, the fourth wall, the third angled wall, and the first curved surface.

* * * * *